US012690733B2

(12) United States Patent
Conrad

(10) Patent No.: US 12,690,733 B2
(45) Date of Patent: Jul. 28, 2026

(54) SURFACE CLEANING APPARATUS AND DOCKING STATION USABLE THEREWITH

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 481 days.

(21) Appl. No.: 18/381,805

(22) Filed: Oct. 19, 2023

(65) Prior Publication Data

US 2025/0057373 A1 Feb. 20, 2025

Related U.S. Application Data

(60) Provisional application No. 63/532,614, filed on Aug. 14, 2023.

(51) Int. Cl.

| | |
|---|---|
| ***A47L 5/24*** | (2006.01) |
| ***A47L 9/20*** | (2006.01) |
| ***A47L 9/28*** | (2006.01) |

(52) U.S. Cl.

CPC ..... *A47L 5/24* (2013.01); *A47L 9/2873* (2013.01)

(58) Field of Classification Search

CPC . A47L 9/149; A47L 9/12; A47L 9/127; A47L 9/1608; A47L 9/20; A47L 9/1691;

(Continued)

(56) References Cited

U.S. PATENT DOCUMENTS 1,106,797 A 8/1914 Fay et al.
2,567,171 A 9/1951 Anderson (Continued)

FOREIGN PATENT DOCUMENTS

CA 2275675 A1 12/1999
CA 2288544 A1 5/2000

(Continued)

OTHER PUBLICATIONS

Ye, Miao-jun, "A Docking Device of Dust Collector," CN 113317716 to CPO, Aug. 31, 2021 (Year: 2021).*

(Continued)

*Primary Examiner* — Nathaniel E Wiehe

*Assistant Examiner* — Joshua R Beebe

(74) *Attorney, Agent, or Firm* — Philip C. Mendes da Costa; SMART & BIGGAR LP

(57) ABSTRACT

An apparatus comprising a surface cleaning apparatus and a docking station is provided. The surface cleaning apparatus comprises a surface cleaning apparatus air flow path; a suction motor; and an air treatment member. The air treatment member comprises a first stage air treatment chamber, a stationary portion and a moveable portion. The moveable portion is moveably mounted by a mount between a closed position in which the first stage air treatment chamber is closed and an open position in which the first stage air treatment chamber is open. The docking station comprises a docking station air flow path and a docking interface. The docking interface comprises wall portions and a docking interface perimeter extending around the wall portions. When the air treatment member is docked with the docking station, the docking interface perimeter contacts the stationary portion of the air treatment member and a closed volume is provided.

27 Claims, 113 Drawing Sheets

(58) Field of Classification Search
CPC ..... A47L 9/1675; A47L 9/2873; A47L 9/00; A47L 9/0063; A47L 5/24; A47L 5/00
See application file for complete search history.

(56) References Cited

U.S. PATENT DOCUMENTS

| | | | |
|---|---|---|---|
| 2,602,417 | A | 7/1952 | Victor |
| 3,724,179 | A | 4/1973 | Leinfelt |
| RE28,201 | E | 10/1974 | Hughes |
| 4,225,814 | A | 9/1980 | Gantz et al. |
| 4,360,947 | A | 11/1982 | DeCosa et al. |
| 4,497,308 | A | 2/1985 | Johnson |
| 4,571,250 | A | 2/1986 | Irmscher et al. |
| 4,598,838 | A | 7/1986 | Zakrajsek |
| RE32,257 | E | 10/1986 | Dyson |
| 4,704,764 | A | 11/1987 | Metelko, Jr. |
| 5,013,343 | A | 5/1991 | Miyamoto |
| 5,267,371 | A | 12/1993 | Soler et al. |
| 5,358,290 | A | 10/1994 | Fleet et al. |
| 5,606,769 | A | 3/1997 | Tomasiak et al. |
| 5,787,545 | A | 8/1998 | Colens |
| 5,974,625 | A | 11/1999 | Garner |
| 6,071,322 | A | 6/2000 | Hulthen |
| 6,076,226 | A | 6/2000 | Reed |
| 6,098,244 | A | 8/2000 | Conrad et al. |
| 6,099,661 | A | 8/2000 | Conrad |
| 6,101,672 | A | 8/2000 | Conrad et al. |
| 6,122,796 | A | 9/2000 | Downham et al. |
| 6,123,779 | A | 9/2000 | Conrad et al. |
| 6,129,213 | A | 10/2000 | Edwards |
| 6,129,775 | A | 10/2000 | Conrad et al. |
| 6,135,708 | A | 10/2000 | Conrad et al. |
| 6,168,716 | B1 | 1/2001 | Conrad et al. |
| 6,170,119 | B1 | 1/2001 | Conrad et al. |
| 6,173,474 | B1 | 1/2001 | Conrad |
| 6,174,127 | B1 | 1/2001 | Conrad et al. |
| 6,178,590 | B1 | 1/2001 | Lindsay et al. |
| 6,183,641 | B1 | 2/2001 | Conrad et al. |
| 6,193,787 | B1 | 2/2001 | Dyson et al. |
| 6,224,325 | B1 | 5/2001 | Conrad et al. |
| 6,231,645 | B1 | 5/2001 | Conrad et al. |
| 6,238,177 | B1 | 5/2001 | Conrad et al. |
| 6,243,917 | B1 | 6/2001 | Conrad |
| 6,251,296 | B1 | 6/2001 | Conrad et al. |
| 6,261,052 | B1 | 7/2001 | Conrad et al. |
| 6,261,379 | B1 | 7/2001 | Conrad et al. |
| 6,280,143 | B1 | 8/2001 | Parker et al. |
| 6,307,358 | B1 | 10/2001 | Conrad |
| 6,312,594 | B1 | 11/2001 | Conrad et al. |
| 6,328,527 | B1 | 12/2001 | Conrad et al. |
| 6,332,551 | B1 | 12/2001 | Copeland |
| 6,334,234 | B1 | 1/2002 | Conrad et al. |
| 6,344,064 | B1 | 2/2002 | Conrad |
| 6,389,329 | B1 | 5/2002 | Colens |
| 6,406,505 | B1 | 6/2002 | Oh et al. |
| 6,440,197 | B1 | 8/2002 | Conrad et al. |
| 6,457,205 | B1 | 10/2002 | Conrad |
| 6,467,124 | B1 | 10/2002 | Small |
| 6,533,834 | B2 | 3/2003 | Conrad et al. |
| 6,599,340 | B2 | 7/2003 | Conrad et al. |
| 6,625,845 | B2 | 9/2003 | Matsumoto et al. |
| 6,782,585 | B1 | 8/2004 | Conrad et al. |
| 6,811,584 | B2 | 11/2004 | Oh |
| 6,824,580 | B2 | 11/2004 | Oh |
| 6,928,692 | B2 | 8/2005 | Oh et al. |
| 7,053,578 | B2 | 5/2006 | Diehl et al. |
| 7,070,636 | B2 | 7/2006 | Mccormick et al. |
| 7,074,248 | B2 | 7/2006 | Jin et al. |
| 7,152,276 | B2 | 12/2006 | Jin et al. |
| 7,152,277 | B2 | 12/2006 | Jung et al. |
| 7,174,602 | B1 | 2/2007 | Foral |
| 7,318,249 | B2 | 1/2008 | Lin |
| 7,318,848 | B2 | 1/2008 | Lee |
| 7,329,294 | B2 | 2/2008 | Conrad |
| 7,351,269 | B2 | 4/2008 | Yau |
| 7,386,916 | B2 | 6/2008 | Bone |
| 7,412,749 | B2 | 8/2008 | Thomas et al. |
| 7,419,520 | B2 | 9/2008 | Lee et al. |
| 7,488,362 | B2 | 2/2009 | Jeong et al. |
| 7,494,520 | B2 | 2/2009 | Nam et al. |
| 7,611,553 | B2 | 11/2009 | Hato |
| 7,647,672 | B2 | 1/2010 | Nam et al. |
| 7,704,290 | B2 | 4/2010 | Oh |
| 7,740,675 | B2 | 6/2010 | Conrad |
| 7,749,293 | B2 | 7/2010 | Conrad |
| 7,752,706 | B2 | 7/2010 | Goodger |
| 7,776,120 | B2 | 8/2010 | Conrad |
| 7,803,207 | B2 | 9/2010 | Conrad |
| 7,811,345 | B2 | 10/2010 | Conrad |
| 7,837,958 | B2 | 11/2010 | Crapser et al. |
| 7,867,308 | B2 | 1/2011 | Conrad |
| 7,882,593 | B2 | 2/2011 | Beskow et al. |
| 7,887,612 | B2 | 2/2011 | Conrad |
| 7,941,895 | B2 | 5/2011 | Conrad |
| 7,958,597 | B2 | 6/2011 | Frantzen et al. |
| 7,962,996 | B1 | 6/2011 | Mondello |
| 8,029,590 | B2 | 10/2011 | Cheng |
| 8,069,529 | B2 | 12/2011 | Groff et al. |
| 8,070,006 | B2 | 12/2011 | Austin et al. |
| 8,100,999 | B2 | 1/2012 | Ashbee et al. |
| 8,127,398 | B2 | 3/2012 | Conrad |
| 8,146,201 | B2 | 4/2012 | Conrad |
| 8,151,407 | B2 | 4/2012 | Conrad |
| 8,156,609 | B2 | 4/2012 | Milne et al. |
| 8,176,596 | B2 | 5/2012 | Conrad |
| 8,192,515 | B2 | 6/2012 | Conrad |
| 8,225,456 | B2 | 7/2012 | Hkan et al. |
| 8,292,979 | B2 | 10/2012 | Conrad |
| 8,296,900 | B2 | 10/2012 | Conrad |
| 8,349,428 | B2 | 1/2013 | Conrad |
| 8,370,993 | B2 | 2/2013 | Conrad |
| 8,375,508 | B2 | 2/2013 | Conrad |
| 8,388,900 | B2 | 3/2013 | Benedek et al. |
| 8,424,154 | B2 | 4/2013 | Beskow et al. |
| 8,444,731 | B2 | 5/2013 | Gomiciaga-Pereda et al. |
| 8,448,291 | B2 | 5/2013 | Conrad |
| 8,479,358 | B2 | 7/2013 | Conrad |
| 8,486,170 | B2 | 7/2013 | Conrad et al. |
| 8,510,907 | B2 | 8/2013 | Conrad |
| 8,533,904 | B2 | 9/2013 | Conrad |
| 8,549,704 | B2 | 10/2013 | Milligan et al. |
| 8,561,257 | B2 | 10/2013 | Conrad |
| 8,567,005 | B2 | 10/2013 | Conrad |
| 8,567,008 | B2 | 10/2013 | Conrad |
| 8,572,799 | B2 | 11/2013 | Won et al. |
| 8,578,550 | B2 | 11/2013 | Conrad |
| 8,578,553 | B2 | 11/2013 | Conrad |
| 8,590,102 | B2 | 11/2013 | Conrad |
| 8,591,615 | B2 | 11/2013 | Kim et al. |
| 8,607,406 | B2 | 12/2013 | Miefalk et al. |
| 8,607,407 | B2 | 12/2013 | Conrad |
| 8,621,709 | B2 | 1/2014 | Conrad |
| 8,640,304 | B2 | 2/2014 | Conrad |
| 8,646,147 | B2 | 2/2014 | Conrad |
| 8,659,184 | B2 | 2/2014 | Conrad |
| 8,677,554 | B2 | 3/2014 | Conrad |
| 8,677,558 | B2 | 3/2014 | Conrad |
| 8,713,751 | B2 | 5/2014 | Conrad |
| 8,713,752 | B2 | 5/2014 | Kang |
| 8,732,892 | B2 | 5/2014 | Lalibert et al. |
| 8,763,201 | B2 | 7/2014 | Kim et al. |
| 8,769,764 | B2 | 7/2014 | Crouch et al. |
| 8,813,305 | B2 | 8/2014 | Conrad |
| 8,834,209 | B2 | 9/2014 | Conrad |
| 8,869,344 | B2 | 10/2014 | Conrad |
| 8,869,345 | B2 | 10/2014 | Conrad |
| 8,869,348 | B2 | 10/2014 | Conrad |
| 8,870,988 | B2 | 10/2014 | Oh et al. |
| 8,875,340 | B2 | 11/2014 | Conrad |
| 8,875,342 | B2 | 11/2014 | Conrad |
| 8,926,723 | B2 | 1/2015 | Kim |
| 8,951,319 | B2 | 2/2015 | Kim et al. |
| 8,978,197 | B2 | 3/2015 | Kang |
| 8,984,708 | B2 | 3/2015 | Kuhe et al. |

(56) References Cited

U.S. PATENT DOCUMENTS 9,027,198 B2 5/2015 Conrad
9,027,199 B2 5/2015 Jung et al.
9,027,203 B2 5/2015 Conrad et al.
9,039,820 B2 5/2015 Han
9,060,666 B2 6/2015 Jang et al.
9,066,642 B2 6/2015 Conrad
9,072,418 B2 7/2015 Hwang et al.
9,119,513 B2 9/2015 Conrad
9,155,434 B2 10/2015 Cho
9,161,666 B2 10/2015 Conrad
9,161,669 B2 10/2015 Conrad
9,167,944 B2 10/2015 Conrad
9,204,769 B2 12/2015 Conrad
9,204,773 B2 12/2015 Conrad
9,215,960 B2 12/2015 Conrad
9,226,630 B2 1/2016 Chong et al.
9,226,633 B2 1/2016 Conrad et al.
9,227,151 B2 1/2016 Conrad
9,227,201 B2 1/2016 Conrad
9,232,881 B2 1/2016 Conrad
9,237,833 B2 1/2016 Hyun et al.
9,238,235 B2 1/2016 Conrad
9,271,618 B2 3/2016 Mantyla et al.
9,295,995 B2 3/2016 Conrad
9,314,138 B2 4/2016 Conrad
9,314,139 B2 4/2016 Conrad et al.
9,315,308 B2 4/2016 Audet et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,855 B2 9/2016 Conrad
9,456,721 B2 10/2016 Conrad
9,462,920 B1 10/2016 Morin et al.
9,492,045 B2 11/2016 Conrad
9,492,048 B2 11/2016 Won et al.
9,526,394 B2 12/2016 Conrad
9,572,463 B2 2/2017 Conrad
9,591,952 B2 3/2017 Conrad
9,591,958 B2 3/2017 Conrad
9,775,484 B2 10/2017 Conrad
9,788,698 B2 10/2017 Morin et al.
9,801,513 B2 10/2017 Conrad et al.
9,820,621 B2 11/2017 Conrad et al.
9,874,873 B2 1/2018 Angle et al.
9,888,818 B2 2/2018 Kuhe et al.
9,901,235 B2 2/2018 Li et al.
9,924,846 B2 3/2018 Morin et al.
10,076,183 B2 9/2018 Conrad et al.
10,149,587 B2 12/2018 Conrad et al.
10,159,393 B2 12/2018 Conrad
10,188,255 B2 1/2019 Lee et al.
10,201,260 B2 2/2019 Conrad et al.
10,214,349 B2 2/2019 Conrad
10,251,519 B2 4/2019 Conrad
10,258,208 B2 4/2019 Conrad
10,314,453 B2 6/2019 Kim et al.
10,357,136 B2 7/2019 Conrad
10,405,717 B2 9/2019 Kim et al.
10,405,719 B2 9/2019 Kim et al.
10,427,085 B2 10/2019 Kim et al.
10,464,746 B2 11/2019 Conrad
10,537,216 B2 1/2020 Conrad
10,537,219 B2 1/2020 Conrad et al.
10,561,291 B2 2/2020 Kim et al.
10,568,477 B2 2/2020 Conrad
10,575,693 B2 3/2020 Conrad
10,610,073 B1 4/2020 Lucas
10,610,075 B2 4/2020 Kim et al.
10,660,493 B2 5/2020 Kim et al.
10,667,663 B2 6/2020 Conrad
10,687,679 B2 6/2020 Conrad et al.
10,688,652 B2 6/2020 Hummel
10,709,308 B2 7/2020 Buehler et al.
10,729,294 B2 8/2020 Conrad et al.
10,791,890 B2 10/2020 Conrad
10,791,896 B2 10/2020 Conrad
10,888,205 B2 1/2021 Conrad et al.
10,932,634 B2 3/2021 Conrad
10,959,588 B2 3/2021 Conrad et al.
10,973,380 B2 4/2021 Seo et al.
11,013,378 B2 5/2021 Conrad
11,108,254 B2 8/2021 Conrad
11,135,602 B2 10/2021 Conrad
11,154,169 B2 10/2021 Conrad
11,198,085 B2 12/2021 Conrad et al.
11,213,179 B2 1/2022 Conrad
11,246,462 B2 2/2022 Conrad
11,285,495 B2 3/2022 Conrad
11,318,482 B2 5/2022 Conrad
11,337,573 B2 5/2022 Kim et al.
11,445,873 B2 9/2022 Conrad et al.
11,445,874 B2 9/2022 Conrad et al.
11,452,417 B2 9/2022 Na et al.
11,478,116 B2 10/2022 Conrad
11,478,117 B2 10/2022 Conrad et al.
11,503,969 B2 11/2022 Cho et al.
11,529,034 B2 12/2022 Conrad
11,534,041 B2 12/2022 Conrad
11,534,043 B2 12/2022 Conrad
11,534,702 B2 12/2022 Conrad
11,547,258 B2 1/2023 Conrad
11,571,097 B2 2/2023 Conrad
11,612,290 B2 3/2023 Conrad
11,641,995 B2 5/2023 Conrad
11,707,170 B2 7/2023 Conrad
11,737,625 B2 8/2023 Conrad
11,745,131 B2 9/2023 Conrad
11,793,374 B2 10/2023 Conrad
11,794,141 B2 10/2023 Conrad
11,839,343 B2 12/2023 Conrad et al.
11,841,024 B2 12/2023 Conrad
11,857,142 B2 1/2024 Conrad
11,896,190 B1 2/2024 Xu et al.
11,950,745 B2 4/2024 Conrad et al.
11,998,150 B2 6/2024 Innes et al.
12,053,143 B2 8/2024 Conrad
12,075,966 B2 9/2024 Conrad
2001/0027587 A1 10/2001 Conrad et al.
2002/0078524 A1 6/2002 Schroter
2002/0162188 A1 11/2002 Harmen
2003/0159235 A1 8/2003 Oh
2003/0201754 A1 10/2003 Conrad
2004/0093837 A1 5/2004 Mauffette et al.
2004/0112022 A1 6/2004 Vuijk
2004/0163206 A1 8/2004 Oh
2004/0216266 A1 11/2004 Conrad
2004/0255425 A1 12/2004 Arai et al.
2005/0015916 A1 1/2005 Orubor
2005/0022331 A1 2/2005 Kim et al.
2005/0132530 A1 6/2005 Macleod et al.
2005/0150519 A1 7/2005 Keppler et al.
2005/0166352 A1 8/2005 Keppler et al.
2006/0090290 A1 5/2006 Lau
2006/0137304 A1 6/2006 Jeong et al.
2006/0156508 A1 7/2006 Khalil
2006/0175336 A1 8/2006 Wang
2006/0191099 A1 8/2006 Fry et al.
2006/0196004 A1 9/2006 Conrad
2006/0278087 A1 12/2006 Sepke et al.
2007/0157415 A1 7/2007 Lee et al.
2007/0157416 A1 7/2007 Lee et al.
2007/0157420 A1 7/2007 Lee et al.
2007/0226948 A1 10/2007 Due
2007/0226949 A1 10/2007 Hahm et al.
2007/0245511 A1 10/2007 Hahm et al.
2007/0271724 A1 11/2007 Hakan et al.
2007/0294858 A1 12/2007 Murphy
2008/0040883 A1 2/2008 Beskow
2008/0056933 A1 3/2008 Moore et al.
2008/0172992 A1 7/2008 Conrad

(56) References Cited

U.S. PATENT DOCUMENTS

2008/0178416 A1 7/2008 Conrad
2008/0178418 A1 7/2008 Conrad
2008/0179133 A1 7/2008 Conrad
2008/0189898 A1 8/2008 Hughes
2008/0196366 A1 8/2008 Conrad
2008/0201895 A1 8/2008 Kim et al.
2008/0216281 A1 9/2008 Conrad
2008/0256744 A1 10/2008 Rowntreer et al.
2009/0049640 A1 2/2009 Lee et al.
2009/0151306 A1 6/2009 Lin
2009/0183633 A1 7/2009 Schiller et al.
2009/0223183 A1 9/2009 Lin
2009/0229230 A1 9/2009 Cheng
2009/0261501 A1 10/2009 Usami
2010/0175217 A1 7/2010 Conrad
2010/0229322 A1 9/2010 Conrad
2010/0229323 A1 9/2010 Conrad
2010/0229325 A1 9/2010 Conrad
2010/0229326 A1 9/2010 Conrad
2010/0229334 A1 9/2010 Conrad
2010/0229335 A1 9/2010 Conrad
2010/0251507 A1 10/2010 Conrad
2010/0301147 A1 12/2010 Harkess et al.
2011/0119860 A1 5/2011 Marcil et al.
2011/0219567 A1 9/2011 Conrad
2011/0219570 A1 9/2011 Conrad
2011/0219579 A1 9/2011 Conrad
2011/0289720 A1 12/2011 Han et al.
2012/0011677 A1 1/2012 Jung et al.
2012/0011679 A1 1/2012 Chong et al.
2012/0030895 A1 2/2012 Chong et al.
2013/0000498 A1 1/2013 Guest et al.
2013/0007984 A1 1/2013 Liu
2013/0305481 A1 11/2013 Jung et al.
2014/0017777 A1 1/2014 Wright et al.
2014/0059797 A1 3/2014 Kim et al.
2014/0237768 A1 8/2014 Conrad
2014/0366310 A1 12/2014 Conrad
2014/0366314 A1 12/2014 Conrad
2015/0020348 A1 1/2015 Miefalk et al.
2015/0107047 A1 4/2015 Hyun et al.
2015/0135470 A1 5/2015 Mantyla et al.
2016/0183752 A1 6/2016 Morin et al.
2016/0278591 A1 9/2016 Hutchins
2016/0367094 A1 12/2016 Conrad
2017/0164800 A1 6/2017 Arakawa
2017/0196430 A1 7/2017 Machida et al.
2017/0209011 A1 7/2017 Robinson et al.
2017/0319033 A1 11/2017 Hyun et al.
2018/0022543 A1 1/2018 Jokinen
2018/0029809 A1 2/2018 Lee et al.
2018/0064303 A1* 3/2018 Meggle ..... A47L 9/2873
2018/0078104 A1 3/2018 Register et al.
2018/0199776 A1 7/2018 Sato et al.
2019/0085852 A1 3/2019 Porras et al.
2019/0092179 A1 3/2019 Kwa et al.
2019/0200825 A1* 7/2019 Crouch ..... A47L 9/165
2020/0022553 A1 1/2020 Mathieu et al.
2020/0101574 A1 4/2020 Caspar
2020/0170468 A1 6/2020 Nakayama et al.
2020/0179952 A1 6/2020 Conrad
2020/0225673 A1 7/2020 Ebrahimi Afrouzi et al.
2020/0229667 A1 7/2020 Yun et al.
2020/0275815 A1 9/2020 Ogihara et al.
2020/0281427 A1 9/2020 Vitz et al.
2020/0281428 A1 9/2020 Vitz et al.
2020/0297180 A1 9/2020 Kang et al.
2020/0305671 A1 10/2020 Conrad
2020/0315419 A1 10/2020 Sato et al.
2020/0329933 A1 10/2020 Hackert et al.
2020/0345195 A1 11/2020 Zhou
2021/0038034 A1 2/2021 Na et al.
2021/0068603 A1 3/2021 Cho et al.
2021/0089040 A1 3/2021 Ebrahimi Afrouzi et al.
2021/0126478 A1 4/2021 Park et al.
2021/0156993 A1 5/2021 Gordon et al.
2021/0228032 A1 7/2021 Conrad
2021/0330157 A1 10/2021 Conrad
2021/0386258 A1 12/2021 Conrad
2022/0061612 A1 3/2022 Wolff et al.
2022/0142440 A1 5/2022 Conrad
2022/0151446 A1 5/2022 Conrad et al.
2022/0175206 A1 6/2022 Li et al.
2022/0218168 A1 7/2022 Shi et al.
2022/0218170 A1 7/2022 Wang
2023/0098664 A1 3/2023 Conrad
2023/0118892 A1* 4/2023 Conrad ..... A47L 9/2873 15/310
2023/0146588 A1 5/2023 Kim et al.
2023/0148814 A1* 5/2023 Conrad ..... A47L 9/1666 15/347
2023/0263350 A1 8/2023 Conrad et al.
2023/0348169 A1 11/2023 Conrad
2023/0406616 A1 12/2023 Conrad
2024/0008699 A1 1/2024 Conrad
2024/0008701 A1 1/2024 Conrad et al.
2024/0016351 A1 1/2024 Conrad
2024/0041284 A1 2/2024 Conrad
2024/0138634 A1 5/2024 Conrad
2024/0172909 A1 5/2024 Conrad
2024/0180373 A1 6/2024 Conrad et al.
2024/0180379 A1 6/2024 Conrad
2024/0245271 A1 7/2024 Conrad
2024/0335077 A1 10/2024 Conrad
2024/0349965 A1 10/2024 Conrad
2024/0358212 A1 10/2024 Conrad
2024/0382056 A1 11/2024 Conrad

FOREIGN PATENT DOCUMENTS

CA 2258416 A1 7/2000
CA 2258419 A1 7/2000
CA 2258421 A1 7/2000
CA 2258422 A1 7/2000
CA 2258423 A1 7/2000
CA 2258426 A1 7/2000
CA 2330801 A1 7/2001
CA 2338193 A1 7/2002
CA 2339514 A1 9/2002
CA 2342673 A1 9/2002
CA 2342993 A1 9/2002
CA 2658014 A1 9/2010
CA 2658022 A1 9/2010
CA 2658160 A1 9/2010
CA 2658366 A1 9/2010
CA 2658397 A1 9/2010
CA 2658497 A1 9/2010
CA 2658643 A1 9/2010
CA 2658644 A1 9/2010
CA 2917900 A1 9/2010
CN 1336154 A 2/2002
CN 101015436 A 8/2007
CN 101095604 A 1/2008
CN 101288572 A 10/2008
CN 101489453 A 7/2009
CN 101489455 A 7/2009
CN 101489457 A 7/2009
CN 101489461 A 7/2009
CN 101657133 A 2/2010
CN 1679439 B 5/2010
CN 201719179 U 1/2011
CN 101984910 A 3/2011
CN 201840420 U 5/2011
CN 102125407 A 7/2011
CN 102188208 A 9/2011
CN 102256523 A 11/2011
CN 202173358 U 3/2012
CN 203852305 U 10/2014
CN 105078367 B 8/2017
CN 107468159 A 12/2017
CN 105747993 B 11/2019
CN 113317716 A 8/2021
CN 116076944 A 5/2023
DE 3825773 A1 2/1990

(56) References Cited

FOREIGN PATENT DOCUMENTS

| | | | |
|---|---|---|---|
| DE | 19704468 | A1 | 8/1998 |
| DE | 20311505 | U1 | 10/2003 |
| DE | 60201666 | T2 | 11/2004 |
| DE | 60211663 | T2 | 6/2006 |
| DE | 112006003479 | T5 | 12/2008 |
| DE | 112007001314 | T5 | 4/2009 |
| DE | 102007059591 | A1 | 6/2009 |
| DE | 112007003039 | T5 | 10/2009 |
| DE | 112007003052 | T5 | 1/2010 |
| DE | 112010001135 | T5 | 8/2012 |
| DE | 102012110765 | A1 | 5/2014 |
| DE | 102013108564 | A1 | 3/2015 |
| DE | 102014113797 | A1 | 3/2016 |
| DE | 102015100057 | A1 | 7/2016 |
| DE | 102019131582 | A1 | 5/2021 |
| DE | 102020116426 | A1 | 12/2021 |
| EP | 322387 | A2 | 6/1989 |
| EP | 1535564 | B1 | 8/2009 |
| EP | 1243218 | B1 | 5/2010 |
| EP | 1743562 | B1 | 9/2011 |
| EP | 2628430 | A2 | 8/2013 |
| EP | 1959809 | B1 | 5/2014 |
| EP | 2798992 | A1 | 11/2014 |
| EP | 2848176 | A1 | 3/2015 |
| EP | 2459043 | B1 | 9/2015 |
| EP | 2959817 | A1 | 12/2015 |
| EP | 2225993 | B1 | 2/2016 |
| EP | 3456234 | B1 | 8/2022 |
| GB | 594471 | A | 11/1947 |
| GB | 2370006 | B | 10/2003 |
| GB | 2449484 | B | 4/2009 |
| GB | 2459300 | B | 3/2010 |
| GB | 2487387 | B | 9/2015 |
| GB | 2618379 | A | 11/2023 |
| JP | 2003038398 | A | 2/2003 |
| JP | 2003180587 | A | 7/2003 |
| JP | 2003339593 | A | 12/2003 |
| JP | 2003339594 | A | 12/2003 |
| JP | 2003339595 | A | 12/2003 |
| JP | 2003339596 | A | 12/2003 |
| JP | 2004283327 | A | 10/2004 |
| JP | 2005218512 | A | 8/2005 |
| JP | 3699679 | B2 | 9/2005 |
| JP | 2006340935 | A | 12/2006 |
| JP | 2007089755 | A | 4/2007 |
| JP | 2008035887 | A | 2/2008 |
| JP | 4070638 | B2 | 4/2008 |
| JP | 2008079922 | A | 4/2008 |
| JP | 2008154801 | A | 7/2008 |
| JP | 2008194177 | A | 8/2008 |
| JP | 2008246154 | A | 10/2008 |
| JP | 4208742 | B2 | 1/2009 |
| JP | 4231808 | B2 | 3/2009 |
| JP | 2009261501 | A | 11/2009 |
| JP | 2010081968 | A | 4/2010 |
| JP | 4977264 | B2 | 7/2012 |
| JP | 5070322 | B2 | 11/2012 |
| JP | 5177814 | B2 | 4/2013 |
| JP | 5330909 | B2 | 10/2013 |
| JP | 2014180647 | A | 9/2014 |
| JP | 5724218 | B2 | 5/2015 |
| JP | 2015119879 | A | 7/2015 |
| JP | 6072502 | B2 | 2/2017 |
| JP | 6088784 | B2 | 3/2017 |
| JP | 2017189453 | A | 10/2017 |
| KR | 1020050091821 | A | 9/2005 |
| KR | 1020050091824 | A | 9/2005 |
| KR | 1020050091826 | A | 9/2005 |
| KR | 1020050091829 | A | 9/2005 |
| KR | 1020050091830 | A | 9/2005 |
| KR | 1020050091833 | A | 9/2005 |
| KR | 1020050091834 | A | 9/2005 |
| KR | 1020050091835 | A | 9/2005 |
| KR | 1020050091836 | A | 9/2005 |
| KR | 1020050091837 | A | 9/2005 |
| KR | 1020050091838 | A | 9/2005 |
| KR | 1020060008365 | A | 1/2006 |
| KR | 100572866 | B1 | 4/2006 |
| KR | 100572877 | B1 | 4/2006 |
| KR | 100634805 | B1 | 10/2006 |
| KR | 1020070012109 | A | 1/2007 |
| KR | 100880492 | B1 | 1/2009 |
| KR | 101134243 | B1 | 3/2012 |
| KR | 101306738 | B1 | 9/2013 |
| KR | 101770755 | B1 | 8/2017 |
| KR | 101952658 | B1 | 2/2019 |
| KR | 101968588 | B1 | 4/2019 |
| WO | 0010718 | A1 | 3/2000 |
| WO | 0243551 | A1 | 6/2002 |
| WO | 2005053495 | A1 | 6/2005 |
| WO | 2008135708 | A1 | 11/2008 |
| WO | 2010102396 | A1 | 9/2010 |
| WO | 2011025071 | A1 | 3/2011 |
| WO | 2012116956 | A1 | 9/2012 |
| WO | 2016040601 | A1 | 3/2016 |
| WO | 2016141960 | A1 | 9/2016 |
| WO | 2016206759 | A1 | 12/2016 |
| WO | 2018119510 | A1 | 7/2018 |
| WO | 2019030481 | A1 | 2/2019 |
| WO | 2020223619 | A1 | 11/2020 |
| WO | 2021177699 | A1 | 9/2021 |
| WO | 2023018048 | A1 | 2/2023 |
| WO | 2023214165 | A1 | 11/2023 |
| WO | 2023214166 | A1 | 11/2023 |

OTHER PUBLICATIONS

Chen, "Cleaning system for realizing multiple cleaning paths by using single vacuum source," CN 116076944 to CPO, May 9, 2023 (Year: 2023).*

Schmitz, K et al., "Vacuum Cleaning Device, System with a Vacuum Cleaning Device and a Base Station and Method for Operating Such a System," De 102019131582A1 to EPO, May 27, 2021 (Year: 2021).*

Fleczok, et al., "Vacuum Cleaning Device," DE 102020116426 A1, to EPO, May 27, 2021 (Year: 2021).*

Morishita, et al. "Vacuum Cleaning Apparatus" JP 2008079922 to JPO, Mar. 10, 2008 (Year: 2008).*

International Search Report and Written Opinion, received in connection to International Patent Application No. PCT/CA2025/050159, mailed on Jun. 3, 2025.

English machine translation of CN105747993B, published on Nov. 12, 2019.

English machine translation of DE60211663T2, published on Jun. 29, 2006.

English machine translation of DE60201666T2, published on Nov. 25, 2004.

English machine translation of DE3825773A1, published on Feb. 1, 1990.

English machine translation of DE112010001135T5, published on Aug. 2, 2012.

English machine translation of DE112007003052T5, published on Jan. 14, 2010.

English machine translation of DE112007003039T5, published on Oct. 29, 2009.

English machine translation of DE112007001314T5, published on Apr. 23, 2009.

English machine translation of DE112006003479T5, published on Dec. 18, 2008.

English machine translation of DE102014113797A1, published on Mar. 24, 2016.

English machine translation of DE102012110765A1, published on May 15, 2014.

English machine translation of CN202173358U, published on Mar. 28, 2012.

English machine translation of CN1336154A, published on Feb. 20, 2002.

English machine translation of C102256523A, published on Nov. 23, 2011.

(56) References Cited

OTHER PUBLICATIONS

English machine translation of CN102188208A, published on Sep. 21, 2011.
English machine translation of CN101657133A, published on Feb. 24, 2010.
English machine translation of CN101489461A, published on Jul. 22, 2009.
English machine translation of CN101489457A, published on Jul. 22, 2009.
English machine translation of CN101489455A , published on Jul. 22, 2009.
English machine translation of CN101489453A, published on Jul. 22, 2009.
English machine translation of CN101288572A, published on Oct. 22, 2008.
English machine translation of CN101095604A, published on Jan. 2, 2008.
English machine translation of CN101015436A, published on Aug. 11, 2010.
English machine translation of KR1020070012109A, published on Jan. 25, 2007.
English machine translation of KR1020060008365A, published on Jan. 26, 2006.
English machine translation of KR1020050091838A, published on Sep. 15, 2005.
English machine translation of KR1020050091837A, published on Sep. 15, 2005.
English machine translation of KR1020050091836A, published on Sep. 15, 2005.
English machine translation of KR1020050091835A, published on Sep. 15, 2005.
English machine translation of KR1020050091834A, published on Sep. 15, 2005.
English machine translation of KR1020050091833A, published on Sep. 15, 2005.
English machine translation of KR1020050091830A, published on Sep. 15, 2005.
English machine translation of KR1020050091829A, published on Sep. 15, 2005.
English machine translation of KR1020050091826A, published on Sep. 15, 2005.
English machine translation of KR1020050091824A, published on Sep. 15, 2005.
English machine translation of KR1020050091821A, published on Sep. 15, 2005.
English machine translation of JP2014180647A, published on Sep. 29, 2014.
English machine translation of JP2010081968A, published on Apr. 15, 2010.
English machine translation of JP2009261501A, published on Nov. 12, 2009.
English machine translation of JP2003180587A, published on Jul. 2, 2003.
English machine translation of KR101952658B1, published on Feb. 27, 2019.
English machine translation of KR101968588B1, published on Apr. 15, 2019.
English machine translation of JP2004283327A, published on Oct. 14, 2004.
International Search Report and Written Opinion, received in connection to international patent application No. PCT/CA2023/051677, mailed on Apr. 1, 2024.
English machine translation of WO2021/177699A1, mailed on Sep. 10, 2021.
"Lupe Cordless Vacuum Cleaner. Powerful. Enduring. Flexible." retrieved at https://www.kickstarter.com/projects/lupepablo/lupe-cordless-vacuum-cleaner-powerful-enduring-flexible; published at least as early as Jun. 18, 2019.
English machine translation of CN203852305U, published on Oct. 1, 2014.
English machine translation of CN201840420U, published on May 25, 2011.
English machine translation of CN201719179U, published on Jan. 26, 2011.
English machine translation of CN107468159A, published on Dec. 15, 2017.
English machine translation of CN105078367B , published on Aug. 25, 2017.
English machine translation of CN102125407A, published on Jul. 20, 2011.
English machine translation of CN101984910A, published on Mar. 16, 2011.
English machine translation of CN1679439B, published on May 26, 2010.
English machine translation of DE102013108564A1, published on Mar. 5, 2015.
English machine translation of DE102007059591A1, published on Jun. 18, 2009.
English machine translation of DE20311505U1, published on Oct. 30, 2003.
English machine translation of DE19704468A1, published on Aug. 13, 1998.
English machine translation of EP2459043B1, published on Sep. 16, 2015.
English machine translation of EP1959809B1, published on May 21, 2014.
English machine translation of EP1535564B1, published on Aug. 19, 2009.
English machine translation of JP5330909B2, published on Oct. 30, 2013.
English machine translation of JP5724218B2, published on May 27, 2015.
English machine translation of JP2008246154A, published on Oct. 16, 2008.
English machine translation of JP2008194177A, published on Aug. 28, 2008.
English machine translation of JP2008154801A, published on Jul. 10, 2008.
International Search Report and the Written Opinion, received in connection to international patent application No. PCT/CA2021/050007, mailed on Mar. 12, 2021.
Preliminary Report on Patentability, in connection to international patent application No. PCT/CA2021/050007, mailed on Jul. 21, 2022.
U.S. Appl. No. 18/590,937, filed Feb. 28, 2024.
U.S. Appl. No. 09/343,479, filed Jun. 30, 1999.
English machine translation of JP2008035887A, published on Feb. 21, 2008.
English machine translation of JP2007089755A, published on Apr. 12, 2007.
English machine translation of JP2006340935A, published on Dec. 21, 2006.
English machine translation of JP2005218512A, published on Aug. 18, 2005.
English machine translation of JP2003339596A, published on Dec. 2, 2003.
English machine translation of JP2003339595A, published on Dec. 2, 2003.
English machine translation of JP2003339594A, published on Dec. 2, 2003.
English machine translation of JP2003339593A, published on Dec. 2, 2003.
English machine translation of JP2003038398A, published on Dec. 2, 2003.
English machine translation of JP6088784B2, published on Mar. 1, 2017.
English machine translation of JP6072502B2 , published on Feb. 1, 2017.
English machine translation of JP3699679B2, published on Sep. 28, 2005.
English machine translation of JP4070638B2, published on Apr. 2, 2008.

(56) References Cited

OTHER PUBLICATIONS

English machine translation of JP4208742B2, published on Jan. 14, 2009.
English machine translation of JP4231808B2, published on Mar. 4, 2009.
English machine translation of JP4977264B2, published on Jul. 18, 2012.
English machine translation of JP5070322B2, published on Nov. 14, 2012.
English machine translation of JP5177814B2, published on Apr. 10, 2013.
English machine translation of KR101770755B1, published on Aug. 23, 2017.
English machine translation of KR101306738B1, published on Sep. 4, 2013.
English machine translation of KR101134243B1, published on Mar. 30, 2012.
English machine translation of KR100880492B1, published on Jan. 19, 2009.
English machine translation of KR100634805B1, published on Oct. 10, 2006.
English machine translation of KR100572877B1, published on Apr. 14, 2006.
English machine translation of KR100572866B1, published on Apr. 14, 2006.
English machine translation of WO2011025071A1, published on Mar. 3, 2011.
International Search Report and Written Opinion received in connection to co-pending International Patent Application No. PCT/CA2024/051039, mailed on Nov. 25, 2024.

* cited by examiner

SURFACE CLEANING APPARATUS AND DOCKING STATION USABLE THEREWITH

CROSS-REFERENCE TO RELATED APPLICATION

This application claims a benefit of priority from Provisional Patent Application No. 63/532,614, filed Aug. 14, 2023, which is incorporated herein in its entirety by reference.

FIELD

This disclosure relates generally to a surface cleaning apparatus and a docking station usable therewith to transfer stored dirt and/or debris from the surface cleaning apparatus to the docking station.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Various types of docking stations for receiving stored dirt and/or debris from the surface cleaning apparatus are known. Docking stations may also charge the surface cleaning apparatus when the surface cleaning apparatus is connected or docked to the docking station.

SUMMARY

In accordance with an aspect, there is provided a surface cleaning apparatus and a docking station therefor. The surface cleaning apparatus has an air treatment assembly (air treatment member) comprising an air treatment chamber (e.g., a cyclone) with a dirt collection region that is dockable with the docking station. The dirt collection region may be internal of the air treatment chamber or external thereto and in communication with the air treatment chamber by one or more dirt outlets. The air treatment member may be dockable while attached to the surface cleaning apparatus or when removed therefrom. The air treatment member has an axially extending sidewall (e.g., a cyclone sidewall extending in the direction of the cyclone axis of rotation) comprising an openable portion. When docked at the docking station, the docking station and the stationary portion abut whereby the openable portion is contained within a closed volume.

In accordance with this aspect, there is provided an apparatus comprising: (a) a surface cleaning apparatus comprising: (i) a surface cleaning apparatus air flow path extending from a surface cleaning apparatus dirty air inlet to a surface cleaning apparatus clean air outlet; (ii) a suction motor positioned in the surface cleaning apparatus air flow path upstream of the surface cleaning apparatus clean air outlet; and, (iii) an air treatment member positioned in the surface cleaning apparatus air flow path, the air treatment member comprising a first stage air treatment chamber, the first stage air treatment chamber having a first end, an axially spaced apart second end, a sidewall extending between the first end of the first stage air treatment chamber and the second end of the first stage air treatment chamber, an air inlet and an air outlet, the air treatment member comprises a stationary portion and a moveable portion, the moveable portion comprises a portion of the sidewall and the moveable portion is moveably mounted by a mount between a closed position in which the first stage air treatment chamber is closed and an open position in which the first stage air treatment chamber is open; and, (b) a docking station comprising: (i) a docking station air flow path extending from a docking station air inlet to a docking station air outlet; and, (ii) a docking interface comprising wall portions and a docking interface perimeter extending around the wall portions, wherein, when the air treatment member is docked with the docking station, the docking interface perimeter contacts the stationary portion of the air treatment member and a closed volume is provided interior of the wall portions, whereby, when the moveable portion is moved to the open position, the moveable portion is moved into the volume and the volume defines the docking station air inlet.

In accordance with this aspect, there is also provided an apparatus comprising: (a) a hand vacuum cleaner comprising: (i) a surface cleaning apparatus air flow path extending from a surface cleaning apparatus dirty air inlet to a surface cleaning apparatus clean air outlet; (ii) a suction motor positioned in the surface cleaning apparatus air flow path upstream of the surface cleaning apparatus clean air outlet; and, (iii) an air treatment member positioned in the surface cleaning apparatus air flow path, the air treatment member comprising an air treatment chamber, the air treatment chamber having a first end, an axially spaced apart second end, a sidewall extending between the first end of the air treatment chamber and the second end of the air treatment chamber, an air inlet and an air outlet, the air treatment member comprises a stationary portion and a moveable portion, the moveable portion comprises a portion of the sidewall and the moveable portion is moveably mounted by a mount between a closed position in which the air treatment chamber is closed and an open position in which the air treatment chamber is open; and, (b) a docking station comprising: (i) a docking station air flow path extending from a docking station air inlet to a docking station air outlet; and, (ii) a docking interface comprising wall portions and a docking interface perimeter extending around the wall portions, wherein, when the air treatment member is docked with the docking station, the docking interface perimeter contacts the hand vacuum cleaner and a closed volume is provided interior of the wall portions, whereby, when the moveable portion is moved to the open position, the moveable portion is moved into the volume and the volume defines the docking station air inlet.

In accordance with another aspect, an air treatment assembly (air treatment member) comprises an air treatment chamber (e.g., a cyclone) with a dirt collection region. The dirt collection region may be internal of the air treatment chamber or external thereto and in communication with the air treatment chamber by one or more dirt outlets. The air treatment member has an axially extending sidewall (e.g., a cyclone sidewall extending in the direction of the cyclone axis of rotation) comprising an openable portion and a stationary portion. The openable portion of the sidewall and the stationary portion of the sidewall abut along a juncture wherein at least a portion of the juncture does not extend in the axial direction.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; and, (c) an air treatment member positioned in the air flow path, the air treatment member comprising an air treatment chamber, the air treatment chamber having a front end, an axially spaced apart rear end, a sidewall extending between the front end of the air treatment chamber and the rear end of the air treatment chamber, an air inlet and an air outlet, the air treatment member comprises a stationary portion and a moveable portion, the moveable portion comprises a portion of the sidewall and the moveable portion is moveably mounted by a mount between a closed position in which the air treatment chamber is closed and an open position in which the air treatment chamber is open, wherein, when the moveable portion is in the closed position, the moveable portion and the stationery portion abut along peripheral edges that extend forwardly from a location of the mount, and the peripheral edge of the moveable portion has a discontinuity.

In accordance with this aspect, there is also provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; and, (c) an air treatment member positioned in the air flow path, the air treatment member comprising an air treatment chamber, the air treatment chamber having a front end, an axially spaced apart rear end, a sidewall extending between the front end of the air treatment chamber and the rear end of the air treatment chamber, an air inlet and an air outlet, the air treatment member comprises a stationary portion and a moveable portion, the moveable portion comprises a portion of the sidewall and the moveable portion is moveably mounted by a mount between a closed position in which the first stage air treatment chamber is closed and an open position in which the first stage air treatment chamber is open, wherein, when the moveable portion is in the closed position, the moveable portion and the stationery portion abut along peripheral edges that extend forwardly from a location of the mount, and wherein the air outlet of the air treatment member is provided at the rear end of the air treatment chamber, the mount is located at or towards the rear end of the air treatment chamber, the air outlet comprises an outlet conduit that extends into the air treatment chamber from the rear end of the air treatment chamber, the outlet conduit has an axial inner end and the peripheral edge of the moveable portion extends downwardly from a location adjacent or rearward of the axial inner end.

In accordance with another aspect, an air treatment member comprises an air treatment chamber (e.g., a cyclone) and a dirt collection chamber exterior to the air treatment chamber. The air treatment chamber has a longitudinal axis that extends between opposed end walls of the air treatment chamber, and at least a portion of the dirt collection chamber is located at an axial end of the air treatment chamber. The air treatment chamber has a stationary portion and a moveable portion which abut along a juncture wherein at least a portion of the juncture does not extend in the axial direction.

In accordance with this aspect, there is provided a surface cleaning apparatus comprising: (a) an air flow path extending from a dirty air inlet to a clean air outlet; (b) an air treatment chamber comprising a first end having a first end wall, an axially opposed second end having a second end wall, an air treatment chamber air inlet, an air treatment chamber air outlet, an air treatment chamber dirt outlet, an air treatment chamber axis extending between the first and second axially opposed ends and an axially extending air treatment chamber sidewall extending between the first and second axially opposed ends; (c) a dirt collection chamber exterior to the air treatment chamber, the dirt collection chamber comprises an axially extending dirt collection chamber sidewall and a first end having a first end wall, the first end wall is spaced from and faces the first end wall of the air treatment chamber, the dirt collection chamber sidewall comprises a portion that extends between the first end of the dirt collection chamber and the first end wall of the air treatment chamber, the dirt collection chamber is in communication with the air treatment chamber through the dirt outlet; and, (d) a suction motor provided in the air flow path, wherein the air treatment chamber has a stationary portion and a moveable portion, the stationary portion comprises the first end wall of the air treatment chamber, and the moveable portion is moveably mounted by a mount between a closed position in which the air treatment chamber is closed and an open position in which the air treatment chamber is open.

In accordance with this aspect, there is also provided a surface cleaning apparatus comprising: (a) an air flow path extending from a dirty air inlet to a clean air outlet; (b) an air treatment chamber comprising a first end having a first end wall, an axially opposed second end having a second end wall, an air treatment chamber air inlet, an air treatment chamber air outlet, an air treatment chamber dirt outlet, a central air treatment chamber axis extending between the first and second axially opposed ends and an axially extending air treatment chamber sidewall extending between the first and second axially opposed ends; (c) a dirt collection chamber exterior to the air treatment chamber, the dirt collection chamber comprises an axially extending dirt collection chamber sidewall and a first end having a first end wall, the first end wall is spaced from and faces the first end wall of the air treatment chamber, the dirt collection chamber sidewall comprises a portion that extends between the first end of the dirt collection chamber and the first end wall of the air treatment chamber, the dirt collection chamber is in communication with the air treatment chamber through the dirt outlet; and, (d) a suction motor provided in the air flow path, wherein the air treatment chamber has a stationary portion and a moveable portion, the moveable portion comprises the first end wall of the air treatment chamber, and the moveable portion is moveably mounted by a mount between a closed position in which the air treatment chamber is closed and an open position in which the air treatment chamber is open, and wherein, when the moveable portion is in the closed position, the moveable portion and the stationery portion abut along peripheral edges that extend along a length of the air treatment chamber sidewall.

In accordance with this aspect, there is also provided a surface cleaning apparatus comprising: (a) an air flow path extending from a dirty air inlet to a clean air outlet; (b) an air treatment chamber comprising a first end having a first end wall, an axially opposed second end having a second end wall, an air treatment chamber air inlet, an air treatment chamber air outlet, an air treatment chamber dirt outlet, a central air treatment chamber axis extends in a first direction from the first end to the second axially opposed end and an axially extending air treatment chamber sidewall extending between the first and second axially opposed ends; (c) a dirt collection chamber exterior to the air treatment chamber, the dirt collection chamber comprises an axially extending dirt collection chamber sidewall and a first end having a first end wall, the first end wall is spaced from and faces the first end wall of the air treatment chamber, the dirt collection chamber comprises a portion that extends between the first end of the dirt collection chamber and the first end wall of the air treatment chamber, the dirt collection chamber is in communication with the air treatment chamber through the dirt outlet; and, (d) a suction motor provided in the air flow path, wherein an axially translatable portion, comprising at least a portion of the sidewall of the dirt collection chamber and at least a portion of the sidewall of the cyclone chamber, is translatable axially to an open position.

In accordance with another aspect, an air treatment assembly comprises a first stage air treatment chamber having a dirt collection region interior thereof or a first stage dirt collection chamber exterior to the first stage air treatment chamber. The air treatment assembly also has and a dirt collection chamber exterior to the first stage air treatment chamber. For example, the dirt collection chamber may be a second stage dirt collection chamber for a second stage air treatment chamber or the first stage dirt collection chamber. At least a portion of the sidewall of the first stage air treatment chamber is axially translatable whereby dirt collected in the dirt collection chamber (e.g., a second stage dirt collection chamber) is transferred to the first stage air treatment chamber and/or a first stage dirt collection chamber.

In accordance with this aspect, there is provided a surface cleaning apparatus comprising: (a) an air flow path extending from a dirty air inlet to a clean air outlet; (b) an air treatment assembly comprising a first stage air treatment chamber and a dirt collection chamber that is exterior to the first stage air treatment chamber; (c) the first stage air treatment chamber comprises a first end having a first end wall, an axially opposed second end having a second end wall, a first stage air treatment chamber air inlet, a first stage air treatment chamber air outlet, a central air treatment chamber axis which extends in a first direction from the first end to the second axially opposed end and an axially extending air treatment chamber sidewall extending between the first and second axially opposed ends; (d) the dirt collection chamber comprises a first end having a first end wall, an axially opposed second end having a second end wall, wherein the dirt collection chamber comprises a portion that is positioned radially (inwardly or outwardly) of the first stage air treatment chamber; and, (e) a suction motor provided in the air flow path, wherein an axially translatable portion, which comprises at least a portion of the axially extending air treatment chamber sidewall, is axially translatable from a closed position to an open position wherein, when the axially translatable portion is in the open position, dirt collected in the dirt collection chamber is transferrable to the first stage air treatment chamber.

In accordance with another aspect, a surface cleaning apparatus has an air treatment stage, which may comprise an air treatment chamber with a dirt collection region interior thereof or a dirt collection chamber exterior to the air treatment chamber, has a longitudinal axis and at least a portion of the air treatment chamber is moveable laterally to open the air treatment chamber and/or the dirt collection region/chamber. For example, a portion of the air treatment stage, when docked at a docking station, may translate into the docking station.

In accordance with this aspect, there is provided a surface cleaning apparatus comprising: (a) an air flow path extending from a dirty air inlet to a clean air outlet; (b) an air treatment assembly comprising a first stage air treatment chamber, the first stage air treatment chamber comprises a first end having a first end wall, an axially opposed second end having a second end wall, a first stage air treatment chamber air inlet, a first stage air treatment chamber air outlet, a central air treatment chamber axis which extends in a first direction from the first end to the second axially opposed end and an axially extending air treatment chamber sidewall extending between the first and second axially opposed ends; and, (c) a suction motor provided in the air flow path, wherein a laterally moveable portion, which comprises at least a portion of the first stage air treatment chamber, is laterally moveable from a closed position to an open position wherein, when the laterally moveable portion is in the open position, the first stage air treatment chamber is opened.

In accordance with another aspect, a surface cleaning apparatus has an air treatment stage, which may comprise an air treatment chamber with a dirt collection region interior thereof or a dirt collection chamber exterior to the air treatment chamber, has a longitudinal axis extending between first and second (e.g., front and rear) ends of the air treatment chamber. An end of the air treatment chamber is laterally moveable from a closed position to an open position wherein, when the end of the air treatment assembly is in the open position, the first stage air treatment chamber is opened. For example, the end, when docked at a docking station, may translate or rotate into the docking station.

In accordance with this aspect, there is provided a surface cleaning apparatus comprising: (a) an air flow path extending from a dirty air inlet to a clean air outlet; (b) an air treatment assembly comprising a first stage air treatment chamber, the air treatment assembly comprises a first end having a first end wall and an axially opposed second end, the first stage air treatment chamber comprises a first end having a first end wall, an axially opposed second end having a second end wall, a first stage air treatment chamber air inlet, a first stage air treatment chamber air outlet and a central air treatment chamber axis which extends in a first direction from the first end to the second axially opposed end of the first stage air treatment chamber; and, (c) a suction motor provided in the air flow path, wherein the first end of the air treatment assembly is laterally moveable from a closed position to an open position wherein, when the first end of the air treatment assembly is in the open position, the first stage air treatment chamber is opened.

In accordance with another aspect, a surface cleaning apparatus has an air treatment stage, which may comprise an air treatment chamber with a dirt collection region interior thereof or a dirt collection chamber exterior to the air treatment chamber. The air treatment chamber has an air outlet comprising a porous member (e.g., a screen). A central air treatment chamber axis extends in a first direction from the first end to the second axially opposed end of the air treatment chamber, and an axially extending air treatment chamber sidewall extends between the first and second axially opposed ends. A portion of the sidewall is openable either concurrently therewith or subsequent thereto, whereupon the porous member is at moved (e.g., translated, rotated) at least partially out of the air treatment chamber.

In accordance with this aspect, there is provided a surface cleaning apparatus comprising: (a) an air flow path extending from a dirty air inlet to a clean air outlet; (b) an air treatment assembly comprising an air treatment chamber, the air treatment chamber comprises a first end having a first end wall, an axially opposed second end having a second end wall, an air treatment chamber air inlet, an air treatment chamber air outlet comprising a porous member, a central air treatment chamber axis which extends in a first direction from the first end to the second axially opposed end of the air treatment chamber, and an axially extending air treatment chamber sidewall extending between the first and second axially opposed ends; and, (c) a suction motor provided in the air flow path, wherein at least a portion of the sidewall of the air treatment chamber is openable, and when the sidewall is opened and opening is provided whereby the porous member is moveable from an in use position, in which the porous member is positioned in the air treatment chamber, to a cleaning position in which the porous member is positioned at least partially outside the air treatment chamber.

In accordance with another aspect, an air treatment assembly comprises a first stage air treatment chamber and a dirt collection chamber exterior to the first stage air treatment chamber. For example, the dirt collection chamber may be a second stage dirt collection chamber for a second stage air treatment chamber. The first stage air treatment chamber may have a dirt collection region interior thereof or a first stage dirt collection chamber exterior to the first stage air treatment chamber. At least a portion of the sidewall of the first stage air treatment chamber is axially translatable whereby dirt collected in the dirt collection chamber (e.g., a second stage dirt collection chamber) is transferred to the first stage air treatment chamber and/or a first stage dirt collection chamber.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; (c) a first stage air treatment chamber comprising a front end, an axially spaced apart rear end, a sidewall extending between the front end of the first stage air treatment chamber and the rear end of the first stage air treatment chamber, an air inlet and an air outlet; and (d) a dirt collection chamber exterior to the first stage air treatment chamber and positioned radially inwardly of the first stage air treatment chamber, the dirt collection chamber comprises an axially extending dirt collection chamber sidewall wall, the dirt collection chamber sidewall having an openable portion whereby the dirt collection chamber is emptyable.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; (c) a first stage air treatment chamber comprising a front end, an axially spaced apart rear end, a sidewall extending between the front end of the first stage air treatment chamber and the rear end of the first stage air treatment chamber, an air inlet and an air outlet; (d) a second stage air treatment chamber comprising a dirt outlet; and (e) a second stage dirt collection chamber exterior to the second stage air treatment chamber and in communication with the second stage air treatment chamber through the dirt outlet, the second stage dirt collection chamber comprises an axially extending second stage dirt collection chamber sidewall wall, the second stage dirt collection chamber sidewall having an openable portion whereby the dirt collection chamber is emptyable.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; (c) a first stage air treatment chamber comprising a front end, an axially spaced apart rear end, a first stage air treatment chamber sidewall extending between the front end of the first stage air treatment chamber and the rear end of the first stage air treatment chamber, an air inlet and an air outlet, the first stage air treatment chamber sidewall having an openable portion whereby the first stage air treatment chamber is emptyable; (d) a second stage air treatment chamber comprising a dirt outlet; and (e) a second stage dirt collection chamber exterior to the second stage air treatment chamber and in communication with the second stage air treatment chamber through the dirt outlet, the second stage dirt collection chamber comprises an axially extending second stage dirt collection chamber sidewall wall, the second stage dirt collection chamber sidewall having an openable portion whereby the second stage dirt collection chamber is emptyable.

In accordance with another aspect, an air treatment assembly comprises an air treatment chamber and a dirt collection chamber exterior to the first stage air treatment chamber. At least a portion of the sidewall of the air treatment chamber is axially translatable whereby the cyclone chamber and the dirt collection chamber are opened. Accordingly, if the air treatment assembly is docked at a docking station and the sidewall is axially translated, the air treatment chamber and dirt collection chamber may then be in air flow communication with an air treatment member of the docking station.

In accordance with this aspect, there is provided a surface cleaning apparatus comprising: (a) an air flow path extending from a dirty air inlet to a clean air outlet; (b) an air treatment assembly comprising a first stage air treatment chamber and a dirt collection chamber that is exterior to the first stage air treatment chamber; (c) the first stage air treatment chamber comprises a first end having a first end wall, an axially opposed second end having a second end wall, a first stage air treatment chamber air inlet, a first stage air treatment chamber air outlet, a central air treatment chamber axis which extends in a first direction from the first end to the second axially opposed end and an axially extending air treatment chamber sidewall extending between the first and second axially opposed ends; (d) the dirt collection chamber comprises a first end having a first end wall, an axially opposed second end having a second end wall, wherein the dirt collection chamber comprises a portion that is positioned radially outwardly of the first stage air treatment chamber; and, (e) a suction motor provided in the air flow path, wherein an axially translatable portion, which comprises at least a portion of the first stage air treatment chamber and the dirt collection chamber, is axially translatable from a closed position to an open position wherein, when the axially translatable portion is in the open position, the cyclone chamber and the dirt collection chamber are opened.

In accordance with another aspect, a hand vacuum cleaner has an air treatment member has an air treatment chamber (e.g., a cyclone) with a longitudinal (e.g., cyclone axis of rotation) that extends transverse to the forward/rearward direction. The air treatment member has a moveable portion.

When the moveable portion moves to the open position, the front wall remains in position.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; (c) an air treatment member positioned in the air flow path, the air treatment member comprising an air treatment chamber and a dirt collection chamber, the air treatment member having a first lateral end, an axially spaced apart second lateral end, an air treatment member sidewall extending between the first and second ends, a front side and a rear side, the front side comprising a front wall; and, (d) the air treatment chamber comprises a first lateral end, an axially spaced apart second lateral end, a sidewall extending between the first lateral end of the air treatment chamber and the second lateral end of the air treatment chamber, a central air treatment chamber axis extending between the first and second lateral ends of the air treatment chamber, a dirt outlet in communication with the dirt collection chamber, an air inlet and an air outlet, the air outlet is provided at one of the first and second ends of the air treatment chamber; wherein the air treatment member comprises a stationary portion and a moveable portion, the moveable portion is moveably mounted by a mount between a closed position in which the dirt collection chamber is closed and an open position in which the dirt collection chamber is open wherein, when the moveable portion moves to the open position, the front wall remains in position.

In accordance with this aspect, a hand vacuum cleaner has an air treatment member has an air treatment chamber (e.g., a cyclone) with a longitudinal (e.g., cyclone axis of rotation) that extends transverse to the forward/rearward direction. The air treatment member has a moveable portion. The sidewall of the air treatment chamber may be the front wall and some or all of the sidewall may be part of the moveable portion. When the moveable portion moves to the open position, some of the front wall may remain in position.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; (c) an air treatment member positioned in the air flow path, the air treatment member comprising an air treatment chamber, the air treatment member having a first lateral end, an axially spaced apart second lateral end, an air treatment member sidewall extending between the first and second ends, a front side and a rear side, the front side comprising a front wall; and, (d) the air treatment chamber comprises a first lateral end, an axially spaced apart second lateral end, a central air treatment chamber axis extending between the first and second lateral ends of the air treatment chamber, a sidewall extending between the first lateral end of the air treatment chamber and the second lateral end of the air treatment chamber, an air inlet and an air outlet, the air outlet is provided at one of the first and second ends of the air treatment chamber; wherein the front wall of the air treatment member comprises at least a portion of the sidewall of the air treatment chamber, and wherein the air treatment member comprises a stationary portion and a moveable portion, the moveable portion comprises the front wall, the moveable portion is moveably mounted by a mount between a closed position in which the air treatment chamber is closed and an open position in which the air treatment chamber is open.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) a suction motor positioned in the air flow path upstream of the clean air outlet; (c) an air treatment member positioned in the air flow path, the air treatment member comprising an air treatment chamber and a dirt collection chamber, the air treatment member having a first lateral end, an axially spaced apart second lateral end, an air treatment member sidewall extending between the first and second ends, a front side and a rear side, the front side comprising a front wall; and, (d) the air treatment chamber comprises a first lateral end, an axially spaced apart second lateral end, a sidewall extending between the first lateral end of the air treatment chamber and the second lateral end of the air treatment chamber, a central air treatment chamber axis extending between the first and second lateral ends of the air treatment chamber, a dirt outlet in communication with the dirt collection chamber, an air inlet and an air outlet, the air outlet is provided at one of the first and second ends of the air treatment chamber; wherein the air treatment member comprises a stationary portion and a moveable portion, the stationary portion comprises a front side of the air treatment chamber, the moveable portion is moveably mounted by a mount between a closed position in which the dirt collection chamber is closed and an open position in which the dirt collection chamber is open.

In accordance with another aspect, there is provided a surface cleaning apparatus having an air treatment assembly (air treatment member) comprising an air treatment chamber (e.g., a cyclone) with a dirt collection region. The dirt collection region may be internal of the air treatment chamber or external thereto and in communication with the air treatment chamber by one or more dirt outlets. The air treatment member has an axially extending sidewall (e.g., a cyclone sidewall extending in the direction of the cyclone axis of rotation) comprising an openable portion. The openable portion comprises a filter, e.g., a pre-motor filter. Accordingly, when the openable portion is moved to the open position, the filter is moved and may be visible to a user.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) an air treatment member positioned in the air flow path, the air treatment member comprising an air treatment chamber, the air treatment chamber having a front end, an axially spaced apart rear end, a sidewall extending between the front end of the air treatment chamber and the rear end of the air treatment chamber, an air inlet and an air outlet, the air treatment member comprises a stationary portion and a moveable portion, the moveable portion is rotatably mounted by a rotational mount between a closed position in which the air treatment chamber is closed and an open position in which the air treatment chamber is open; (c) a pre-motor filter positioned downstream of the air treatment chamber, the pre-motor filter has a first side and an axially opposed second side; and, (d) a suction motor positioned in the air flow path upstream of the clean air outlet, wherein the moveable portion comprises the pre-motor filter whereby, when the moveable portion is in the closed position, the first side of the pre-motor filter faces generally forwardly and when the moveable portion is in the open position, the first side of the pre-motor filter faces generally rearwardly.

In accordance with another aspect, there is provided a hand vacuum cleaner having an air treatment assembly (air treatment member) comprising an air treatment chamber (e.g., a cyclone) with a dirt collection region. The dirt collection region may be internal of the air treatment chamber or external thereto and in communication with the air treatment chamber by one or more dirt outlets. The air treatment member has an axially extending sidewall (e.g., a cyclone sidewall extending in the direction of the cyclone axis of rotation). The air treatment assembly has a stationary portion and an openable portion (e.g., a portion of the sidewall). The openable portion is an upper portion of the air treatment assembly (e.g., the inlet nozzle may be located at the upper end and may be part of the openable portion).

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet, the dirty air inlet is provided at an upper end of the hand vacuum cleaner; (b) an air treatment chamber comprising a front end having a front end wall, an axially opposed rear end having a rear end wall, an air treatment chamber air inlet, an air treatment chamber air outlet, an air treatment chamber axis extending between the front and rear axially opposed ends and an axially extending air treatment chamber sidewall extending between the front and rear axially opposed ends; and, (c) a suction motor provided in the air flow path, wherein the air treatment chamber has a stationary portion and a moveable portion, the moveable portion comprises an upper end of the air treatment chamber, and the moveable portion is moveably mounted by a mount between a closed position in which the air treatment chamber is closed and an open position in which the air treatment chamber is open.

In accordance with another aspect, there is provided a hand vacuum cleaner having an air treatment assembly (air treatment member) comprising an air treatment chamber (e.g., a cyclone) and a dirt collection chamber. The first collection chamber may be a dirt collection chamber for a first stage air treatment chamber and/or a dirt collection chamber for a second stage air treatment chamber. The air treatment member has a moveable portion which, when opened, opens a front portion (e.g., the front end and/or a portion of a sidewall at the front end) of the dirt collection chamber.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) an air treatment member comprising a first stage air treatment chamber and a dirt collection chamber, (c) the first stage air treatment chamber comprising a front end having a front end wall, an axially opposed rear end having a rear end wall, a first stage air treatment chamber air inlet, a first stage air treatment chamber air outlet, an air treatment chamber axis extending between the front and rear axially opposed ends and an axially extending air treatment chamber sidewall extending between the front and rear axially opposed ends; (d) the dirt collection chamber is exterior to the air treatment chamber, the dirt collection chamber comprises a front end having a front end wall and a rearward portion that has a forward port; and, (e) a suction motor provided in the air flow path, wherein the air treatment member has a stationary portion and a moveable portion, the moveable portion comprises a portion of the air treatment chamber and the front wall of the dirt collection chamber, and the moveable portion is moveably mounted by a mount between a closed position in which the air treatment chamber and the front end of the dirt collection chamber are closed and an open position in which the air treatment chamber and the forward port of the dirt collection chamber are open.

In accordance with another aspect, an air treatment assembly has a longitudinal axis (e.g., a cyclone axis of rotation). The air treatment assembly has a diameter in a direction transverse to the longitudinal axis. The transverse diameter is smaller at one side (e.g., a lower side) of the air treatment assembly.

In accordance with this aspect, there is provided an apparatus comprising: (a) a surface cleaning apparatus comprising: (i) a surface cleaning apparatus air flow path extending from a surface cleaning apparatus dirty air inlet to a surface cleaning apparatus clean air outlet; (ii) a suction motor positioned in the surface cleaning apparatus air flow path upstream of the surface cleaning apparatus clean air outlet; and, (iii) an air treatment member positioned in the surface cleaning apparatus air flow path, the air treatment member comprising an air treatment chamber and a dirt collection chamber, the air treatment chamber having a first end, an axially spaced apart second end, a central air treatment chamber axis extending between the first and second axially opposed ends of the air treatment chamber, a sidewall extending between the first end of the air treatment chamber and the second end of the air treatment chamber, an air inlet and an air outlet, the dirt collection chamber is positioned radially outwardly of the air treatment chamber; and, (b) a docking station comprising: (i) a docking station air flow path extending from a docking station air inlet to a docking station air outlet; and, (ii) a docking interface comprising wall portions and a docking interface perimeter extending around the wall portions, wherein, the dirt collection chamber has a radial inner portion and a radial outer portion, the radial outer portion is narrower in a direction transverse to the central air treatment chamber axis than the radial inner portion and, when the air treatment member is docked with the docking station, at least a portion of the radial outer portion is exterior to the docking station.

In accordance with this aspect, there is provided a hand vacuum cleaner having an upper end, a lower end, a front end, a rear end, a handle and a forward/rearward axis, the hand vacuum cleaner comprising: (a) an air flow path extending from a dirty air inlet provided at the front end of the hand vacuum cleaner to a clean air outlet positioned rearward of the dirty air inlet; (b) an air treatment member comprising an air treatment chamber and a dirt collection chamber, (c) the air treatment chamber comprising a front end having a front end wall, an axially opposed rear end having a rear end wall, an air treatment chamber air inlet, an air treatment chamber air outlet, an air treatment chamber axis extending between the front and rear axially opposed ends and an axially extending air treatment chamber sidewall extending between the front and rear axially opposed ends; (d) the dirt collection chamber is positioned radially outwardly of the air treatment chamber; and, (e) a suction motor provided in the air flow path, wherein, the dirt collection chamber has a radial inner portion and a radial outer portion, the radial outer portion is narrower in a direction transverse to the central air treatment chamber axis than the radial inner portion.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
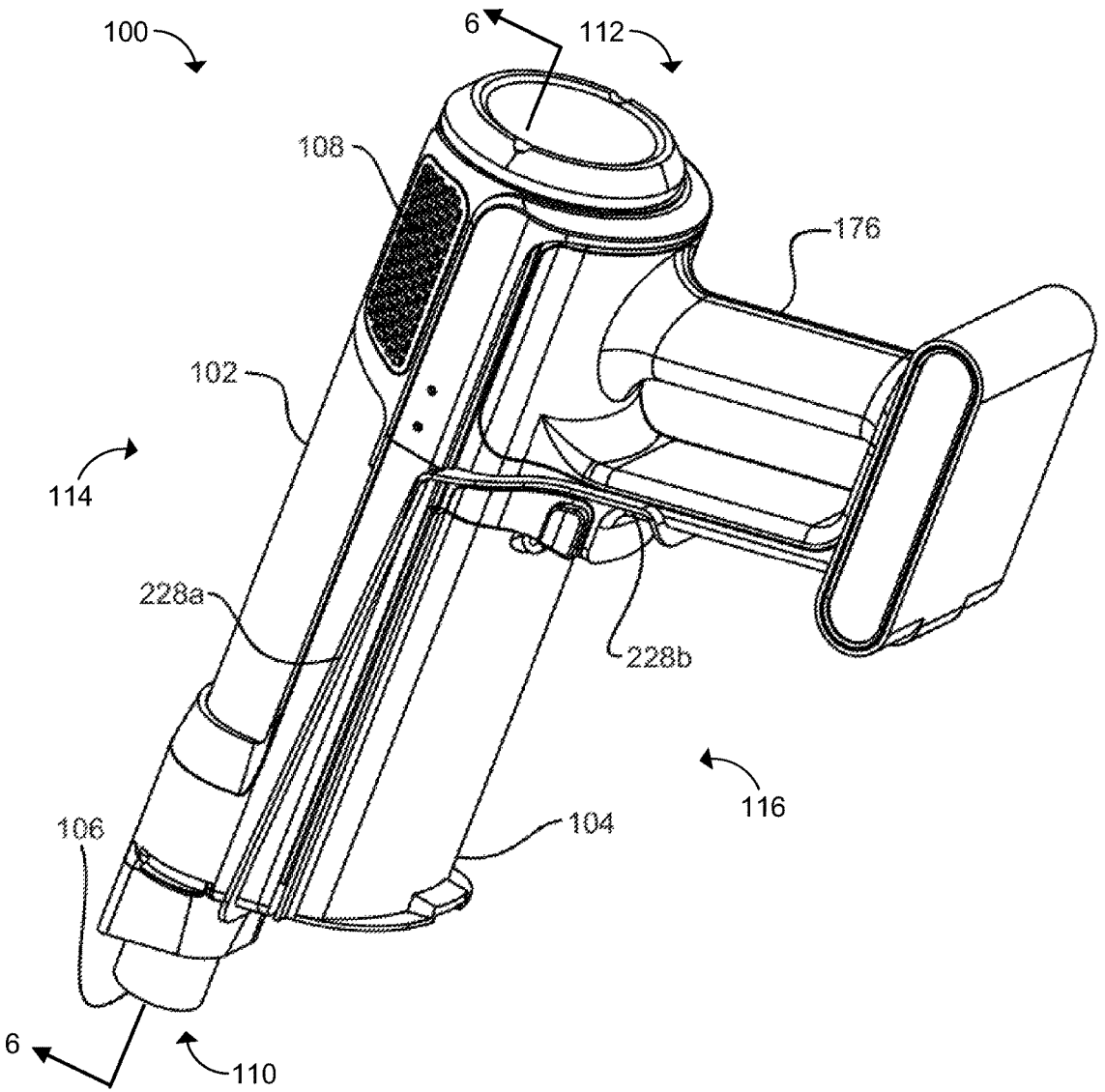
FIG. 1 is a perspective view of a surface cleaning apparatus, in accordance with an embodiment.

The drawings included herewith are for illustrating various examples of articles, methods, and apparatuses of the teaching of the present specification and are not intended to limit the scope of what is taught in any way.

DESCRIPTION OF VARIOUS EMBODIMENTS

Various apparatuses will be described below to provide an example of an embodiment of each claimed invention. No embodiment described below limits any claimed invention and any claimed invention may cover apparatuses that differ from those described below. The claimed inventions are not limited to apparatuses having all of the features of any one apparatus described below or to features common to multiple or all of the apparatuses described below. It is possible that an apparatus described below is not an embodiment of any claimed invention. Any invention disclosed in an apparatus described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment", "embodiment", "embodiments", "the embodiment", "the embodiments", "one or more embodiments" "some embodiments", and "one embodiment" mean "one or more (but not all) embodiments of the present invention(s)," unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Surface Cleaning Apparatus

Referring to FIGS. 1 to 6, an exemplary embodiment of a surface cleaning apparatus is shown generally as 100. The following is a general discussion of surface cleaning apparatus 100, which provides a basis for understanding several of the features that are discussed herein. As discussed subsequently, each of the features may be used individually or in any particular combination or sub-combination in this or in other embodiments disclosed herein.

In the illustrated embodiments, surface cleaning apparatus 100 is a hand vacuum cleaner. In other embodiments, surface cleaning apparatus 100 may not be a hand vacuum cleaner, for example, surface cleaning apparatus 100 may be an upright vacuum cleaner or a canister vacuum cleaner or any other surface cleaning apparatus.

As used herein, a hand vacuum cleaner is a vacuum cleaner that can be operated to clean a surface generally one-handedly. That is, the entire weight of the hand vacuum cleaner may be held by the same hand as the one used to direct a dirty air inlet of the hand vacuum cleaner with respect to a surface to be cleaned. For example, the handle and the dirty air inlet of the hand vacuum cleaner may be rigidly coupled to each other (directly or indirectly) so as to move as one while maintaining a constant orientation relative to each other. This is to be contrasted with canister and upright vacuum cleaners, whose weight is typically supported by a surface (e.g., a floor) during use. When a canister vacuum cleaner is operated or when an upright vacuum cleaner is operated in a 'lift-away' configuration, a second hand is typically required to direct the dirty air inlet at the end of a flexible hose.

Figure 6:
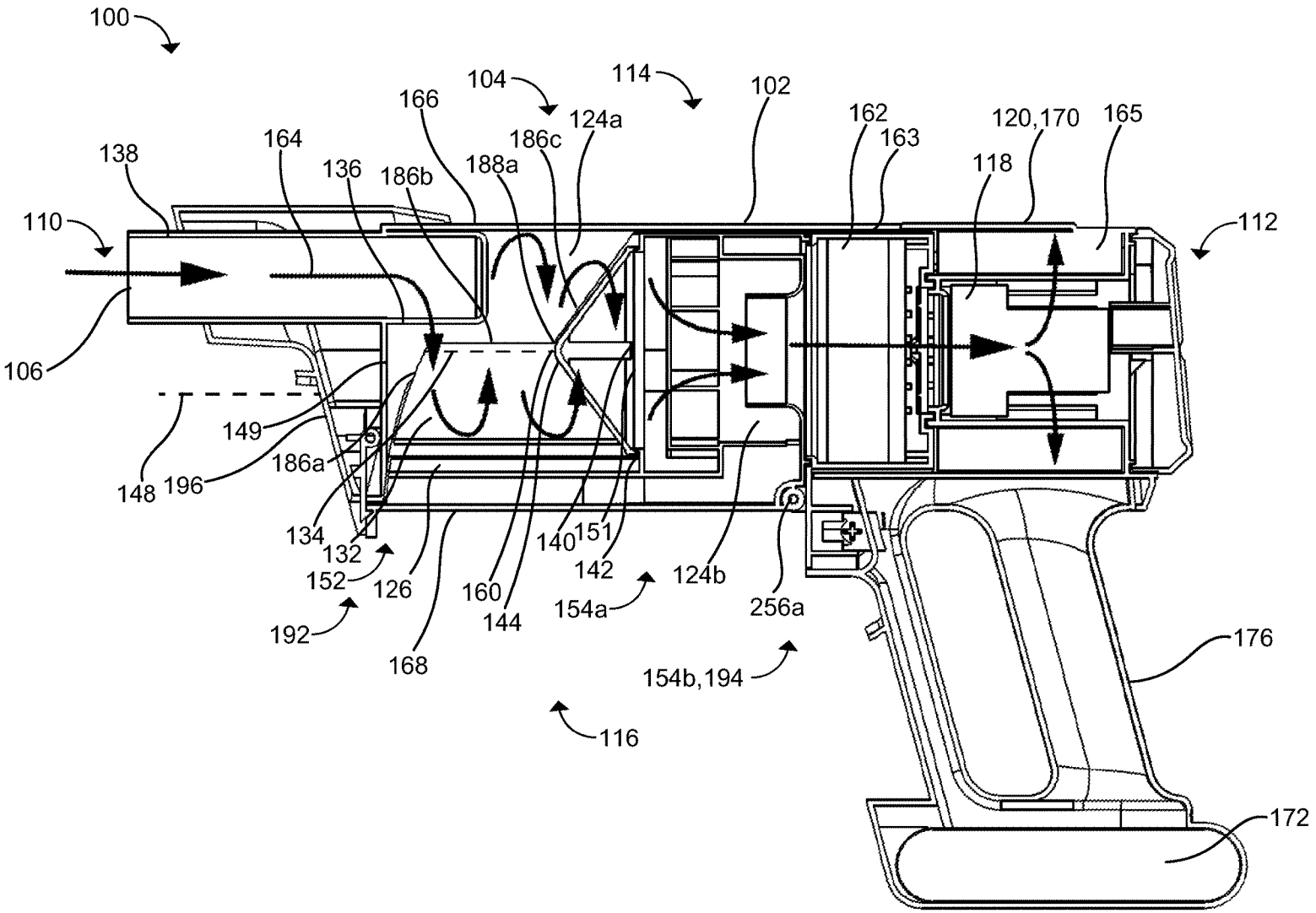
FIG. 6 is a side (vertical) cross-sectional view taken along line 6-6 in FIG. 1.

Referring to FIG. 1, surface cleaning apparatus 100 includes a main body 102 having an air treatment member 104 (which may be permanently affixed to main body 102 or may be removable in part or in whole therefrom for emptying), a dirty air inlet 106, and a clean air outlet 108. As shown in FIG. 6, surface cleaning apparatus 100 has an air flow path 164 extending from dirty air inlet 106 through air treatment member 104 to clean air outlet 108.

As exemplified in FIG. 1, surface cleaning apparatus 100 has a front end 110, a rear end 112, an upper end 114, and a lower end 116. In the illustrated embodiment, dirty air inlet 106 is at an upper portion of front end 110 and clean air outlet 108 is at a rearward portion of main body 102. It will be appreciated that dirty air inlet 106 and clean air outlet 108 may be provided in different locations. For example, the dirty air inlet 106 may be at the lower end or centrally located on the front end (face).

Turning to FIG. 6, a longitudinal axis 148 (also referred to herein as forward/rearward axis 148) extends between front end 110 and rear end 112. Unless expressly stated otherwise, any description herein that relates to the position of one or more components of surface cleaning apparatus 100 relative to the position of one or more other components of surface cleaning apparatus 100 is made when axis 148 is horizontal and in the orientation of FIG. 10, wherein upper end 114 is above lower end 116.

A suction motor 118 is positioned in air flow path 164, upstream of clean air outlet 108, to generate vacuum suction through air flow path 164. Suction motor 118 is positioned within a suction motor housing 120, which may be part of main body 102. Suction motor 118 may be a fan-motor assembly including an electric motor and impeller blade(s). In the illustrated embodiment, suction motor 118 is positioned downstream of air treatment member 104. In this configuration, suction motor 118 may be referred to as a "clean air motor". Alternatively, suction motor 118 may be positioned at alternate locations, such as upstream of air treatment member 104 in which case it may be referred to as a "dirty air motor".

Still referring to FIG. 6, air treatment member 104 is configured to remove particles of dirt and other debris from the air flow. Air treatment member or assembly 104 may include a single or multiple air treatment chambers 124 (e.g., as illustrated in FIG. 6, air treatment member 104 may include a first air treatment stage such as first stage air treatment chamber 124*a* and a second air treatment stage such as second stage air treatment chamber 124*b*). Optionally, one or more air treatment chambers 124 is a cyclone chamber. Each treatment stage may include a single air treatment chamber (e.g., a single cyclone) or a plurality of air treatment chambers (e.g., cyclones) in parallel. Alternatively, air treatment chambers 124 may not be cyclone chambers, and can include any suitable air treatment chamber known in the vacuum cleaner arts (e.g., a non-cyclonic momentum separator) and/or may optionally incorporate a bag, a porous physical filter media (such as foam or felt), or other air treating means.

Air treatment member 104 has a first end 192 (as exemplified a front end 192) and an axially opposed second end 194 (as exemplified a rear end 194). First end 192 has a first end wall 196. Air treatment member 104 has an axially extending air treatment member sidewall 198 that extends between the axially opposed first end 192 and second end 194.

Each air treatment member 104 may have a single or multiple dirt collection chambers 126. Dirt collection chamber(s) 126 may be external to air treatment chamber 124 or may be internal to air treatment chamber 124 and configured as a dirt collection area or region within the air treatment chamber. A portion of the dirt and other debris removed from the air flow may accumulate in dirt collection chamber 126 until the dirt collection chamber is emptied. Air treatment chamber 124 and dirt collection chamber 126 may be of any configuration suitable for separating dirt from an air stream and collecting the separated dirt respectively. As exemplified in FIG. 6, dirt collection chamber 126 may be positioned below air treatment chamber 124 when surface cleaning apparatus 100 is oriented with axis 148 horizontal and upper end 114 above lower end 116, e.g., positioned substantially parallel to a horizontal surface. Alternatively, or in addition, at least a portion of dirt collection chamber 126 may surround part of all of air treatment chamber 124 as seen for example in FIGS. 10-11.

Still referring to FIG. 6, air treatment chamber 124 has a first end 152 (as exemplified a front end 152) and an axially opposed second end 154 (as exemplified a rear end 154). First end 152 has a first end wall 149 and second end 154 has a second end wall 151. Air treatment chamber 124 has an axially extending air treatment chamber sidewall 132 that extends between the axially opposed first end 152 and second end 154. Air treatment chamber 124 has an air treatment chamber axis 134 that extends from first end 152 to second end 154.

Air treatment chamber 124 may be oriented in any direction. As exemplified in FIG. 6, when surface cleaning apparatus 100 is oriented with axis 148 horizontal and upper end 114 above lower end 116, e.g., positioned substantially parallel to a horizontal surface, air treatment chamber axis 134 may be oriented horizontally. In alternative embodiments, air treatment chamber 124 may be oriented at any angle between horizontal and vertical.

Figure 66:
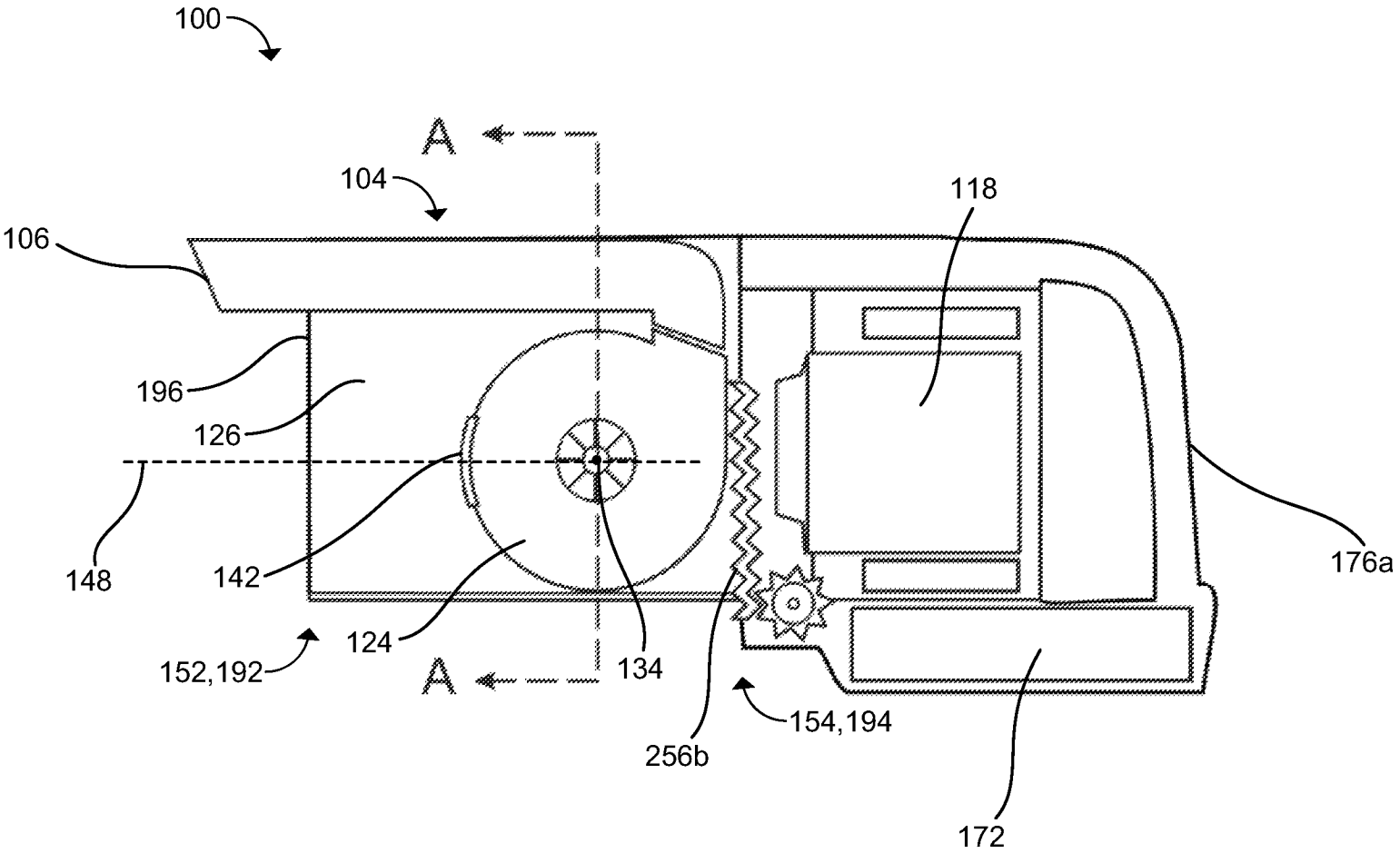
FIG. 66 is a side cross-sectional view of an alternate surface cleaning apparatus with an air treatment member of the surface cleaning apparatus in a closed position.

As exemplified in FIG. 6, horizontal air treatment chamber axis 134 may be oriented substantially parallel to longitudinal axis 148. Alternatively, horizontal air treatment chamber axis 134 may be oriented substantially transverse (e.g., perpendicular) to axis 148 or at any other suitable orientation to axis 148. For example, FIG. 66 shows an embodiment having a horizontal air treatment chamber axis 134 that is transverse to longitudinal axis 148.

Air treatment chamber 124 includes an air treatment chamber air inlet 136 in fluid communication with an inlet conduit 138, an air treatment chamber air outlet 140, and a dirt outlet 142 that is in communication with dirt collection chamber 126. As exemplified in FIG. 6, air treatment chamber 124 may have a single dirt outlet 142. Alternatively, air treatment chamber 124 may include two or more dirt outlets that are in communication with the same dirt collection chamber, or optionally with different dirt collection chambers.

Figure 7:
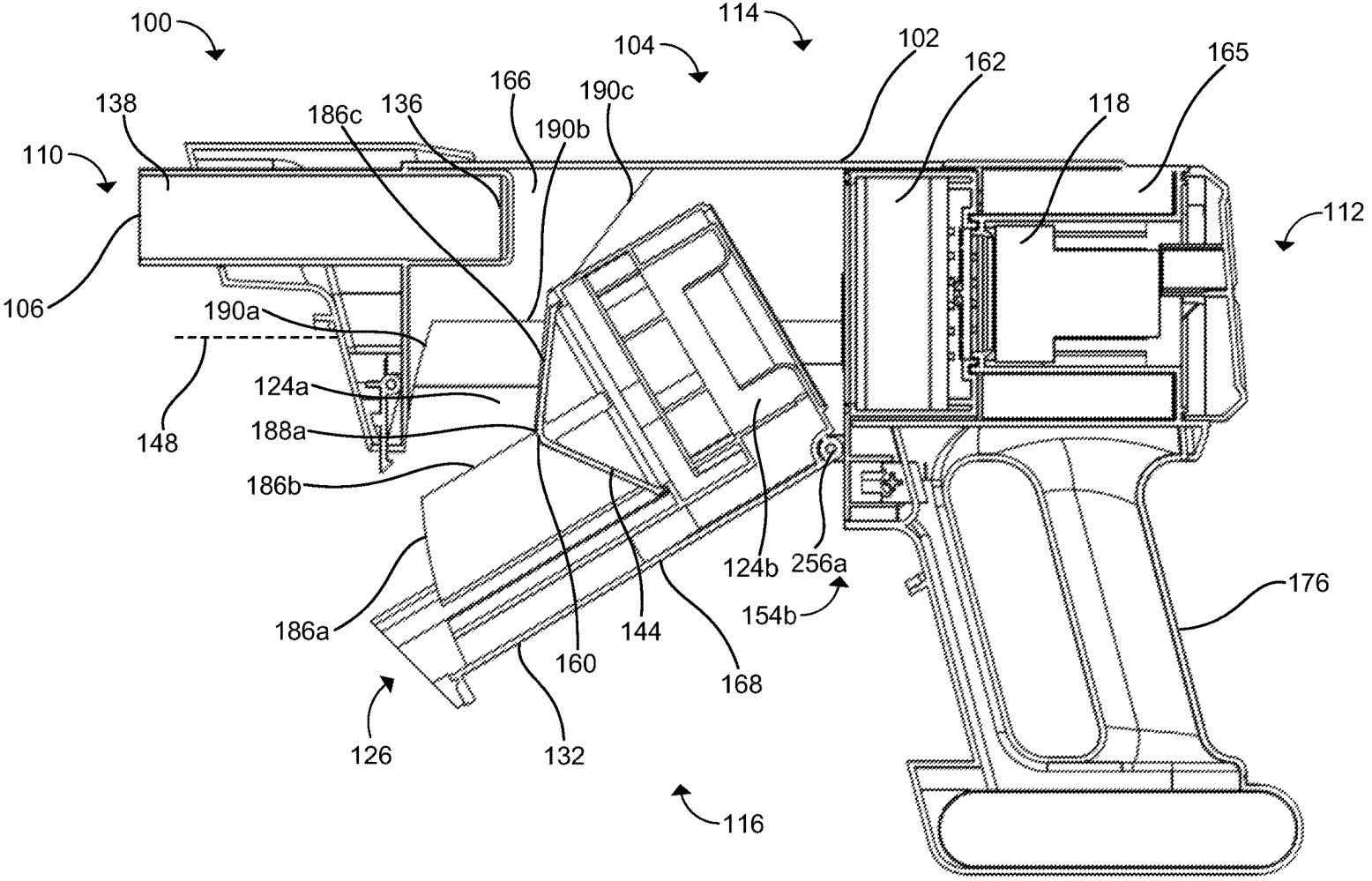
FIG. 7 is the cross-sectional view of FIG. 6 with the air treatment member in an open position.

Referring to FIGS. 6-7, in some embodiments, air treatment chamber **124*a* can be a cyclone chamber 124*a*. Air circulates about cyclone axis 134 when in cyclone chamber 124*a*. Accordingly, cyclone axis 134** is alternatively referred to herein as a "cyclone axis of rotation" or "cyclone rotation axis".

The air treatment chamber air inlet 136, air treatment chamber air outlet 140 and air treatment chamber dirt outlet 142 may be of any design and positioning that is known in the art. In embodiments where air treatment chamber **124*a* is a cyclone chamber 124*a*, the air treatment chamber air inlet 136 is generally tangentially oriented relative to sidewall 132 as shown, so that air entering the cyclone chamber 124 will tend to swirl and circulate within cyclone chamber 124, thereby disentraining dirt and debris from the air flow, before leaving cyclone chamber 124 through the air treatment chamber air outlet 140**.

Figure 10:
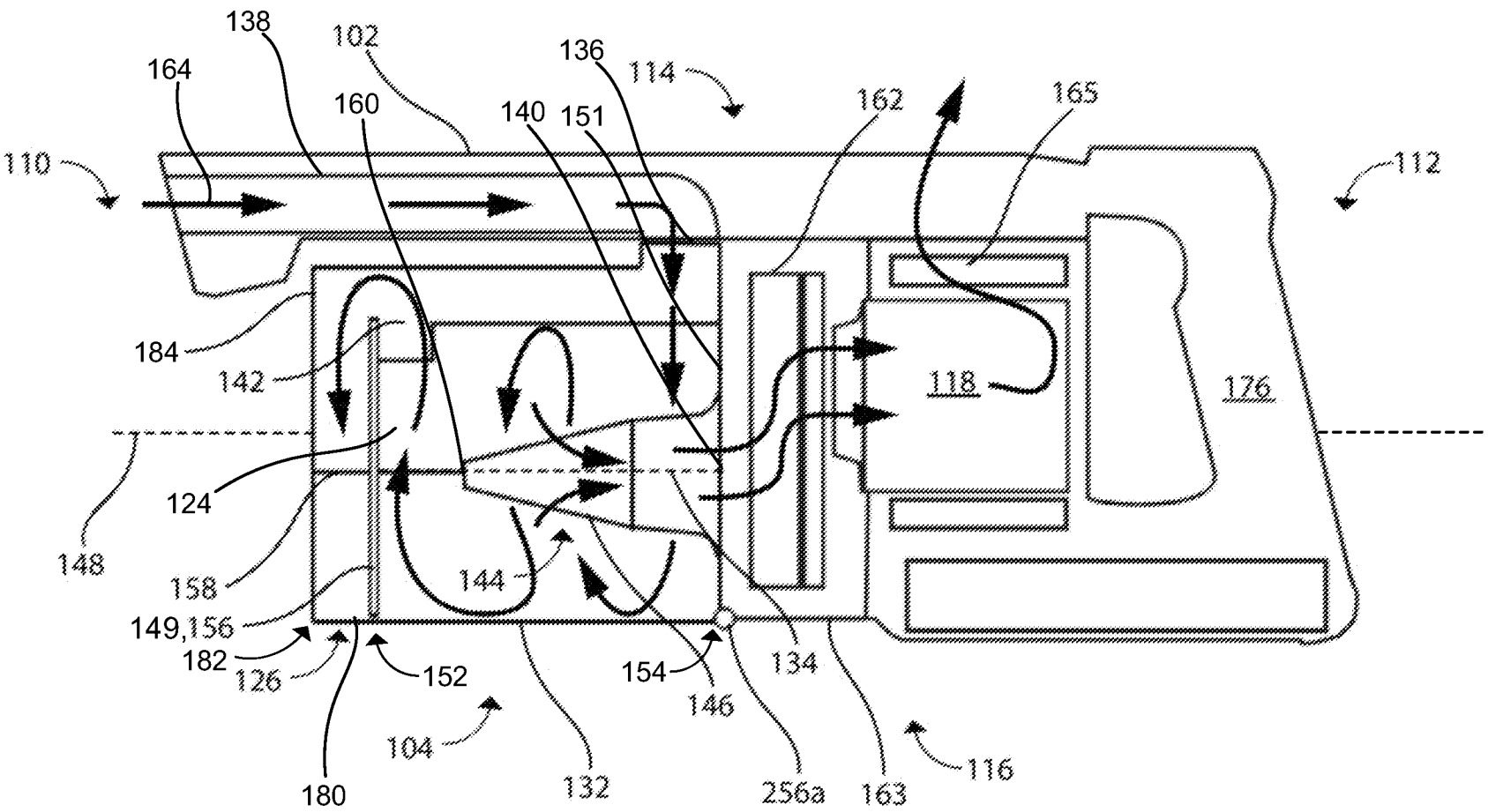
FIG. 10 is a side cross-sectional view of an alternate surface cleaning apparatus with an air treatment member of the surface cleaning apparatus in a closed position.

As illustrated in FIG. 6, cyclone chamber 124 may optionally be a 'uniflow' cyclone chamber (i.e., where the air treatment chamber air inlet 136 and air treatment chamber air outlet 140 are at opposite ends of the cyclone chamber 124, e.g., the air inlet may be at the front end as exemplified) . Alternatively, as illustrated in FIG. 10, cyclone chamber 124 may provide bidirectional air flow (i.e., where the air treatment chamber air inlet 136 and air treatment chamber air outlet 140 are at the same end, e.g. rear end, of the cyclone chamber).

Returning to FIG. 6, the air treatment chamber air outlet 140 includes an outlet conduit or vortex finder 144 that extends into air treatment chamber 124 from second end 154. Vortex finder 144 has an axial inner end 160. Vortex finder 144 may include a porous member 146 (e.g., a mesh screen 146) to help filter lint, fluff, and other debris, such as hair, that remains in the exiting air flow. Any outlet may be used and it may use any porous outlet.

Preferably, at least a portion of air treatment member 104 may be openable for emptying. As exemplified in FIGS. 6 and 10, air treatment member 104 may include a movable portion 168 that moves (to an open position) relative to a stationary portion 166 of air treatment member 104. The movement of moveable portion 168 from the closed position (FIGS. 6 and 10) to the open position (FIGS. 7 and 11) may open the dirt collection chamber and/or the air treatment chamber for emptying. The moveable portion 168 of air treatment member 104 may include a portion or all of sidewall 132 of air treatment chamber 124 and/or the sidewall of the dirt collection chamber 126. The moveable portion 168 may be moveably mounted by a mount 256 (e.g. hinge, flexible member, or rail) between a closed position in which the air treatment chamber 124 and/or the dirt collection chamber 126 is closed (FIGS. 6 and 10) and an open position in which the air treatment chamber 124 and/or the dirt collection chamber 126 is open (FIGS. 7 and 11). Optionally, the moveable portion 168 may include a portion or all of any one or more (or all) of the first end wall 149, second end wall 151, vortex finder 144 and/or mesh screen 146.

In some embodiments, a user may push a button 276 (FIG. 4A) to actuate movement of the moveable portion 168 from a closed position to an open position. In some embodiments, docking station 200 may include an actuator 240 (FIG. 4B) that engages with and automatically pushes button 276 when surface cleaning apparatus 100 is docked with docking station 200. This can automatically initiate movement of moveable portion 168 from the closed position to the open position. The actuator 240 may not engage with and push button 276 when surface cleaning apparatus 100 is not docked (or not securely docked) with docking station 200. This may prevent accidental emptying of trapped dirt into the environment instead of the docking station. It will be appreciated that the docking station may interface with the air treatment assembly or an alternate portion of the surface cleaning apparatus in any way to actuate movement of the moveable portion 168, such as by an electrical circuit being closed when the air treatment assembly or an alternate portion of the surface cleaning apparatus is docked at the docking station whereby an electromechanical member (e.g., a solenoid or stepper motor) moves the moveable portion.

Figure 4A:
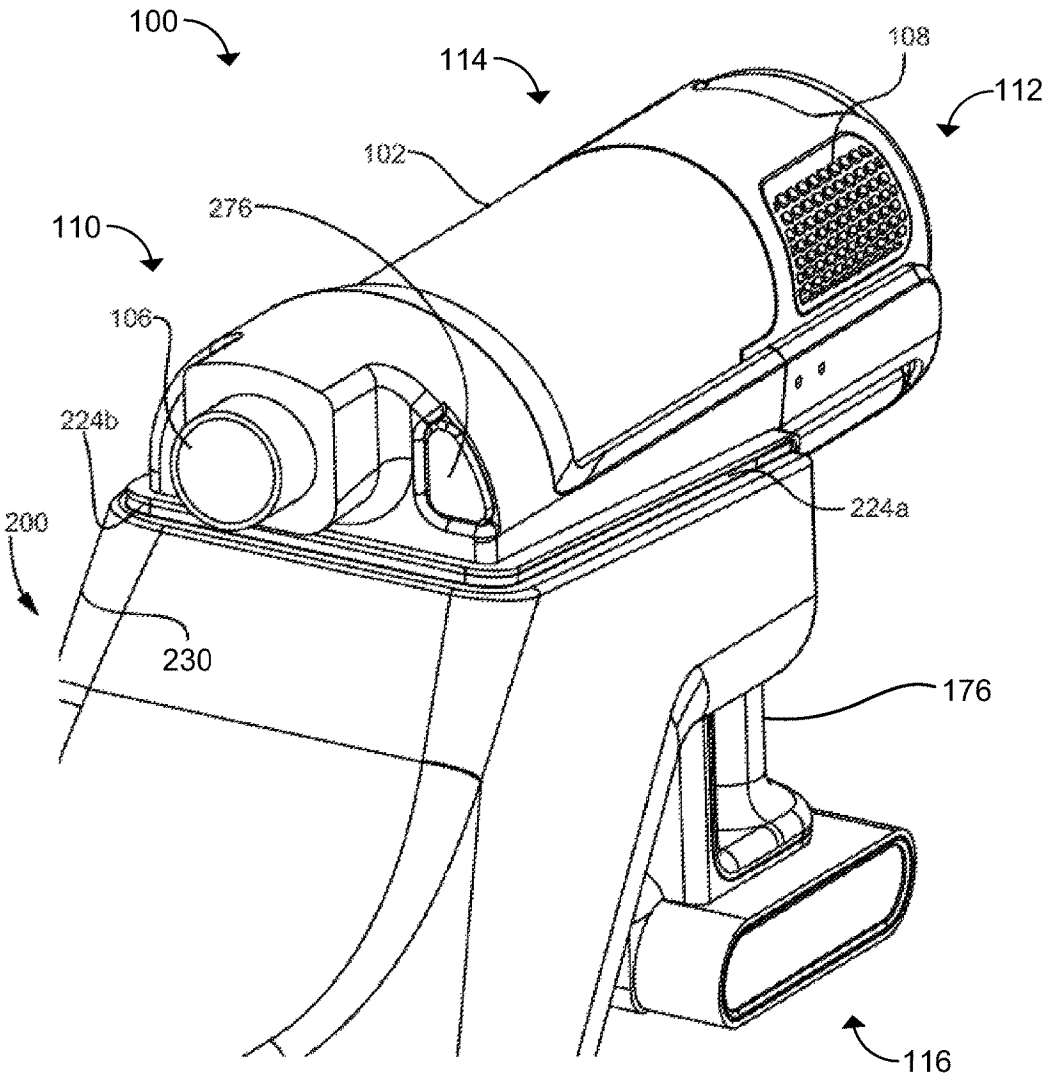
FIG. 4A is a partial perspective view of the surface cleaning apparatus of FIG. 1 in the docked position of FIG. 3A showing a sealing interface between the surface cleaning apparatus and the docking station.
Figure 4B:
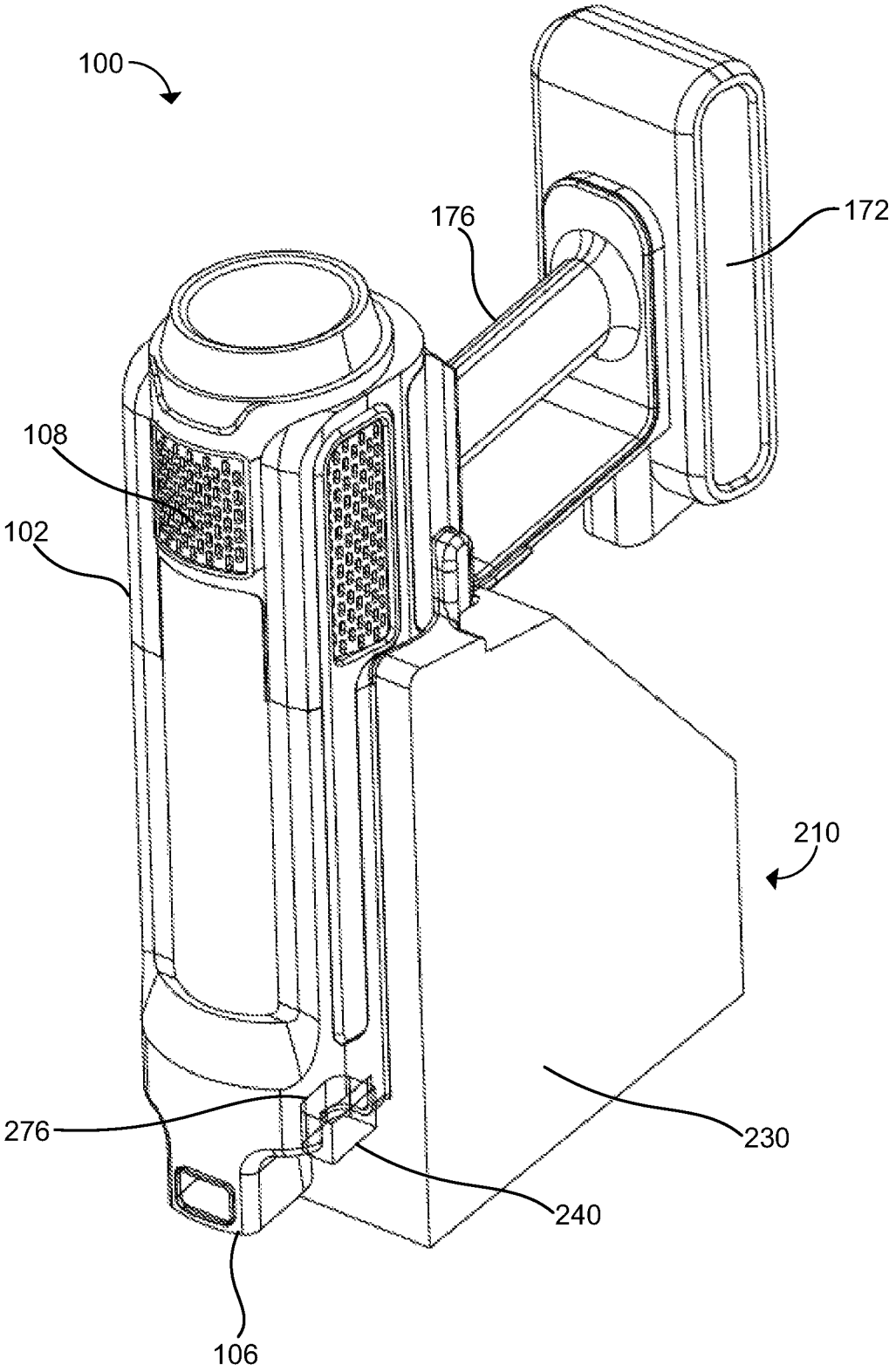
FIG. 4B is a partial perspective view of the surface cleaning apparatus of FIG. 1 in the docked position of FIG. 3A showing an actuator to open an air treatment chamber of the surface cleaning apparatus.
Figure 4C:
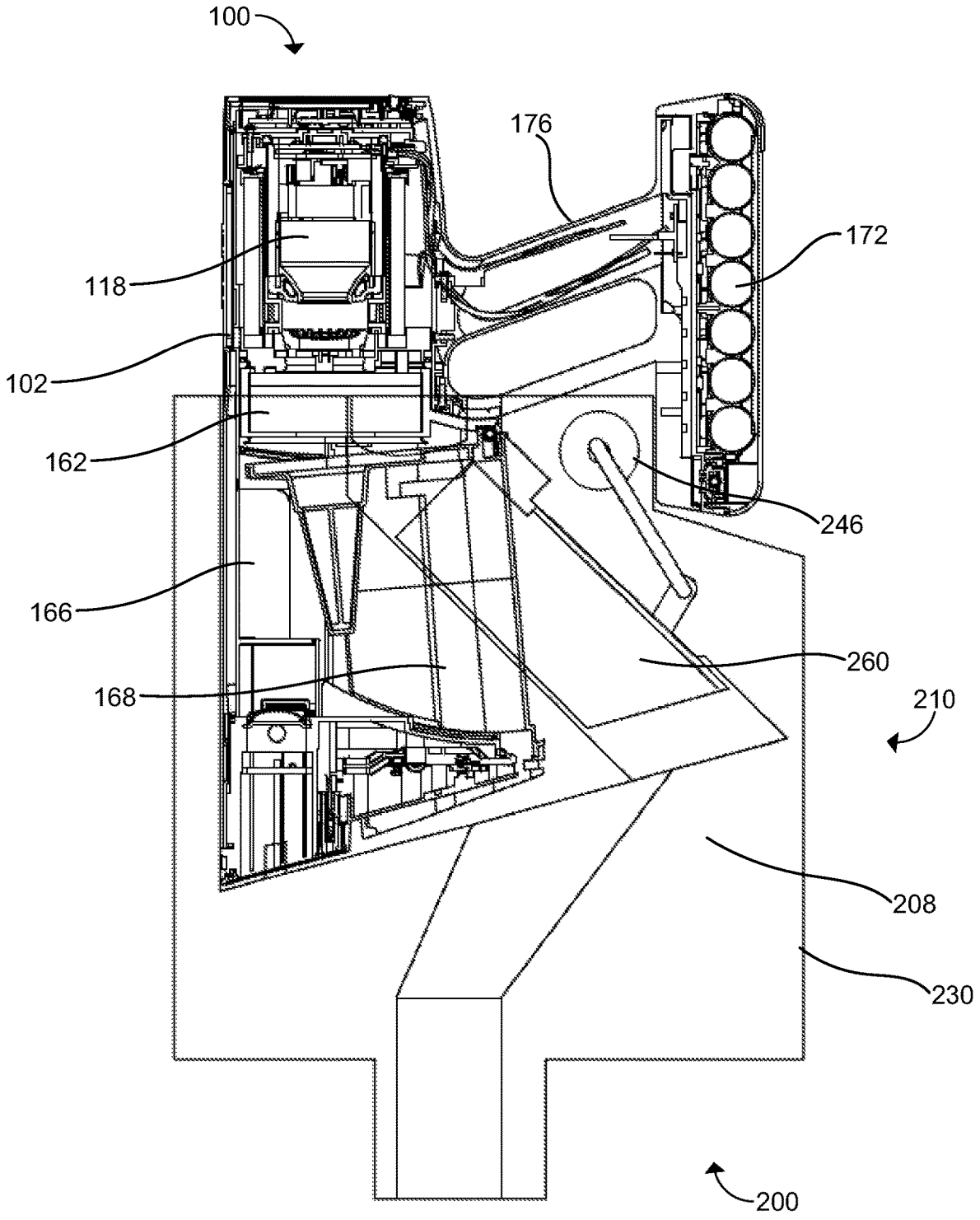
FIGS. 4C to 4E are side cross-sectional views of the surface cleaning apparatus of FIG. 1 in a docked position to a docking station showing an electromechanical member of the docking station engaged with an air treatment member of the surface cleaning apparatus, in accordance with an embodiment.
Figure 4D:
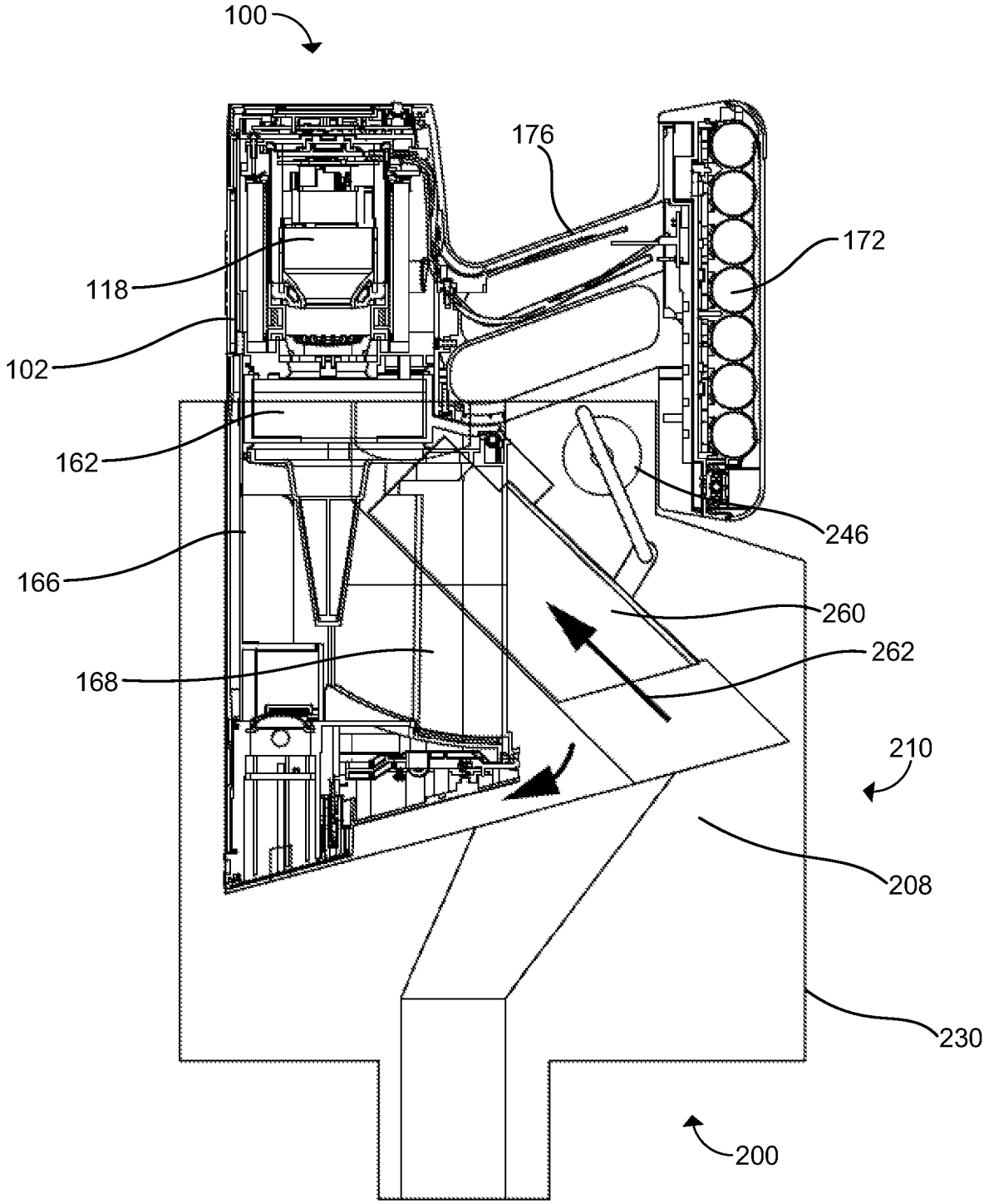

As exemplified in FIGS. 4C and 4D, the movement of the moveable portion 168 may be actuated using an electromechanical member 246 (e.g., a motor or a solenoid) that moves the moveable portion 168 between open and closed positions. This may provide a simplified experience for the user as compared with a moveable portion 168 that is manually moved between open and closed positions by the user, all else being equal.

Electromechanical member 246 may be connected to moveable portion 168 in any suitable manner. For example, electromechanical member 246 may be connected to moveable portion 168 using coupling member 260 (e.g. rod, shaft, belt, or gear). Electromechanical member 246 may move coupling member 260 along a linear path 262 to move the moveable portion 168 between the open and closed positions. FIG. 4C shows an example of moveable portion 168 in a partially open position while being moved from the open position to the closed position. FIG. 4D shows an example of moveable portion 168 in a closed position. The electromechanical member 246 may be part of the surface cleaning apparatus 100 or the docking station 200. In the illustrated example, electromechanical member 246 includes a stepper motor that is part of docking station 200.

Figure 4E:
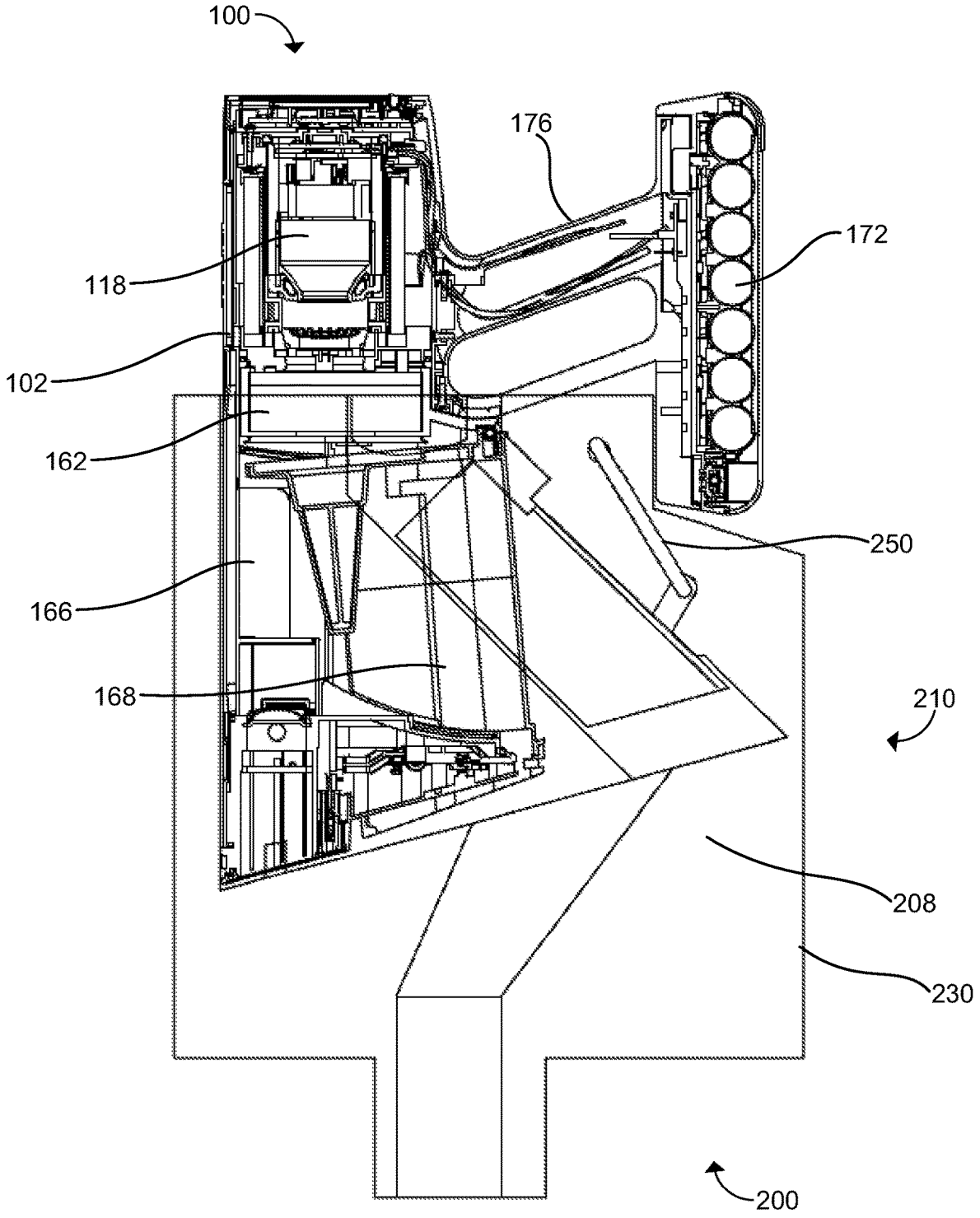

As another example, FIG. 4E shows moveable portion 168 connected to a pneumatic member 250 (e.g., a pneumatic cylinder) that is activatable to move the moveable portion 168 between open and closed positions. The pneumatic member 250 may be part of the surface cleaning apparatus 100 (e.g. the air treatment member) or the docking station 200.

Referring to FIG. 10, in some embodiments, the first end wall 149 of the air treatment chamber 124 may be formed as a deflector or plate 156 that is positioned at the interface between air treatment chamber 124 and dirt collection chamber 126, which as exemplified may be partially or entirely axially spaced from the air treatment chamber 124. In such an embodiment, dirt outlet 142 may be provided by one or more gaps between plate 156 and the end of sidewall 132 of air treatment chamber 124. Alternatively or in addition, plate 156 may abut the end of sidewall 132 and the sidewall and/or plate may have slots that define dirt outlet 142.

Optionally, plate 156 may be fixed in its position with respect to sidewall 132 or may be moveable or openable. Providing an openable plate 156 may help facilitate emptying of air treatment chamber 124. Optionally, plate 156 may be openable concurrently with another portion of the surface cleaning apparatus, including, for example, dirt collection chamber 126 or subsequent to other portion opening.

Returning to FIG. 6, one or more pre-motor filters 162 may optionally be positioned in the air flow path 164 (e.g., in a pre-motor filter housing 163 that may be part of main body 102) downstream of air treatment member 104 and upstream of suction motor 118. Pre-motor filter(s) 162 may be formed from any suitable physical, porous filter media and may have any suitable shape and may be removable. For example, pre-motor filter 162 may be one or more of a foam filter, felt filter, HEPA filter, other physical filter media, electrostatic filter, and the like.

Alternately or in addition, one or more post-motor filters 165 may be positioned in the air flow path 164 (e.g., in a post-motor filter housing 170 that may be part of main body 102) downstream of suction motor 118 and upstream of clean air outlet 108 to help further treat the air passing through surface cleaning apparatus 100. The post-motor filter(s) may be formed from any suitable physical, porous filter media and may have any suitable shape and may be removable. For example, the post-motor filter may be one or more of a foam filter, felt filter, HEPA filter, other physical filter media, electrostatic filter, and the like.

Figure 69:
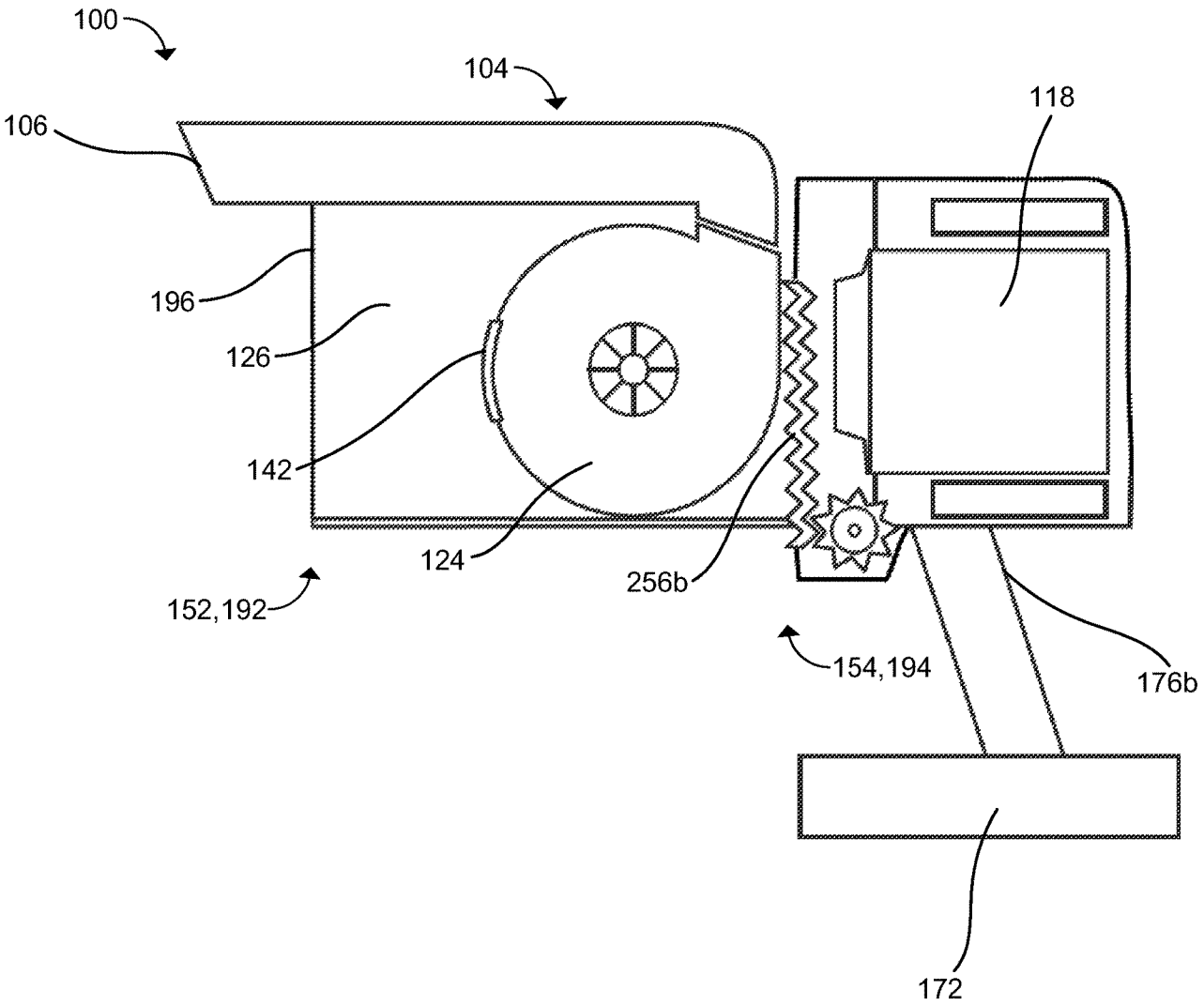
FIGS. 69 and 70 are side cross-sectional views of a surface cleaning apparatus with an air treatment member of the surface cleaning apparatus in a closed position, showing handle configurations of the surface cleaning apparatus in accordance with various embodiments.
Figure 70:
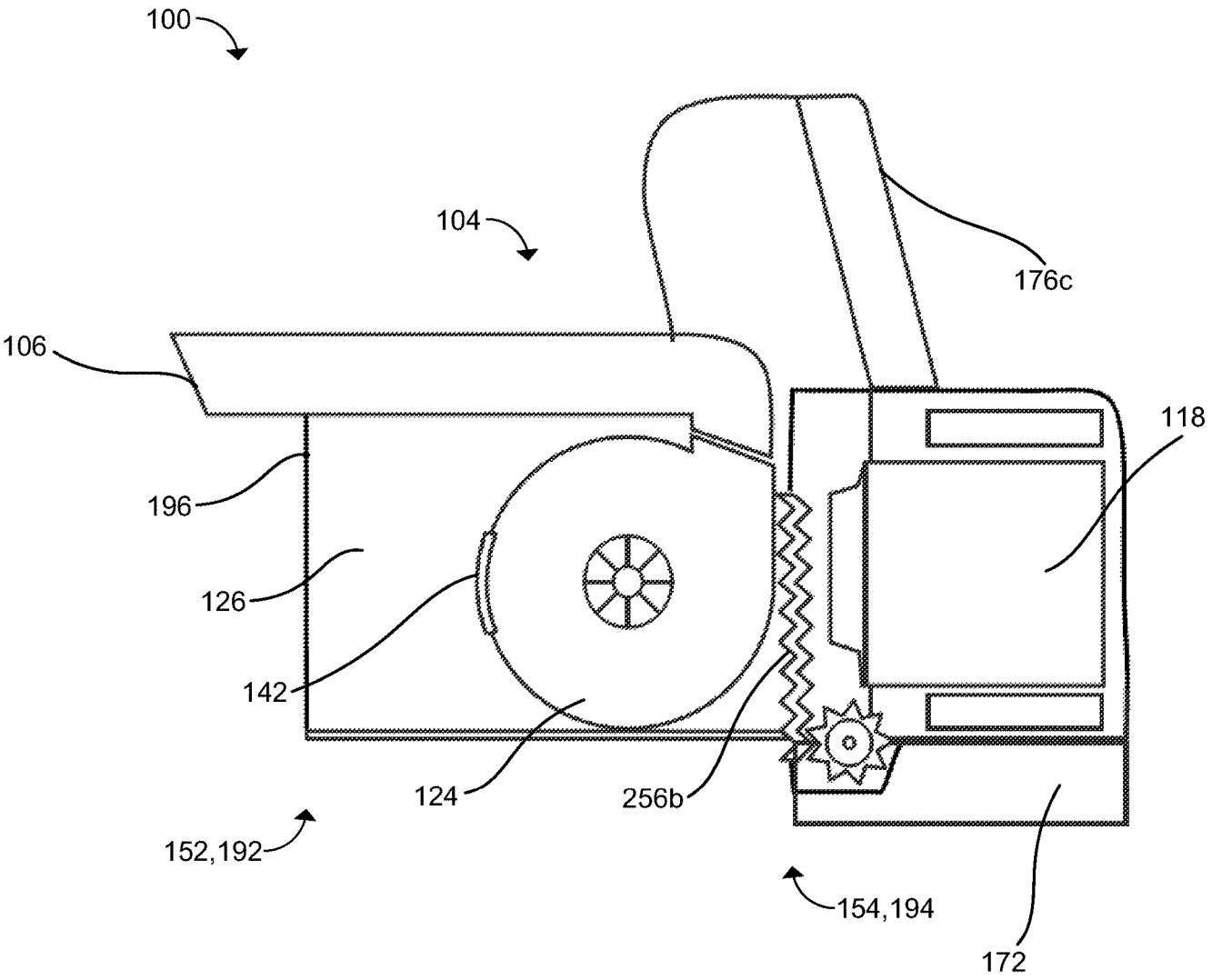
Figure 71:
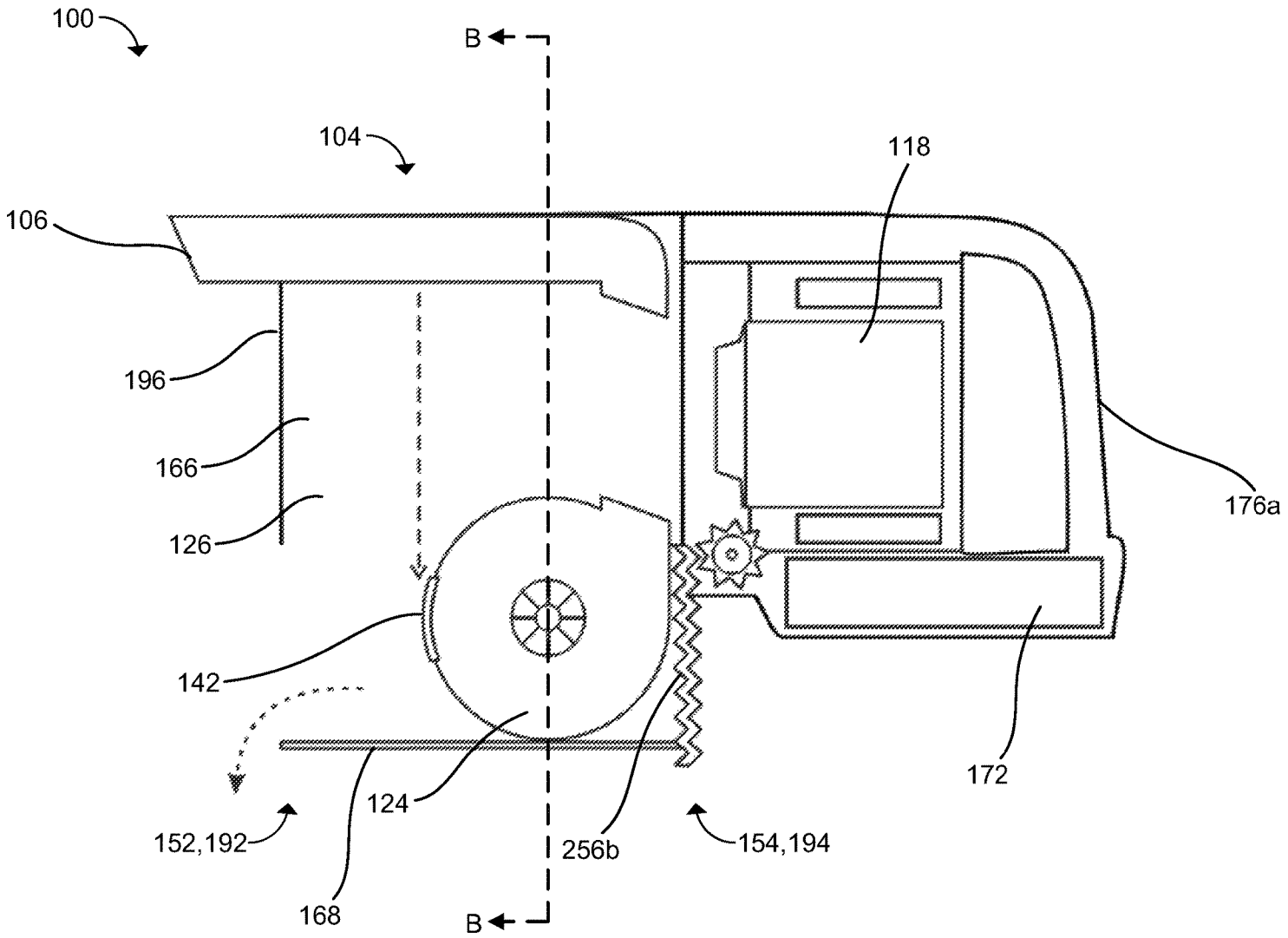
FIG. 71 is a side cross-sectional view of the surface cleaning apparatus of FIG. 66 with the air treatment member in an open position.
Figure 72:
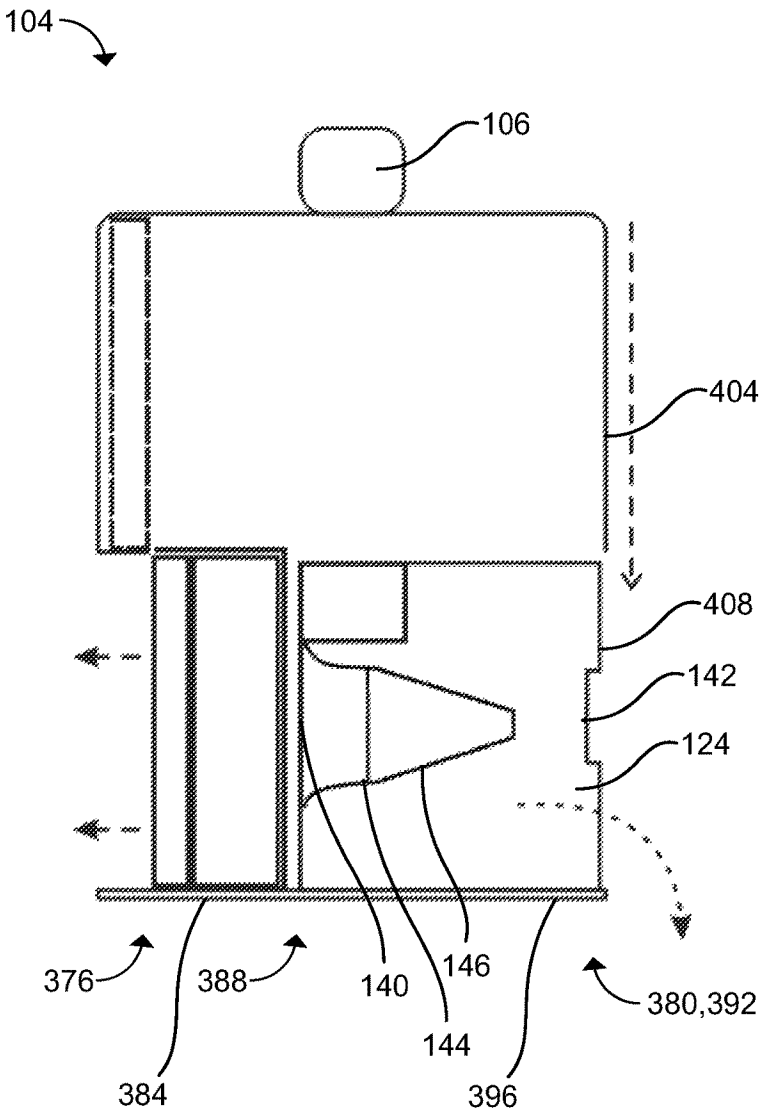
FIG. 72 is a cross-sectional front view taken along line B-B in FIG. 71.

Surface cleaning apparatus 100 can include a handle 176 for the user to grasp when operating surface cleaning apparatus 100 (e.g., when carrying and operating surface cleaning apparatus 100 one handed in the case of a hand vacuum). Handle 176 may have various positional arrangements and configurations, which may improve the ergonomics of surface cleaning apparatus 100. As exemplified in FIG. 1, handle 176 may be configured as a pistol grip handle that is located on a lower end at the rear end 112 of surface cleaning apparatus 100. As exemplified in, handle 176*a* (FIG. 66) is provided at a middle-rear portion of surface cleaning apparatus 100 rearward of suction motor 118, handle 176*b* (FIG. 69) is provided at lower-rear portion of surface cleaning apparatus 100 below suction motor 118 and handle 176*c* (FIG. 70) is provided at an upper portion of surface cleaning apparatus 100 above suction motor 118.

Surface cleaning apparatus 100 can include an energy storage member 172 (e.g., a battery, capacitor) that supplies energy to suction motor 118. Energy storage member 172 may have any suitable positional arrangement and configuration. As exemplified in FIG. 6, energy storage member 172 may be located below handle 176.

Still referring to FIG. 6, in operation, after activating suction motor 118, dirty air enters surface cleaning apparatus 100 through dirty air inlet 106 and is directed through inlet conduit 138 to air treatment chamber 124*a*. Dirt particles and other debris is disentrained (i.e., separated) from the dirty air flow as the dirty air flows through air treatment chamber 124*a*. For example, if air treatment chamber 124*a* is a cyclonic chamber, dirty air from inlet conduit 138 is directed through the air treatment chamber air inlet 136 into cyclone chamber 124*a*. The dirty air may be directed into cyclone chamber 124*a* in a tangential direction (e.g., the air inlet is a tangential air inlet) to promote cyclonic motion. After entering cyclone chamber 124*a*, the air rotates and exits cyclone chamber 124*a* through the air treatment chamber air outlet 140. Dirt particles and other debris are disentrained (i.e., separated) from the dirty air flow as the dirty airflow rotates in cyclone chamber 124*a* while travelling from the air treatment chamber air inlet 136 to the air treatment chamber air outlet 140. Some (e.g., the heavier) dirt may be separated from the air stream by gravity due to the air flow rate decreasing as the air enters cyclone chamber 124*a* and/or a change in the direction of the air flow as it enters or travels through cyclone chamber 124*a*. Additional dirt and debris may be separated by mesh screen 146 of vortex finder 144 due to filtration. At least some of the disentrained dirt particles and debris may be discharged from cyclone chamber 124*a* through dirt outlet 142 into an external dirt collection chamber 126 (if provided), where the dirt particles and debris may be collected and stored until dirt collection chamber 126 is emptied.

From air treatment chamber 124*a*, the air flow may be directed to a second stage air treatment chamber 124*b*. As described above with reference to air treatment chamber 124*a*, dirt particles and other debris is disentrained as the air flows through air treatment chamber 124*b*. From air treatment chamber 124*b*, the air flow may be drawn through an optional pre-motor filter 162, through suction motor 118 and then discharged from surface cleaning apparatus 100 through clean air outlet 108. Prior to exiting clean air outlet 108, the treated air may pass through an optional post-motor filter 165.

General Description of a Docking Station

Figure 3A:
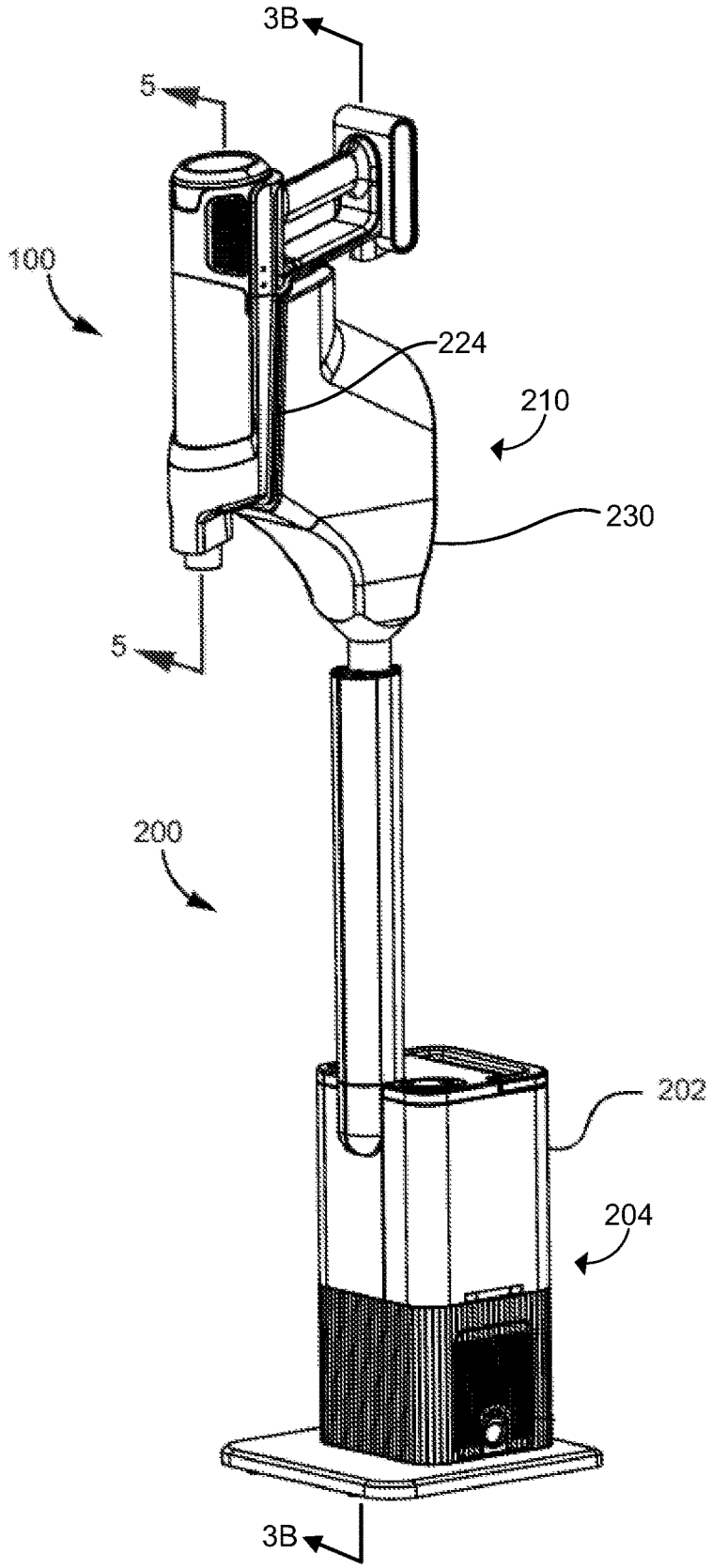
FIG. 3A is a perspective view of the surface cleaning apparatus of FIG. 1 in a docked position to the docking station of FIG. 2.
Figure 3B:
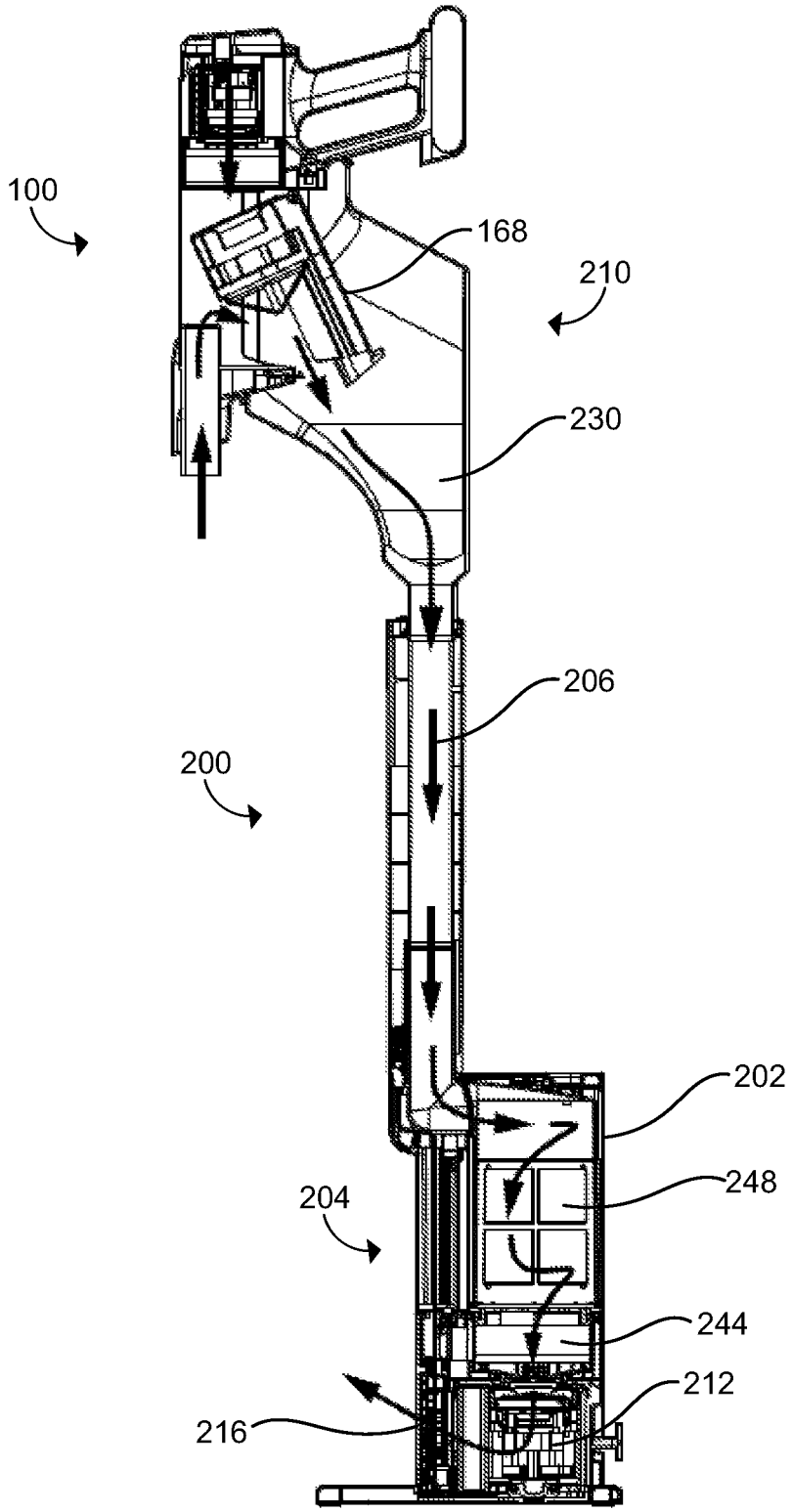
FIG. 3B is a cross-sectional view taken along line 3B-3B in FIG. 3A.

Referring to FIGS. 3A and 3B, in the course of cleaning, and during periods of inactivity, surface cleaning apparatus 100 may, at times, be docked (or connected) to a docking station 200. When docked, dust, dirt, and/or debris (collectively referred to herein as "dirt"), collected by surface cleaning apparatus 100, may be transferred from surface cleaning apparatus 100 to docking station 200. Dirt may be transferred by any method known in the vacuum cleaner arts. By transferring dirt from surface cleaning apparatus 100 to docking station 200, a user may only be required to empty (i.e., clean-out) docking station 200. That is, a user may not be required to empty surface cleaning apparatus 100 itself. Further, since docking station 200 may hold a greater volume of dirt compared to that of surface cleaning apparatus 100, by only cleaning out docking station 200, a user may be required to clean docking station 200 less often than if they had to clean out surface cleaning apparatus 100.

Optionally, docking station 200 can also be used to re-charge energy storage member 172 of surface cleaning apparatus 100 during docking.

Docking station 200 may be of any shape and configuration and may use any dirt collection member(s) known in the vacuum cleaner arts to receive and retain dirt collected by surface cleaning apparatus 100. As shown, docking station 200 may include a housing 202, an air treatment assembly 204, a docking station air flow path 206, and a docking interface 210. Docking interface 210 can facilitate docking of surface cleaning apparatus 100 when dirt is transferred from surface cleaning apparatus 100 to docking station 200. Housing 202 may include electrical connections for charging surface cleaning apparatus 100, when surface cleaning apparatus 100 is docked to docking station 200. Air treatment assembly 204 of docking station 200 receives and stores the dirt collected by surface cleaning apparatus 100.

Air treatment assembly 204 may be any air treatment member(s) know in the vacuum cleaner arts and may be any air treatment member discussed herein. Further, air treatment assembly 204 may use one or more air treatment stages, each of which may comprise one or more air treatment chambers. Each air treatment stage may have one or more external air treatment chambers or an internal dirt collection region as discussed previously.

Dirt may be transferred from surface cleaning apparatus 100 to docking station 200 mechanically, pneumatically (e.g., by forced air flow), or both. For example, surface cleaning apparatus 100 may include a blowing device (e.g., suction motor 118 (FIG. 6) operating in reverse or with a redirected air flow path, or a separate device) to blow dirt from within surface cleaning apparatus 100 and into docking station air inlet 208. Alternatively or in addition, docking station 200 may include a suction motor 212 that can draw the dirt out from surface cleaning apparatus 100 and into docking station air inlet 208. Further, in some embodiments, docking station 200 may have a suction motor 212 and surface cleaning apparatus 100 may have a blowing device. Either or both of suction motor 212 and the blowing device may include, for example, a fan-motor assembly including an electric motor and impeller blade(s). It will be appreciated that, if the docking station has a suction motor or blowing device, then only the air treatment assembly of the surface cleaning apparatus may be docked at the docking station.

Still referring to FIGS. 3A and 3B, in embodiments where docking station 200 includes a suction motor 212, suction motor 212 can be located in housing 202 or in air treatment assembly 204. In operation, suction motor 212 may generate an air flow along docking station air flow path 206. In some embodiments, when surface cleaning apparatus 100 is docked, the generated air flow path may extend to the air treatment chamber of surface cleaning apparatus 100 to draw dirt therefrom to docking station 200. Dirt transferred from surface cleaning apparatus may be collected in dirt container 248 of air treatment assembly 204. As exemplified in FIG. 3B, air treatment assembly 204 may include a pre-motor filter positioned downstream of docking station air inlet 208 and upstream of suction motor 212.

Alternatively, or in addition to suction motor 212 and/or the blowing device of apparatus 100, at least one of surface cleaning apparatus 100 and docking station 200 may include a mechanical dirt transfer mechanism (not shown). A mechanical dirt transfer mechanism may include, for example, a member (for example a ram) which physically engages and moves dirt from surface cleaning apparatus 100 towards and/or into docking station air inlet 208. In some examples, the mechanical dirt transfer mechanism is located in surface cleaning apparatus 100 and pushes the dirt. In other examples, the mechanical dirt transfer mechanism is located in docking station 200 and pulls the dirt. In other examples, each of surface cleaning apparatus 100 and docking station 200 include a mechanical dirt transfer mechanism.

Optionally, air treatment assembly 204 of docking station 200 or at least a dirt container 248 of air treatment assembly 204 may be removably mounted to housing 202 to allow a user to dispose of the dirt stored therein.

The following is a discussion of a number of aspects, namely a sealing interface, non-linear interface, plate configuration, auto-closing mechanism, axially translatable air treatment chamber sidewall, air treatment member with laterally moveable air treatment chamber, air treatment member with laterally moveable front portion, air treatment member having an air treatment chamber with a portion that moves after the air treatment chamber is opened, air treatment member with a moveable portion that includes a portion of the air treatment chamber sidewall and a portion of the dirt collection chamber sidewall, air treatment member with a transverse air treatment chamber, removable filter, air treatment member having a moveable portion that includes an upper end of the air treatment chamber, air treatment member with an air treatment member having a radially outward narrower portion, air treatment member having a dirt collection chamber with a sidewall portion that is openable and air treatment member having a moveable portion that includes a front end wall of the dirt collection chamber, which are disclosed herein. Each aspect may be used by itself or in combination or sub-combination with one or more of the other aspects disclosed herein.

Sealing Interface

In accordance with one aspect of this disclosure, in some embodiments, a sealing interface is formed between the docking interface and the surface cleaning apparatus when the surface cleaning apparatus is docked to the docking station. In the docked position, during an evacuation operation a dirt transferal air flow can be generated with a path that extends from the surface cleaning apparatus to the docking station to transfer dirt collected in surface cleaning apparatus (e.g., in one or more dirt collection chambers and/or on one or more filters) to the docking station. The dirt transferal air flow may be generated, for example, by a motor and fan assembly of the surface cleaning apparatus and/or the docking station. The sealing interface may be on the air treatment assembly. It will be appreciated that is the air treatment assembly is separated from the surface cleaning apparatus before being docked, then the sealing interface is formed between the docking interface and the sir treatment assembly.

In one aspect, the sealing interface can prevent or mitigate dirt from escaping into the ambient environment during the dirt transfer process, which would result in a loss of dirt transfer efficiency (i.e., a reduction in the proportion of dirt in the surface cleaning apparatus which successfully transfers into the docking station). For example, the sealing interface may inhibit the escape of dirt through unsealed gaps in the interface during the transfer process.

In another aspect, the sealing interface can also prevent or mitigate the ingress of air at the interface of the surface cleaning apparatus and the docking station, which would also result in a loss of dirt transfer efficiency. For example, the sealing interface may inhibit a loss of airflow through the intended airflow path resulting from an extraneous ingress of air at the interface and therefore a higher air flow through the region of the surface cleaning apparatus that is being emptied.

The sealing interface may be used by itself or in combination with one or more (or all) of the other aspects including the non-linear interface, the plate configuration, the auto-closing mechanism, the removable filter and the air treatment member configurations.

According to this aspect, the docking interface and the surface cleaning apparatus collectively form a closed volume when the surface cleaning interface is docked with the docking station. The closed volume may be shaped and sized to permit a moveable portion of the air treatment member to be moved into the closed volume as the moveable portion is moved to an open position while docked and without breaking the seal. This may prevent the escape of dirt into the environment because the dirt remains trapped inside the surface cleaning apparatus and the surface cleaning apparatus is not opened until after it forms a sealed interface with the docking station.

The closed volume may be formed by abutting or interengaging surfaces of the docking station and the surface cleaning apparatus. Accordingly, each of the surface cleaning apparatus and the docking station may have a surface (e.g., a rib, flange or the like) which are positioned such that the a continuous or generally continuous abutment is formed between the surface cleaning apparatus and the docking station when the surface cleaning apparatus is docked. The juncture at which the continuous or generally continuous abutment occurs may be provided with a flexible sealing member, such as a resilient material which deforms during docking.

Referring to FIGS. 2-5, docking interface 210 may include wall portions 230, an interface opening 220, and a docking interface perimeter 242 that forms a perimeter around the interface opening 220. As shown, docking interface perimeter 242 includes first abutment surface 232. As exemplified, when surface cleaning apparatus 100 is docked with docking station 200, first abutment surface 232 contacts the stationary portion of the air treatment member and a closed volume defining a docking station air inlet 208 is formed interior of the wall portions. While surface cleaning apparatus 100 is docked, the closed volume accommodates movement of the moveable portion 168 of air treatment member 104. As shown in FIG. 3B, docking station air flow path 206 extends from the docking station air inlet 208 to docking station air outlet 216.

As exemplified in FIG. 1, main body 102 of surface cleaning apparatus 100 may include a second abutment surface 228. Second abutment surface 228 may be of any suitable shape and configuration to form a sealing interface in the docked position. It will be appreciated that the first abutment surface 232 may contact any portion of the surface cleaning apparatus that is not part of the moveable portion and accordingly the second abutment surface 228 may be at various locations.

In the illustrated example, second abutment surface 228 is formed as an outwardly extending rib that extends along a perimeter of main body 102. Second abutment surface 228 may include one or multiple segments (e.g., 228*a*, 228*b*) that are oriented in various directions along the perimeter portion of main body 102. Optionally, second abutment surface 228 extends continuously to form a closed loop. This may allow second abutment surface 228 to form a continuous seal that may help prevent leakage in the seal as compared with a second abutment surface 228 that has gaps. In other embodiments, second abutment surface 228 has one or more gaps. In some examples, these gaps may be closed by the mating first abutment surface 232 of the docking station 200, thereby mitigating air leakage. For example, the first and second abutment surfaces may be interleaved when the surface cleaning apparatus is docked.

Figure 2:
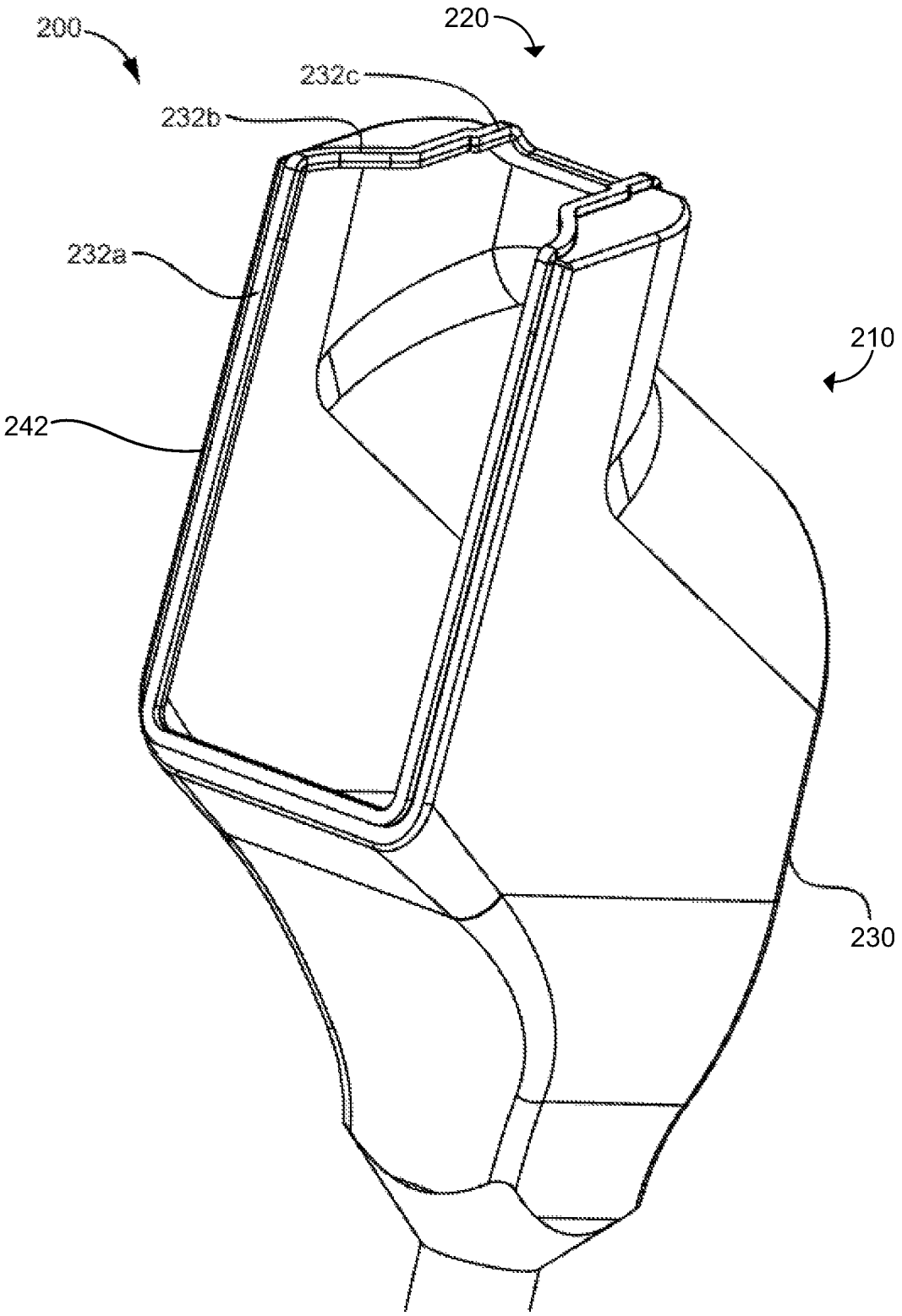
FIG. 2 is a partial perspective view of a portion of a docking station with which an air treatment assembly as exemplified in FIG. 1 may dock, in accordance with an embodiment.

As exemplified in FIG. 2, first abutment surface 232 may be of any suitable shape and configuration to form a sealing interface when surface cleaning apparatus 100 is docked with docking station 200 (the "docked position"). As shown, first abutment surface 232 may extend along docking interface perimeter 242. For example, first abutment surface 232 may extend continuously to form a closed loop around docking station air inlet 208. This may help prevent leakage as compared with a first abutment surface 232 that has gaps. In other embodiments, first abutment surface 232 has one or more gaps. For example, these gaps may be closed by the mating second abutment surface 228 of surface cleaning apparatus 100, thereby mitigating air leakage.

As discussed previously, the juncture of the abutment surfaces may be provided with a flexible sealing member. The sealing member may be provided on part or all of the first abutment surface and/or part or all of the second abutment surface. For example, the illustrated example, first abutment surface 232 is formed as a resiliently compressible gasket (e.g., rubberized edge segments 232*a*-232*c* or applied O-ring) that is sized and shaped to match (i.e., mate with) second abutment surface 228. Resiliently compressible gasket material (e.g., rubber or foam) may be effective at forming an air tight seal when in the docked position. Segments 232*a*-232*c* of first abutment surface 232 may be oriented in various directions along the perimeter portion of housing 202 to match corresponding segment(s) of second abutment surface 228.

In other embodiments, a portion or all of first abutment surface 232 is formed as an outwardly extending rib and correspondingly, a portion or all of second abutment surface 228 is formed as a resiliently compressible gasket.

In some embodiments, neither of abutment surfaces 228, 232 are formed with a resiliently compressible gasket. Instead, both abutment surfaces 228, 232 are formed of substantially incompressible rigid materials (e.g., rigid plastic or metal). This may reduce the cost of manufacturing and assembling abutment surfaces 228, 232 as resiliently compressible gaskets.

As exemplified in FIGS. 3A to 5, in the docked position, the second abutment surface is seated on the first abutment surface to form a sealing interface 224. Each of first abutment surface 232 and second abutment surface 228 may include a stepped contour to accommodate the corners of main body 102 as shown. Optionally, first abutment surface 232 and second abutment surface 228 may be formed with smoothed or curved contours to avoid sharp corners. This may reduce manufacturing complexity and/or air leaks developing at the sharp corners.

As shown, when in the docked position, first abutment surface 232 and second abutment surface 228 may be mated to reduce or eliminate air leakage at the interface of surface cleaning apparatus 100 and docking station 200. For example, surface cleaning apparatus 100 may dock with docking station 200, whereby abutment surfaces 228, 232 may engage to seal or essentially seal the interface against air leakage, at least when the moveable portion of air treatment member 104 is in a closed position (see, e.g., FIG. 1), and optionally when the moveable portion of air treatment member 104 is in an open position (see, e.g., FIG. 5). This may mitigate the spilling of dirt compared to a design that required air treatment member 104 to be opened prior to docking with docking station 200. As shown, second abutment surface 228 may extend entirely exterior to air treatment member 104 so that second abutment surface 228 is accessible to mate with first abutment surface 232 of docking station 200 when the moveable portion of air treatment member 104 is in the closed position.

Figure 5:
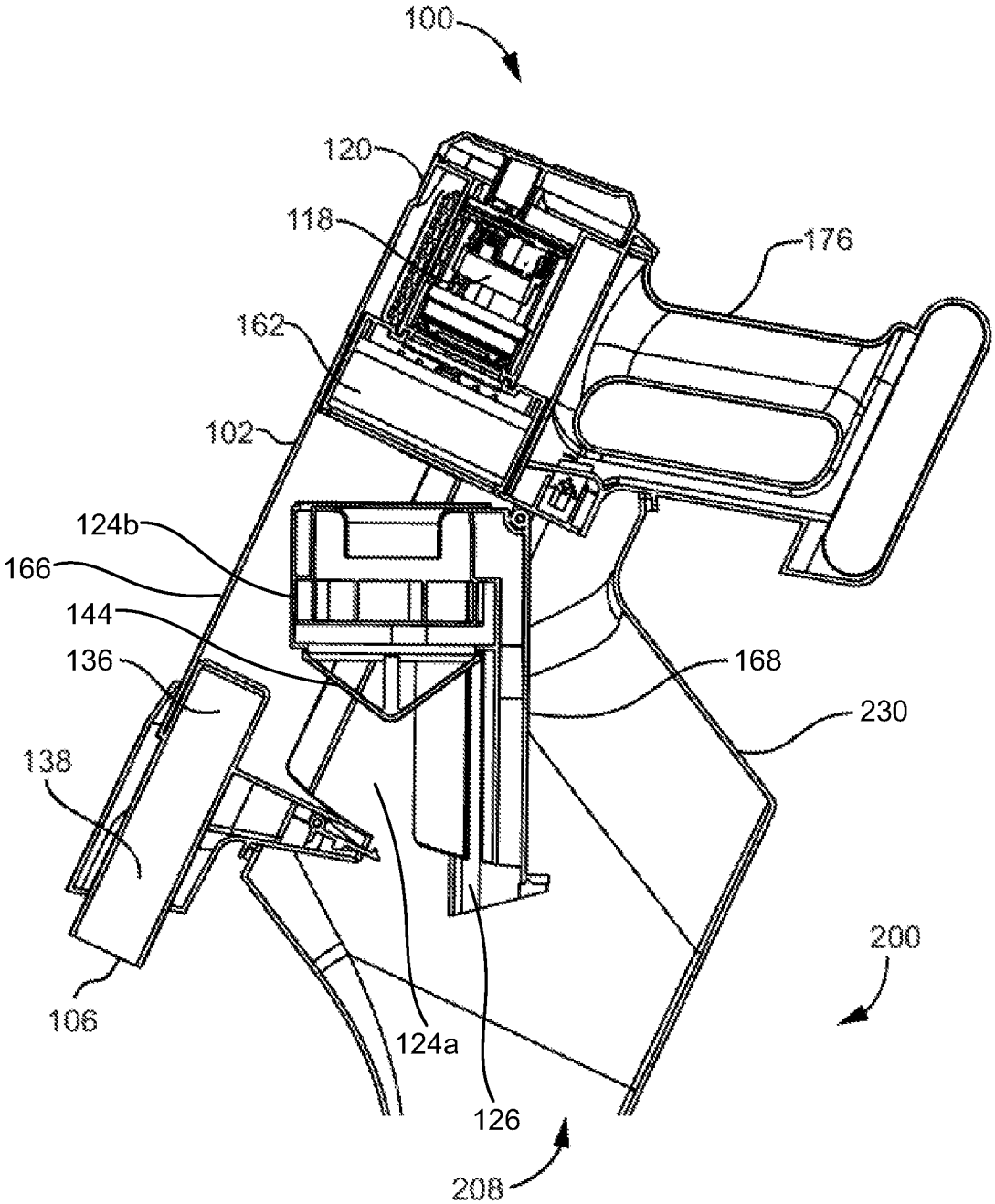
FIG. 5 is a cross-sectional view taken along line 5-5 in FIG. 3A, with an air treatment chamber of the surface cleaning apparatus in an open position.

As exemplified in FIG. 5, wall portions 230 of docking station 200 may be shaped and sized to accommodate the movement of the moveable portion of air treatment member 104 to the open position. Alternatively, or in addition, handle 176 may be positioned and/or shaped to accommodate the corresponding shape and size of wall portions 230 of docking station 200.

For example, it the rotational mount 256*a* is located towards the handle, as exemplified in FIG. 6, then the upper end of the docking station interface 210 may be recessed rearwardly (in the orientation of FIG. 3B) to enable the moveable portion to rotate into the docking station interface 210 to the open position as exemplified in FIG. 3B without the lower surface of the moveable portion (the part reference numeral 168 touches in FIG. 3B) being prevented from movement due to engagement of the openable portion with the interior of the docking station interface 210. Alternately, or in addition, the abutment surface 228*b* may be recessed downwardly from the openable portion (see, e.g., FIG. 1) so that the fingers of a user are spaced from the openable portion and therefore will not be contacted by the openable portion if the user is holding the handle when the openable portion is opened.

When the moveable portion of the air treatment member is in the closed position, the moveable portion and the stationery portion abut along peripheral edges. As exemplified, the peripheral edges of the moveable portion and the stationary portion may extend at least partially in an axial direction along longitudinal axis 148. In some embodiments, the peripheral edges may extend along the full axial length of air treatment member 104 to expose a large portion of air treatment chamber 124 when the moveable portion is moved to the open position (e.g., peripheral edge 186 of the moveable portion 168 illustrated in FIG. 7). In other embodiments, the peripheral edges may extend along a portion of the axial length of air treatment member 104 to reduce the length of the interface between the docking station and the surface cleaning apparatus that needs to be sealed.

Accordingly, each of the moveable portion and the stationary portion may comprise a portion of the sidewall of the air treatment chamber whereby part or all of the axial length of the air treatment chamber may be opened when the moveable portion is moved to the open position.

Any suitable mechanism may be used to move the moveable portion of the air treatment member to the open position. For example, the moveable portion may be rotated and/or translated into the open position. For rotational movement, the moveable portion is rotatably mounted by a rotational mount whereby, when the moveable portion is moved to the open position, the moveable portion is rotated into the closed volume defining the docking station air inlet. The rotational mount may be located at any suitable position of the air treatment member. For example, the rotational mount may be located adjacent the first end or the second end of the air treatment chamber to enable a large portion of the air treatment chamber to be exposed when the moveable portion is moved to the open position. As exemplified in FIGS. 11A and 11B, the moveable portion 168 is rotated into the open position by a rotational mount 256*a*. The rotational mount 256*a* is located adjacent the second end 154 of air treatment chamber 124. Optionally, if the air treatment assembly is vertically oriented when docked, the rotational mount is at an upper end of the of the moveable portion.

Figure 27:
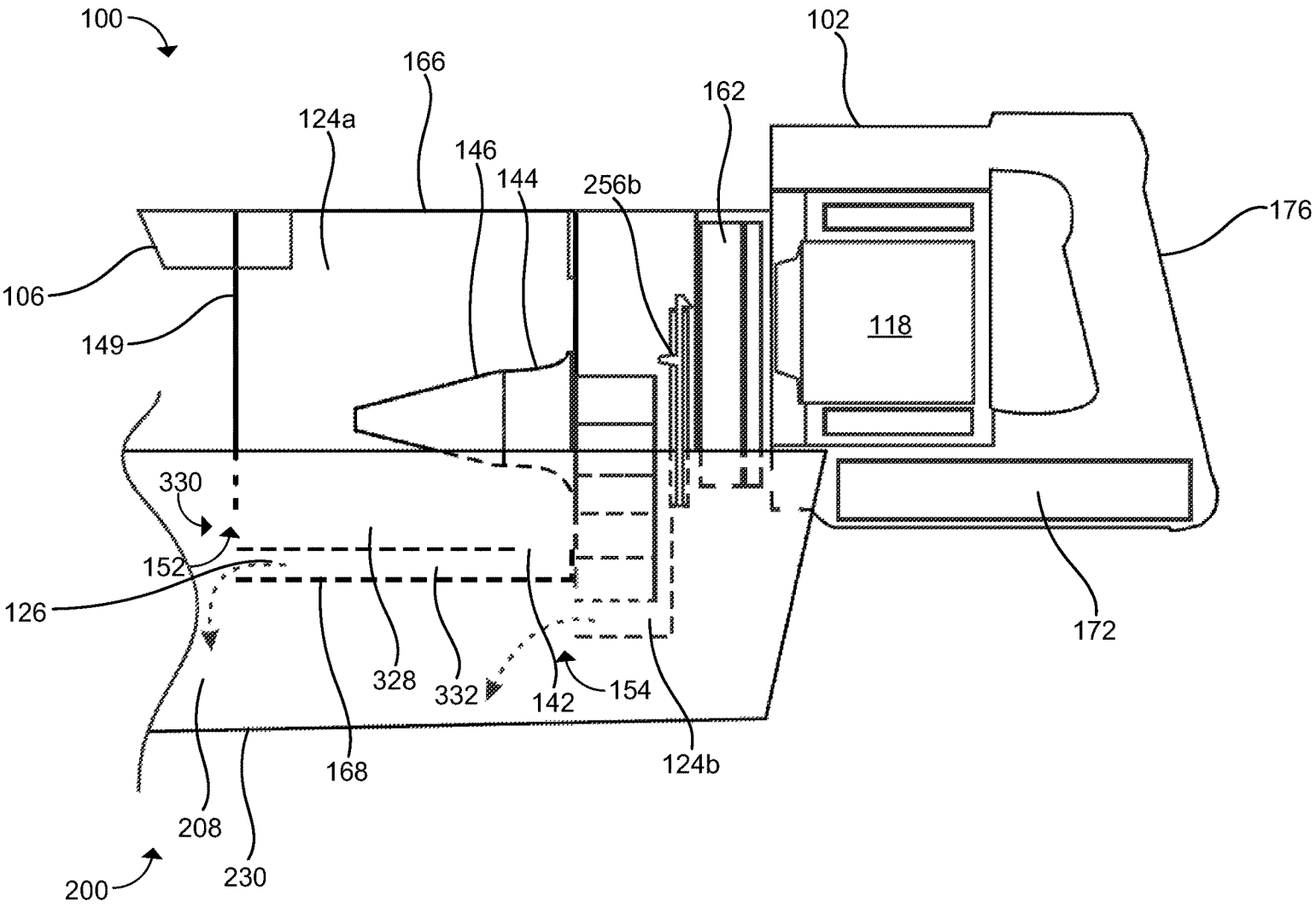
FIGS. 27 to 32 are side cross-sectional views of alternate surface cleaning apparatus docked to the docking station of FIG. 2 with an air treatment member of the surface cleaning apparatus in an open position.
Figure 28:
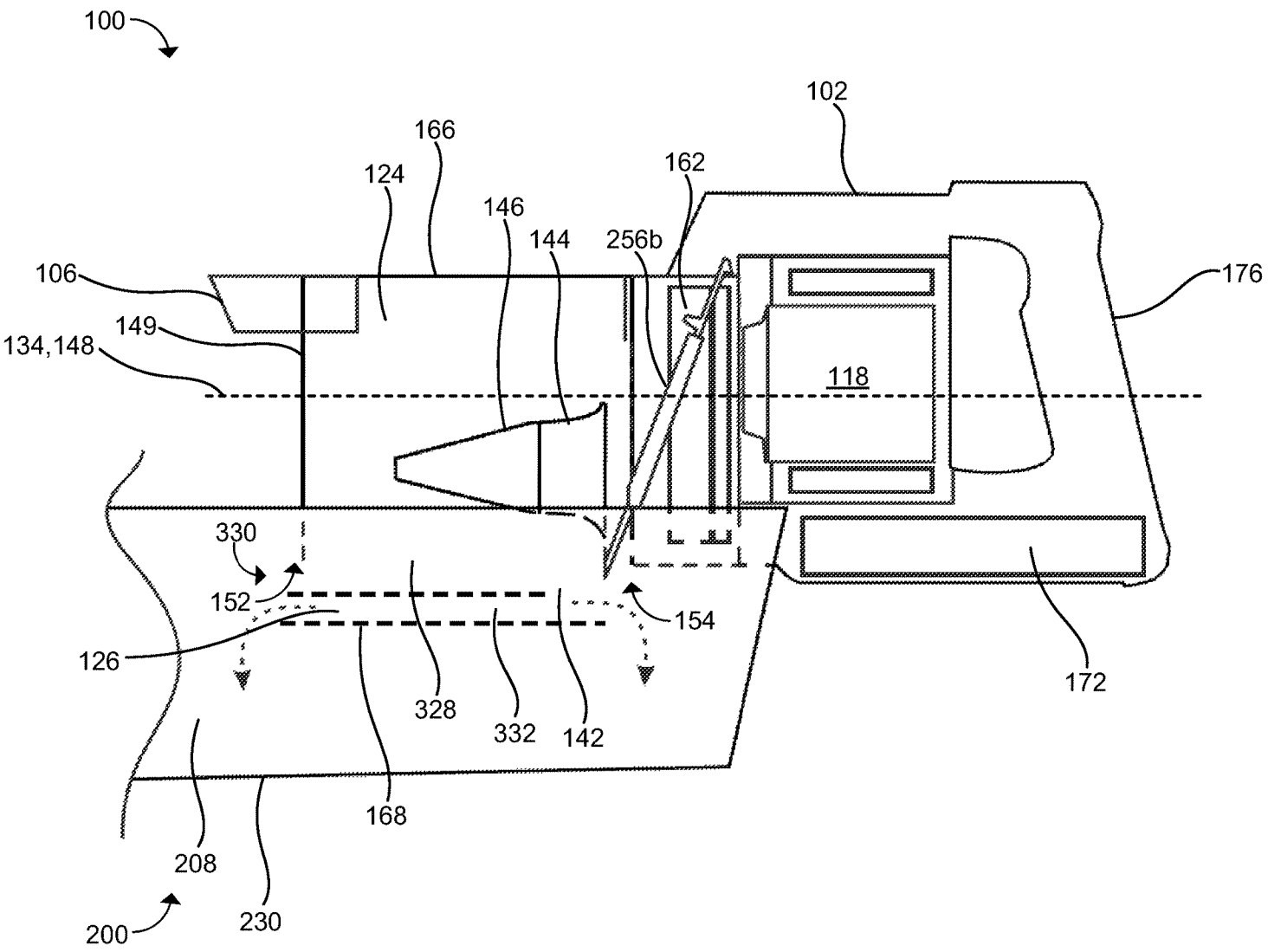
Figure 29:
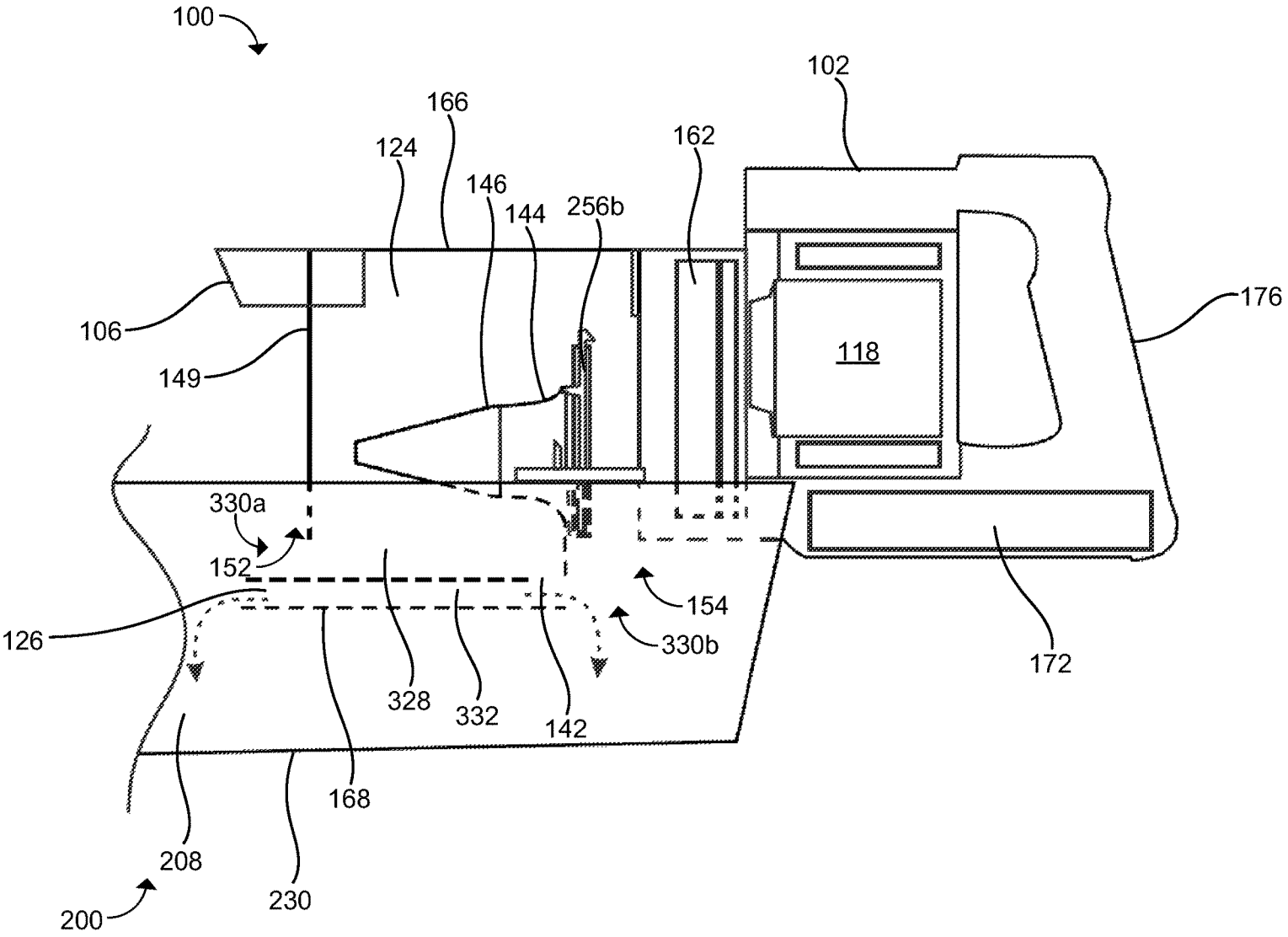

For translation movement, a translatable mount translates the moveable portion to the open position whereby, the moveable portion is translated into the closed volume defining the docking station air inlet. The translatable mount may be located at any suitable position of the air treatment member. For example, the translatable mount may be located adjacent the first end or the second end of the air treatment chamber to enable a large portion of the air treatment chamber to be exposed when the moveable portion is moved to the open position. As exemplified in FIGS. 27 and 28, the moveable portion 168 is translated into the open position by a translatable mount 256*b*. The translatable mount 256*b* is located adjacent the second end 154 of air treatment chamber 124.

In some embodiments, the movable portion may further include a pre-motor filter 162, and/or some or all of a second stage air treatment chamber (e.g., one or more second stage cyclone(s)). For example, the movable portion may have any configuration described herein in connection with this embodiment and other embodiments. Sizing docking interface 210 to accommodate this movement may mitigate spilling dirt outside of the dock by permitting the movable portion to move to an open position while a seal is maintained between surface cleaning apparatus 100 and docking station 200.

It will be appreciated that, when docked and opened, some or all of the moveable portion may abut the interior of the docking station but optionally, all of the moveable portion is spaced therefrom.

Non-Linear Interface

In accordance with one aspect of this disclosure, in some embodiments, a non-linear interface is formed between the moveable and stationary portions of the air treatment member when the moveable portion is in the closed position. The moveable and stationary portions abut along peripheral edges and the peripheral edge of the moveable portion has at least one discontinuity that makes the interface between the moveable and stationary portions non-linear.

The peripheral edges of the moveable and stationary portions may each be formed of two or more portions joined at a discontinuity. The discontinuity may be a junction between two linear and non-parallel portions of the peripheral edge, thereby forming a stepped (non-linear) interface. In other examples, at least one of the two portions of the peripheral edge can be non-linear or curved. For example, both portions of the peripheral edge may be curved portions having different centers and/or radii of curvature, and the discontinuity may be a junction between the two curved portions, thereby forming a curved (non-linear) interface.

The positioning of the discontinuity and the design of the non-linear interface can enable efficient dirt transfer from the surface cleaning apparatus to the docking station for various configurations of the air treatment member of the surface cleaning apparatus. For example, the discontinuity can be positioned and/or the non-linear interface can be designed to enable one or more dirt collection chambers to be exposed when the moveable portion of the air treatment member is moved to the open position. As another example, the discontinuity can be positioned and/or the non-linear interface can be designed to enable user access to one or more mesh screens and/or filters of the surface cleaning apparatus. The non-linear interface may be used by itself or in combination with one or more (or all) of the sealing interface, the plate configuration, the auto-closing mechanism, the removable filter and the air treatment member configurations.

Referring to FIGS. 6 to 9, the moveable portion 168 may be moveably mounted by a mount 256*a* between a closed position in which the air treatment chamber 124*a* is closed and an open position in which the air treatment chamber 124*a* is open. In the illustrated example, mount 256*a* of the moveable portion 168 is shown located at rear end 154*b* of air treatment chamber 124*b*. In other examples, mount 256*a* may be located at any other suitable location.

In the closed position, moveable portion 168 and stationary portion 166 may abut along peripheral edges (e.g., peripheral edge 186 of moveable portion 168 and peripheral edge 190 of stationary portion 166) that extend forwardly from the location of the mount. The peripheral edges 186 and 190 may extend partially or fully along the axial length of the air treatment member.

Peripheral edge 186 of moveable portion 168 may have a discontinuity 188 that makes the interface between moveable portion 168 and stationary portion 166 non-linear. In some examples, peripheral edge 186 may include multiple discontinuities (e.g., 2 to 4). A lower number of discontinuities (e.g., 1 to 3) may reduce manufacturing complexity. A higher number of discontinuities (e.g., 4 to 6) may provide greater design flexibility.

Discontinuity 188 can be located at any position along the axial length of air treatment member 104. For example, discontinuity 188 may be located forward, adjacent or rearward with reference to an axial inner end 160 of vortex finder 144.

Peripheral edge 186 may include multiple peripheral edge portions (186*a*-186*e*) that extend forwardly, generally in axial direction 148, from rear end 154*b*. The peripheral edge portions may be linear (e.g., peripheral edge portions 186*b*, 186*c* and 186*e*) or non-linear (e.g., peripheral edges 186*a* and 186*d*). In the illustrated examples, the moveable portion 168 rotates downward to the open position. The moveable portion 168 and peripheral edge 186 may extend downward from a location adjacent or rearward of axial inner end 160 of vortex finder 144. Peripheral edge 186 may extend downward linearly or non-linearly. For example, peripheral edge portions 186*c* and 186*e* extend downward linearly from a location rearward of axial inner end 160.

Figure 8:
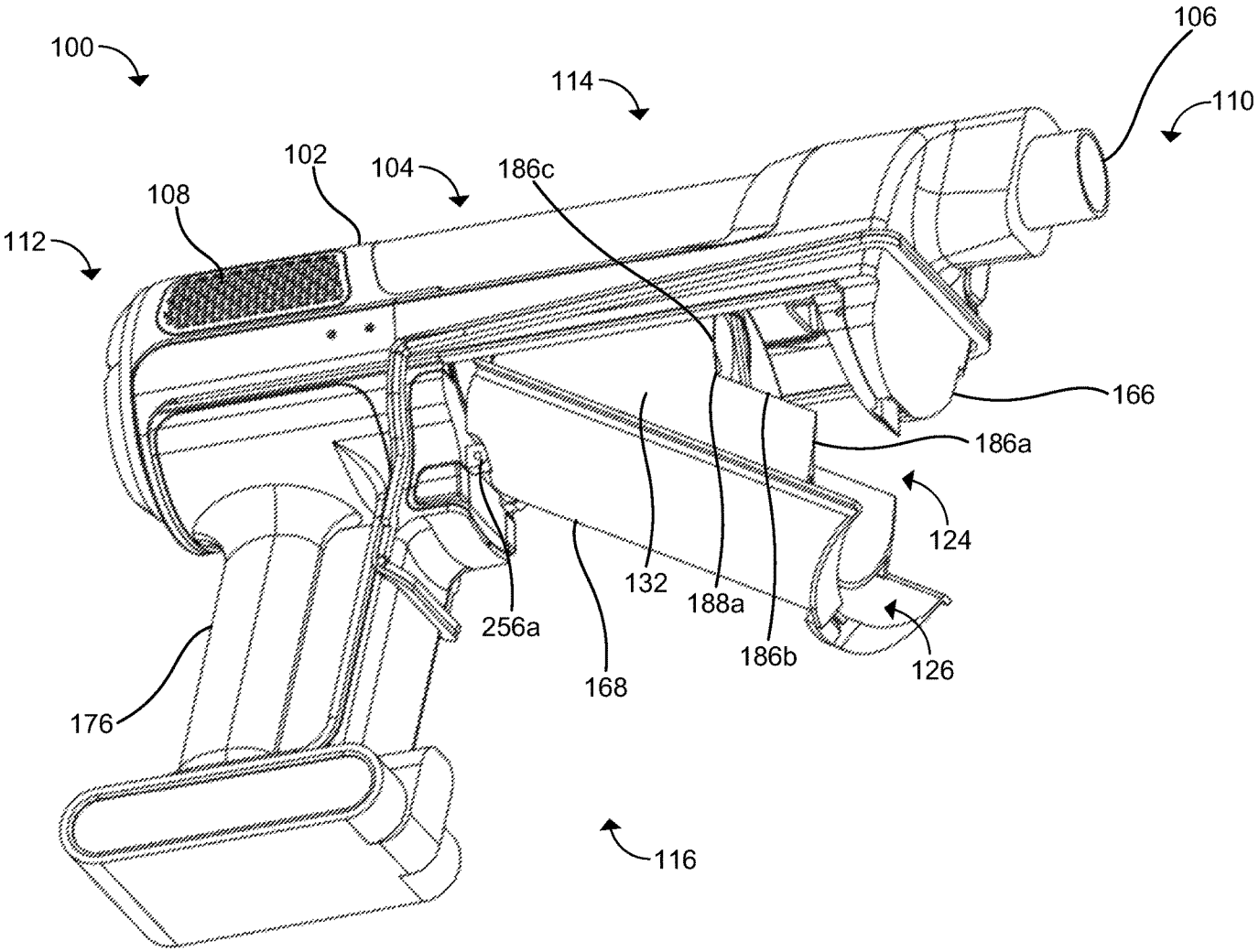
FIG. 8 is a perspective view of the surface cleaning apparatus of FIG. 6 with the air treatment member in an open position.
Figure 9:
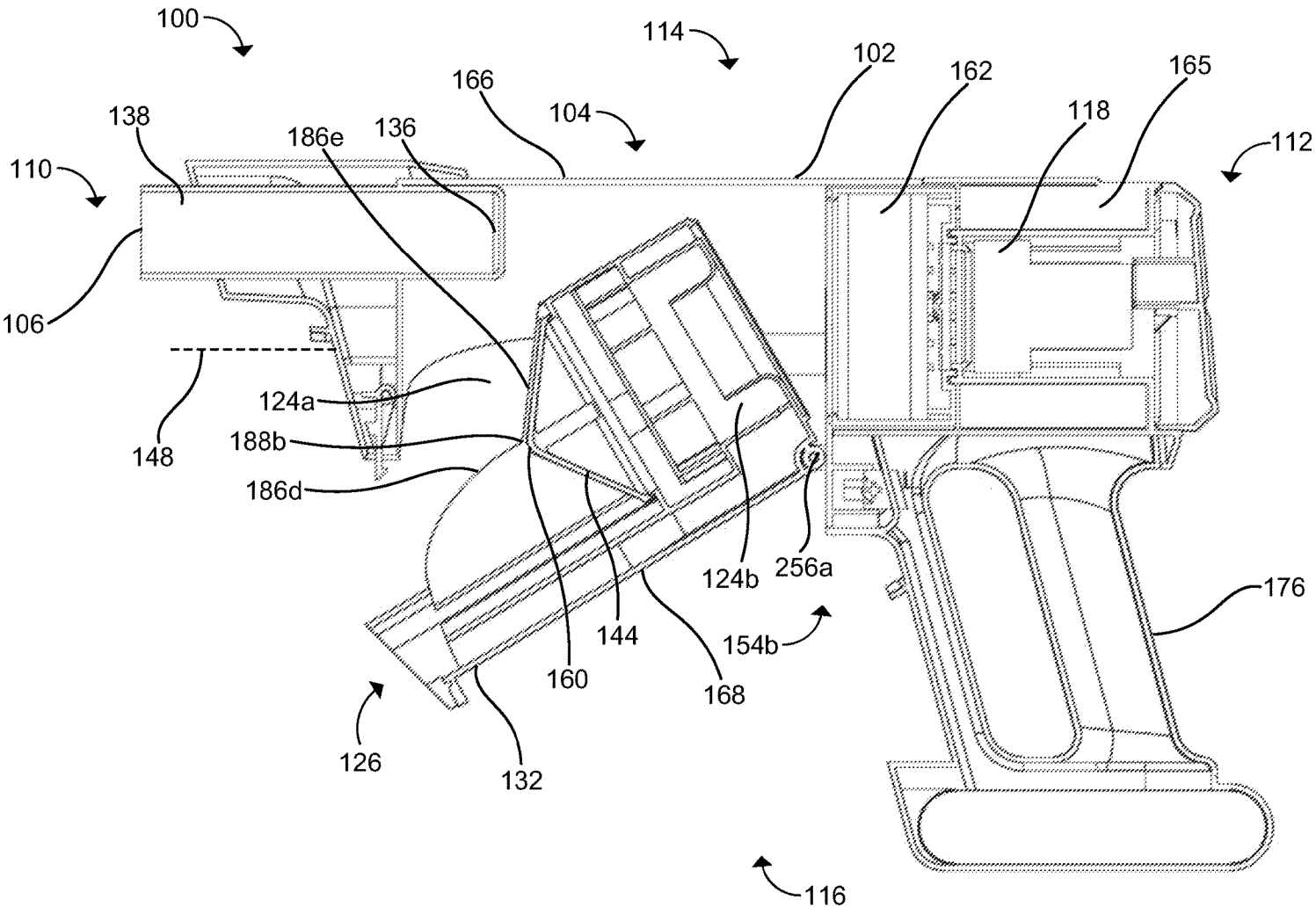
FIG. 9 is a side cross-sectional view of an alternate surface cleaning apparatus with an air treatment member of the surface cleaning apparatus in an open position.

As exemplified in FIGS. 6 to 8, discontinuity 188*a* is located at a junction of peripheral edge portions 186*b* and 186*c*. When the moveable portion 168 is in the closed position (FIG. 6), discontinuity 188*a* is located adjacent to axial inner end 160. Peripheral edge portion 186*c* extends linearly forward and downward from a location rearward of axial inner end 160. Peripheral edge portion 186*b* extends linearly forward from discontinuity 188*a*. For the example, in the embodiment illustrated in FIG. 9, discontinuity 188*b* is located at a junction of peripheral edge portions 186*d* and 186*e*. When the moveable portion 168 is in the closed position, discontinuity 188*b* is located adjacent to axial inner end 160. Peripheral edge portion 186*e* extends linearly forward and downward from a location rearward of axial inner end 160. Peripheral edge portion 186*d* extends non-linearly forward and downward from discontinuity 188*b*.

Plate Configuration

In accordance with another aspect of this disclosure, the air treatment member may include part or all of an end wall (a plate) that may remain stationary or move with the moveable portion of the air treatment member when the air treatment member is moved between the open and closed positions, i.e., either of the stationary portion or the moveable portion may include the plate. Optionally, the plate (whether included in the stationary portion or the moveable portion) may be moveable mounted to the stationary portion or the moveable portion and the plate may be moveable independent of the movement of the moveable portion. The plate may be independently movable before, during and/or after the movement of the moveable portion between the open and closed positions. The various configurations of the plate may help reduce resistance to the dirt transferal air flow (while in the docked position) for higher dirt transfer efficiency, and greater user access to internal components of the air treatment member, e.g., the mesh screen, pre-motor filter etc. for cleaning, repair, or replacement.

The plate configuration may be used by itself or in combination with one or more (or all) of the other aspects including the sealing interface, the non-linear interface, the auto-closing mechanism, the removable filter, and the air treatment member configurations.

Referring to FIGS. 10 to 21, the dirt collection chamber 126 may be exterior to the air treatment chamber 124. The dirt collection chamber 126 can be in communication with the air treatment chamber 124 through the air treatment chamber dirt outlet 142. The exterior-positioned dirt collection chamber 126 may have an axially extending dirt collection chamber sidewall 180 and a first end 182 having a first end wall 184. The dirt collection chamber sidewall 180 may extend between the first end 182 and the first end wall 149 of the air treatment chamber 124. The first end wall 184 of the dirt collection chamber 126 may be spaced from and face the first end wall 149 of the air treatment chamber 124.

Referring to FIG. 10, in some embodiments, plate 156 is mounted to so as to be supported by and spaced from first end wall 184 of dirt collection chamber 126, by a support member 158. Support member 158 may be of any suitable configuration and may be formed from any suitable material that is capable of supporting plate 156 and resisting stresses exerted on plate 156 by the air flow in air treatment chamber 124 or dirt particles exiting air treatment chamber 124.

Figure 11A:
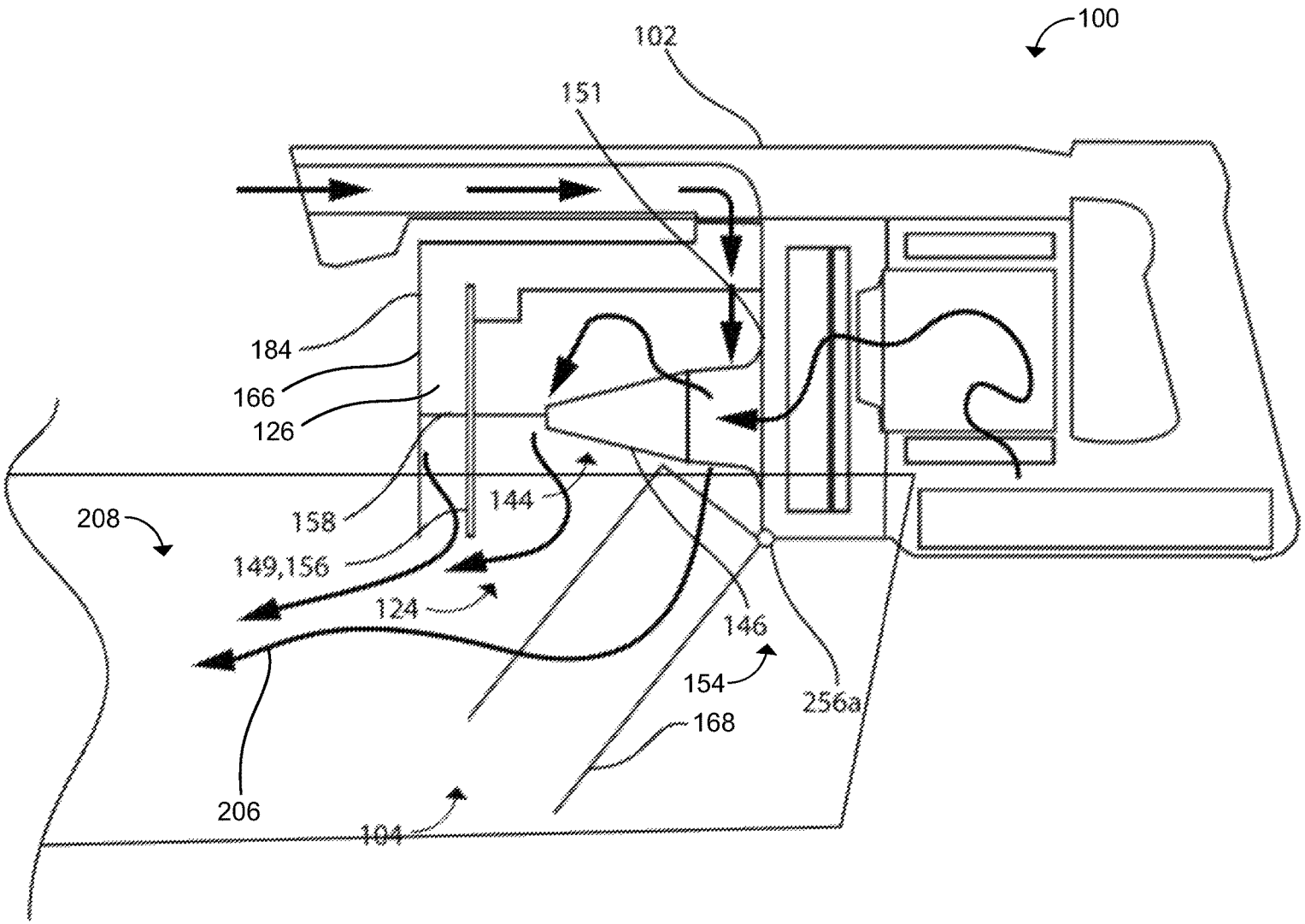
FIG. 11A is a side cross-sectional view of the surface cleaning apparatus of FIG. 10 docked to the docking station of FIG. 2 with the air treatment member of the surface cleaning apparatus in an open position showing the air flow during an evacuation operation.
Figure 11B:
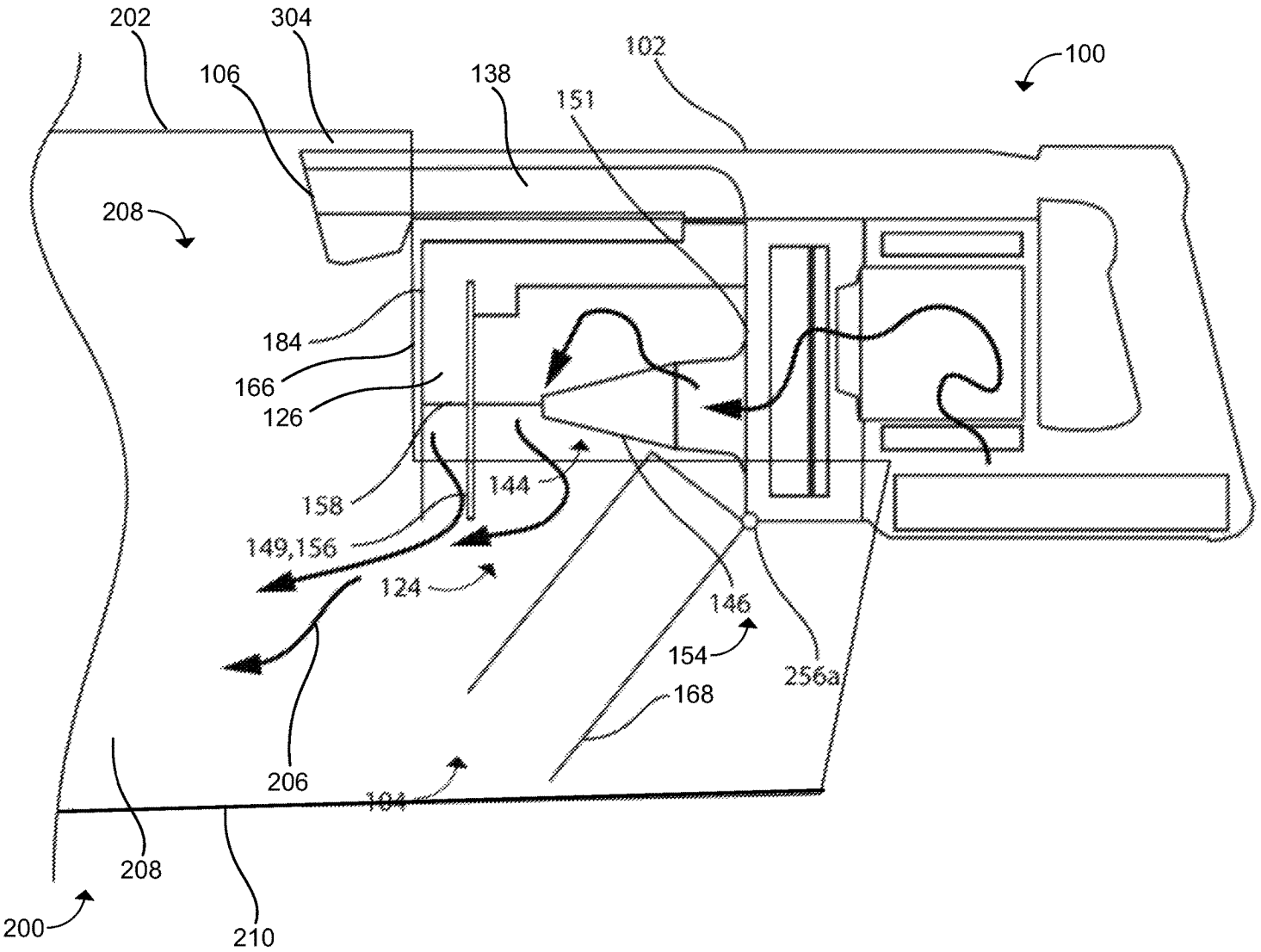
FIG. 11B is a side cross-sectional view of the surface cleaning apparatus of FIG. 10 docked to the docking station of FIG. 2 with the air treatment member of the surface cleaning apparatus in an open position showing the airflow during an alternate evacuation operation.
Figure 12:
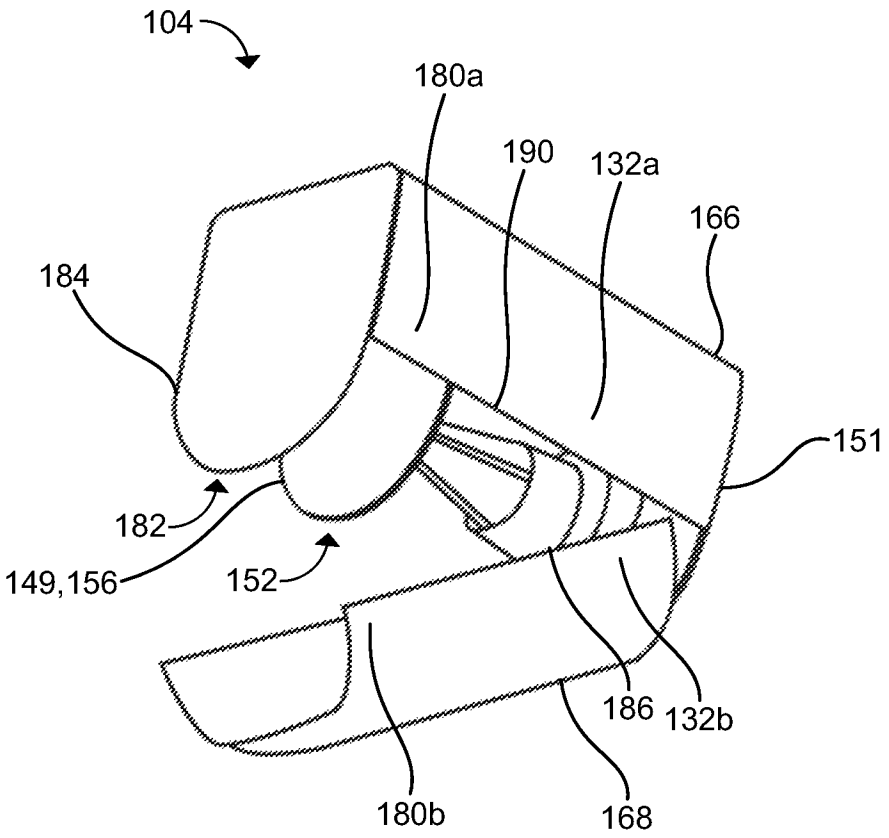
FIG. 12 is a partial perspective view of the air treatment member of FIG. 10 in an open position.
Figure 13:
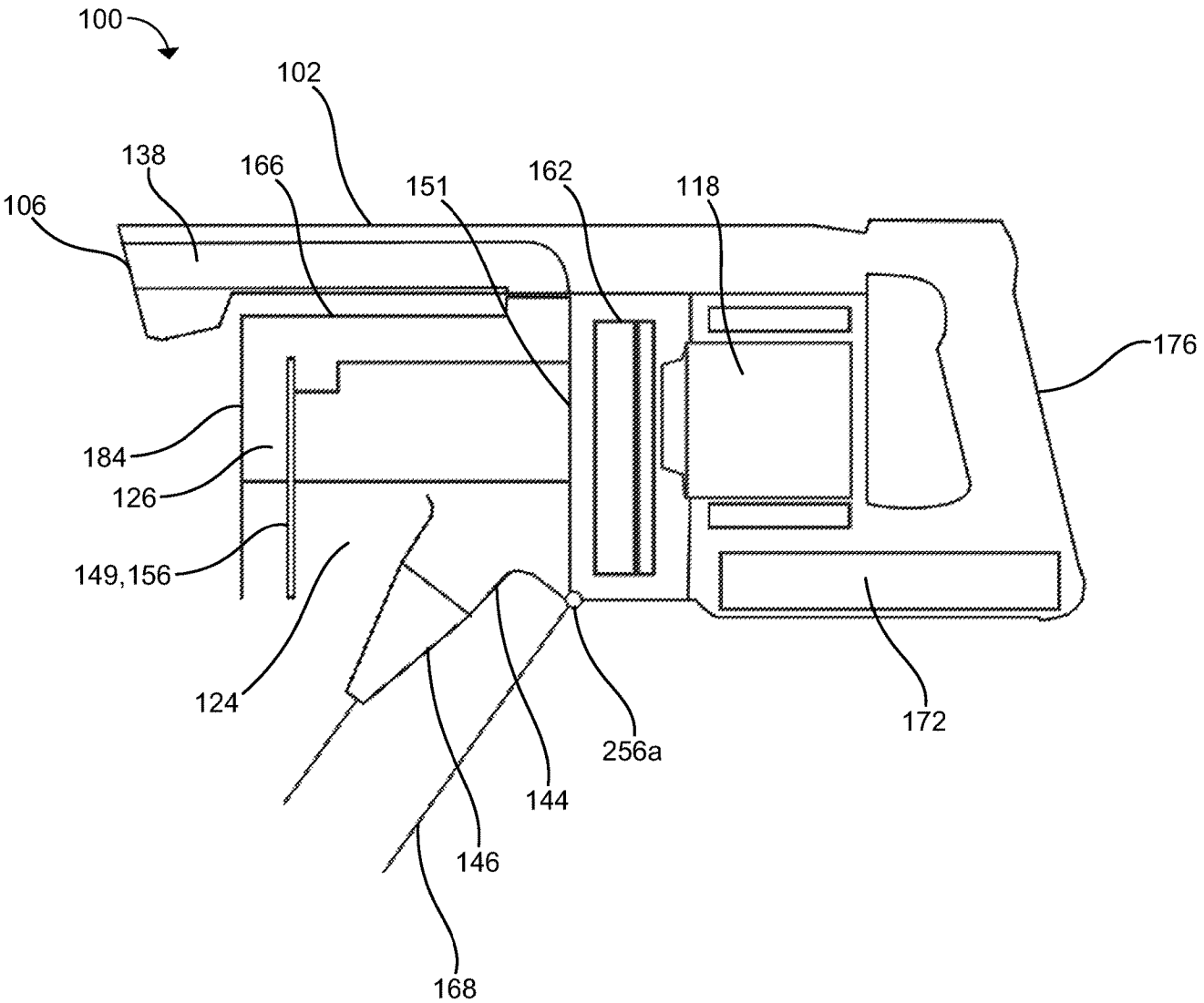
FIGS. 13 to 16B are side cross-sectional views of alternate surface cleaning apparatus with an air treatment member in an open position.

In the closed position, moveable portion 168 and stationary portion 166 may abut along peripheral edges to provide a sealed connection when in the closed position. Referring now to FIG. 12, moveable portion 168 has a peripheral edge 186 and stationary portion 166 has a peripheral edge 190. In the illustrated example, the peripheral edges 186 and 190 extend along the entire longitudinal (i.e., axial) length of the air treatment chamber sidewall 132 and the dirt collection chamber sidewall 180. The size and configuration of the peripheral edges 188, 190 provide an enlarged opening when the moveable portion is in the open position. This may reduce air resistance for the dirt transferal air flow (while in the docked position) and/or provide greater user access to components of the air treatment chamber. In other examples, the peripheral edges 186 and 190 may extend only partly along the length of the air treatment chamber sidewall 132 and the dirt collection chamber sidewall 180 (e.g., less than about 75% of the length of air treatment chamber sidewall 132 and dirt collection chamber sidewall 180). This may reduce the size of air treatment member 104 when in the open position, which in turn may allow for a more compact docking interface 210 (FIG. 11B).

Figure 14:
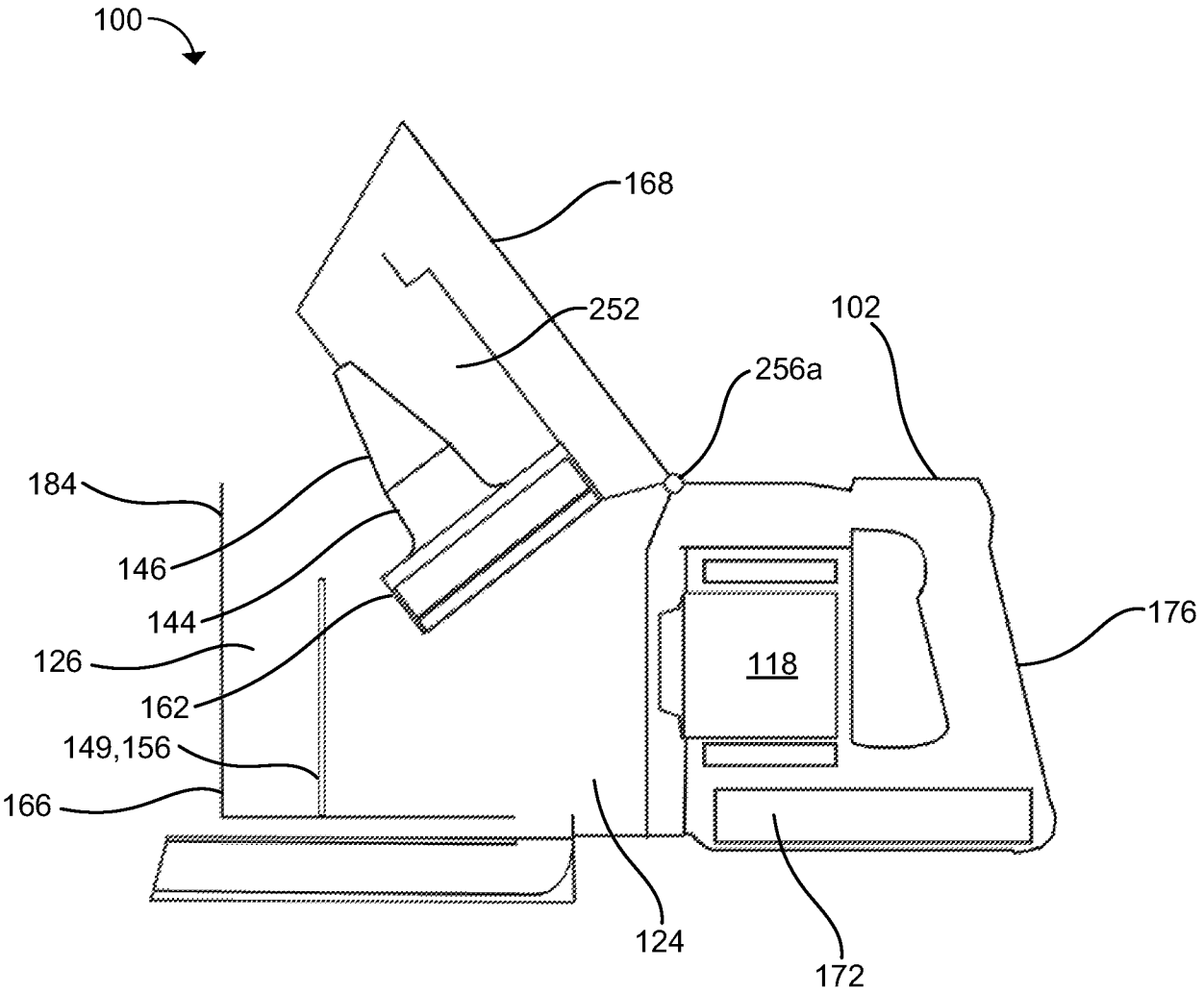
Figure 15:
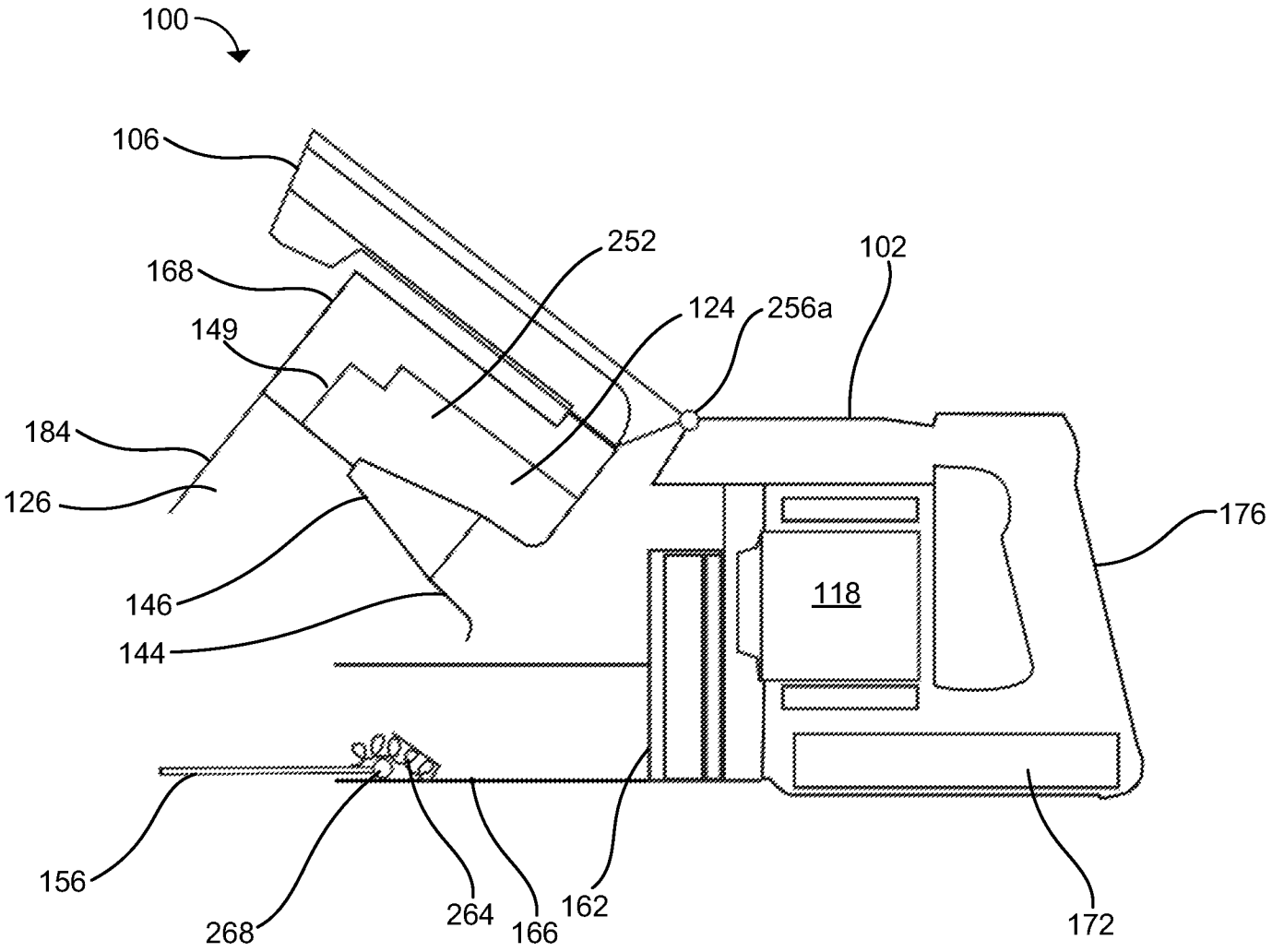

Referring now to FIGS. 10 to 15, the stationary portion 166 may include the plate 156. A rotational mount 256*a* may be used to rotate the moveable portion 168 between an open and a closed position. The rotation can be in an upward or downward direction. For example, FIGS. 11A to 13 illustrate the moveable portion 168 rotated downward into an open position. FIGS. 14 and 15 illustrate the moveable portion 168 rotated upward into an open position. The rotation direction may be configured to provide design flexibility for the main body of surface cleaning apparatus and/or housing of the docking station.

For example, when the surface cleaning apparatus is in the upright storage position, the surface cleaning apparatus may be docked by moving the upper end (which is in this configuration a forward facing end of the surface cleaning apparatus) forwardly to dock with the docking station. In such an embodiment, the moveable portion of the surface cleaning apparatus may be the upper end of the surface cleaning apparatus or the upper end of the air treatment assembly whereby the upper end may pivot open into the docking station interface.

In some embodiments, the stationary portion 166 may include the vortex finder 144 and mesh screen 146. For example, FIGS. 11A, 11B, and 12 illustrate an example in which the vortex finder 144 and mesh screen 146 remain stationary when the moveable portion 168 is moved to the open position. This may enable the dirt transferal air flow 206 to flow through and remove dirt captured by (e.g., on or inside) the mesh screen 146. In other embodiments, the moveable portion 168 may include the vortex finder 144 and mesh screen 146. For example, FIGS. 13 to 17 illustrate examples where the moveable portion 168 including the vortex finder 144 and mesh screen 146. The movement of the vortex finder 144 and mesh screen 146 may reduce backpressure of the dirt transferal air flow and/or provide greater user access to otherwise hidden components (e.g., pre-motor filter 162) of surface cleaning apparatus 100 when in the open position.

Alternately or in addition, the stationary portion 166 may include a pre-motor filter 162. For example, FIGS. 11 to 13 and 15 illustrate examples in which the pre-motor filter 162 remains stationary when the moveable portion 168 is moved to the open position. This may enable the dirt transferal air flow to flow through and remove dirt captured by (e.g., on or inside) the pre-motor filter 162. Alternatively or in addition to moveable portion 168 including the plate 156, the vortex finder 144 and/or the mesh screen 146, in some embodiments, the moveable portion 168 may include the pre-motor filter 162. For example, FIGS. 14, 16 and 17 illustrate the moveable portion 168 including the pre-motor filter 162. The movement of the pre-motor filter 162 when in the open position may decrease backpressure of the dirt transferal air flow.

In some embodiments, the moveable portion 168 may include an upper end 252 (e.g., FIGS. 14 and 15) of the air treatment chamber 124. FIG. 14 shows an example in which moveable portion 168 includes upper end 252 and stationary portion 166 includes dirty air inlet 106. As shown, dirty air inlet 106 may be positioned below air treatment member 104. FIG. 15 shows an example in which moveable portion 168 includes upper end 252 and dirty air inlet 106. As shown, dirty air inlet 106 may be positioned above air treatment member 104.

In some embodiments, the plate 156 may be moveably mounted to the stationary portion 166. For example, plate 156 may be manual and/or automatically moveable concurrently with or after the moveable portion 168 moves from the closed position to the open position. Any mechanism may be used that is suitable for movably mounting the plate 156 to stationary portion 166 and providing the described manual and/or automatic movement. For example, as illustrated in FIG. 15, the plate 156 may be pivotally mounted to stationary portion 166 between a working position and an emptying position. In the working position (FIG. 10), the arrester plate 156 is oriented transverse (e.g., perpendicular) to the air treatment chamber axis 134 (FIG. 10) to act as an end wall of air treatment member 104. In the emptying position (FIG. 15), the arrester plate 156 is moved away from the working position to provide greater airflow and/or user access.

A biasing member 264 (e.g., a spring) may apply (e.g., automatically apply) a biasing force to pivot plate 156 around a hinge 268 in a biasing direction to the emptying position when the moveable portion 168 moves to the open position. The movement of plate 156 may reduce backpressure of the dirt transferal air flow (when surface cleaning apparatus is docked to the docking station) and/or reduce obstruction to dirt falling by gravity from air treatment chamber 124 when being manually emptied. Alternately, the plate may be biased to the closed position. In either case, if the plate is biased in one direction, a driving member is provided to move the plate in a direction opposite to the biasing direction. The driving member may be driven by the actuator that commences the evacuation cycle or which terminates the evacuation cycle.

Alternatively, plate 156 may not be moveably mounted to the stationary portion 166 (FIGS. 11 to 14). This may reduce manufacturing cost and complexity, and may improve the structural integrity and reliability of plate 156.

Alternately, as exemplified in to FIGS. 16A to 17D, the moveable portion 168 may include the plate 156. The plate 156 may move with the rest of the moveable portion 168 when the moveable portion 168 is moved between an open and a closed position. The moveable portion 168 may be translated and/or rotated between the open and closed positions as discussed elsewhere herein. For example, as illustrated in FIGS. 16A to 17D the moveable portion 168 may be rotated to an open position. The rotation can be in an upward or downward direction. The movement of the plate may provide greater user access to other components (e.g., a screen or a pre-motor filter 162) of surface cleaning apparatus 100.

Figure 17A:
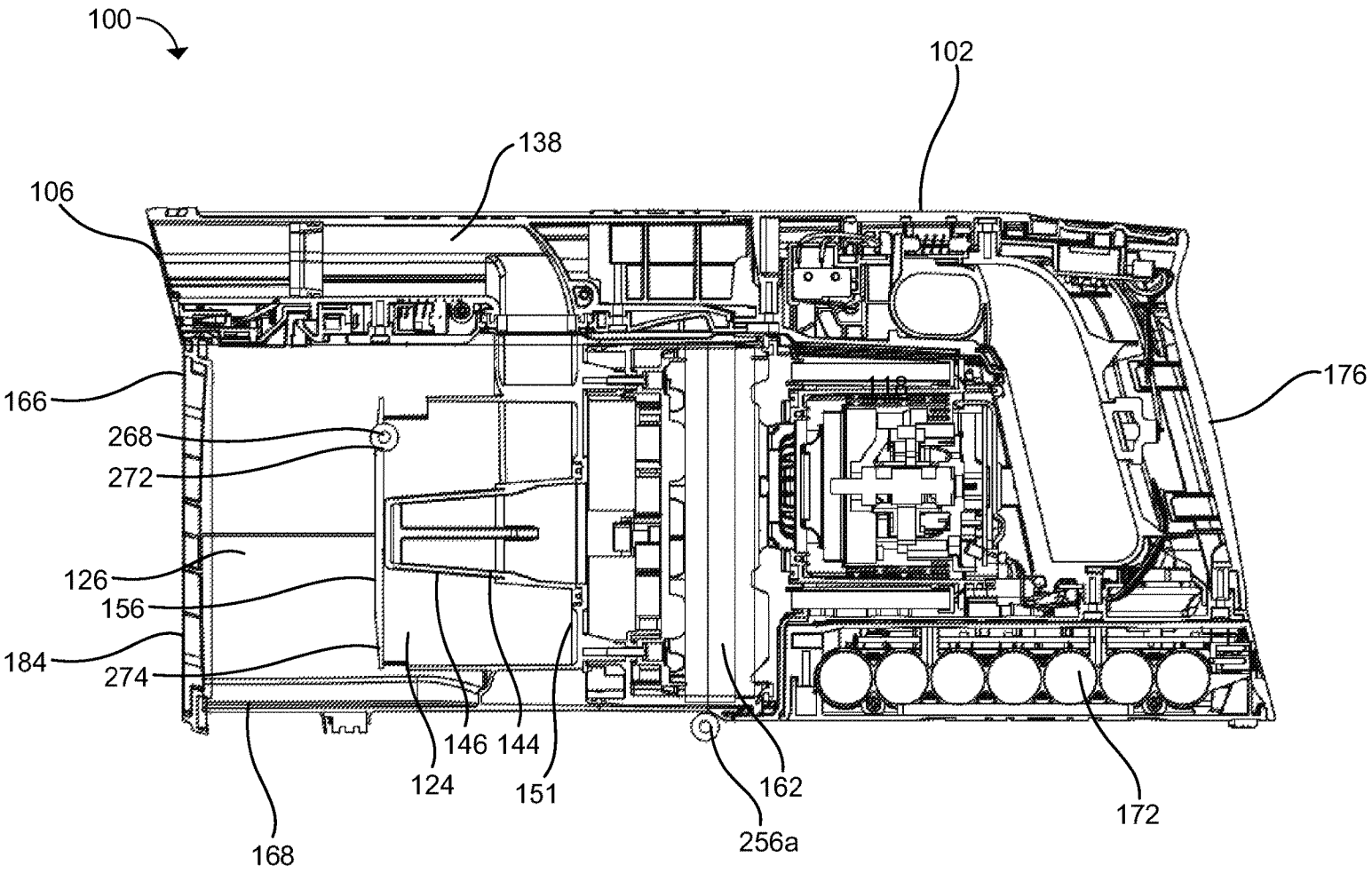
FIG. 17A is a side cross-sectional view of a surface cleaning apparatus with an air treatment member of an alternate surface cleaning apparatus in a closed position.
Figure 17B:
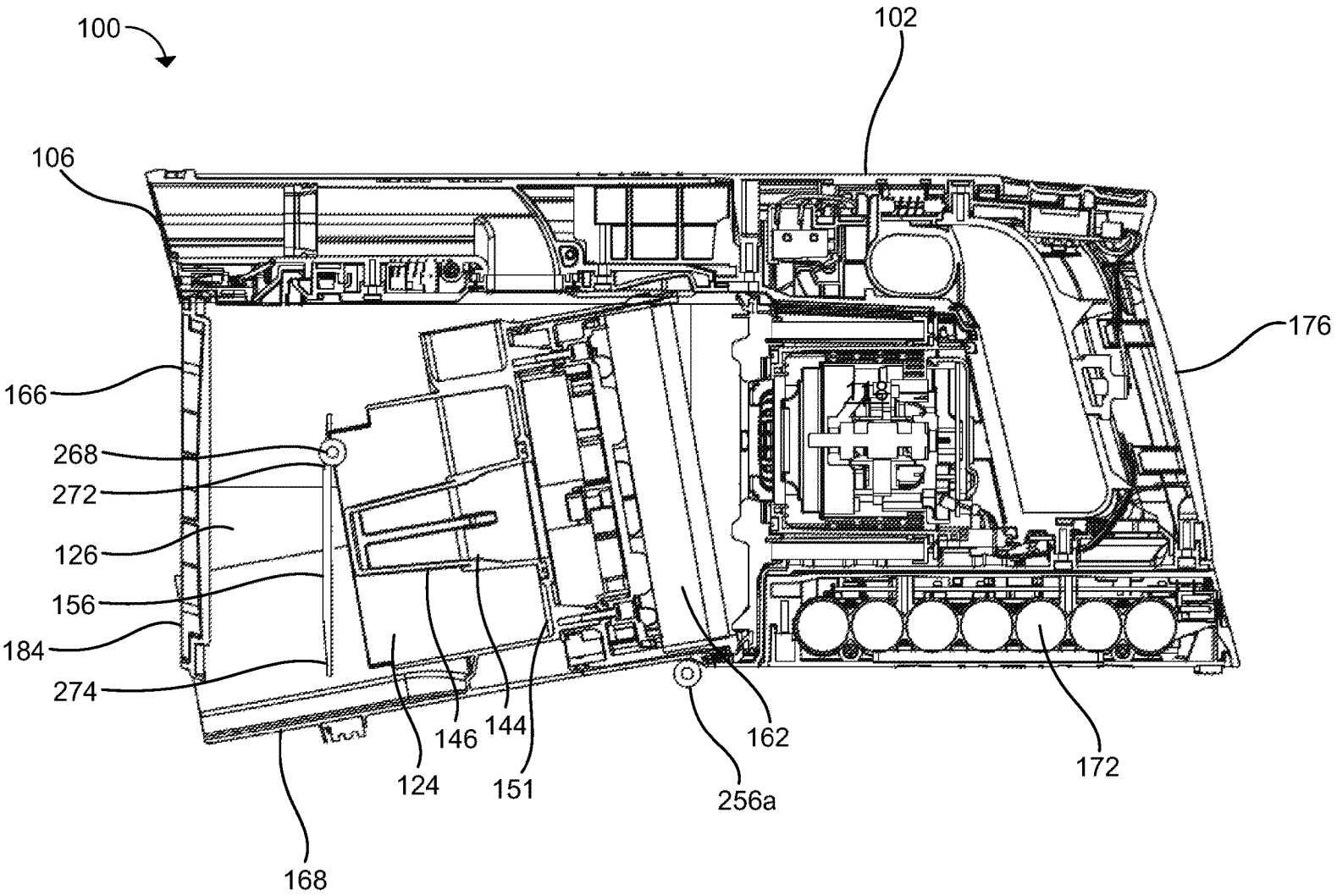
FIGS. 17B and 17C are side cross-sectional views of the surface cleaning apparatus of FIG. 17A with the air treatment member of the surface cleaning apparatus in partially open positions.
Figure 17C:
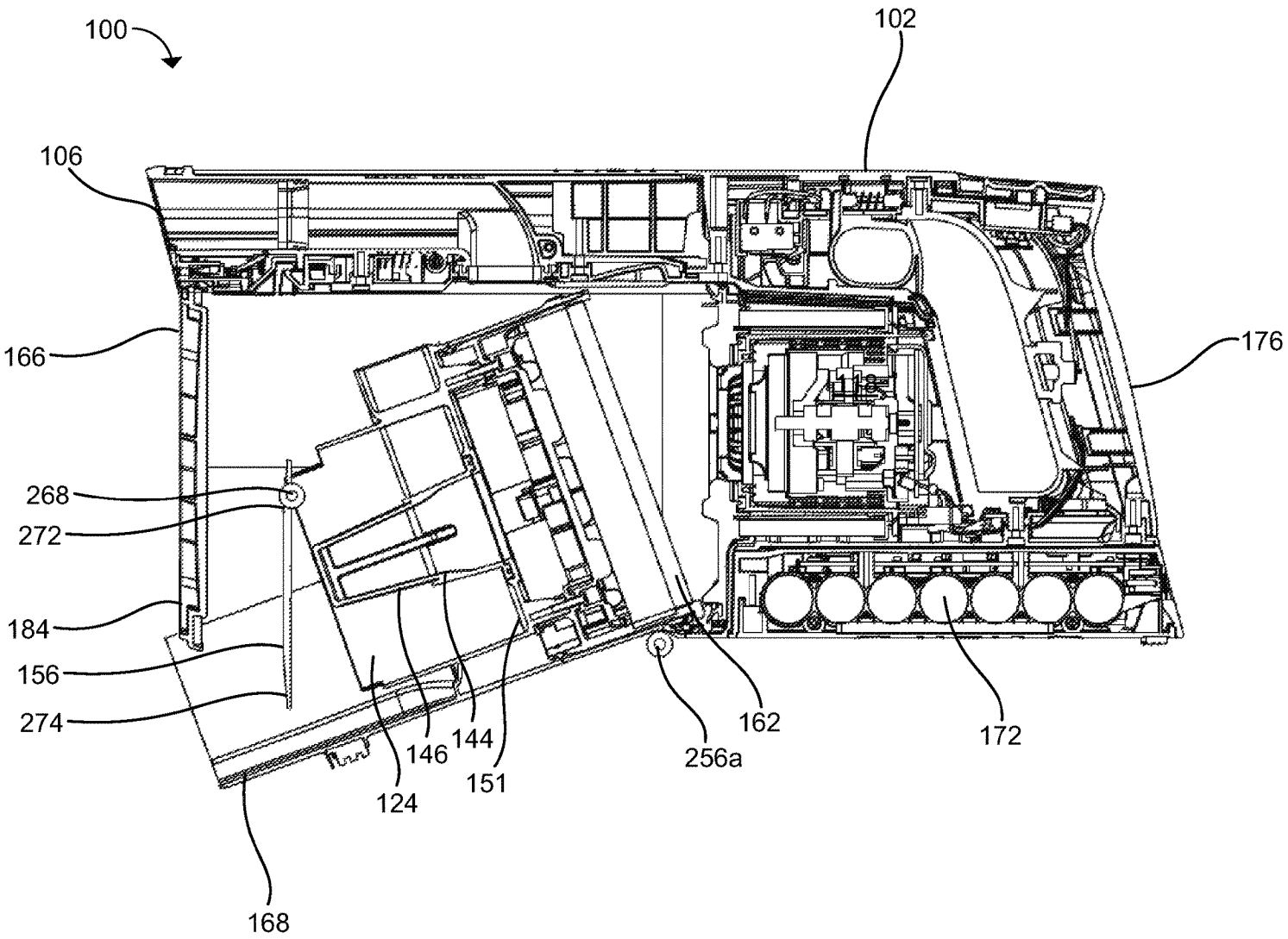
Figure 17D:
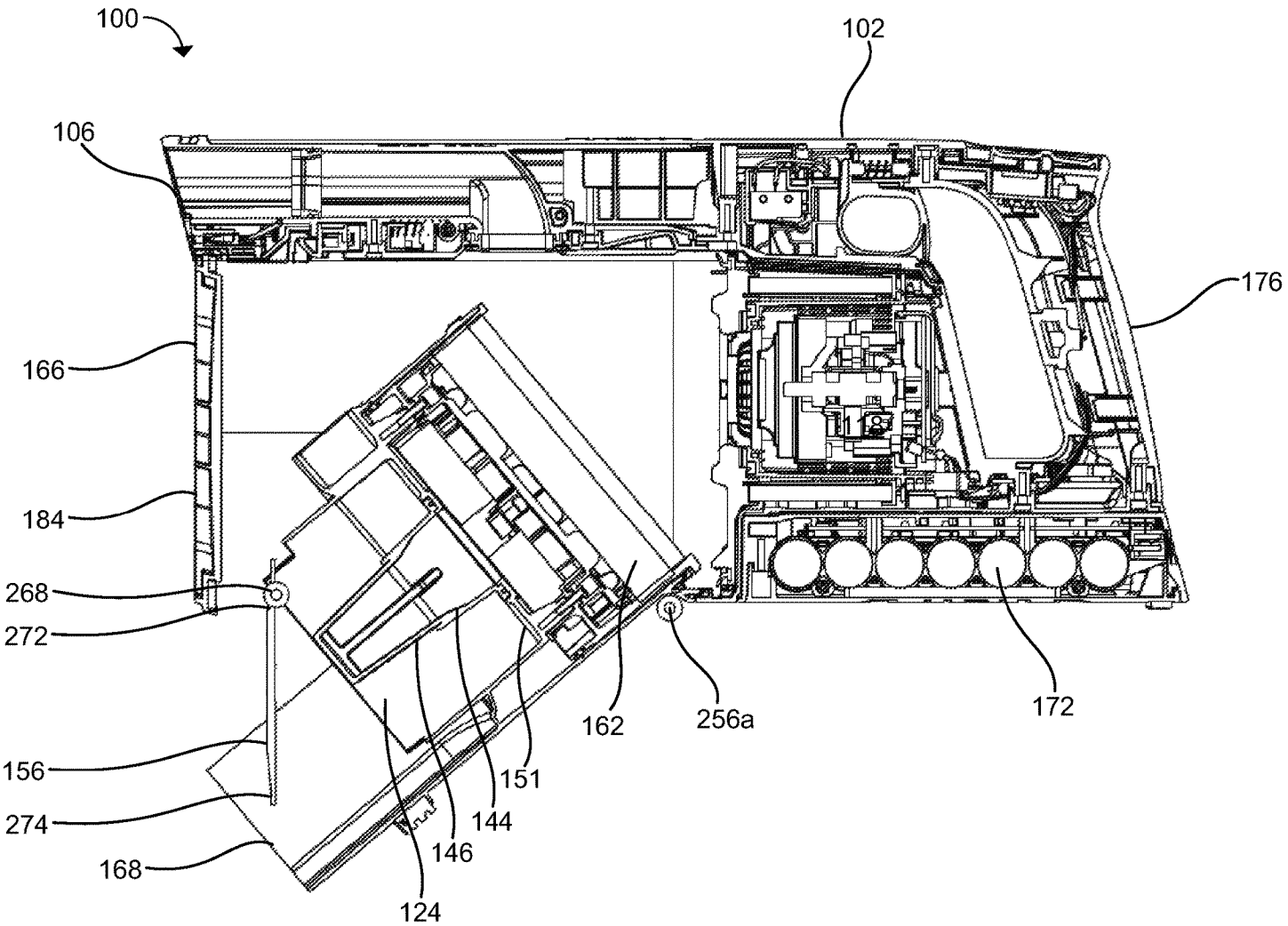
FIG. 17D is a side cross-sectional view of the surface cleaning apparatus of FIG. 17A with the air treatment member of the surface cleaning apparatus in an open position.
Figure 18:
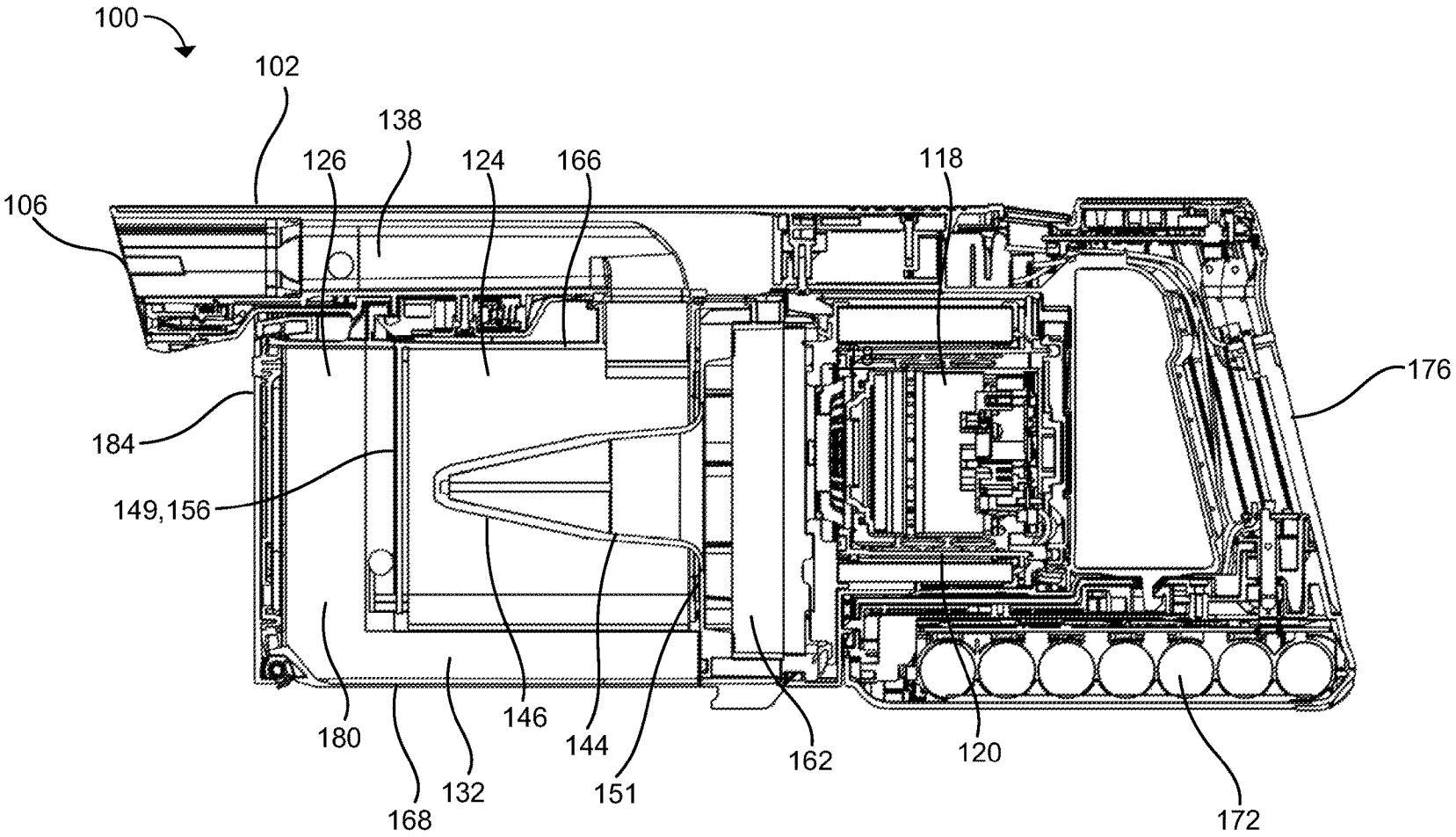
FIG. 18 is a side cross-sectional view of an alternate surface cleaning apparatus with an air treatment member of the surface cleaning apparatus in a closed position.

In some embodiments, the plate 156 may be moveably mounted to the moveable portion 168 between the working and emptying positions described above. FIGS. 17A to 17D show a movement sequence from a working position (FIG. 17A) to an emptying position (FIG. 17D). As exemplified in FIGS. 17A to 17D, plate 156 may move concurrently between the working position (FIG. 17A) and emptying position (FIG. 17D) during movement of the moveable portion 168 between the closed position (FIG. 17A) and open position (FIG. 17D).

Figure 16A:
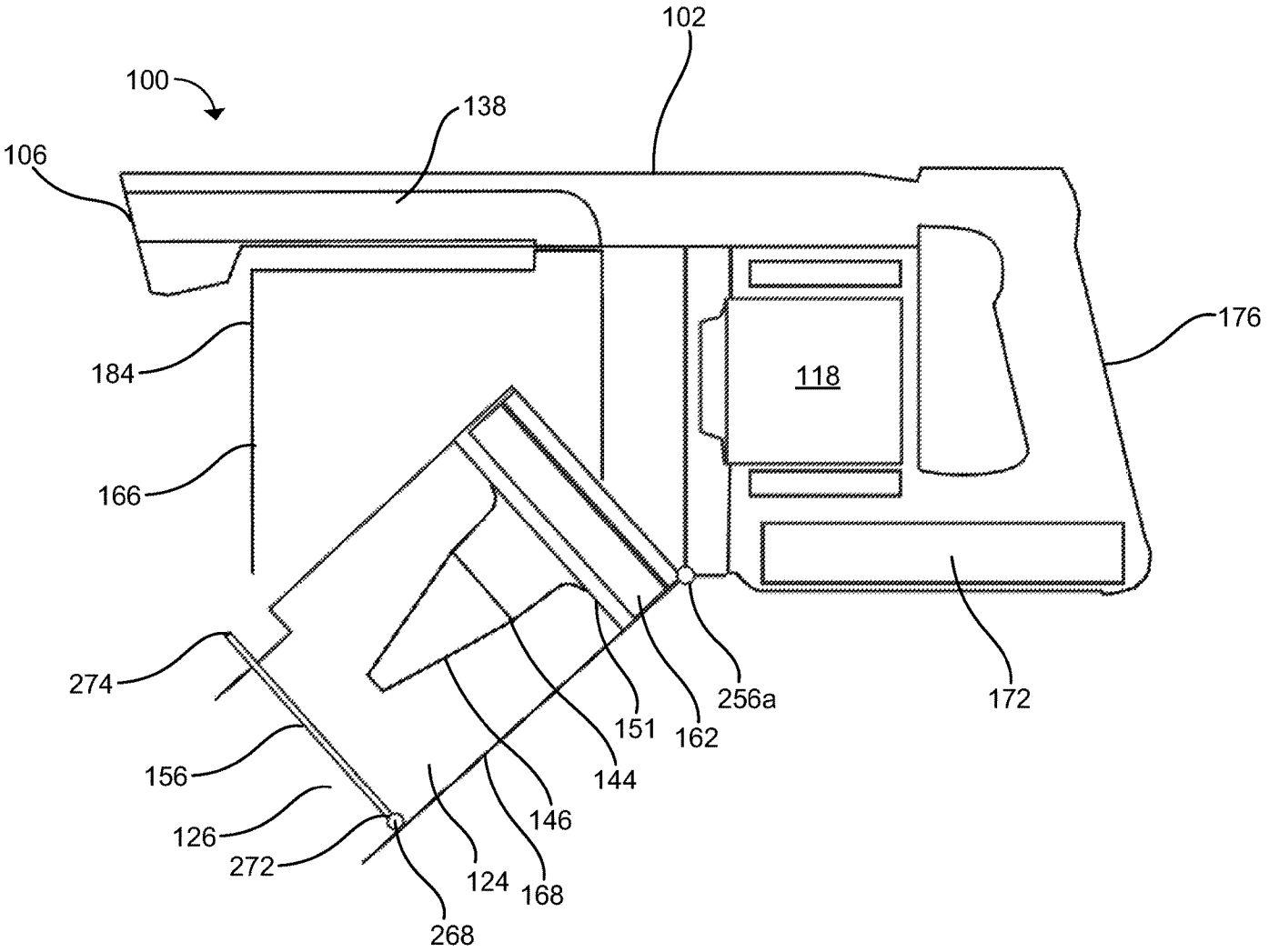
Figure 16B:
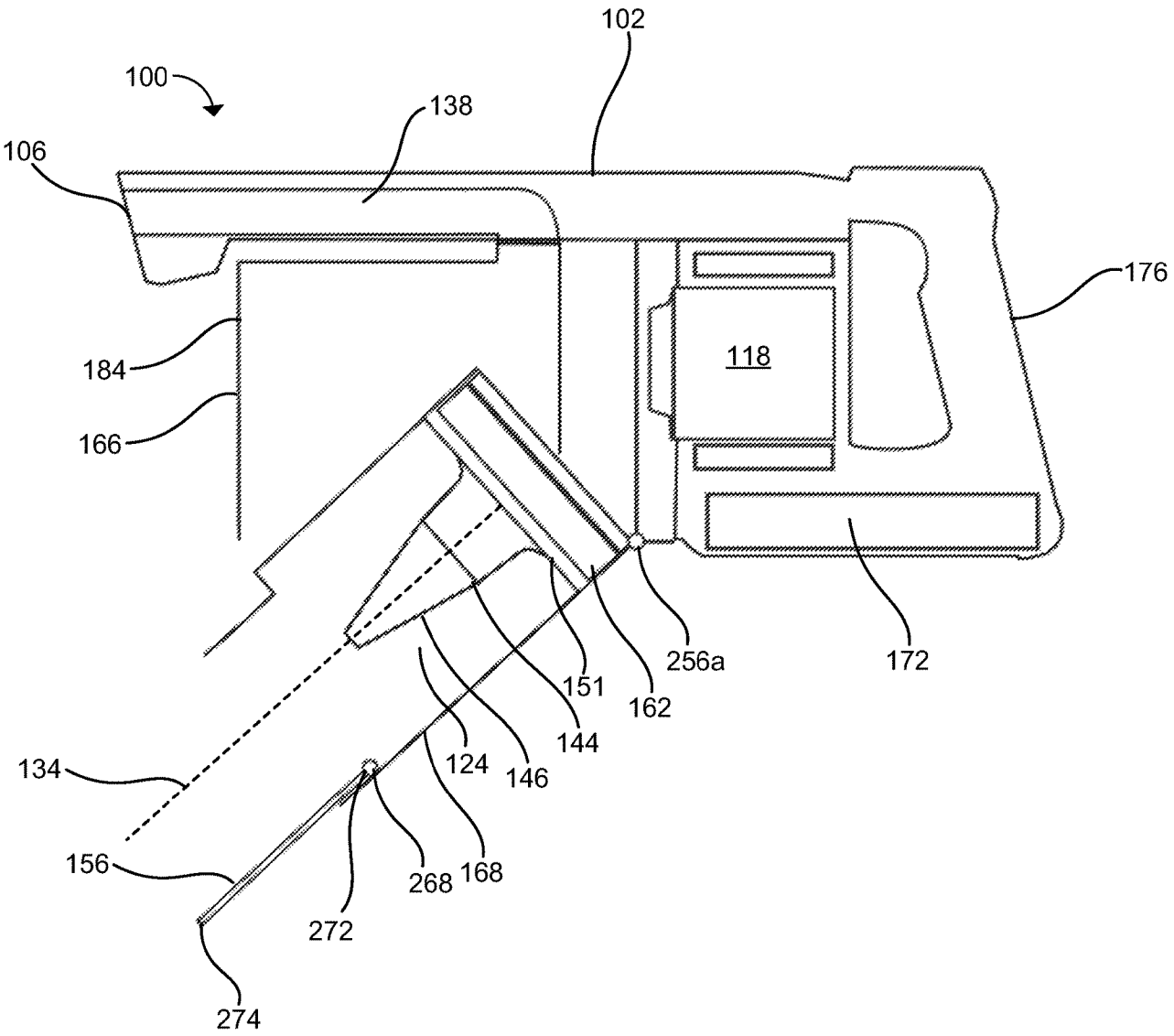

Regardless of whether plate 156 is mounted to the stationary or moveable portion, plate 156 may move automatically or be manually movable between the working and emptying position upon or after moveable portion 168 begins or completes moving from the closed position to the open position. This may prevent dirt held back by arrester plate 156 from spilling before moveable portion 168 has begun, or completed, moving to the open position. FIGS. 16A and 16B show an example in which moveable portion 168 is in the open position and arrester plate 156 is movable between the working position (FIG. 16A) and the emptying position (FIG. 16B).

Any suitable mechanism may be used for movably mounting the plate 156 to moveable portion 168. A first end 272 of the plate 156 may be moveably mounted to the moveable portion 168 and an opposing end 274 of the plate 156 may move relative to moveable portion 168. For example, as illustrated in FIGS. 16A to 17D, first end 272 of plate 156 may be pivotally mounted at hinge 268 to moveable portion 168 and opposing end 274 may move away from second end wall 151 of air treatment chamber 124 when plate 156 moves with relation to moveable portion 168 from the working position toward the emptying position. When moveable portion 168 is in the working position, air treatment chamber axis 134 may extend through the plate 156. As illustrated in FIG. 16B, when moveable portion 168 is in the emptying position, the plate 156 may be oriented generally parallel to air treatment chamber axis 134. Alternatively, plate 156 may not be moveably mounted to the moveable portion 168. This may reduce manufacturing cost and complexity, and may improve the structural integrity and reliability of plate 156.

Referring now to FIGS. 18 to 21, the moveable portion 168 may include a portion 284 of sidewall 132 of air treatment chamber 124 and a portion 288 of sidewall 180 of dirt collection chamber 126. This may improve the dirt transferal air flow and/or user access to interiors of air treatment chamber 124 and dirt collection chamber 126 for emptying.

Figure 19:
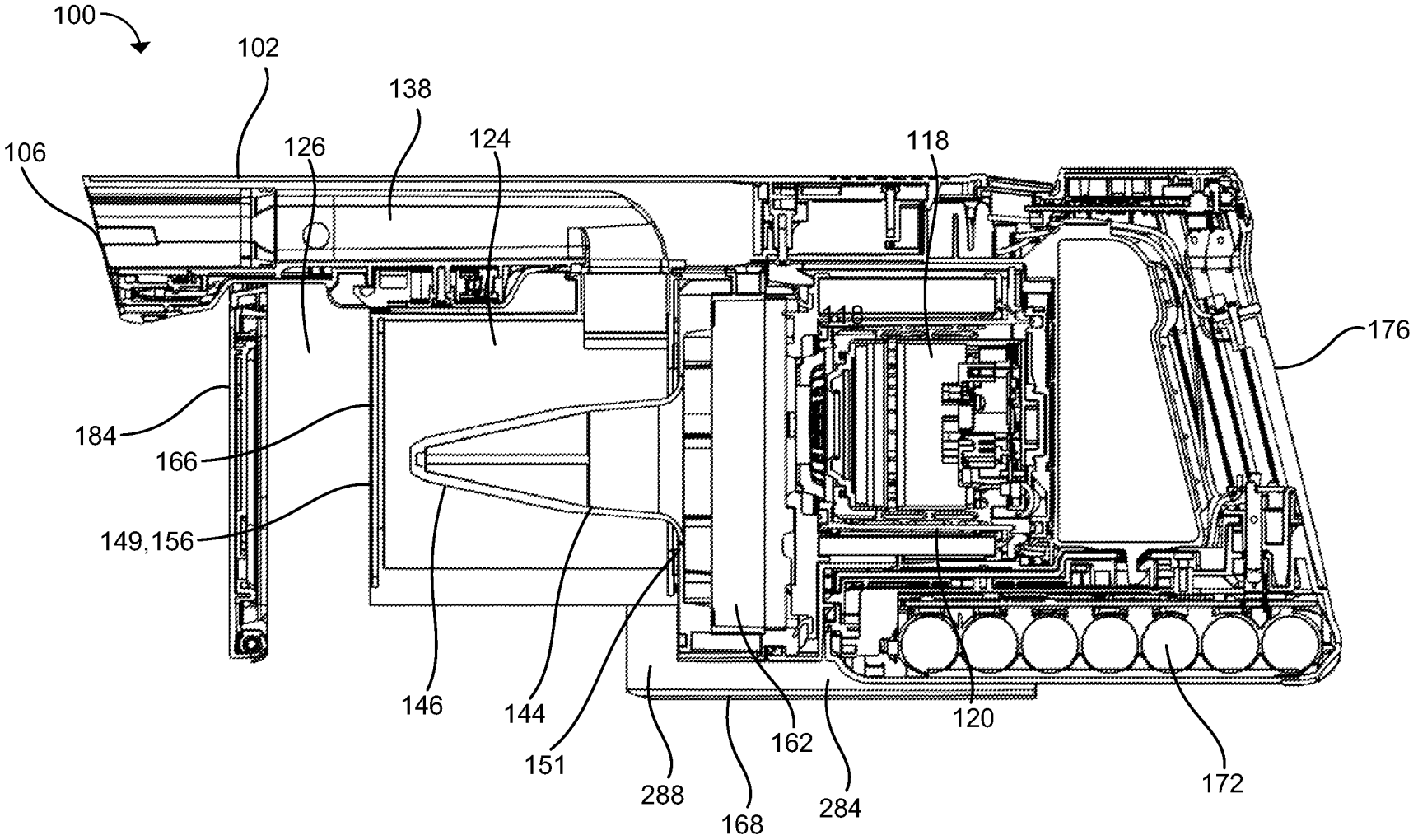
FIG. 19 is a side cross-sectional view of the surface cleaning apparatus of FIG. 18 with the air treatment member of the surface cleaning apparatus in an open position.

A translational mount 256*b* (FIGS. 20 and 21) may be used to axially translate the moveable portion 168 between an open position and a closed position. The translational motion may be in a forward direction (FIGS. 20 and 21) or in a rearward direction (FIG. 19). As illustrated in FIG. 19, when the translational motion is in the rearward direction, air treatment chamber sidewall portion 284 and/or dirt collection chamber sidewall portion 288 may overlie suction motor housing 120 which houses suction motor 118. The docking interface can be sized to accommodate the translation movement and in the docked position, the sealing interface can maintain a closed volume when the moveable portion 168 translates into the open position and moves into the closed volume. The opening created by the translation movement can enable removal of dirt held by one or more dirt collection chambers and/or filters of surface cleaning apparatus 100.

Still referring to FIG. 19, air treatment chamber sidewall portion 284 may include the section of sidewall 132 which extends between first end wall 149 and second end wall 151 of air treatment chamber 124. Portion 284 may include any suitably sized portion of sidewall 132. A smaller portion 284 may enable a more compact design of the docking interface to accommodate the moveable portion 168. A larger portion 284 may enable a larger opening and provide less backpressure to the dirt transferal air flow. In some embodiments, portion 284 may include all of sidewall 132. The example illustrated in FIG. 19 shows sidewall portion 284 that extends from first end wall 149 to second end wall 151.

Dirt collection chamber sidewall portion 288 may include the section of dirt collection chamber sidewall 180 which extends between the first end wall 184 of dirt collection chamber 126, and the plate 156. Portion 288 may include any suitably sized portion of sidewall 180. A smaller portion 288 may enable a more compact design of the docking interface to accommodate the moveable portion 168. A larger portion 288 may enable a larger opening and provide less backpressure to the dirt transferal air flow. In some embodiments, portion 288 may include all of sidewall 180.

Moveable portion 168 may include any suitable combination of portions 284 and 288. For example, moveable portion 168 may include a portion 284 that includes all of sidewall 132 and a portion 288 that is a section of sidewall 180 which extends between first end wall 184 and plate 156. As another example, moveable portion 168 may include a portion 284 that includes a section of sidewall 132 that extends between first end wall 149 and second end wall 151 and a portion 288 that includes all of sidewall 180. The example illustrated in FIG. 19 shows moveable portion 168 that includes all of sidewall 132 and all of sidewall 180.

Figure 20:
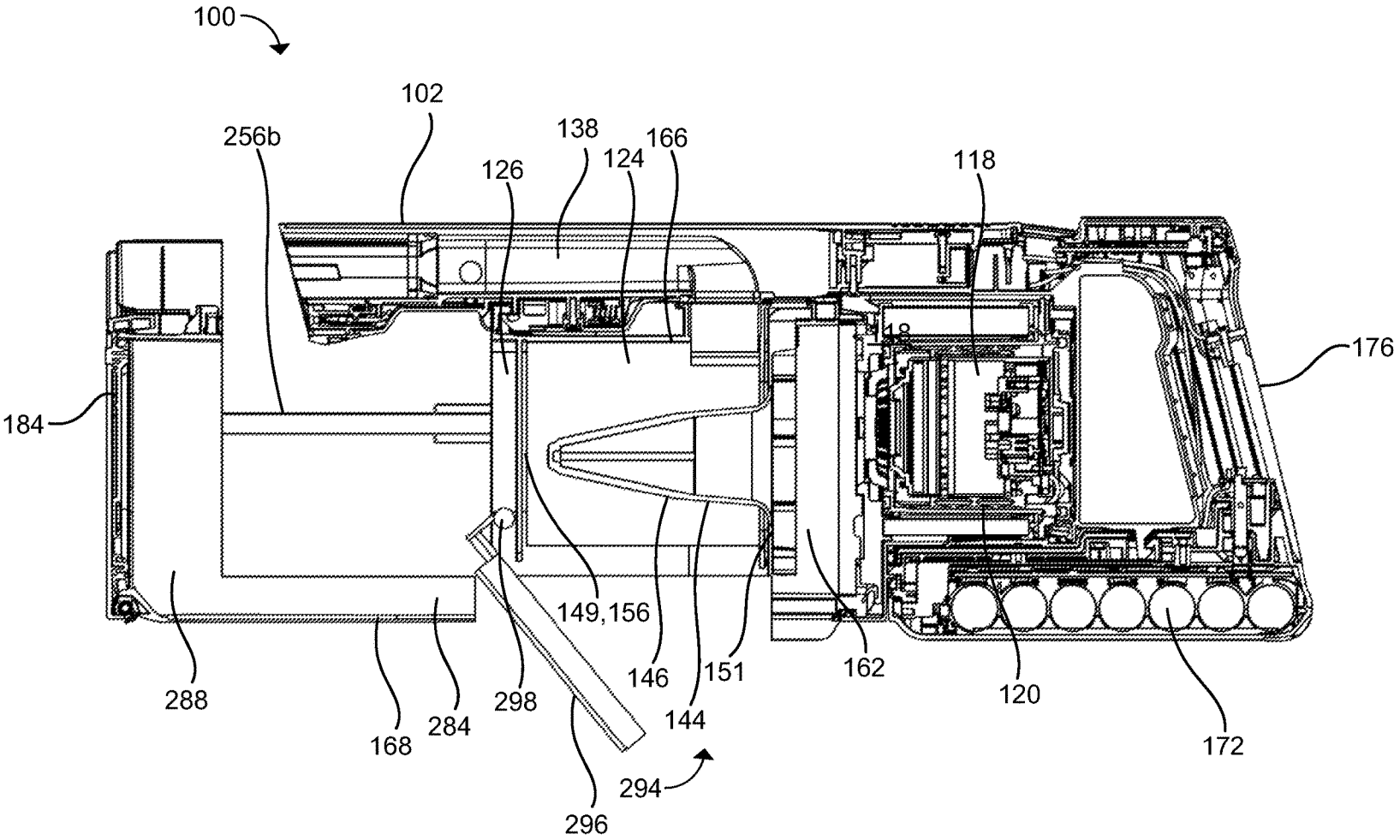
FIG. 20 is a side cross-sectional view of an alternate surface cleaning apparatus with an air treatment member in an open position.
Figure 21:
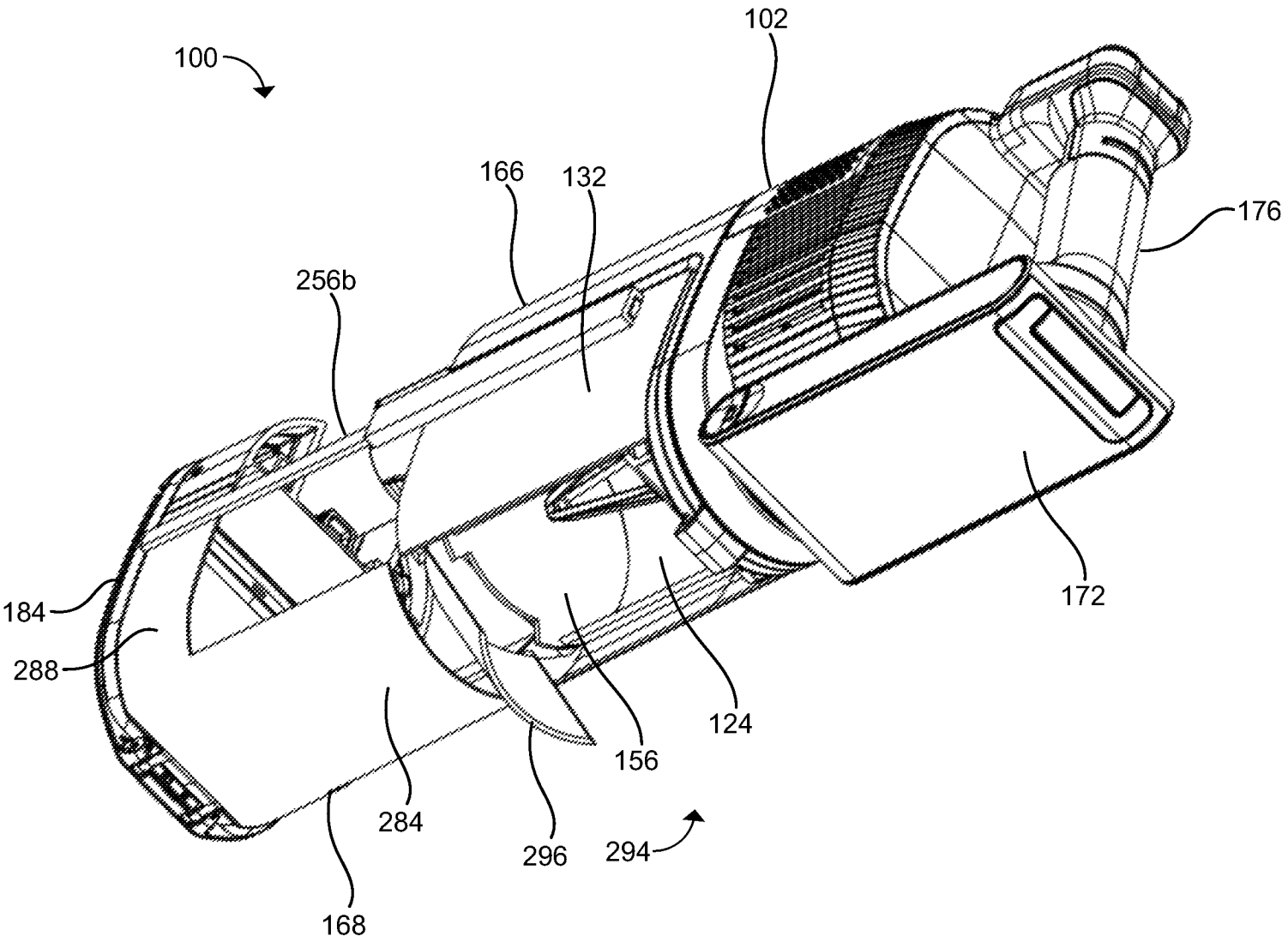
FIG. 21 is a perspective view of the surface cleaning apparatus of FIG. 20.

Referring to FIGS. 19 to 21, in some embodiments, the stationary portion 166 may include the first end wall 149 (which may be a plate 156 as shown). The moveable portion 168 may be moveable relative to first end wall 149/plate 156. The first end wall 149/plate 156 may remain stationary as the moveable portion 168 commences and completes axial translation movement from the closed position to the open position. This may reduce manufacturing complexity. In other embodiments, the moveable portion 168 may include the plate 156. This may provide greater access to internal components of air treatment chamber 124 and/or reduce backpressure in the dirt transferal flow (in the docked position).

Referring to FIG. 19, in some embodiments, the stationary portion 166 may include the first end wall 184 of dirt collection chamber 126. As shown, the moveable portion 168 may be moveable relative to first end wall 184. The first end wall 184 may remain stationary as the moveable portion 168 commences and completes axial translation movement from the closed position to the open position. As exemplified in FIGS. 20 and 21, the moveable portion 168 may include the first end wall 184 of dirt collection chamber 126.

In some embodiments, a portion 296 of sidewall 132 of air treatment chamber 124 may be independently moveable with respect to the moveable portion 168. For example, as illustrated in FIGS. 20 and 21, portion 296 may be a lower portion of sidewall 132 that opens downwardly through opening 294 formed at a rear end of moveable portion 168 in the open position. Portion 296 may be automatically closed when moveable portion 168 is moved from the open position to the closed position. Portion 296 may move between open and closed positions by any suitable mechanism. As exemplified in FIGS. 20 and 21, portion 296 may rotate between open and closed positions using a hinge 298. The opening of portion 296 may provide greater user access to mesh screen 146 for dirt removal.

It will be appreciated that the moveable plate may be used by itself, e.g., without the use of a docking station. If the moveable plate is used with a docking station, then the closed volume which is produced when the surface cleaning apparatus is docked at the docking station is optionally sized to enable the plate to be moved to the open position.

Auto-Closing Mechanism

In accordance with another aspect of this disclosure, an auto-closing mechanism is provided to close (e.g., prevent) air flow into the air treatment chamber from the dirty air inlet of the surface cleaning apparatus.

In the docked position, a dirt transferal air flow can be generated (e.g., by one or both of the surface cleaning apparatus or the docking station) that travels from the surface cleaning apparatus downstream to the docking station to transfer dirt collected in surface cleaning apparatus (e.g., in one or more dirt collection chambers and/or on one or more filters) to the docking station. The air flow may be generated, for example, by a blowing device of surface cleaning apparatus and/or a suction motor of the docking station. If, during an evacuation operation, air travels from the rear end of the air treatment chamber, through the air treatment chamber into the docking station interface 210, then air entrained into the dirt transferal air flow through the dirty air inlet reduces the air flow forwardly through the air treatment chamber and may thereby reduce the efficiency of the removal of dirt from the air treatment chamber. In such a case, the auto-closing mechanism can improve the dirt transfer efficiency by closing the dirty air inlet. The auto-closing mechanism may be implemented using any suitable mechanism to close air flow at the dirty air inlet or any portion of the inlet conduit. The auto-closing mechanism may be used by itself or in combination with one or more (or all) of the sealing interface, the non-linear interface, the plate configuration, the removable filter and the air treatment member configurations or any other aspect disclosed herein.

The auto-closing mechanism may be actuated during a docking operation, the actuation of an evacuation operation or manually by a user.

Referring now to FIGS. 11B to 11E, the auto-closing mechanism may be implemented using a portion of housing 202 or docking interface 210 of docking station 200. For example, a portion of housing 202 or a portion of wall portions 230 may automatically block dirty air inlet 106 when surface cleaning apparatus 100 is docked to docking station 200, and may unblock dirty air inlet 106 when surface cleaning apparatus 100 is undocked from docking station 200.

In the example illustrated in FIG. 11B, a portion 304 of housing 202 blocks dirty air inlet 106 when surface cleaning apparatus 100 is docked to docking station 200. For example, portion 304 may be a closed recess in the docking station interface 210. When docked, dirty air inlet may abut the facing wall of recess, which may optionally have a resilient member provided thereon. Alternately, or in addition, a sealing member (e.g., an O-ring) may be provided on the sidewall of the recess. The O-ring may engage the sidewall of the inlet conduit when the surface cleaning apparatus is docked.

Alternately, or in addition, the auto-closing mechanism may be a moveable sealing member that is part of the surface cleaning apparatus and/or the docking station.

Figure 11C:
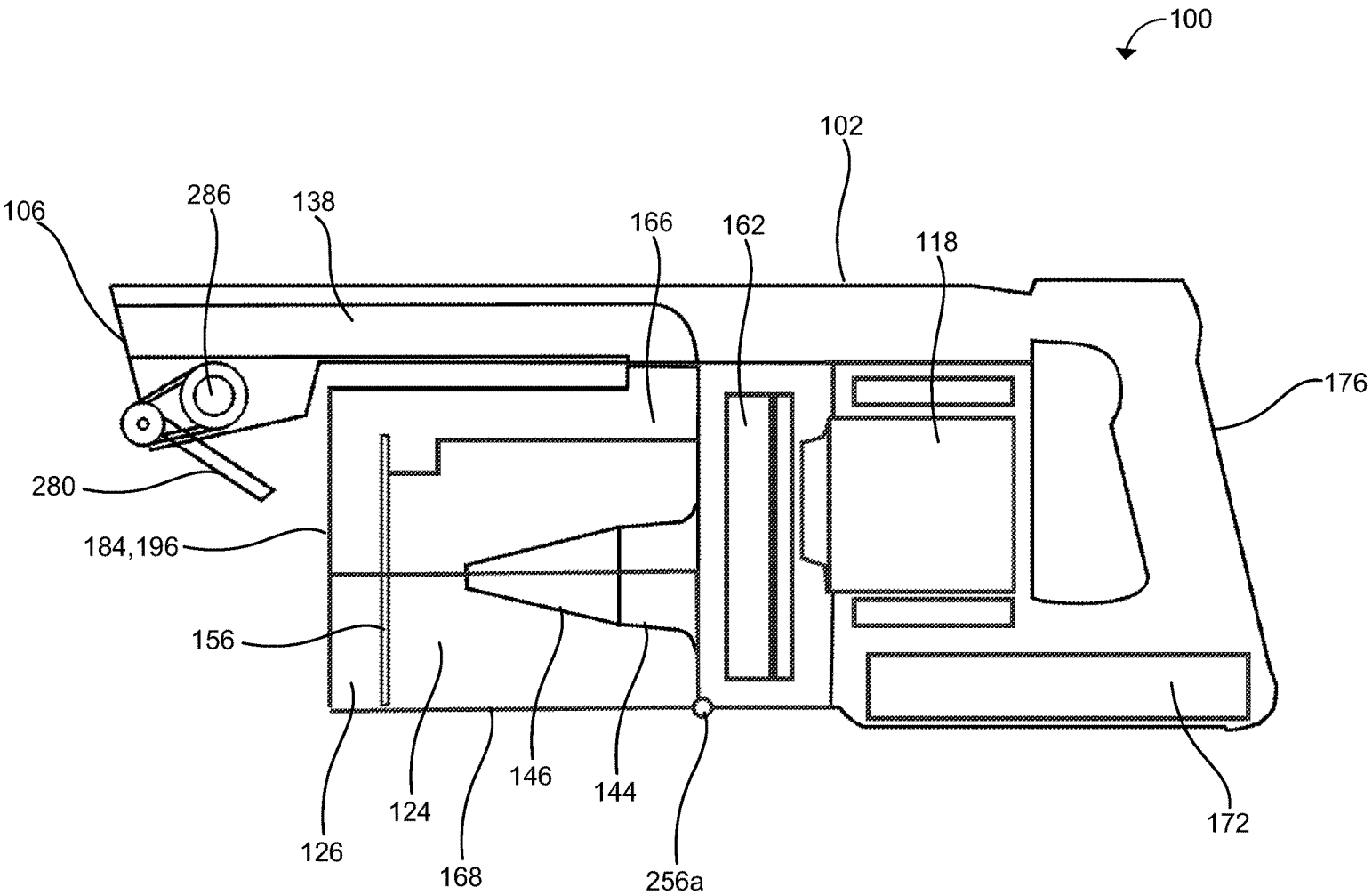
FIG. 11C is a side cross-sectional view of an alternate surface cleaning apparatus with a nozzle sealing member of the surface cleaning apparatus in an open position.
Figure 11D:
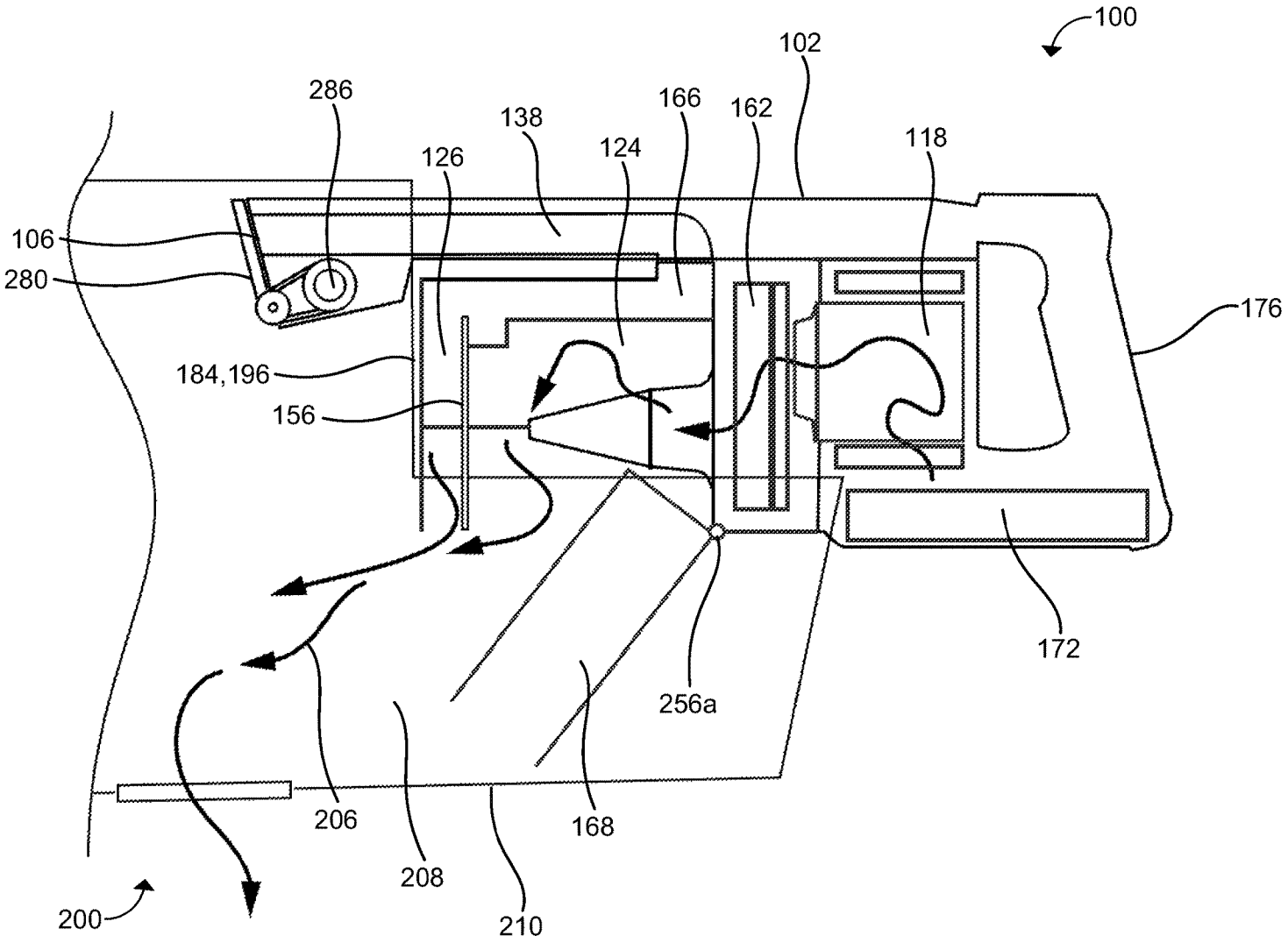
FIG. 11D is a side cross-sectional view of the surface cleaning apparatus of FIG. 11C docked to the docking station of FIG. 2 with the nozzle sealing member of the surface cleaning apparatus in the closed position, in accordance with an embodiment.
Figure 11E:
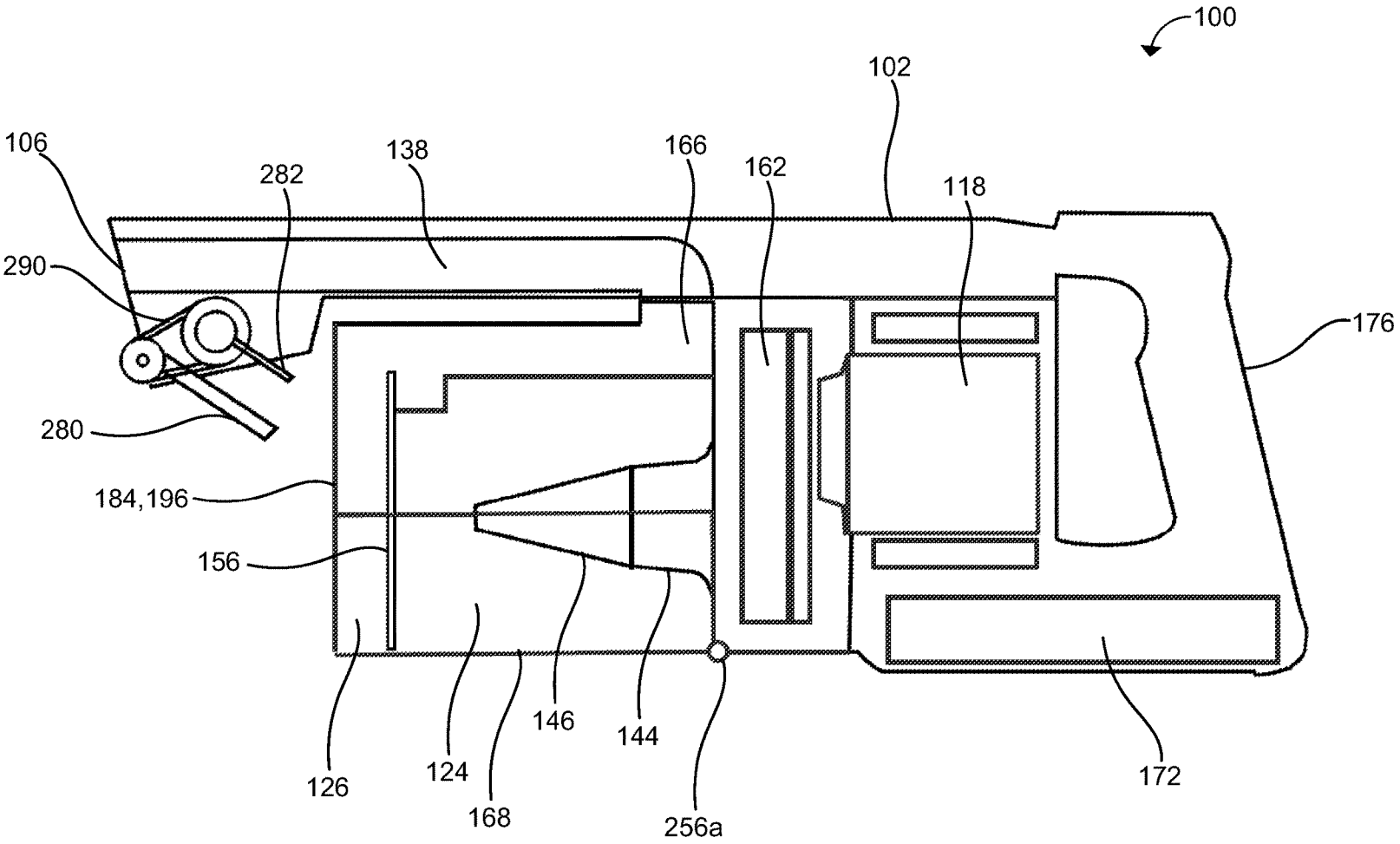
FIG. 11E is a side cross-sectional view of a surface cleaning apparatus with an alternate nozzle sealing member of the surface cleaning apparatus in an open position.

As exemplified in FIGS. 11C to 11E, a sealing member 280 (e.g., a flap) is moved to close dirty air inlet 106, or any portion of inlet conduit 138, when air treatment chamber 124 is opened for emptying. For example, a user may push a button (e.g., button 276 shown in FIG. 4A) to actuate movement of the moveable portion 168 to open air treatment chamber 124 for emptying. Button 276 may also actuate movement of the sealing member 280 to close air flow from dirty air inlet 106 into air treatment chamber 124.

Button 276 may activate an electronic switch that triggers an electromechanical opening device 286 (e.g., motor or solenoid) to move the sealing member 280 to the closed position (FIG. 11D) when, e.g., the button 276 is pressed and/or when surface cleaning apparatus 100 is docked, and to move the sealing member 280 to the open position (FIG. 11C) after button 276 is released and/or upon undocking surface cleaning apparatus 100.

As exemplified in FIG. 11E, a user may manually actuate movement of sealing member 280 using a lever 282 or lever may be moved during the docking operation. A mechanical connection 290 between lever 282 and the sealing member 280 may cause the sealing member 280 to move between an open position and a closed position when lever 282 is actuated.

Axially Translatable Air Treatment Chamber Sidewall

In accordance with another aspect of this disclosure, the moveable portion of the air treatment member may be part or all of an air treatment chamber sidewall that is axially translatable.

When the moveable portion is axially translated to the open position, dirt collected in one or more dirt collection chambers or regions of a first stage air treatment chamber and/or one or more dirt collection chambers or regions of a second stage air treatment chamber can be removed (e.g., transferred to a docking station).

In some examples, the dirt collected in the dirt collection chamber(s) or region of the second stage air treatment chamber(s) may first be transferred to the first stage air treatment chamber and/or first stage dirt collection chamber. This can allow dirt from both stages to be emptied by opening only the first stage air treatment chamber and/or first stage dirt collection chamber.

In other examples, in the open position, both the first and second stage air treatment chambers and/or first and second dirt collection chambers may be concurrently opened to remove/transfer collected dirt from both stages.

An axially translatable sidewall may be used by itself or in combination with one or more (or all) of the sealing interface, the non-linear interface, the plate configuration, the auto-closing mechanism, the removable filter, and the other air treatment member configurations or any other aspect disclosed herein.

Figure 22:
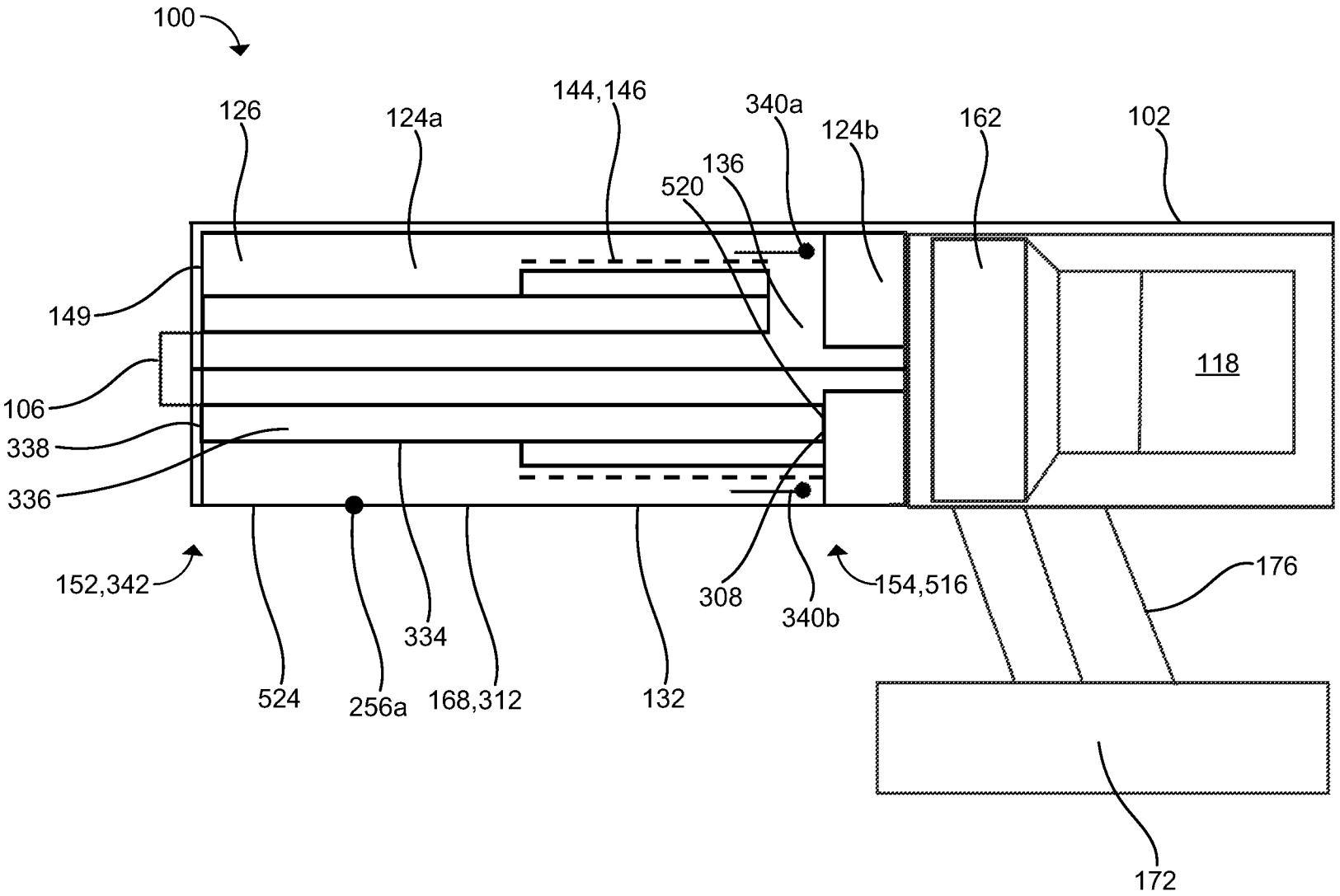
FIG. 22 is a side cross-sectional view of an alternate surface cleaning apparatus with an axially translatable portion of an air treatment chamber sidewall of the surface cleaning apparatus in a closed position.

Referring now to FIGS. 22 to 24, surface cleaning apparatus 100 may include first stage air treatment chamber 124*a*, second stage air treatment chamber 124*b*, and a second stage dirt collection chamber 336 that is positioned radially inwardly of first stage air treatment chamber 124*a*. Dirt collection chamber 336 may include a first end 342 having a first end wall 338 and an axially opposed second end 516 having a second end wall 520. Dirt collection chamber 336 may include a sidewall 334 extending between first end wall 338 and second end wall 520. Dirt collection chamber 336 may be in communication with second stage air treatment chamber 124*b* through a dirt outlet 308.

The moveable portion 168 may include an axially translatable portion 312 of sidewall 132 that can be translated between a closed position (FIG. 22) and an open position (FIGS. 23A to 24B) in which an opening 314 is created that connects first stage air treatment chamber 124*a* and dirt collection chamber 336 in fluid flow communication. Dirt collected in dirt collection chamber 336 may be transferred to first stage air treatment chamber 124*a* through opening 314. The translation movement can be in a forward or a rearward direction.

In the illustrated examples, the moveable portion 168 translates in a forward direction to move from the closed position (FIG. 22) to the open position (FIGS. 23A to 24B). In the closed position, first end 152 and second end 154 of air treatment chamber 124*a*, and first end 342 and second end 516 of dirt collection chamber 336 may be closed (FIG. 22). As exemplified in FIGS. 23A to 24B, in the open position, first end 152 of air treatment chamber 124*a* may remain closed and second end 154 of air treatment chamber 124*a* may be opened. Accordingly, if the dirt air treatment assembly faces downwardly, then dirt may fall out of second stage dirt collection chamber 336 to the first end wall 149.

The docking interface 210 (FIG. 2) can be sized to accommodate the translation movement and in the docked position, the sealing interface 224 (FIG. 3A) can maintain a closed volume when the moveable portion 168 translates into the open position and moves within the closed volume.

Figure 23A:
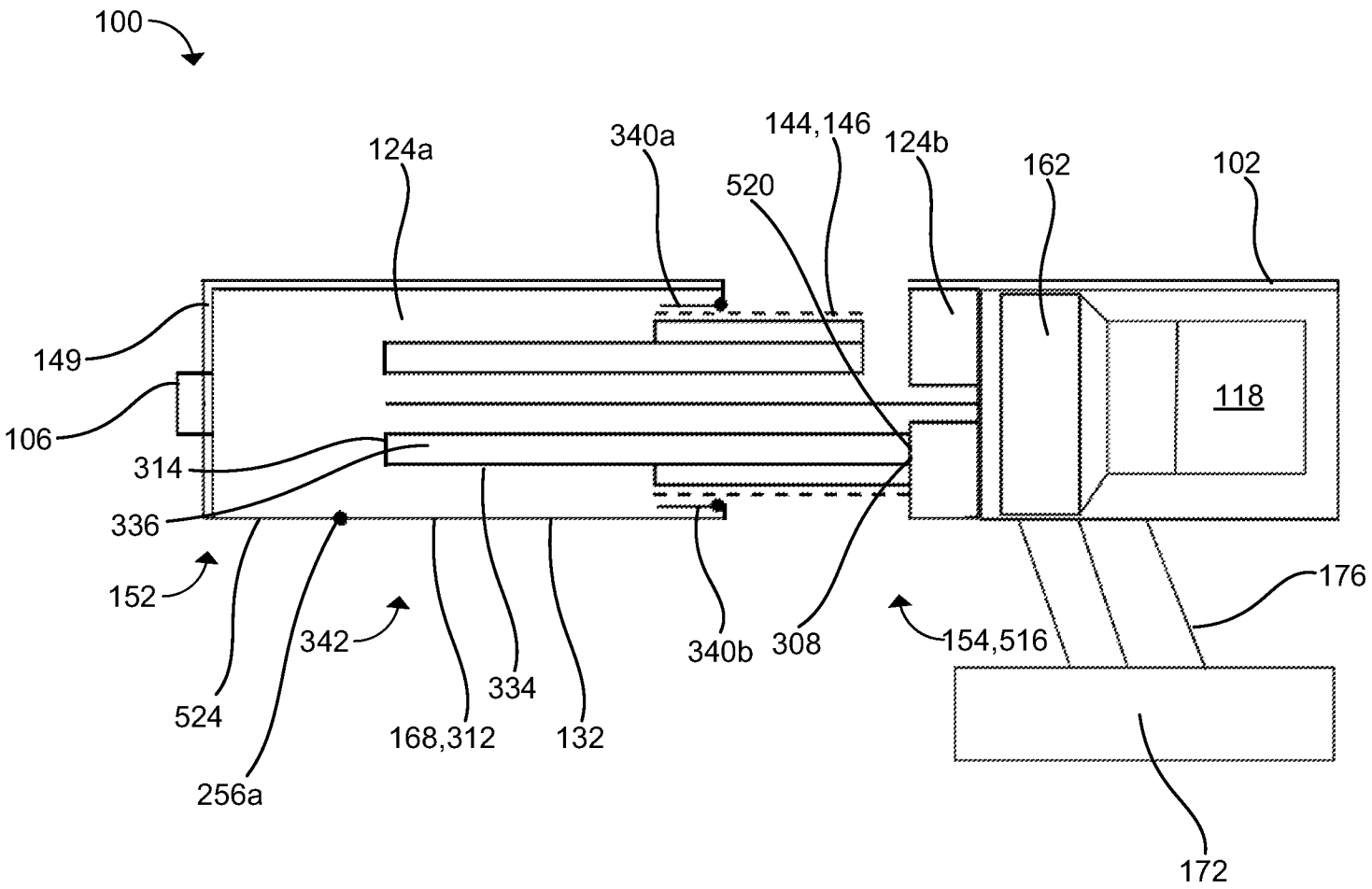
FIG. 23A is a side cross-sectional view of the surface cleaning apparatus of FIG. 22 with the axially translatable portion in an open position and a door portion of the air treatment chamber sidewall in a closed position.

As exemplified in FIGS. 22 and 23A/B, collected dirt from both air treatment chambers 124*a* and 124*b* may be concurrently removed. The axially translatable portion 312 may first be moved from a closed position (FIG. 22) to an open position (FIG. 23A). This may create an opening 314. Wipers 340 (if present) may be moved from a retracted position (FIG. 22) to an extended position (FIG. 23A). The wipers 340 can enable cleaning of vortex finder 144 by pushing away dirt collected on mesh screen 146 of vortex finder 144. The opening 314 may enable dirt collected in dirt collection chamber 336 to be transferred to first stage air treatment chamber 124*a*. Subsequently, a door portion 524 of sidewall 132 may be opened (e.g., translated or rotated) to create an opening 528 (see, e.g., FIG. 23B). Door portion 524 may be positioned at any suitable location, e.g., along sidewall 132. For example, door portion 524 may be located at a first end 152 of air treatment chamber 124*a*.

Door portion 524 may be moved in any direction that provides an opening and may be actuated prior to, during or subsequent to the axial movement of the sidewall portion.

Figure 23B:
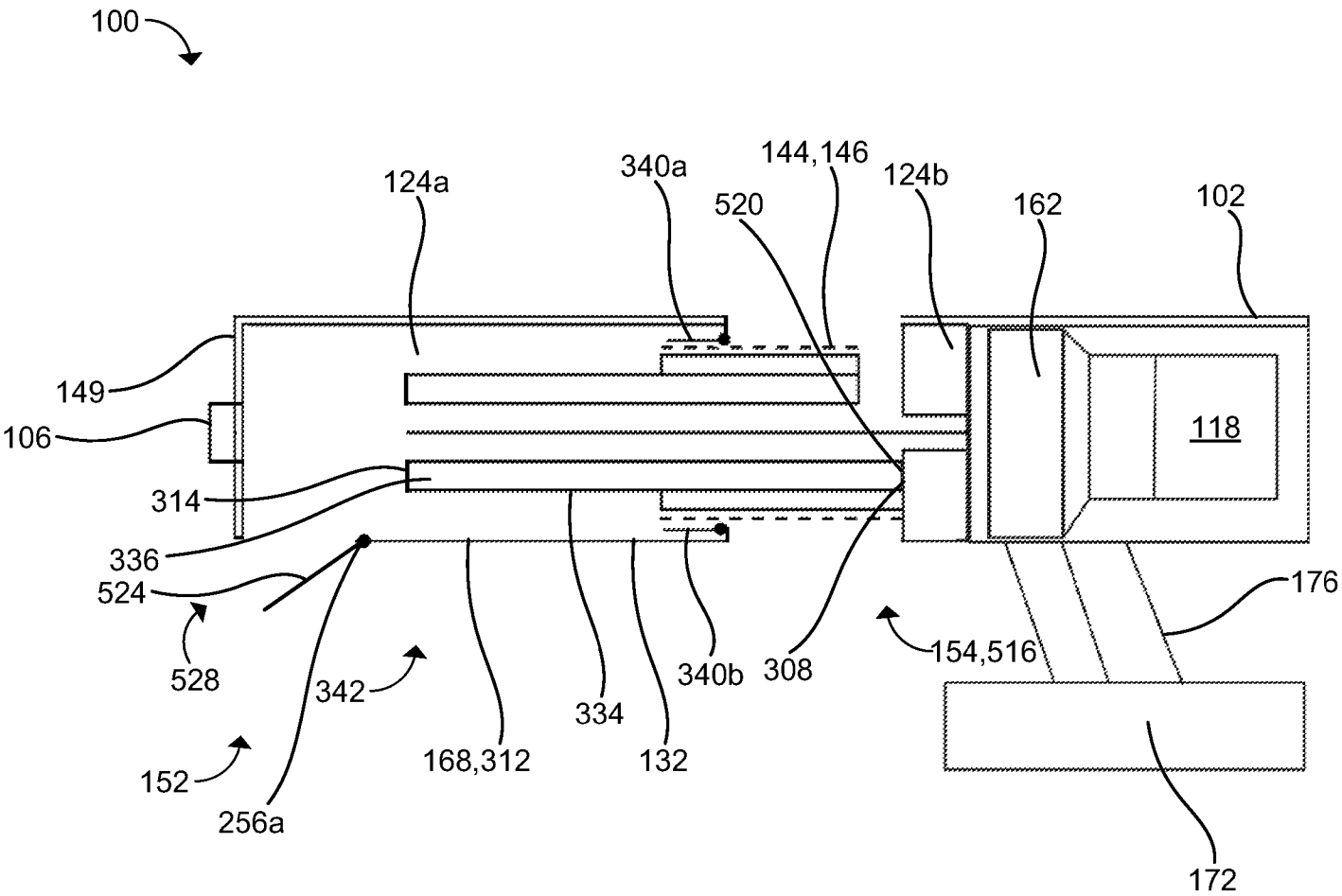
FIG. 23B is a side cross-sectional view of the surface cleaning apparatus of FIG. 23A with the door portion in an open position.

In the example illustrated in FIG. 23B, door portion 524 is moved open using a mount 256*a* (e.g. rotated by rotational mount 256*a* as shown, or translated by a translational mount such as a rail) to form an opening 528. Collected dirt from both air treatment chambers 124*a* and 124*b* may be removed through opening 528.

Figure 24A:
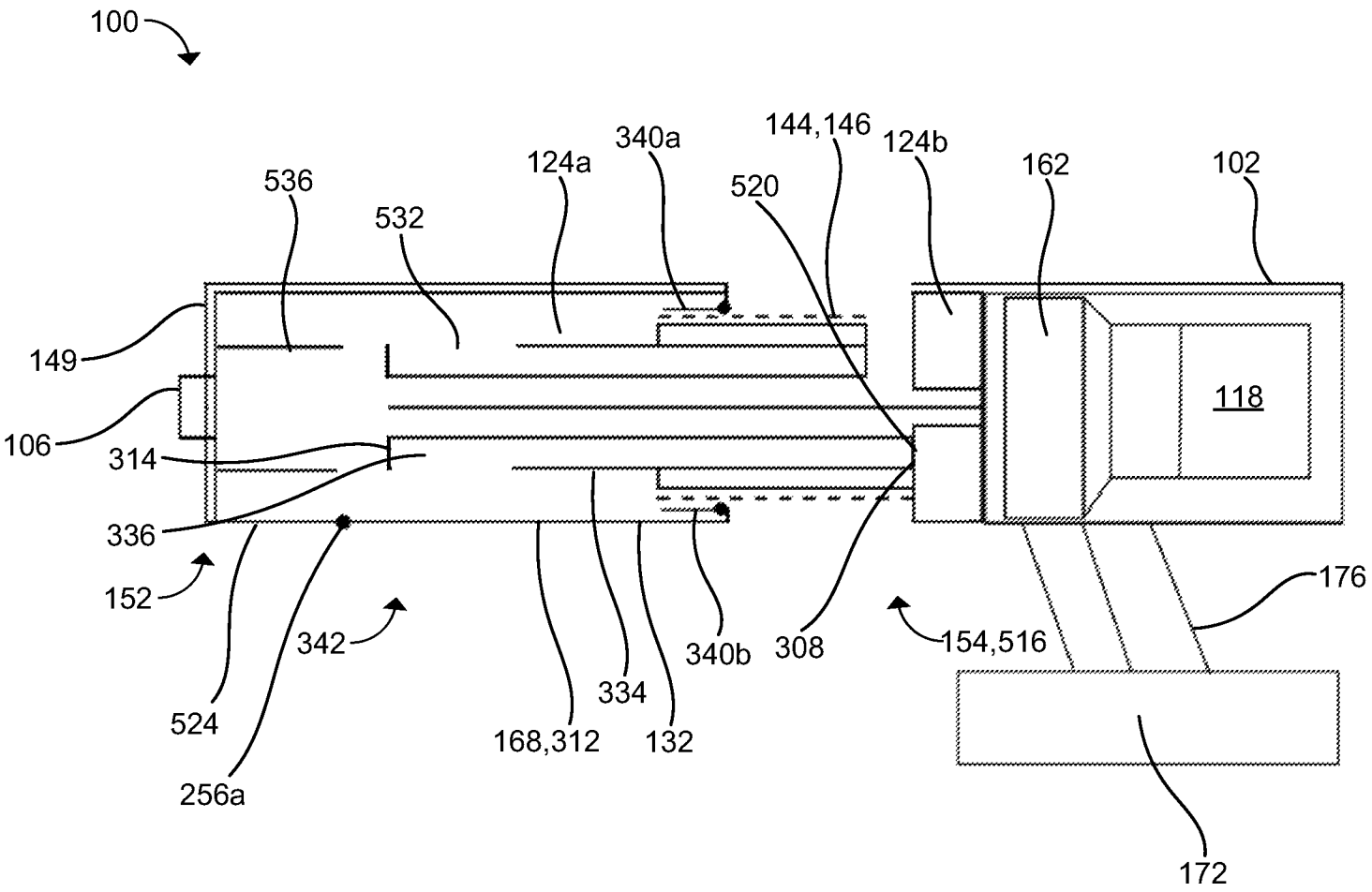
FIG. 24A is a side cross-sectional view of an alternate surface cleaning apparatus with an axially translatable portion of an air treatment chamber sidewall of the surface cleaning apparatus in an open position and a door portion of the air treatment chamber sidewall in a closed position.
Figure 24B:
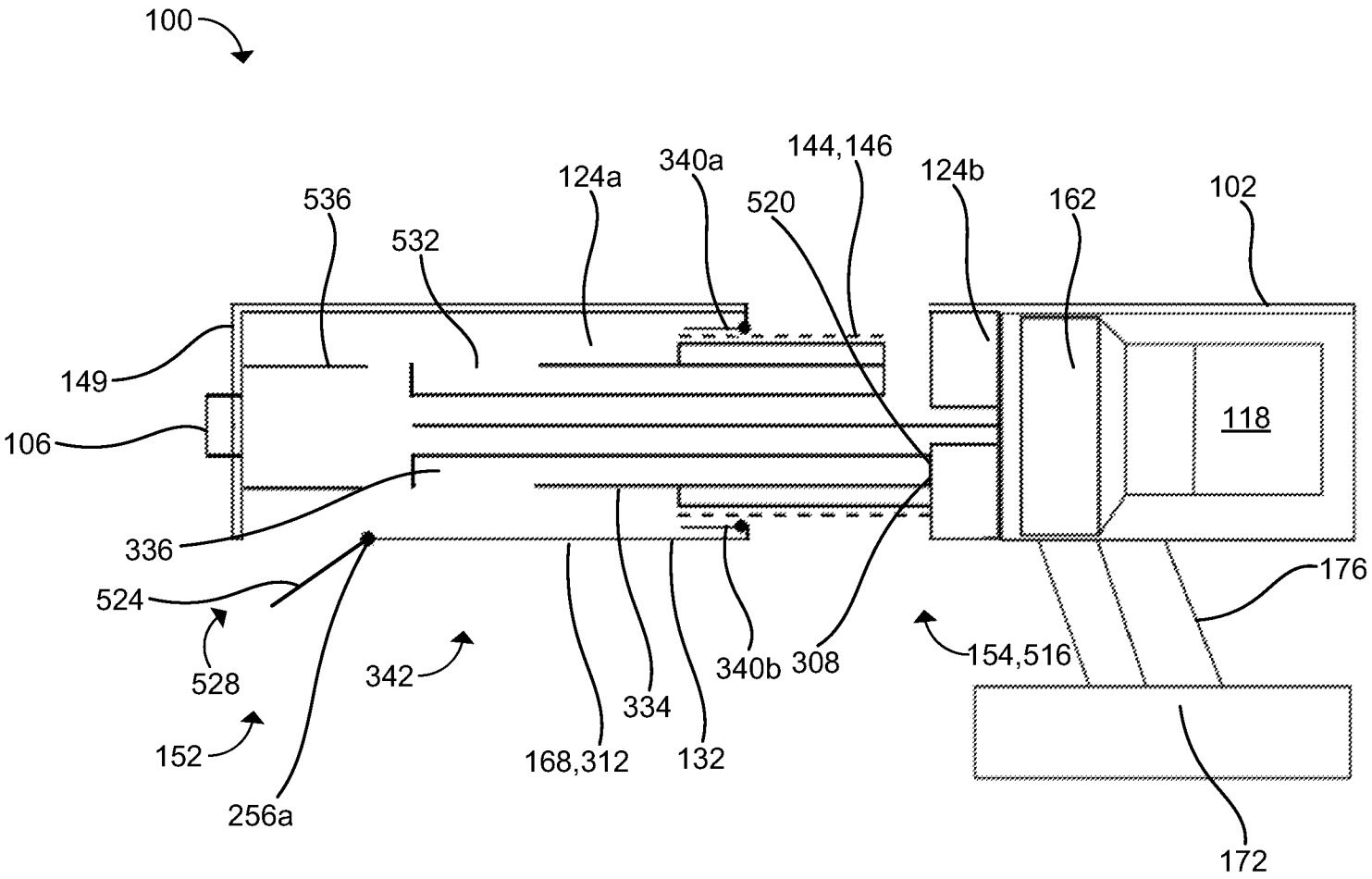
FIG. 24B is a side cross-sectional view of the surface cleaning apparatus of FIG. 24A with the door portion in an open position.

The embodiment of FIGS. 24A and 24B is similar to the embodiment of FIGS. 22 and 23A/B except that the axially translatable portion 312 also includes a portion 536 of sidewall 334 of second stage dirt collection chamber 336. Accordingly, when portion 312 is axially translated from a closed position to an open position, an opening 532 is created. It will be appreciated that portion 536 of sidewall 334 may be any portion of the wall defining the second stage dirt collection chamber 336 and it may be opened prior to, concurrently with or subsequent to door portion 524 opening.

Air Treatment Member with Laterally Moveable Air Treatment Chamber

In accordance with another aspect of this disclosure, the moveable portion of the air treatment member may be part or all of an air treatment chamber that moves laterally between an open position and a closed position.

The laterally moveable portion may be all or part of the sidewall. For example, all of the sidewall may move laterally with or without the front end wall 149. If the front end wall 149 remains stationary, then when the sidewall is translated laterally an open tubular portion may be provided. This may be all or a portion of an air treatment chamber (e.g., a first stage air treatment chamber) and optionally a first stage external dirt collection chamber.

Alternately, only a portion of the sidewall may be moveable laterally. For example, if the openable and stationary portions of the sidewall abut along the longitudinal axis, then, e.g., a generally U-shaped portion of the air treatment assembly may be moved laterally. In such a case, the front wall 149 may be part of the stationary portion and may remain in position. In such a case, e.g., if the suction motor of the surface cleaning apparatus is used, air may be directed forwardly through the vortex fined and through the open air treatment chamber (and optionally an open dirt collection chamber). Air may contact front wall 149 and be deflected into the docking station interface 210.

Accordingly, in the docked position, the moveable portion can move laterally into the docking station and a dirt transferal air flow may be generated. This air flow may enter the rear of the open tubular portion and flow therethrough and out the open front.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

The docking interface 210 (FIG. 2) can be sized to accommodate the lateral (translation) movement and in the docked position, the sealing interface 224 (FIG. 3A) can maintain a closed volume when the moveable portion 168 translates into the open position and moves into the closed volume. The opening 330 (FIGS. 26A to 37) created by the translation movement can enable removal of dirt held by one or more dirt collection chambers and/or filters of surface cleaning apparatus 100.

Referring now to FIGS. 25 to 37, the moveable portion 168 may include a laterally translatable portion 328 of sidewall 132 that can be laterally moved between an open position and a closed position. The stationary portion 166 may include first end wall 149. The lateral movement can be in a direction that is generally transverse to longitudinal axis 148. The lateral movement can be a translation movement in any suitable direction, e.g., upward, downward, sideward movement or a combination thereof.

As exemplified in FIGS. 26A, 27, 30, 31 and 34, the lateral movement may be a downwardly movement. As exemplified in FIGS. 32 and 36, the lateral movement may be an upwardly movement. As exemplified in FIG. 28, the lateral movement may be a diagonal movement where the moveable portion 168 is translated in a direction that is transverse to both axis 148 (and/or central air treatment chamber axis 134) and a plane that is transverse to axis 148 (and/or central air treatment chamber axis 134). In the illustrated example, the moveable portion 168 is translated in a forward-and-down direction, which is both transverse to axes 148, 134 and transverse to a plane that is transverse to axes 148, 134 (e.g. a vertical, forward-facing plane).

In some embodiments, the movement of the moveable portion 168 may include an axial movement (along longitudinal axis 148 and/or central air treatment member axis 134) in addition to the lateral movement. The movement can be a single movement (e.g., a diagonal movement) or a combination of sequential movements. For a combination of sequential movements, either of the axial or lateral movements may be performed or started first, followed subsequently by other movements. As exemplified in FIG. 29, the movement may be a combination of a downward movement and a forward movement where the forward movement begins after the downward movement has begun or has completed.

Figure 25:
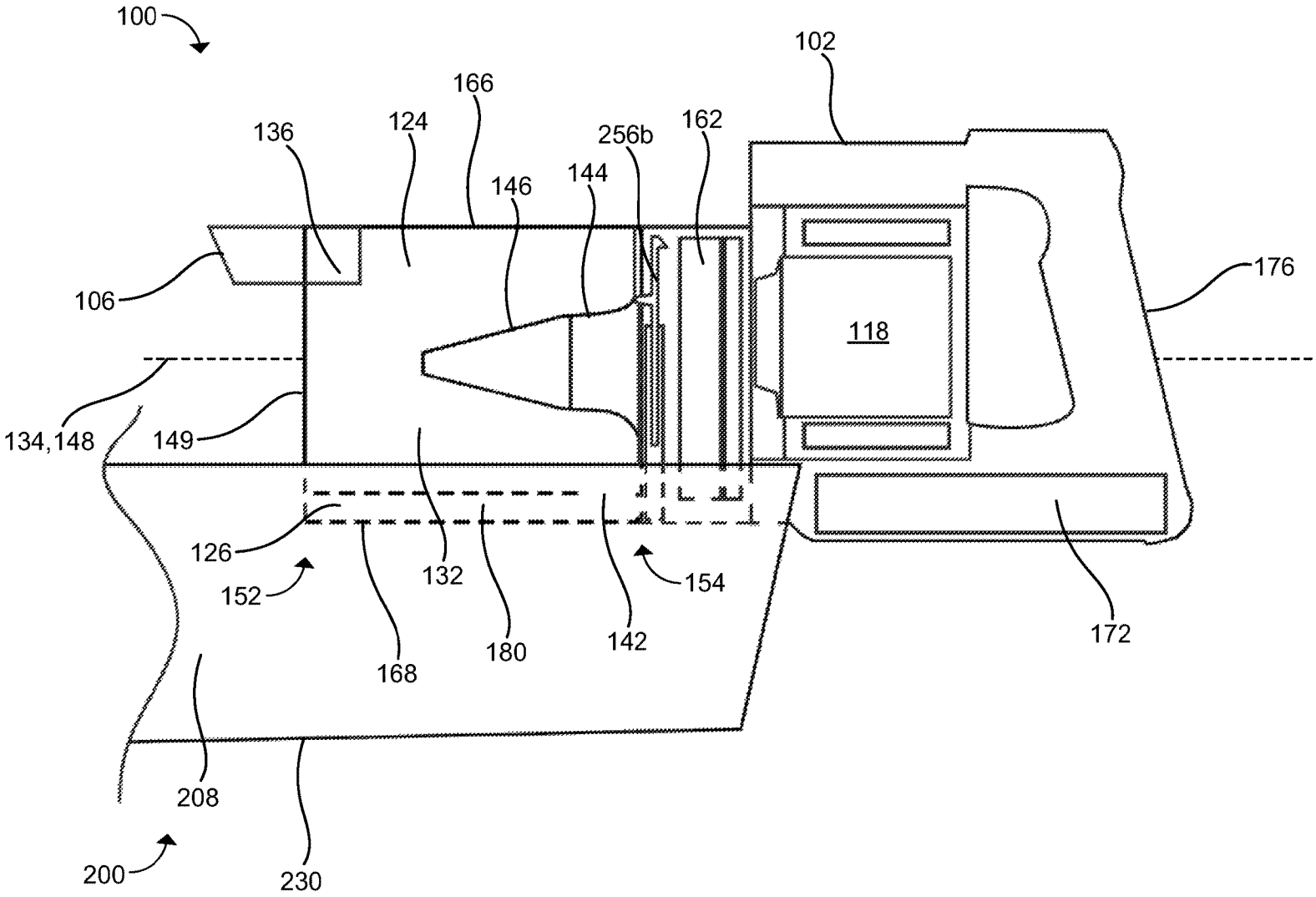
FIG. 25 is a side cross-sectional view of an alternate surface cleaning apparatus docked to the docking station of FIG. 2 with an air treatment member of the surface cleaning apparatus in a closed position.
Figure 26A:
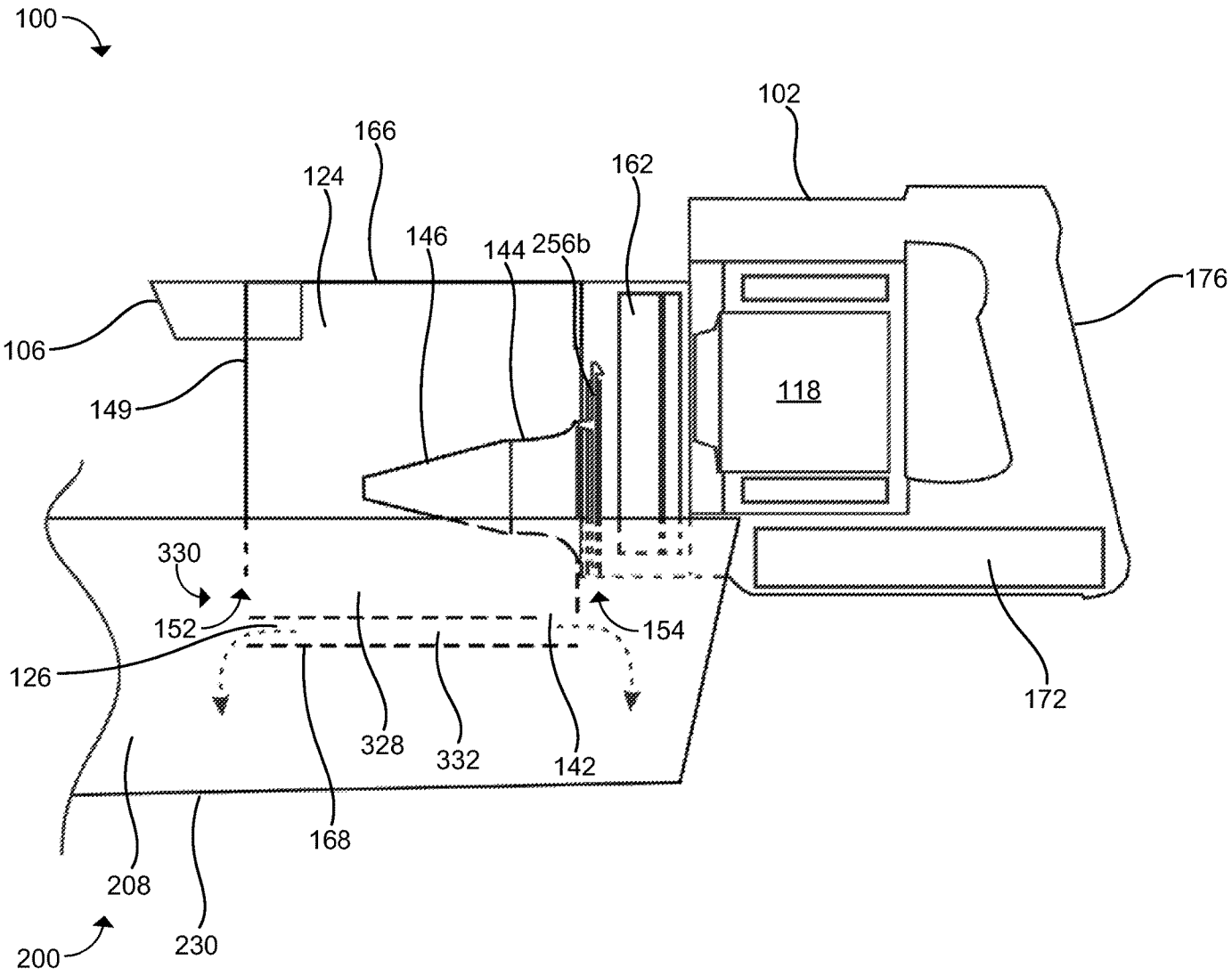
FIG. 26A is a side cross-sectional view of the surface cleaning apparatus of FIG. 25 with the air treatment member of the surface cleaning apparatus in an open position.

As exemplified in FIGS. 25 and 26A, second end 154 of air treatment chamber 124 may be closed when moveable portion 168 is in the closed position and second end 154 may be opened when moveable portion 168 moves to the open position. For example, moveable portion 168 may not include second end wall 151. In other examples, second end 154 may remain closed when moveable portion 168 moves to the open position. For example, moveable portion 168 may include second end wall 151 to which the vortex finder may be attached.

Figure 37A:
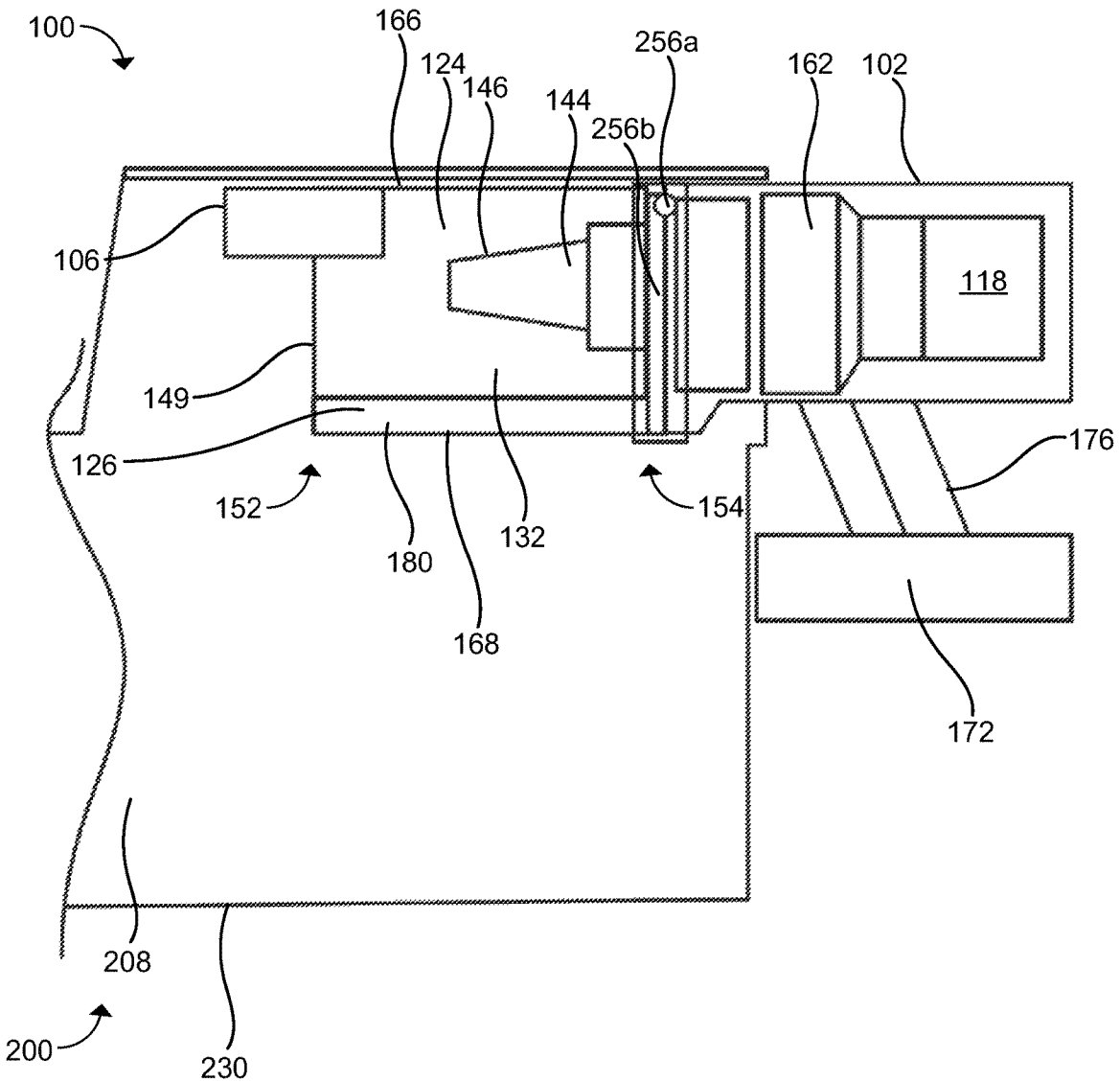
FIG. 37A is a side cross-sectional view of an alternate surface cleaning apparatus docked to the docking station of FIG. 2 with an air treatment member of the surface cleaning apparatus in a closed position.
Figure 37B:
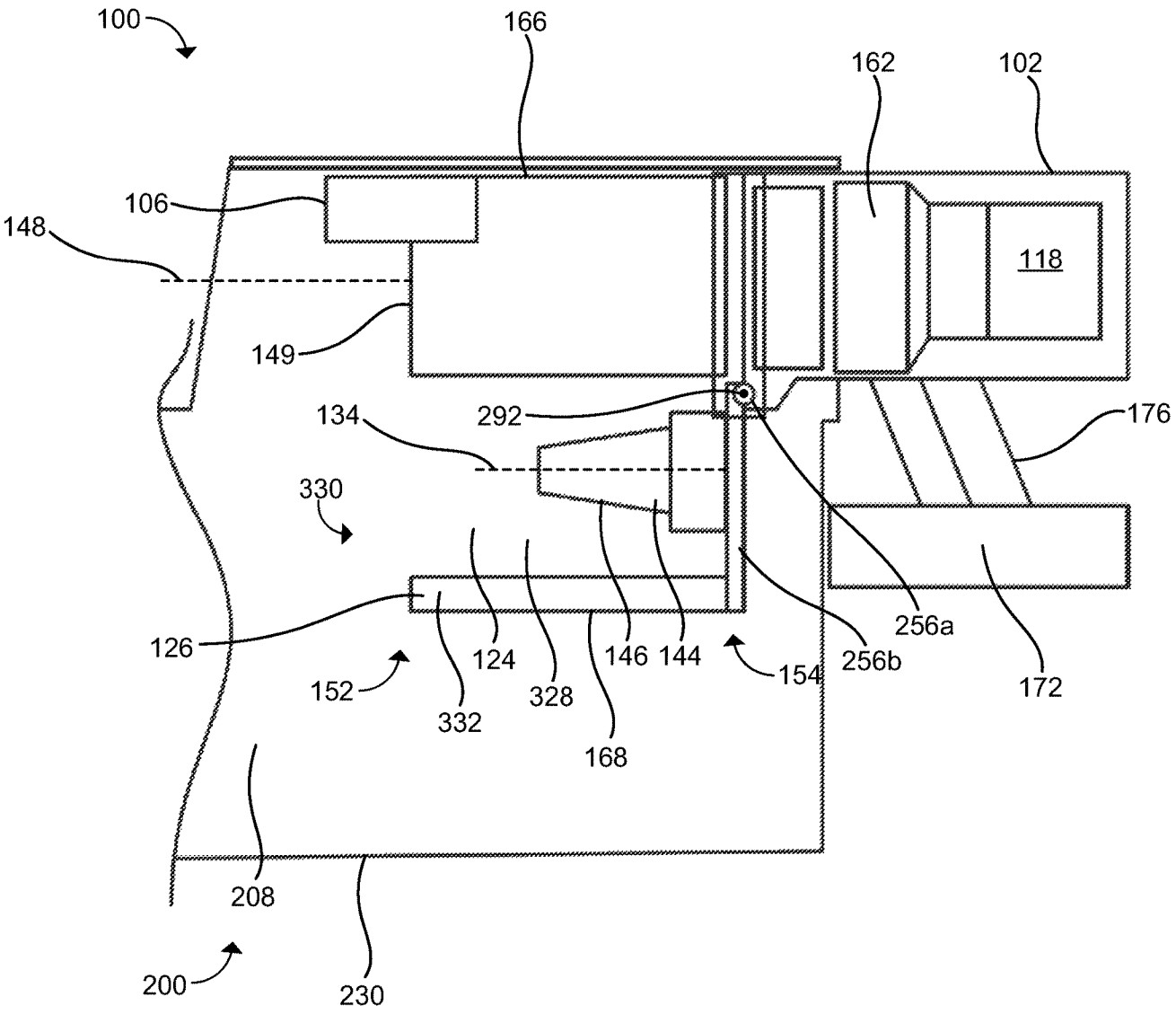
FIG. 37B is a side cross-sectional view of the surface cleaning apparatus of FIG. 37A with the air treatment member of the surface cleaning apparatus in an intermediate position.
Figure 37C:
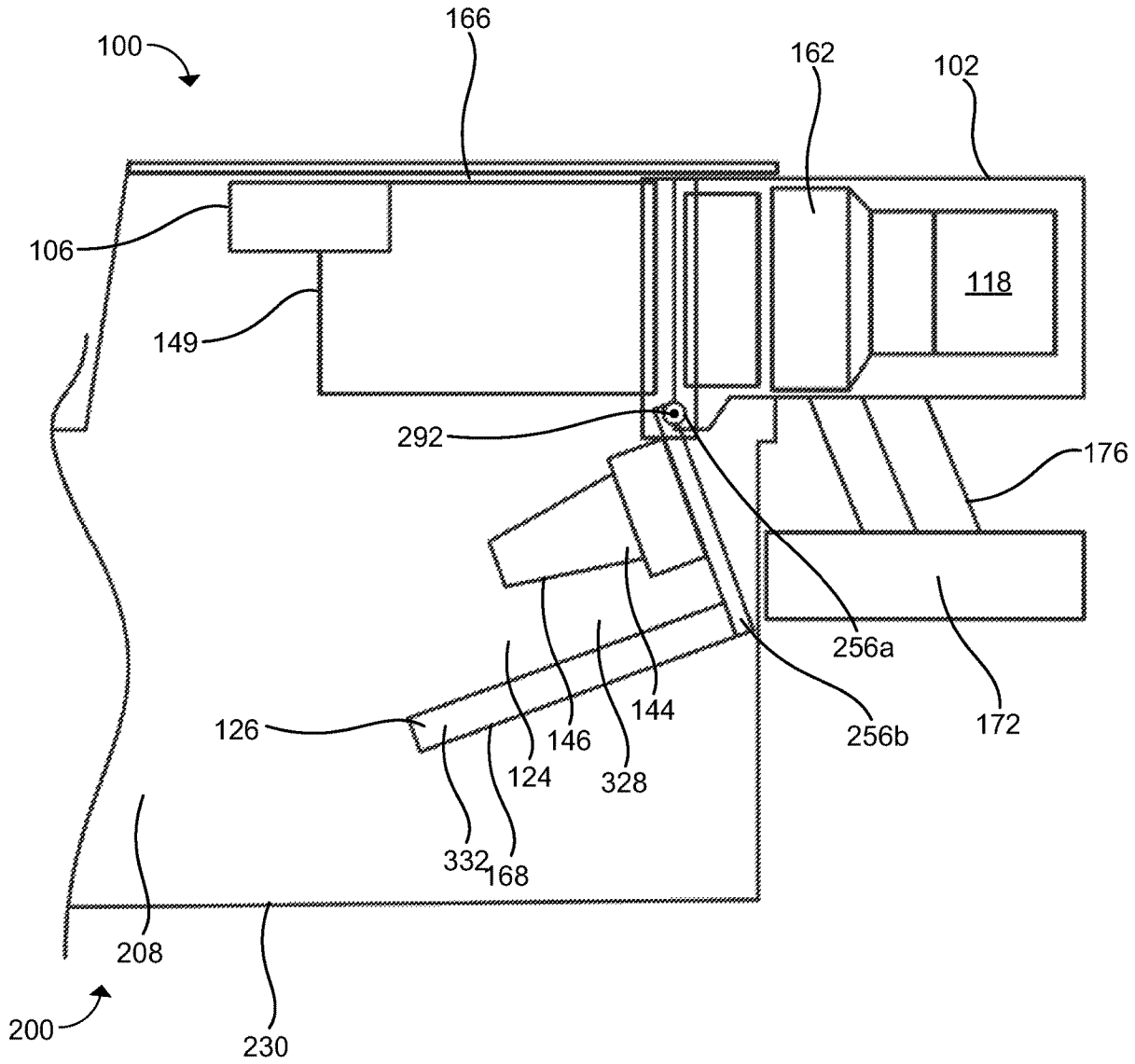
FIG. 37C is a side cross-sectional view of the surface cleaning apparatus of FIG. 37A with the air treatment member of the surface cleaning apparatus in an open position.

In some embodiments, the movement of the moveable portion 168 may include rotational movement. For example, the movement can be a translational movement followed by a rotational movement. As exemplified in FIGS. 37A to 37C, the moveable portion 168 may include a downward translation from a closed position (FIG. 37A) to an intermediate position (FIG. 37B). Subsequently, the moveable portion 168 may be rotated from intermediate position (FIG. 37B) to the open position (FIG. 37C). The moveable portion 168 may include vortex finder 144 and mesh screen 146 and the combination of the translational and rotation movement may provide greater user access to pre-motor filter 162 (e.g., for cleaning or replacement).

Moveable portion 168 may be rotatable by a rotational mount 256*a* to the open position (see, e.g., FIG. 37B). Rotational mount 256*a* may provide any suitable rotation axis 292. For example, mount rotation axis 292 may be transverse to one or both of axes 148, 134. FIGS. 37B-37C show an example in which mount rotation axis 292 extends laterally. This may permit moveable portion 168 to rotate downward to the open position, which may allow dirt held by moveable portion 168 to discharge by gravity.

In some embodiments, the moveable portion 168 may include at least a portion of dirt collection chamber 126. As exemplified in FIGS. 25 and 26A, the moveable portion 168 may include a portion 332 of sidewall 180 of dirt collection chamber 126. When the moveable portion 168 is in the closed position (FIG. 25), dirt collection chamber 126 may be closed. When the moveable portion 168 moves to the open position (FIG. 26A), dirt collection chamber 126 may be opened. For example, moveable portion 168 may not include one or both of dirt collection chamber end walls 184, 328 such that one or both of dirt collection chamber ends 18, 324 is opened when moveable portion 168 is moved to the open position. Dirt collected inside dirt collection chamber 126 may be removed (e.g., manually dumped, or transferred to a docking station) when dirt collection chamber 126 is opened.

Any suitable mechanism may be used to enable the translation motion of moveable portion 168. The mechanism may be mechanical, electromechanical or pneumatic. For example, a mechanical mechanism may include a translational mount 256*b* (e.g., a rail system).

The movement of moveable portion 168 to the open position may occur upon docking or it may be actuated prior to, during or subsequent to an evacuation operation commencing and may use any actuation option discussed herein. For example, the mechanical movement may be driven using an electromechanical member 246 (FIGS. 4C and 4D) or a pneumatic member 250 (FIG. 4E).

As one example, the mechanical movement may be actuated using a button (e.g., button 276 shown in FIG. 4A) on the surface cleaning apparatus and/or on the docking station. A user may dock the surface cleaning apparatus with the docking station and actuate the mechanical movement using by pushing the button.

Figure 30:
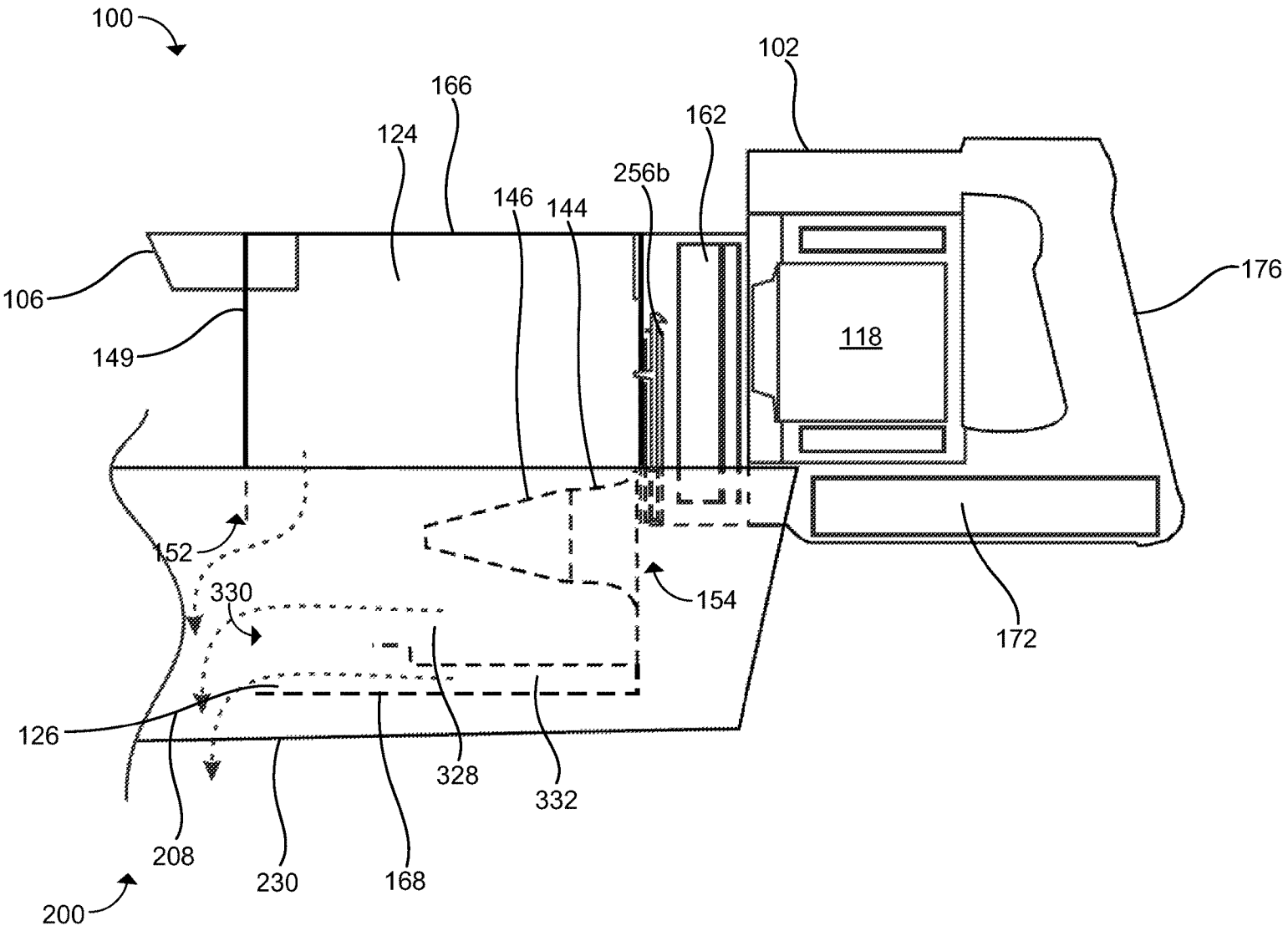
Figure 31:
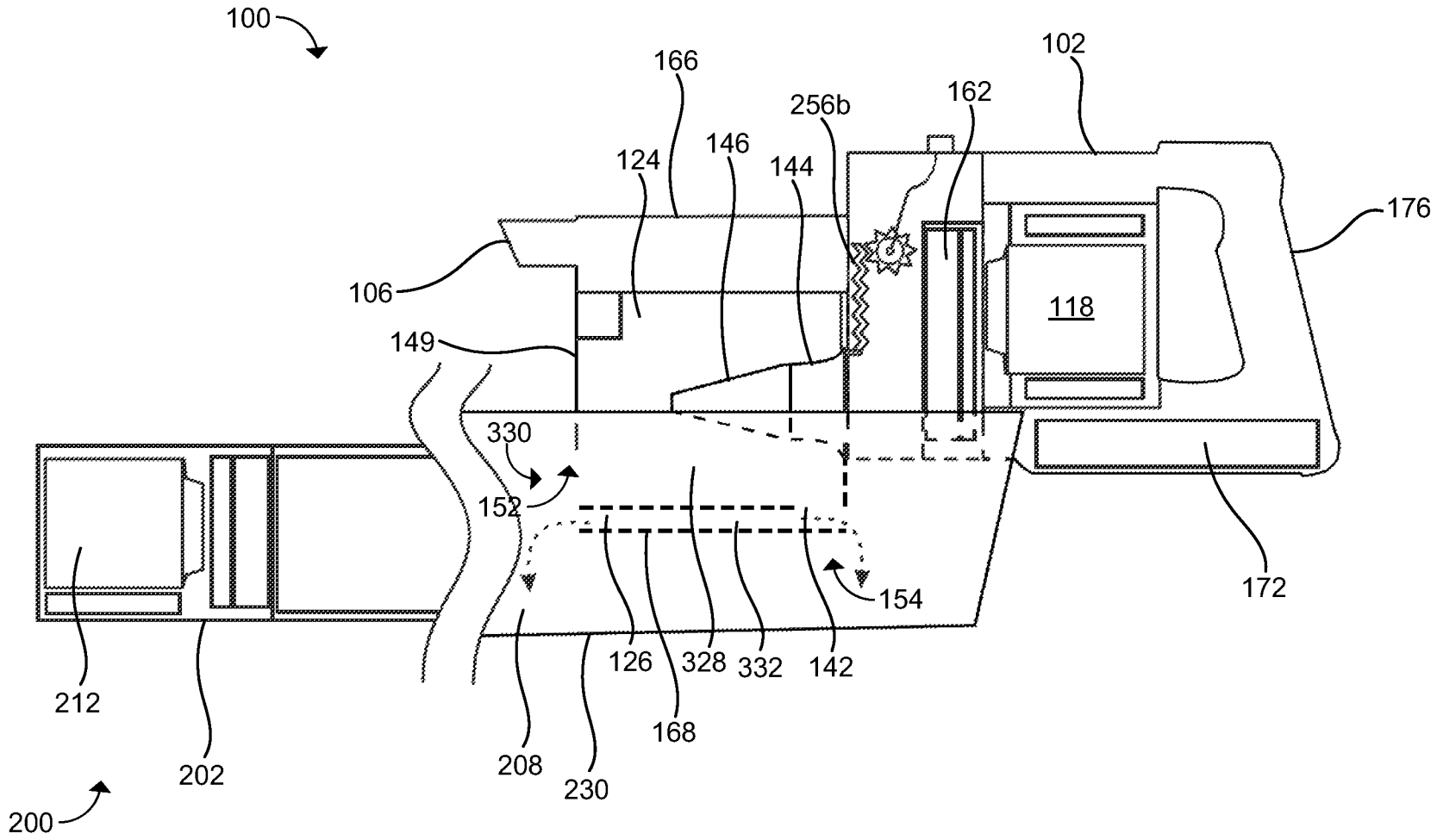

Optionally, the moveable portion 168 includes one or more (if present) of a plate, a portion of second-stage air treatment chamber 124*b* (e.g., FIGS. 27, 32, and 37), pre-motor filter 162 (e.g., FIG. 32), and vortex finder 144 with a mesh screen 146 (FIGS. 30 and 37). This may provide greater user access for cleaning/replacement of the components and/or reduced backpressure for the dirt transferal air flow (in docked position). In other embodiments, the stationary portion includes one or more or all of (if present) the plate, second-stage air treatment chamber 124*b*, pre-motor filter 162, vortex finder 144 with the mesh screen 146. This may reduce manufacturing complexity and may improve product reliability and durability.

Figure 33:
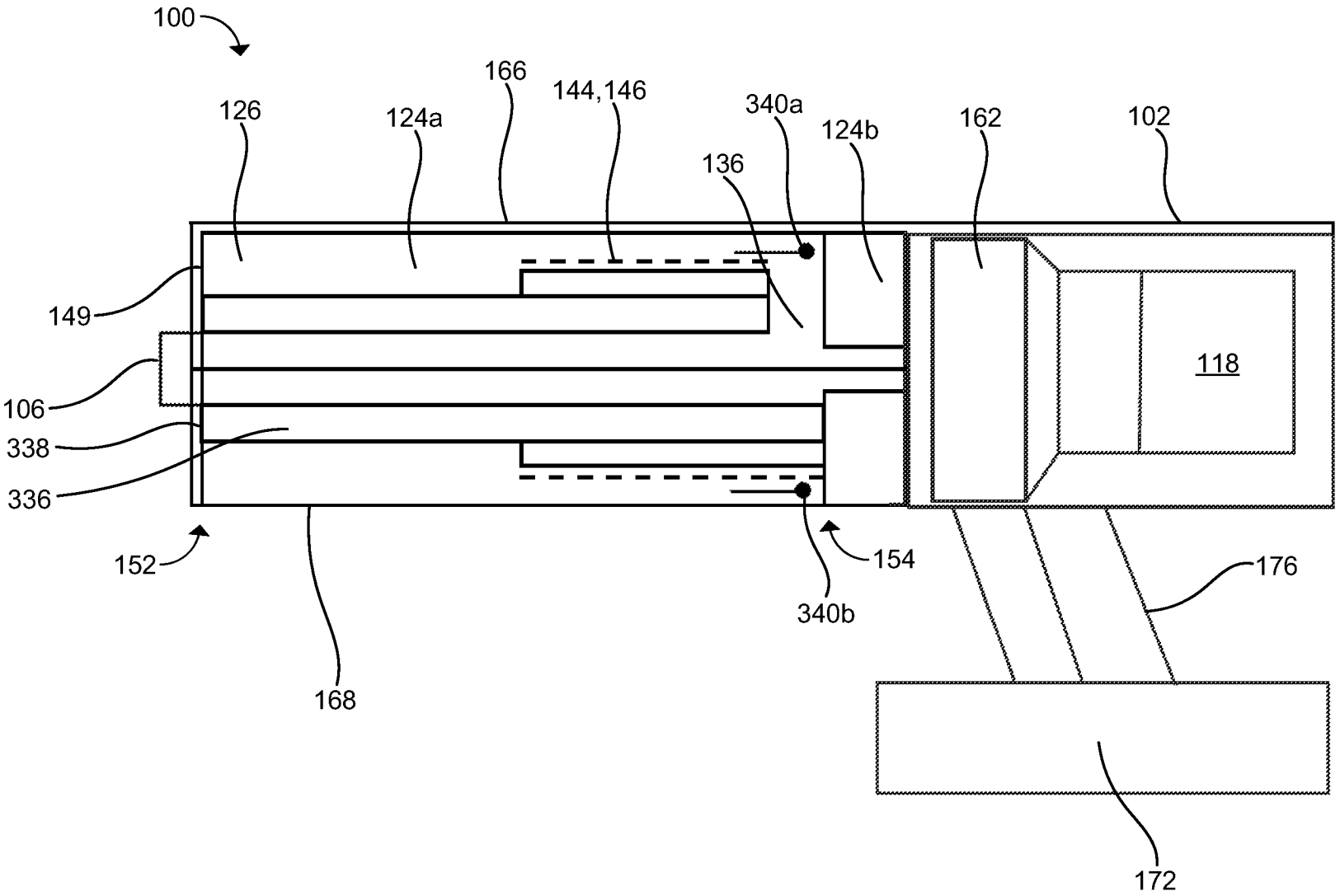
FIG. 33 is a side cross-sectional view of an alternate surface cleaning apparatus with an air treatment member of the surface cleaning apparatus in a closed position and wipers of the air treatment member in a retracted position.
Figure 34:
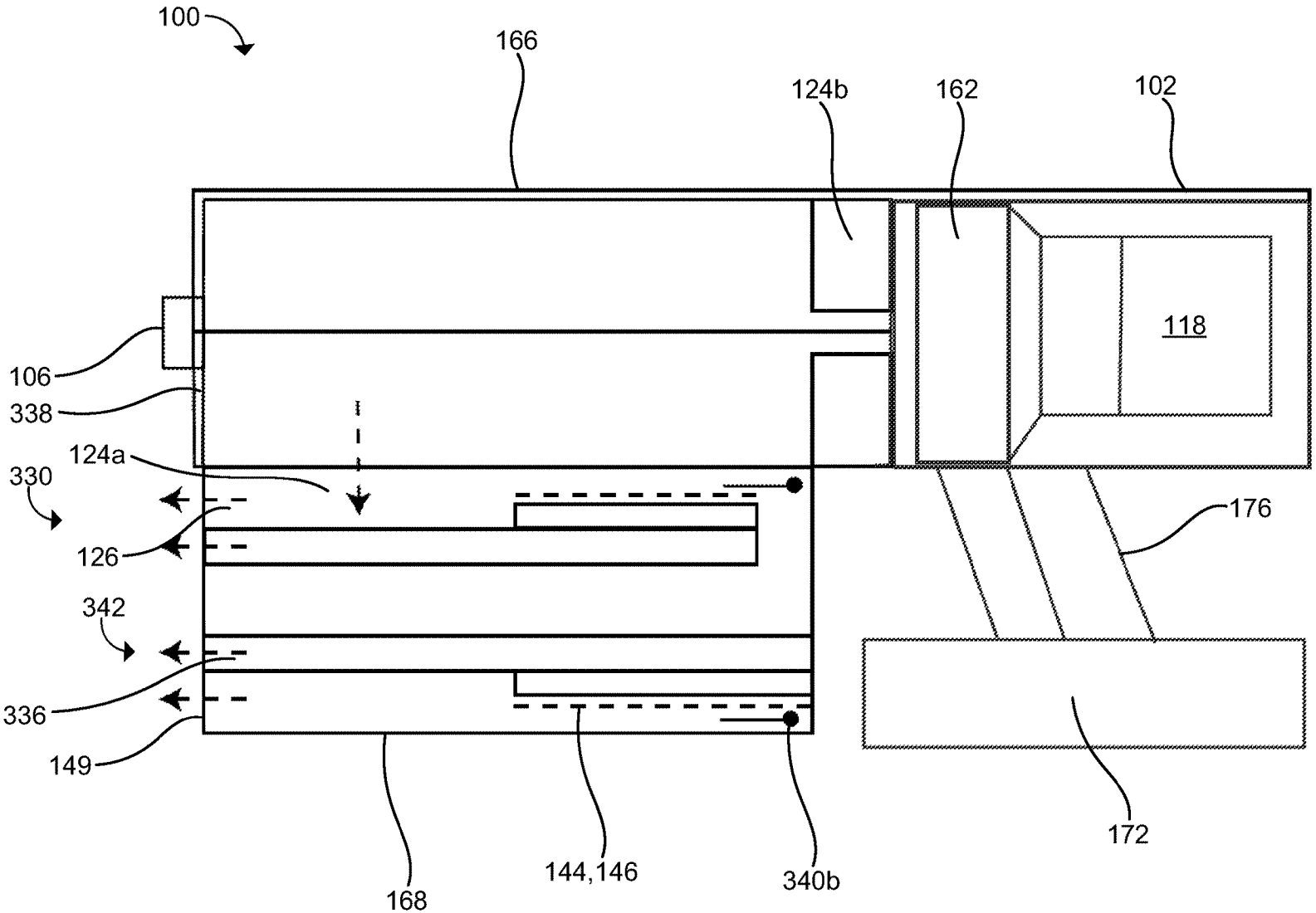
FIG. 34 is a side cross-sectional view of the surface cleaning apparatus of FIG. 33 with the air treatment member in an open position and the wipers in the retracted position.
Figure 35:
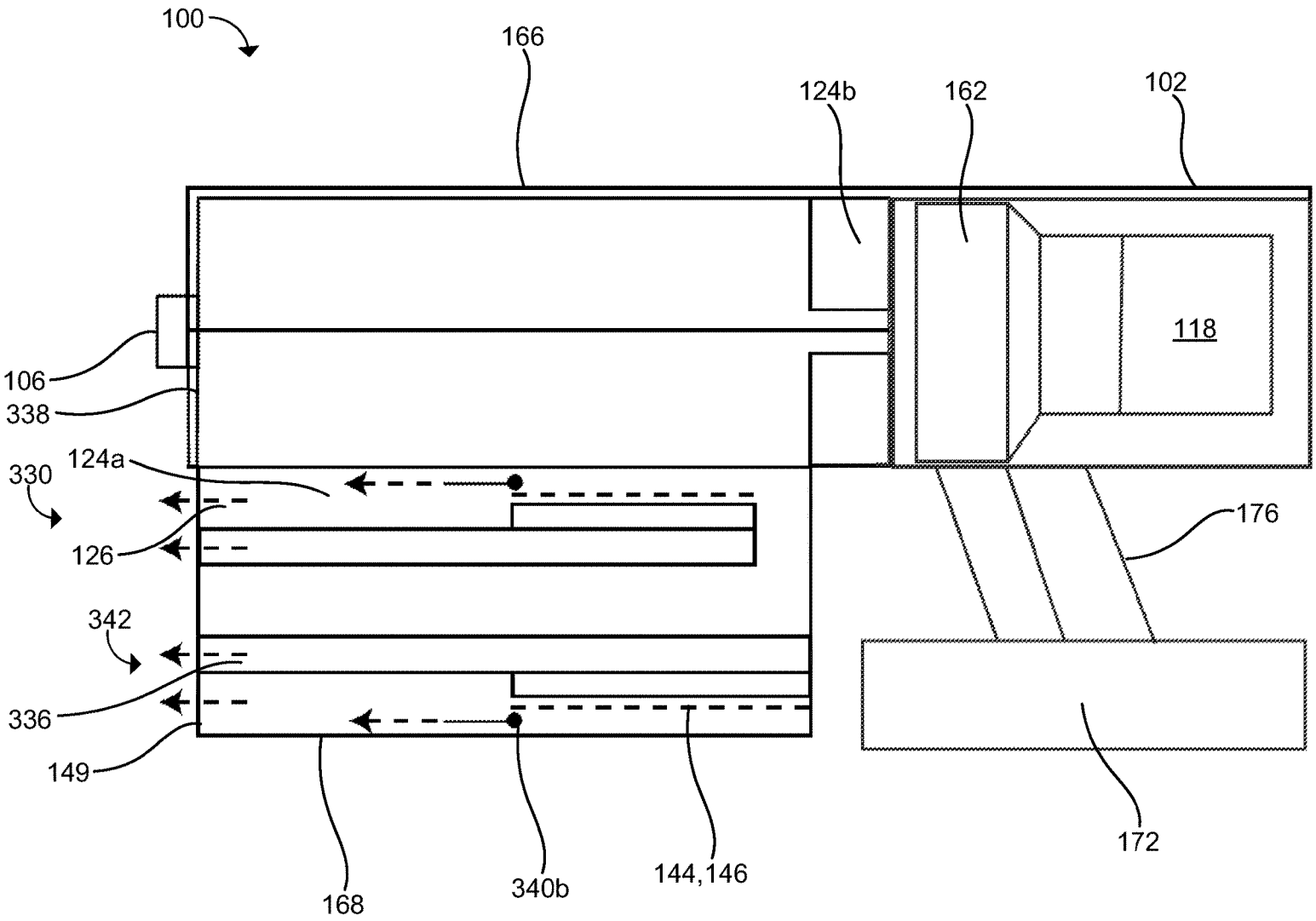
FIG. 35 is a side cross-sectional view of the surface cleaning apparatus of FIG. 33 with the air treatment member in the open position and the wipers in an extended position.
Figure 36:
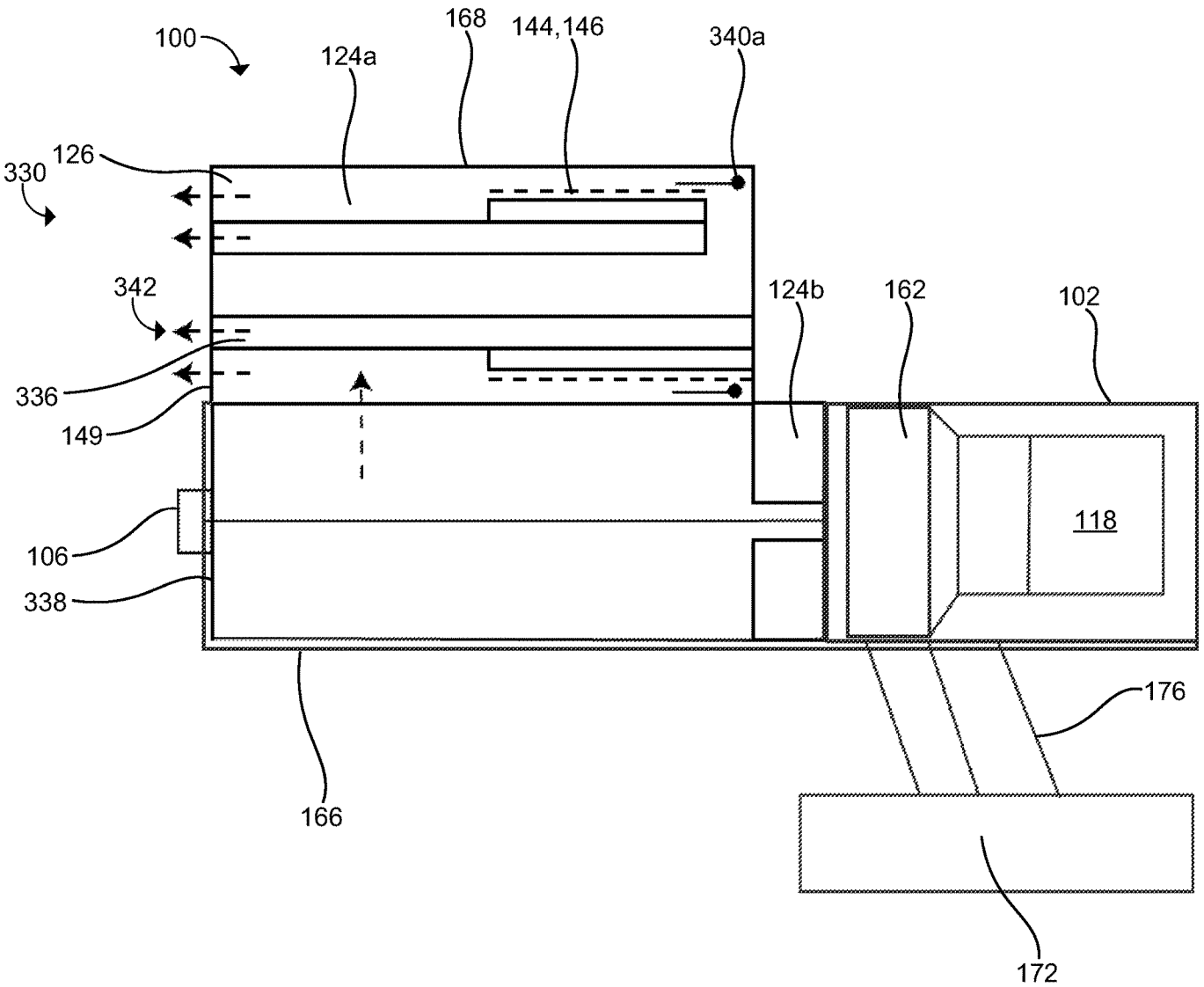
FIG. 36 is a side cross-sectional view of an alternate surface cleaning apparatus with an air treatment member of the surface cleaning apparatus in an open position and wipers of the air treatment member in a retracted position.

Referring to FIG. 33, in some embodiments that include a second stage air treatment chamber 124*b*, air treatment member 104 may include a second-stage dirt collection chamber 336 for collecting dirt separated by second stage air treatment chamber 124*b*. As exemplified, second-stage dirt collection chamber 336 may be closed when moveable portion 168 is in the closed position. FIGS. 34 to 36 show examples where second-stage dirt collection chamber 336 may be opened when moveable portion 168 is moved to the open position. For example, moveable portion 168 may not include an end wall 338 of second-stage dirt collection chamber 336, such that a first end 342 of second-stage dirt collection chamber 336 may become opened when moveable portion 168 is moved to the open position. This can enable removal of dirt collected in second stage dirt collection chamber 336. Optionally, air treatment member 104 includes one or more wipers 340 that can move between a retracted position (e.g., FIGS. 33 and 34) to an extended position (e.g., FIG. 35). The wipers 340 can enable cleaning of vortex finder 144 by pushing away dirt collected at mesh screen 146 of vortex finder 144.

Figure 26B:
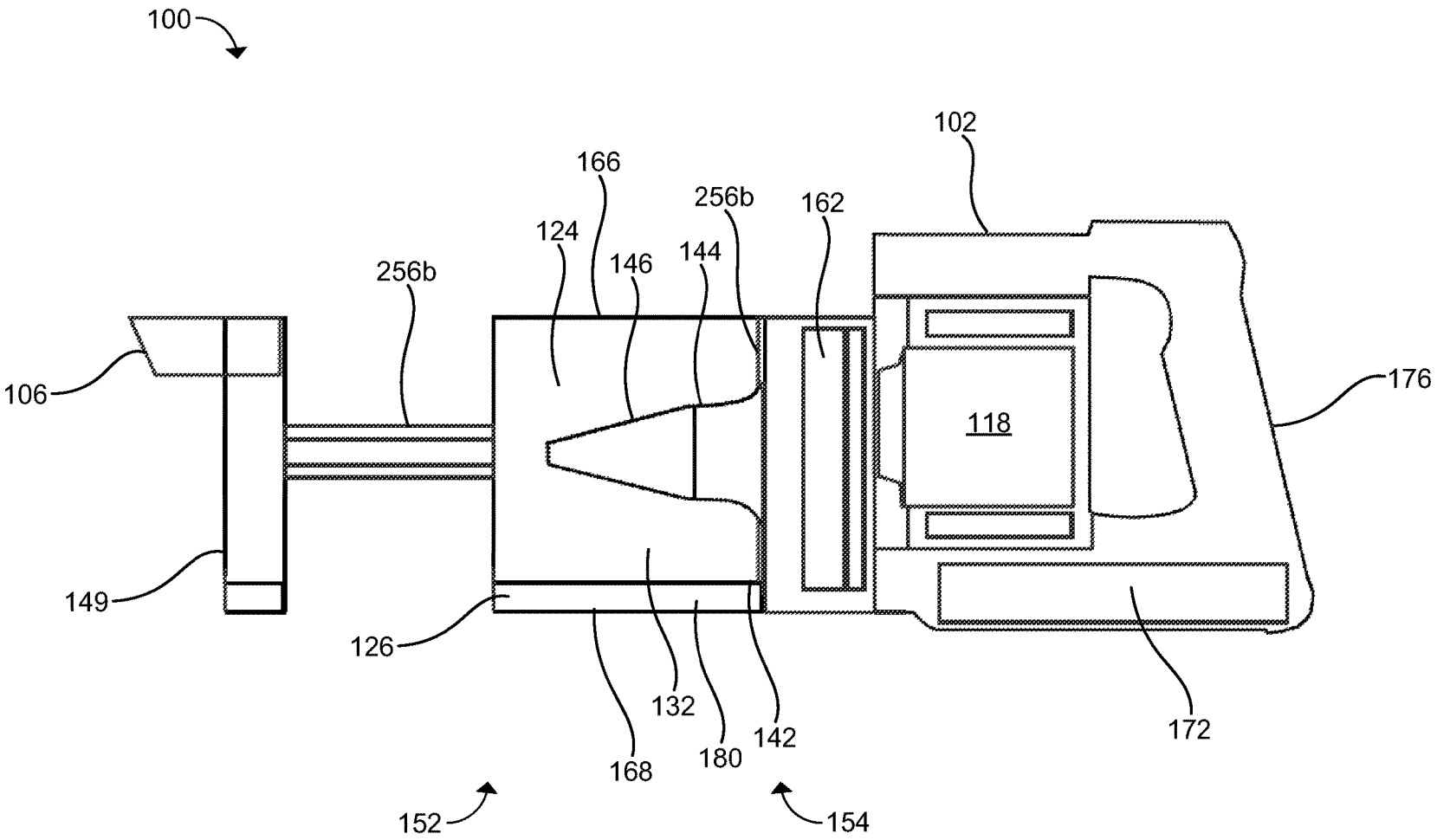
FIG. 26B is a side cross-sectional view of the surface cleaning apparatus of FIGS. 25 and 26A showing an alternate open position of the air treatment member.

In some embodiments, first end 152 may be moveable independent of the moveable portion 168. For example, at least a portion of first end wall 149 may be openable (e.g., rotatable or translatable) when moveable portion 168 is in the closed position. As exemplified in FIGS. 25 and 26B, end wall 149 may be translated between a closed position (FIG. 25) and an open position (FIG. 26B). In the open position, a front end 152 of air treatment chamber 124 may be opened. This may enable user access to internal components of the air treatment chamber from a front end 152 that is away from the dirt outlet 142 positioned proximal to rear end 154.

Air Treatment Member with Laterally Moveable Front Portion

In accordance with another aspect of this disclosure, the moveable portion includes a front portion of the air treatment member. The stationary portion includes the vortex finder, the mesh screen and the rear end wall of the air treatment chamber. The moveable portion moves laterally between an open position and a closed position. When the moveable portion is moved to the open position, the air treatment chamber and/or a dirt collection chamber/region is opened.

If used with a docking station, dirt collected in the dirt collection chamber and/or the air treatment chamber can be removed/transferred to the docking station. In the docked position, the moveable portion moves laterally into the docking station and a dirt transferal air flow may be generated through the rear end of the air treatment chamber, towards or through the front end of the air treatment chamber and then to the docking station air inlet.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

The direction of movement, the actuation of and the drive member may be any of those discussed with respect to the laterally moveable air treatment chamber.

Figure 38:
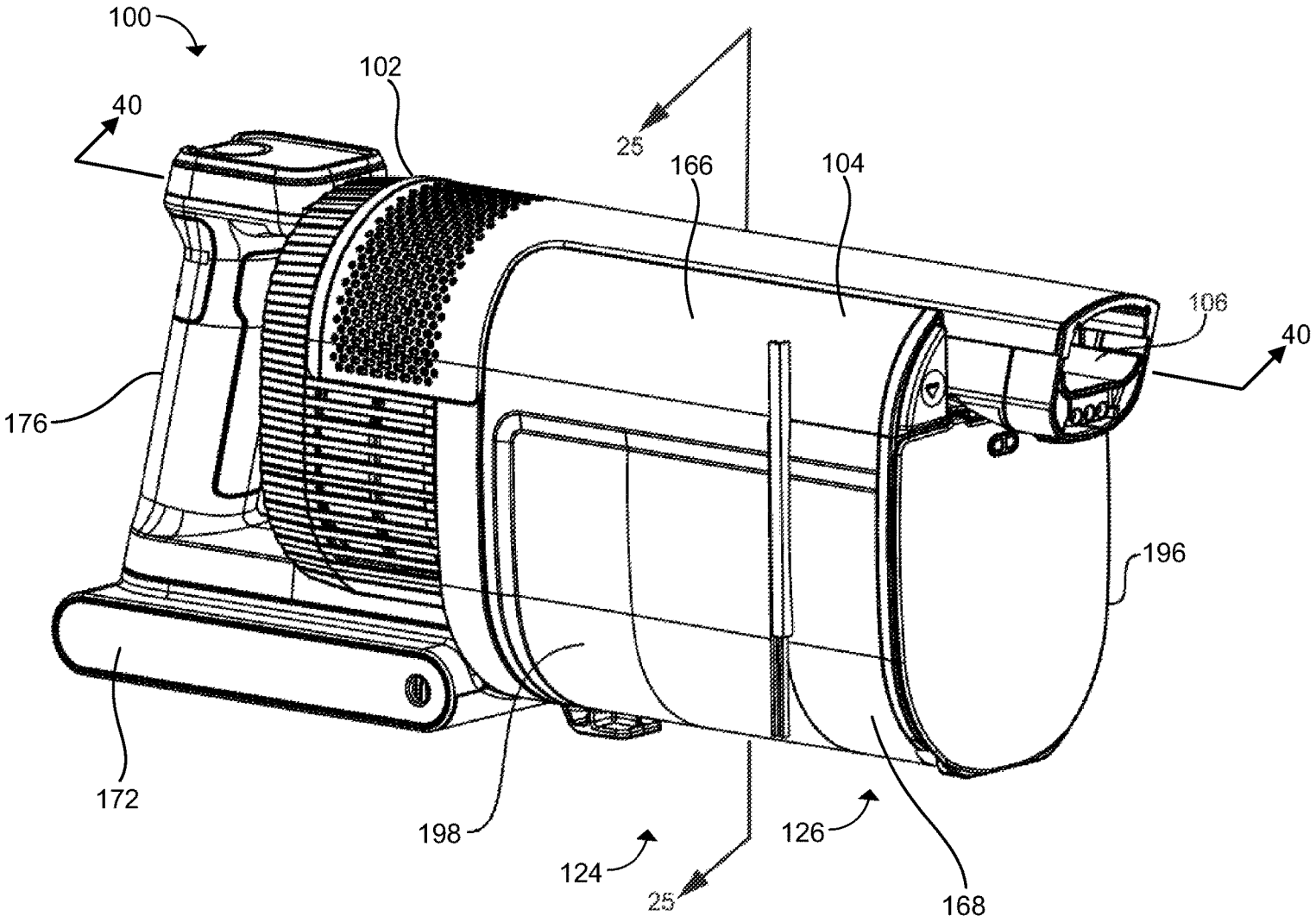
FIG. 38 is a perspective view of an alternate surface cleaning apparatus with an air treatment member of the surface cleaning apparatus in a closed position.
Figure 39:
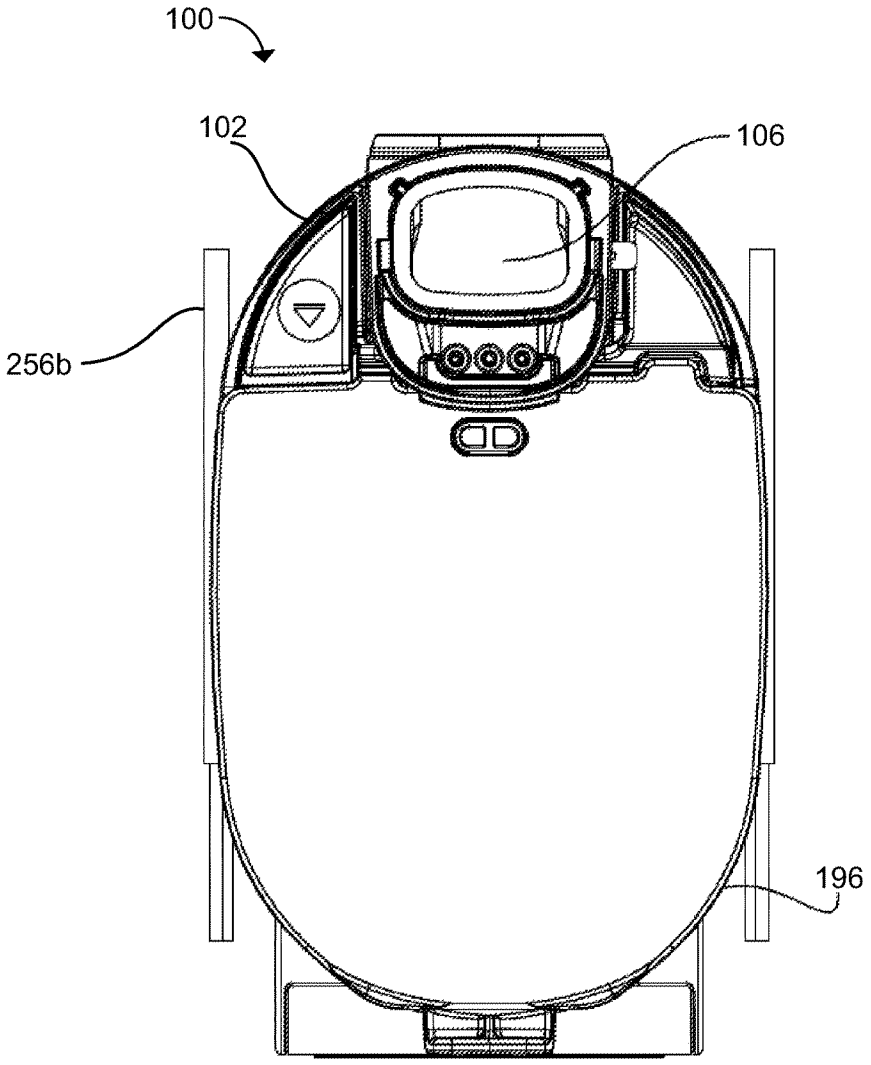
FIG. 39 is a front view of the surface cleaning apparatus of FIG. 38.
Figure 40:
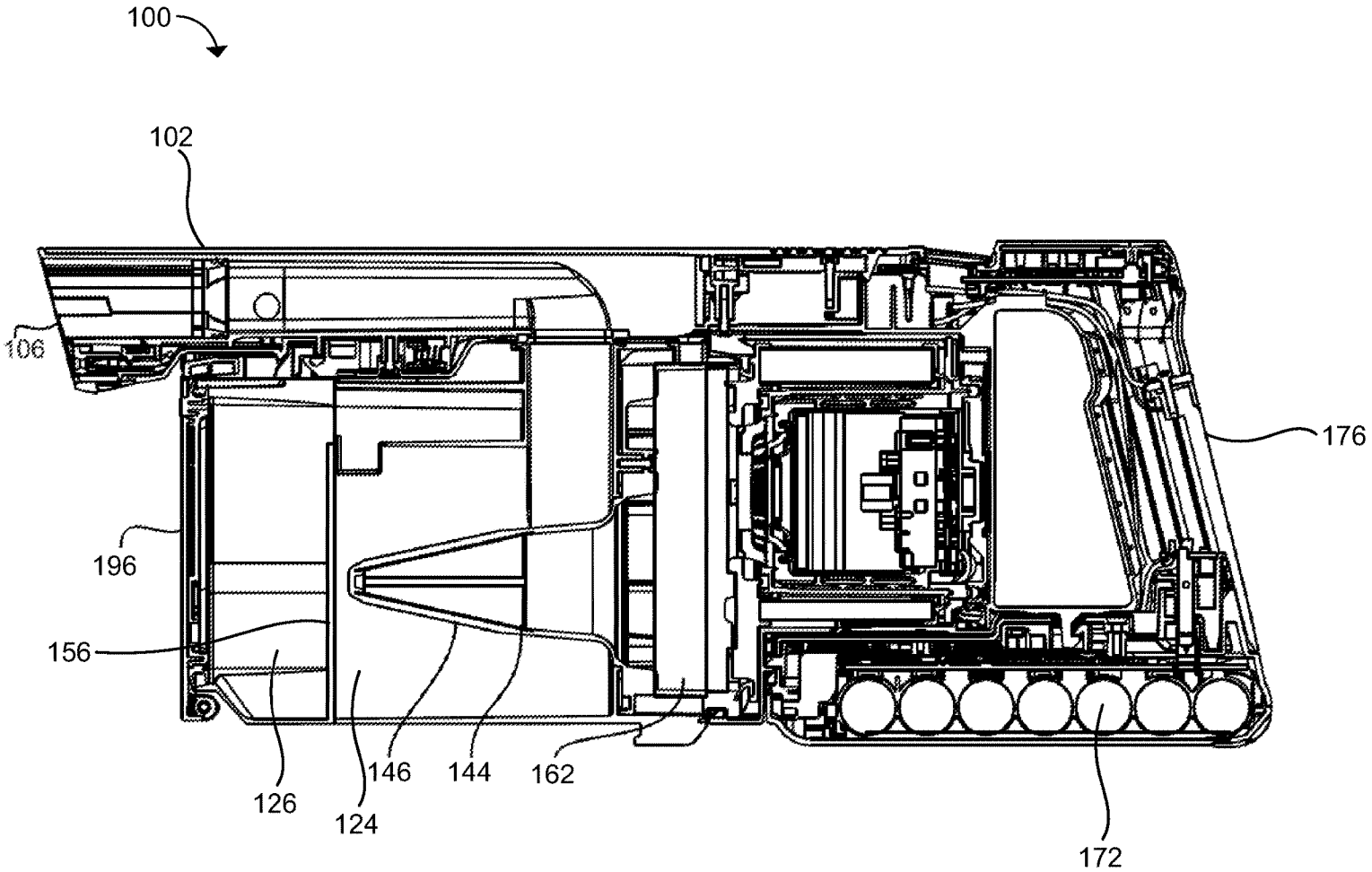
FIG. 40 is a side cross-sectional view taken along line 40-40 in FIG. 38.
Figure 41:
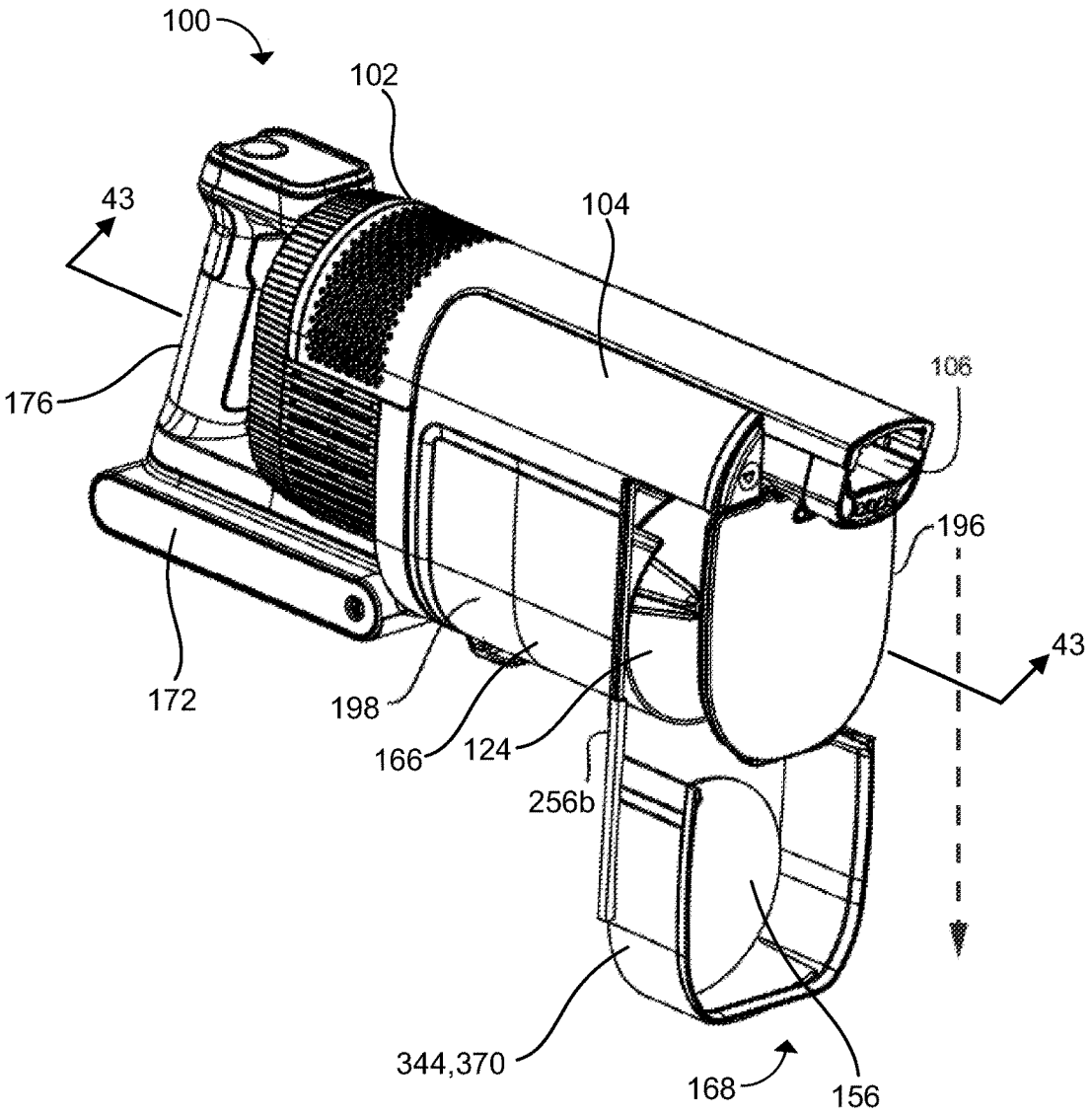
FIG. 41 is a perspective view of the surface cleaning apparatus of FIG. 38 with the air treatment member of the surface cleaning apparatus in an open position.
Figure 42:
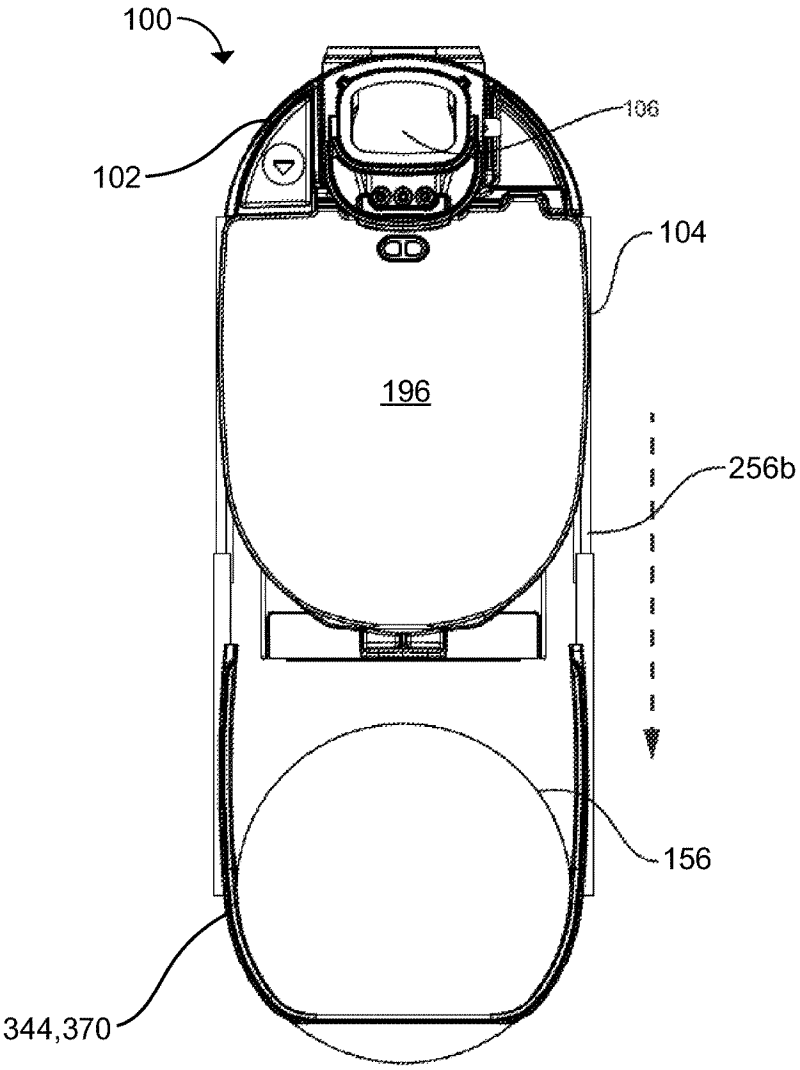
FIG. 42 is a front view of the surface cleaning apparatus of FIG. 41.
Figure 43:
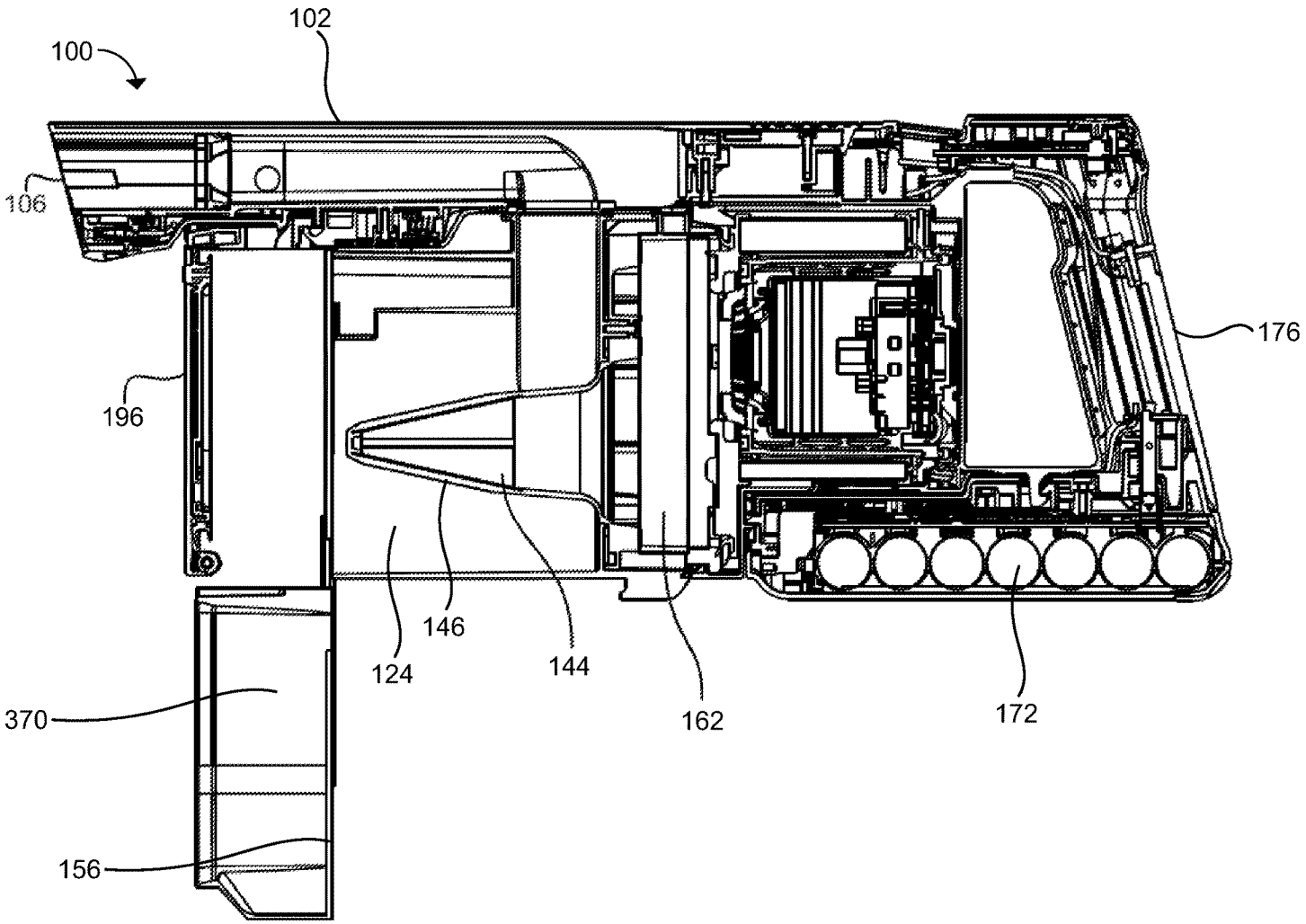
FIG. 43 is a side cross-sectional view taken along line 43-43 in FIG. 41.
Figure 44:
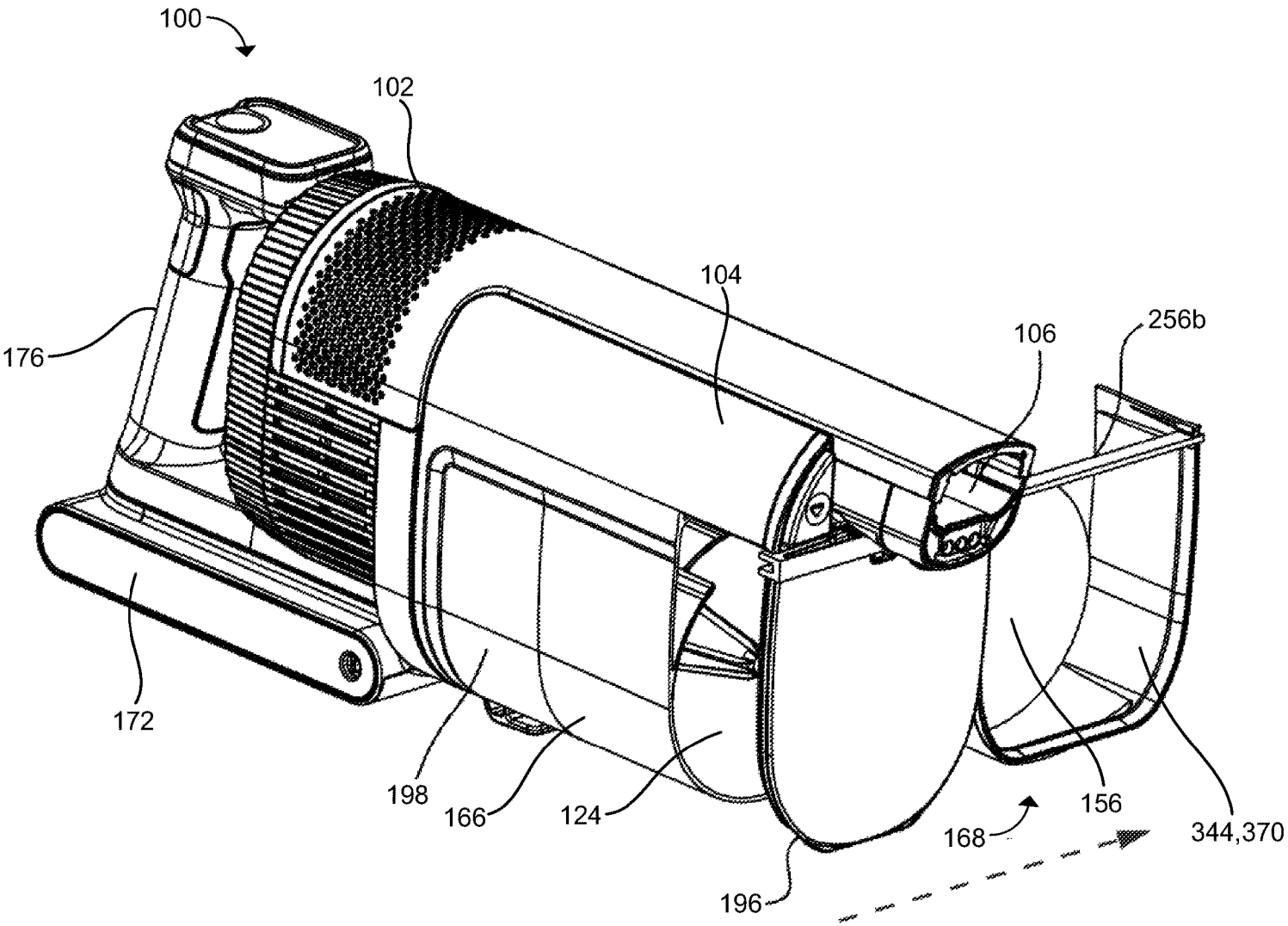
FIG. 44 is a perspective view of a surface cleaning apparatus similar to FIG. 38 showing an alternate opening of the air treatment member.
Figure 45:
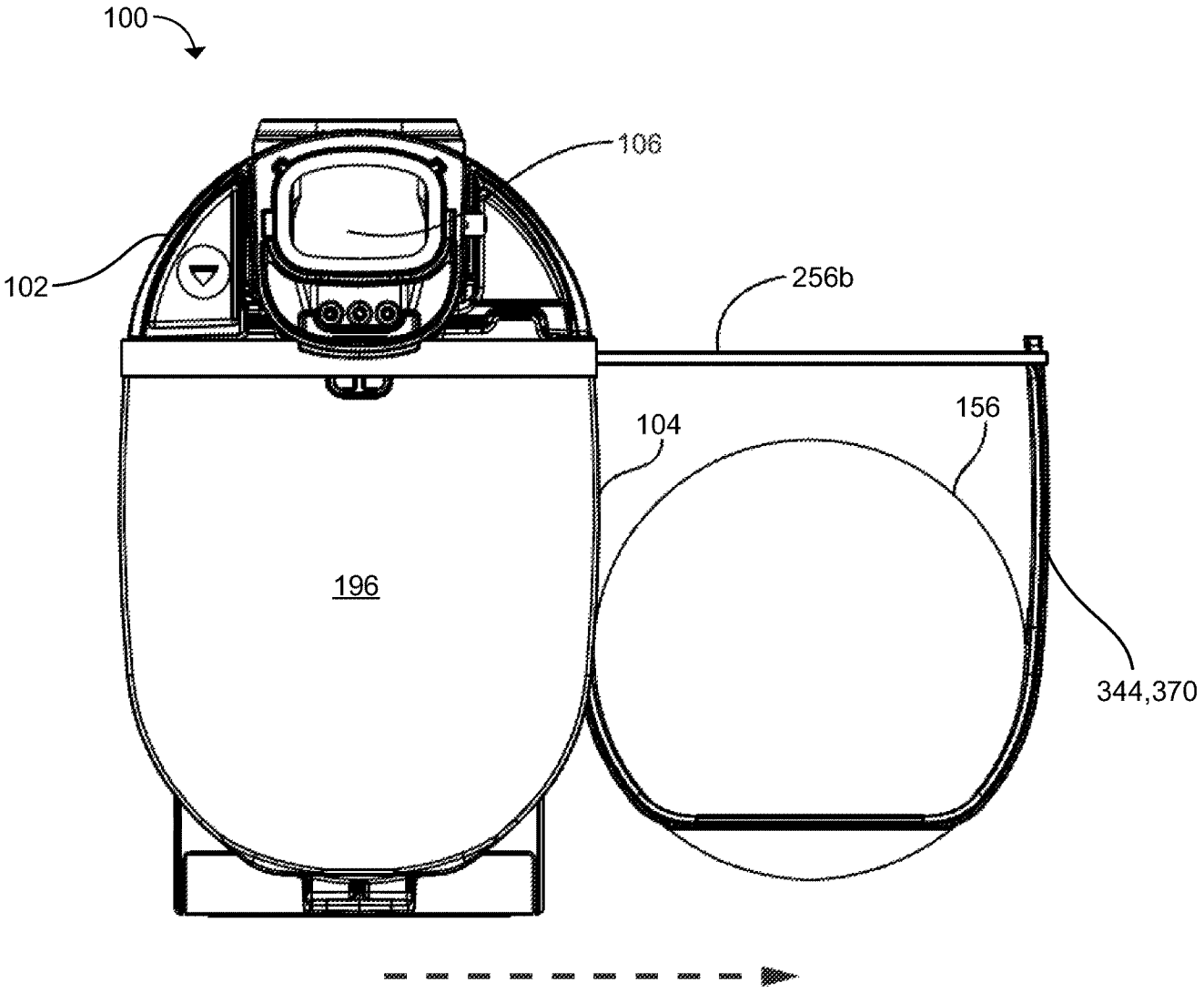
FIG. 45 is a front view of the surface cleaning apparatus of FIG. 44.
Figure 46:
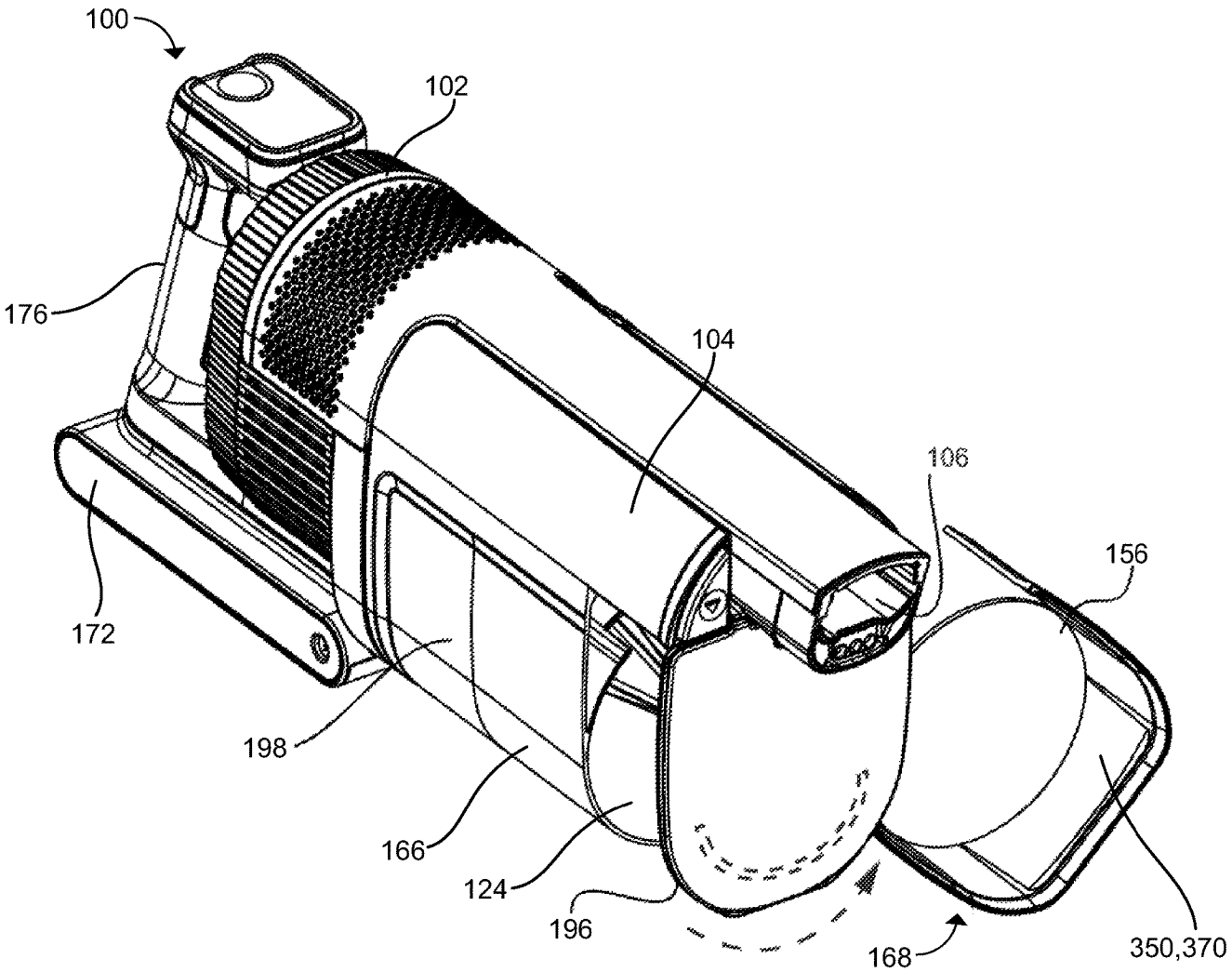
FIG. 46 is a perspective view of a surface cleaning apparatus similar to FIG. 38 showing an alternate opening of the air treatment member.
Figure 47:
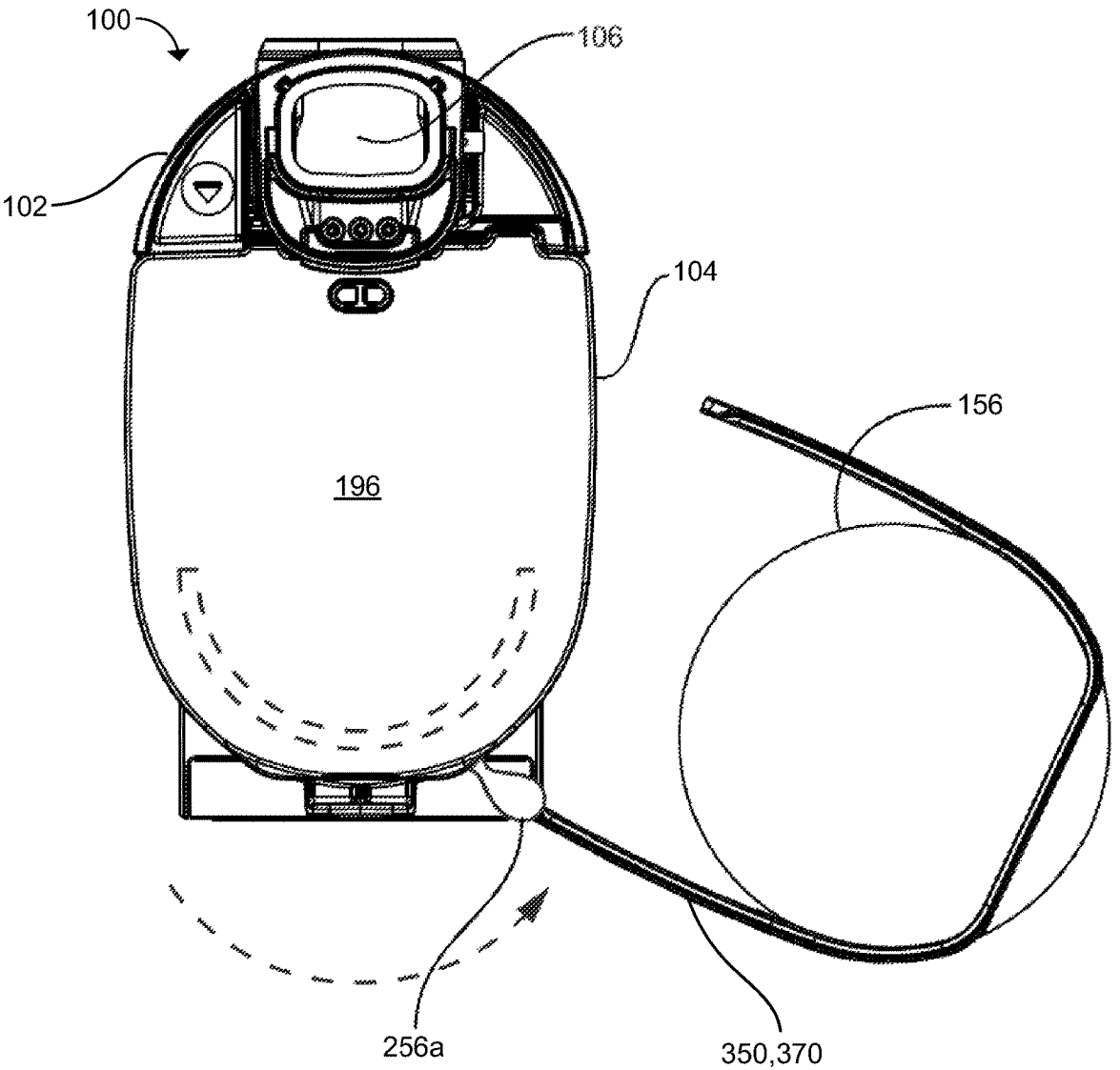
FIG. 47 is a front view of the surface cleaning apparatus of FIG. 46.

Reference is now made to FIGS. 38 to 52. As exemplified in FIGS. 38 to 40, the air treatment chamber 124 may be closed when the moveable portion 168 is in the closed position. As exemplified in FIGS. 41 to 51, the air treatment chamber 124 can be opened when the moveable portion 168 is in the open position. The moveable portion 168 may include a front portion 370 of air treatment member 104. Front portion 370 may include a portion of sidewall 198 that is positioned forward of vortex finder 144. This may enable front portion 370 to move laterally between open and closed positions without interference by vortex finder 144.

In some embodiments, the lateral movement of the moveable portion 168 may include a translational movement. The moveable portion 168 may be translated using a translational mount 256*b* between the closed and open positions. As exemplified in FIGS. 41 to 45, the moveable portion 168 may include a plate 156 and a laterally translatable portion 344 of sidewall 198 of air treatment member 104. The moveable portion 168 may be translated in any suitable direction, e.g., in an upward, downward (e.g., FIGS. 41 to 43), sideward (e.g., FIGS. 44 and 45), or diagonal direction. The movement between the closed and open positions can be a single movement (e.g., a single diagonal movement) or a sequential or simultaneous combination of movements (e.g., a diagonal movement that includes a combination of a downward and a sideward movement).

In some embodiments, the lateral movement of the moveable portion 168 may include a rotational movement. The moveable portion 168 may be rotated using a rotational mount 256*a* between the closed and open positions. As exemplified in FIGS. 46 and 47, the moveable portion 168 includes plate 156 and a laterally rotatable portion 350 of sidewall 198 of air treatment member 104. The rotational movement may be a single movement or an additional movement in combination with a translational movement. For example, the movement of the front portion can be a downward movement followed by a rotational movement.

Figure 48:
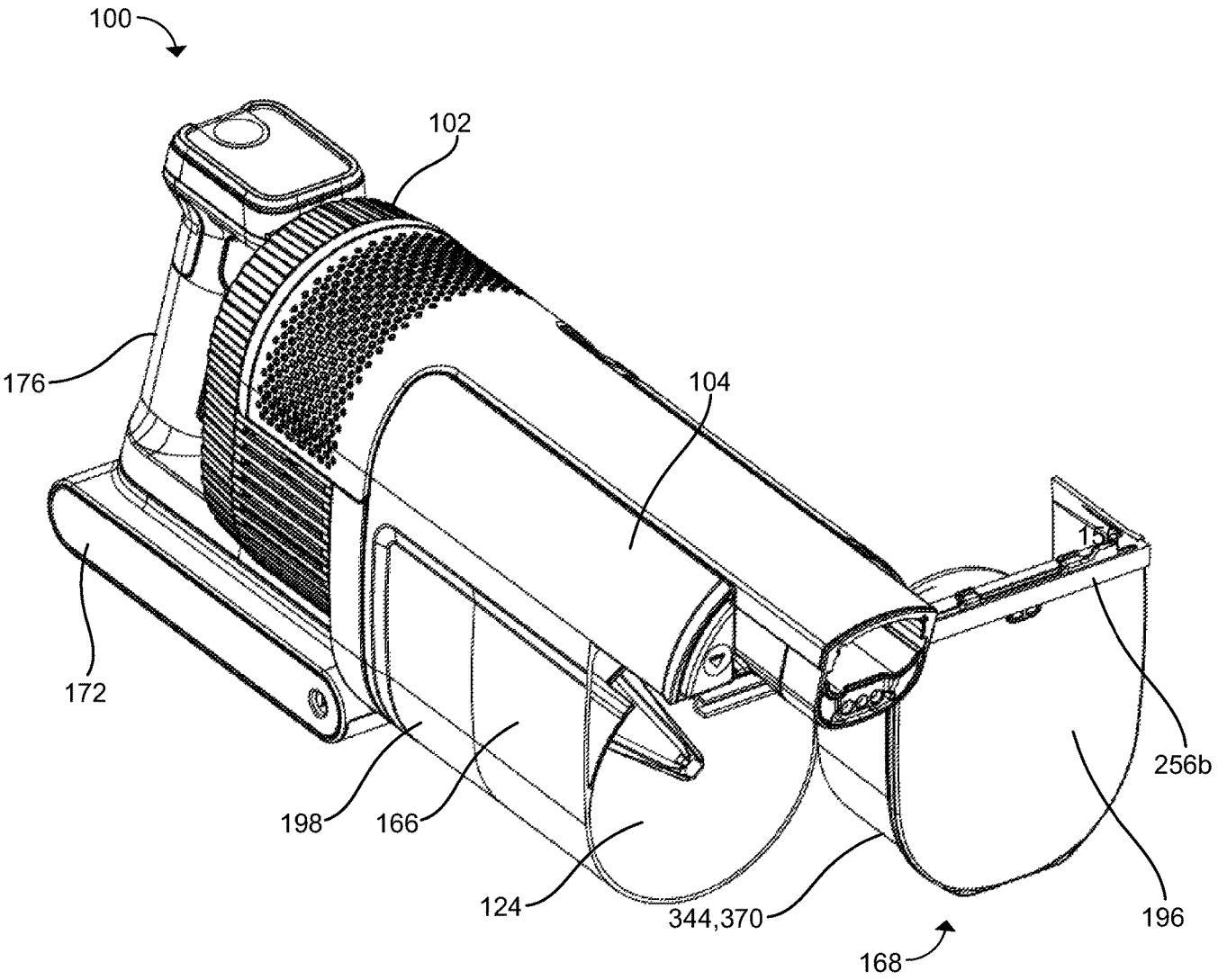
FIGS. 48 to 50 are perspective views of surface cleaning apparatus similar to FIG. 38 showing alternate opening of the air treatment member.

Referring to FIG. 48, in some embodiments, moveable portion 168 includes the first end wall 196 of air treatment member 104. This may provide greater user access to internal components of air treatment chamber 124 and/or provide reduced backpressure for the dirt transferal air flow (when in docked position). Further, this may provide an unobstructed exit from the air treatment assembly for air travelling forwardly through the air treatment assembly (e.g., if a plate 156 is not provided or if plate 156 is moved as part of the front end.

Figure 49:
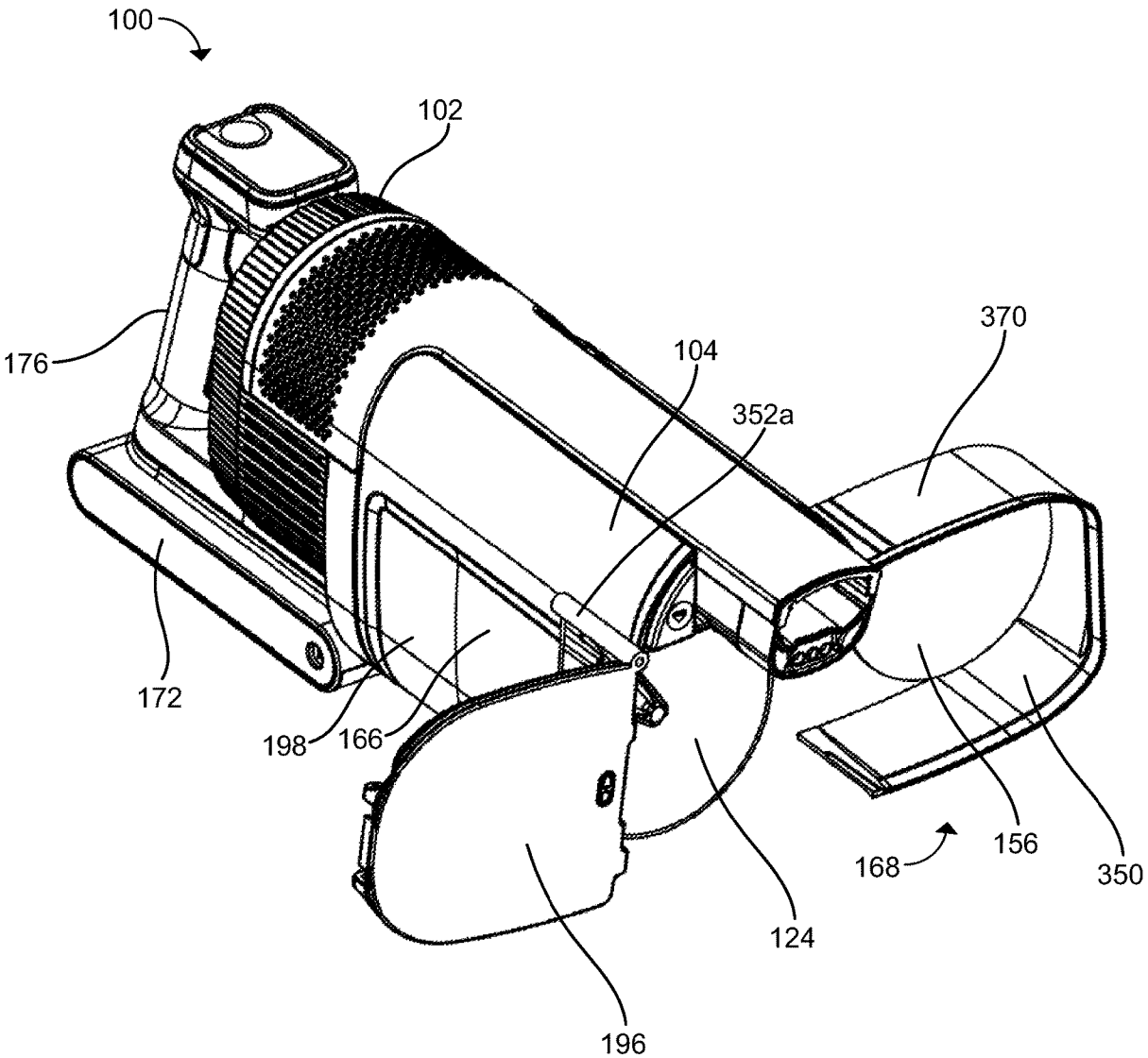
Figure 50:
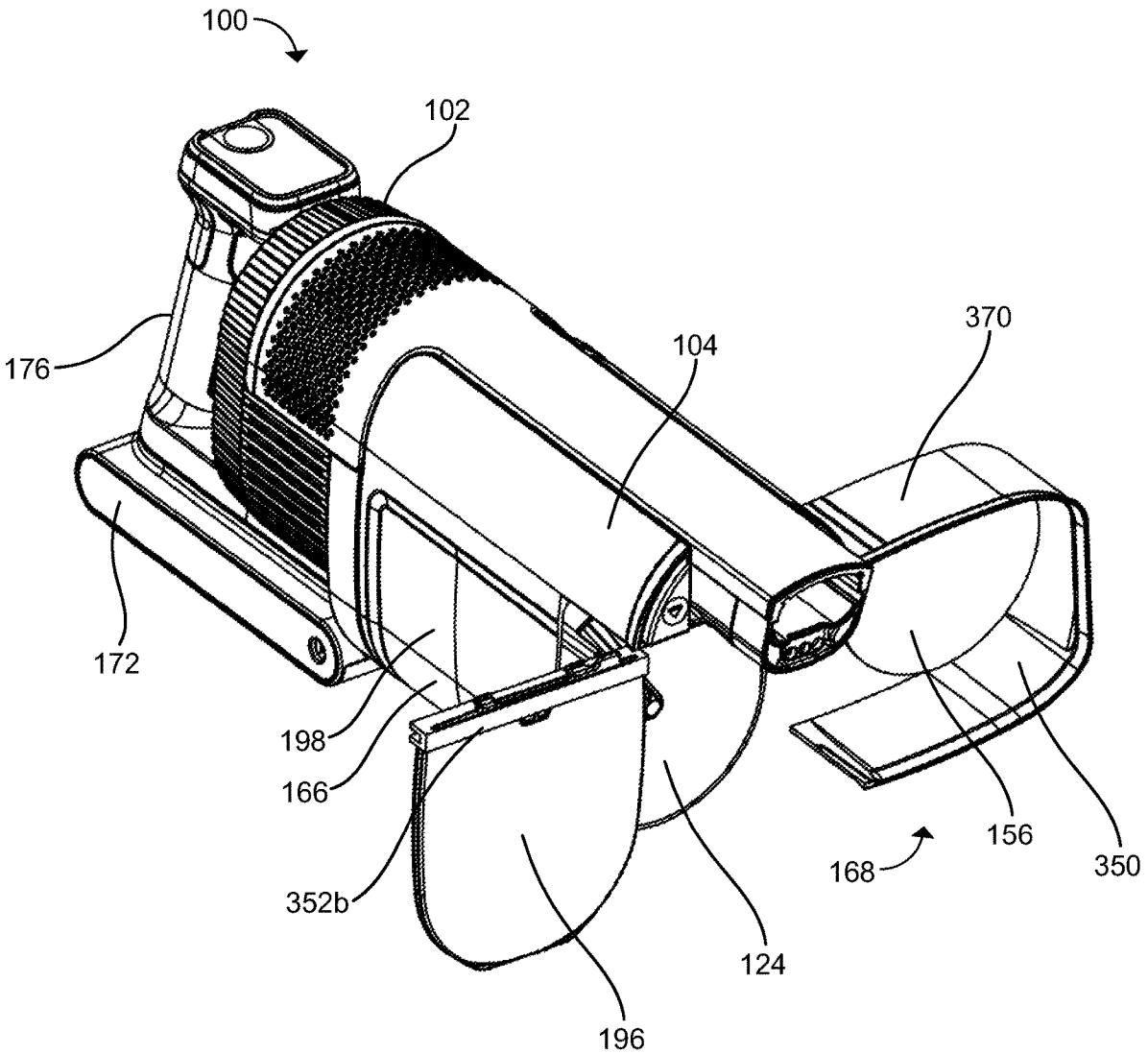

Alternatively, first end wall 196 may move independently of moveable portion 168. The independent movement of first end wall 196 may be a rotational or translational movement and may be in any suitable direction. For example, FIG. 49 shows first end wall 196 rotated in a direction opposite to moveable portion 168 using a rotational mount 352*a*. FIG. 50 shows first end wall 196 translated in a direction opposite to moveable portion 168 using a translational mount 352*b*.

Figure 51A:
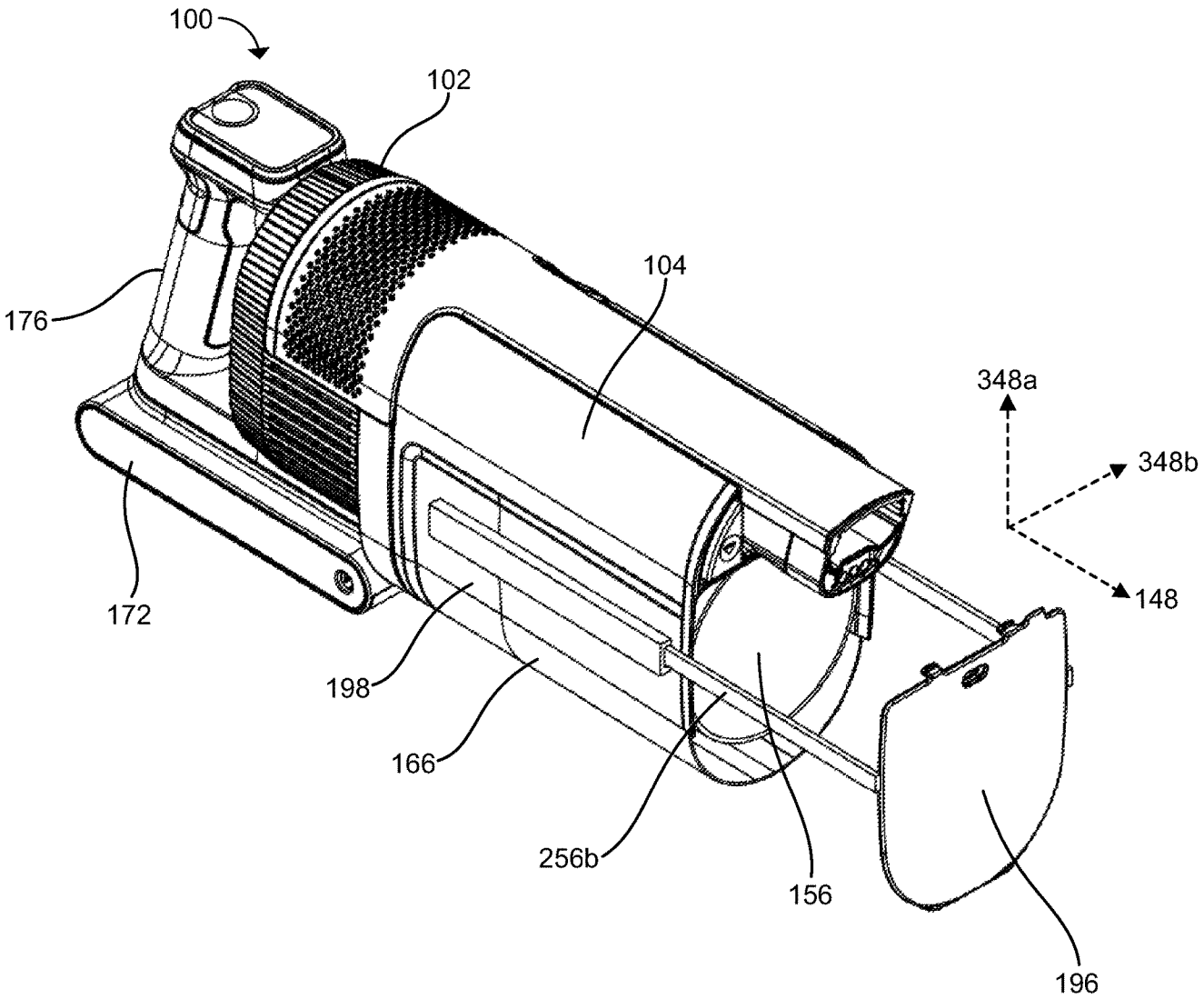
FIG. 51A is a perspective view of a surface cleaning apparatus similar to FIG. 38 showing an alternate opening of the air treatment member.
Figure 51B:
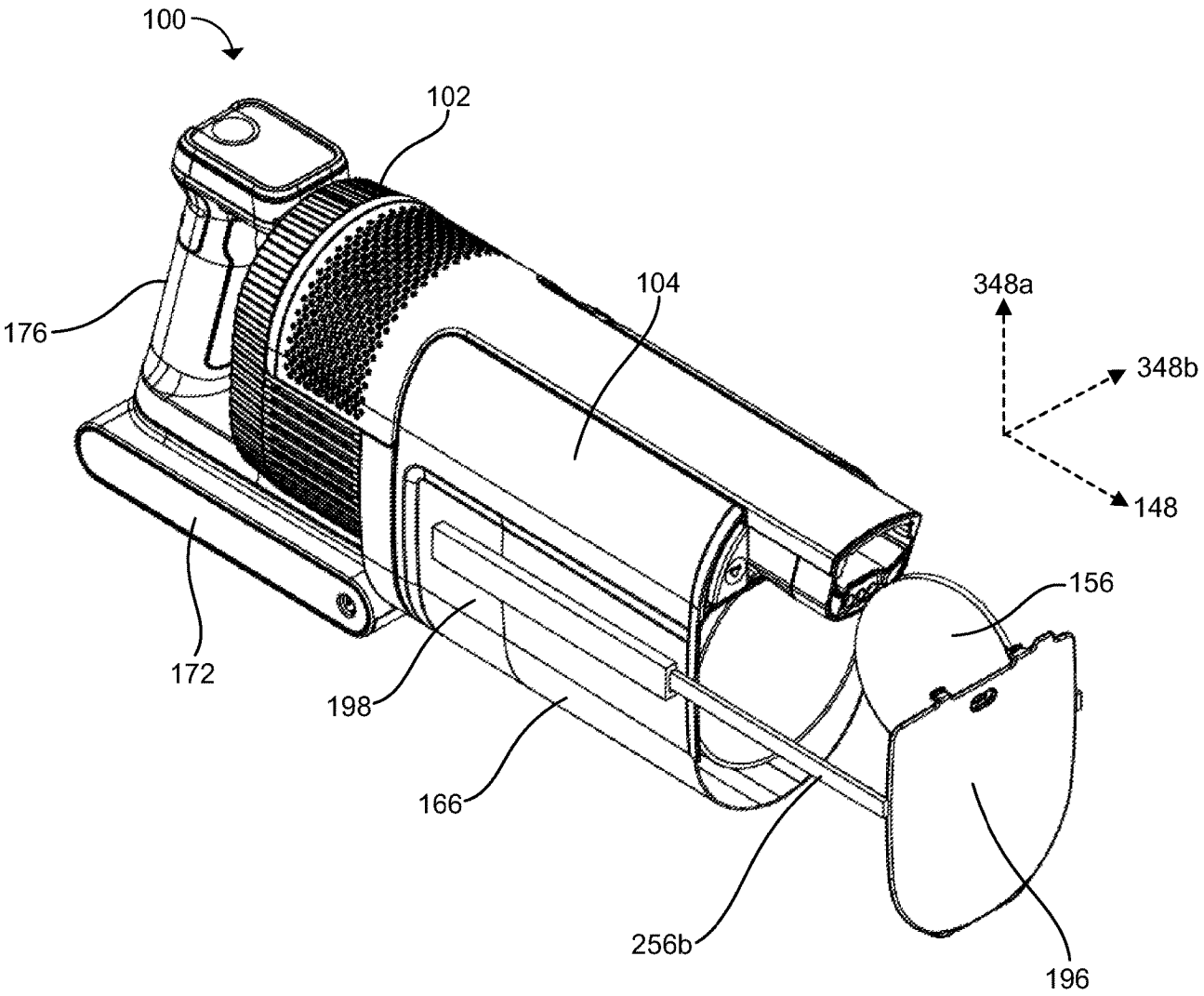
FIG. 51B is a perspective view of the surface cleaning apparatus of FIG. 51A with an end wall or plate of the air treatment member in a rotated position.
Figure 52:
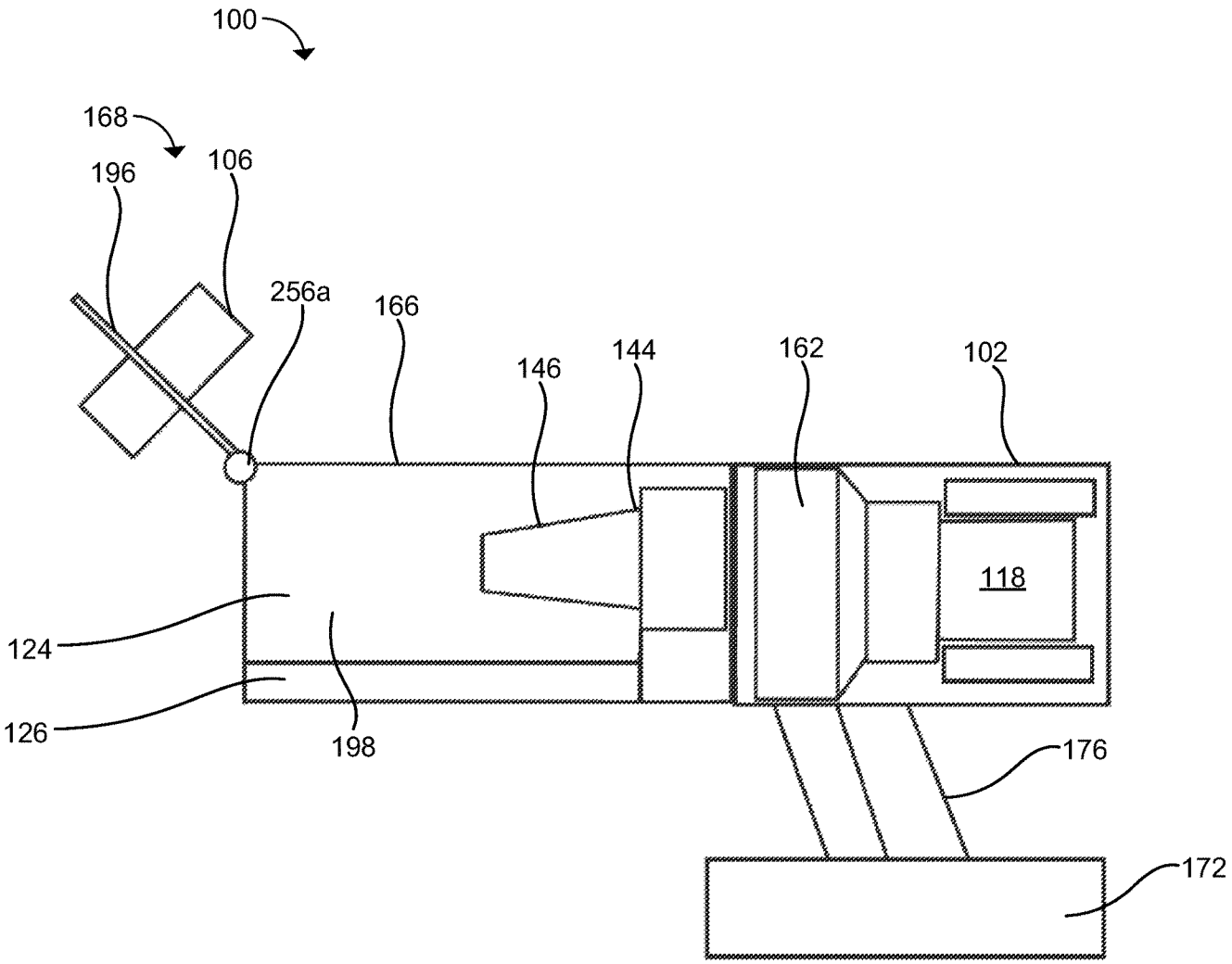
FIG. 52 is a side cross-sectional view of an alternate surface cleaning apparatus with an air treatment member of the surface cleaning apparatus in an open position.
Figure 53B:
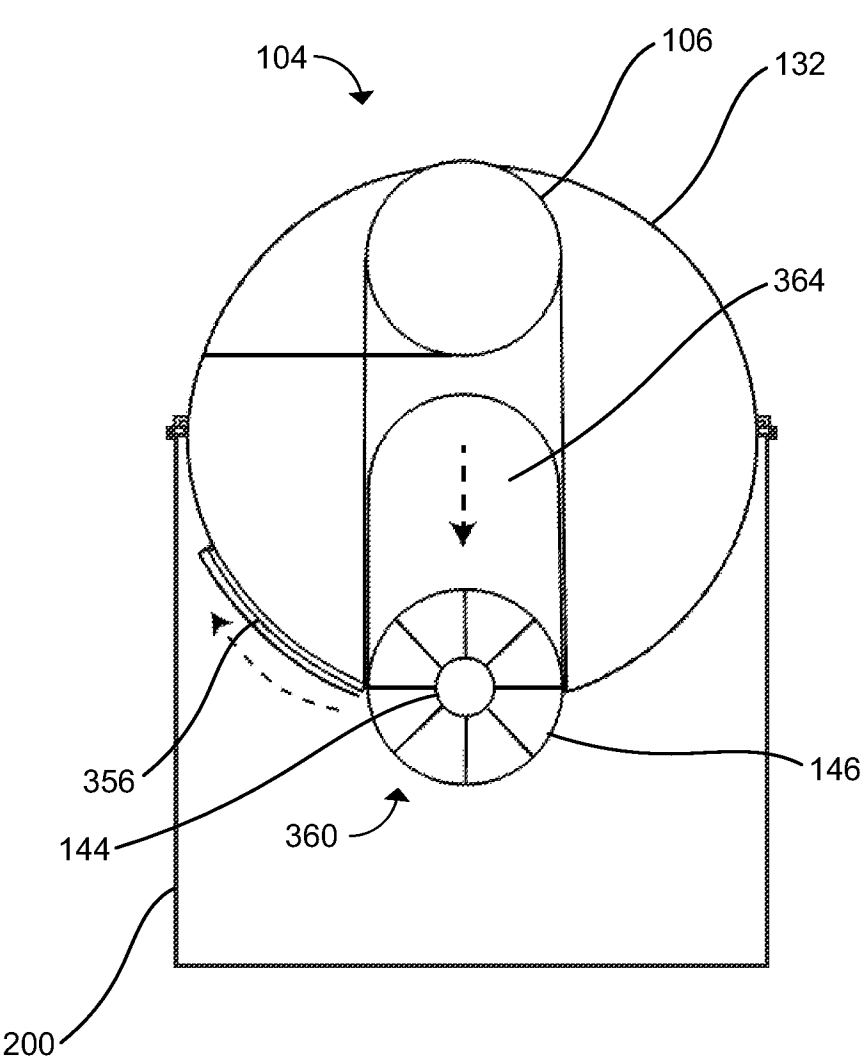
FIG. 53B is a front view of the surface cleaning apparatus of FIG. 53A with an air treatment member of the surface cleaning apparatus in an open position.
Figure 53A:
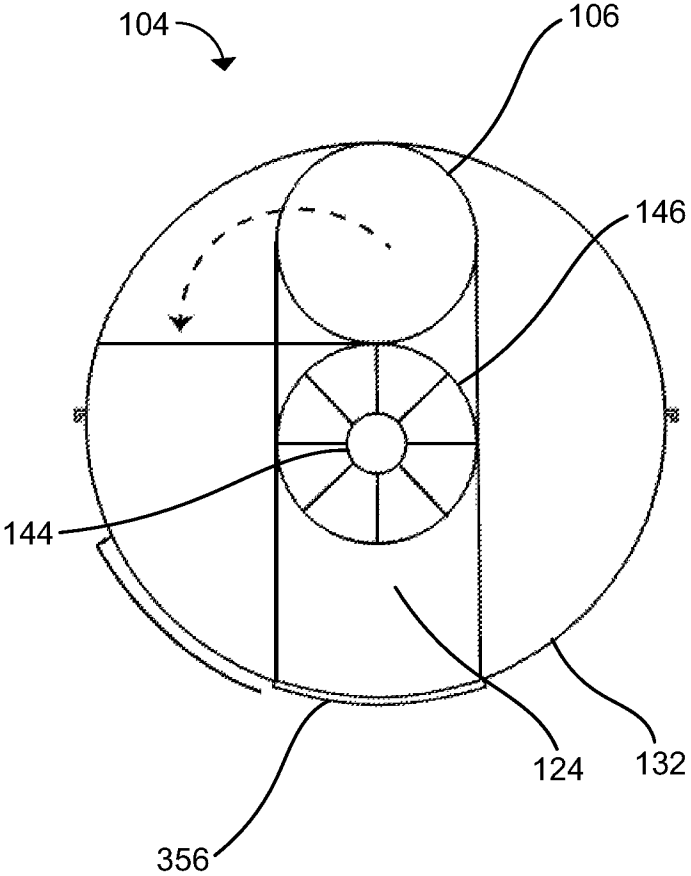
FIG. 53A is a front view of an alternate surface cleaning apparatus with an air treatment member of the surface cleaning apparatus in a closed position.
Figure 54B:
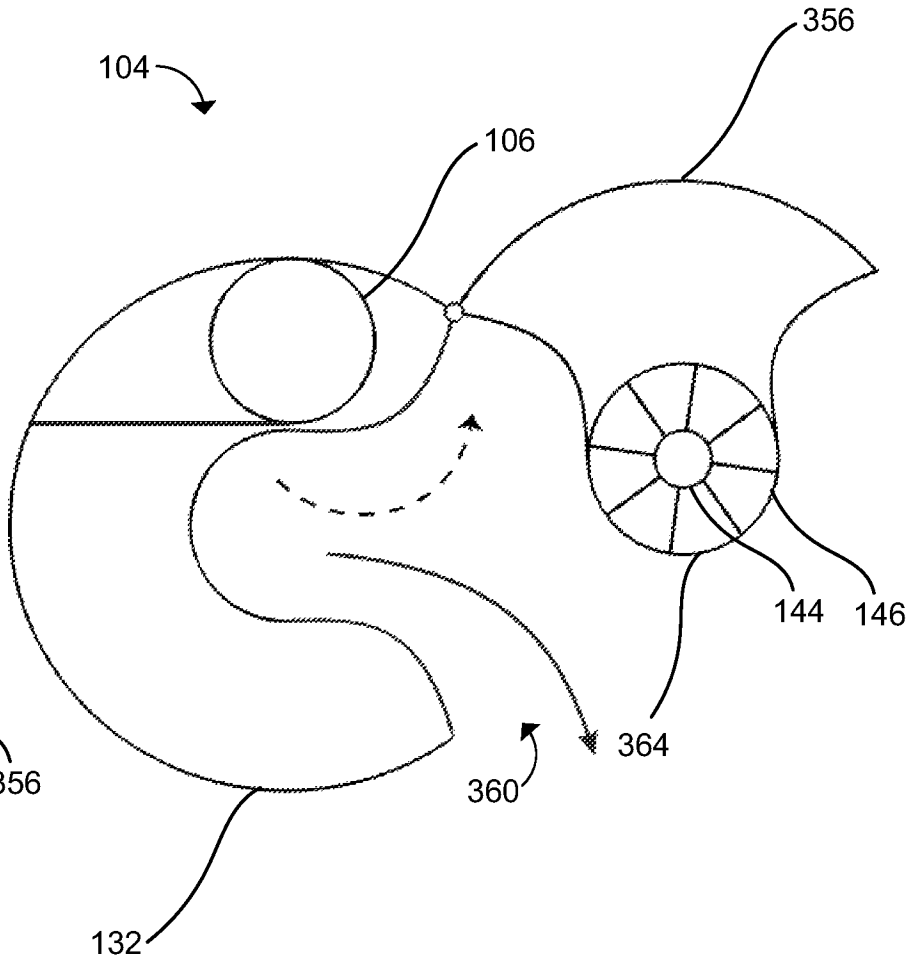
FIG. 54B is a front view of the surface cleaning apparatus of FIG. 54A with an air treatment member of the surface cleaning apparatus in an open position.
Figure 54A:
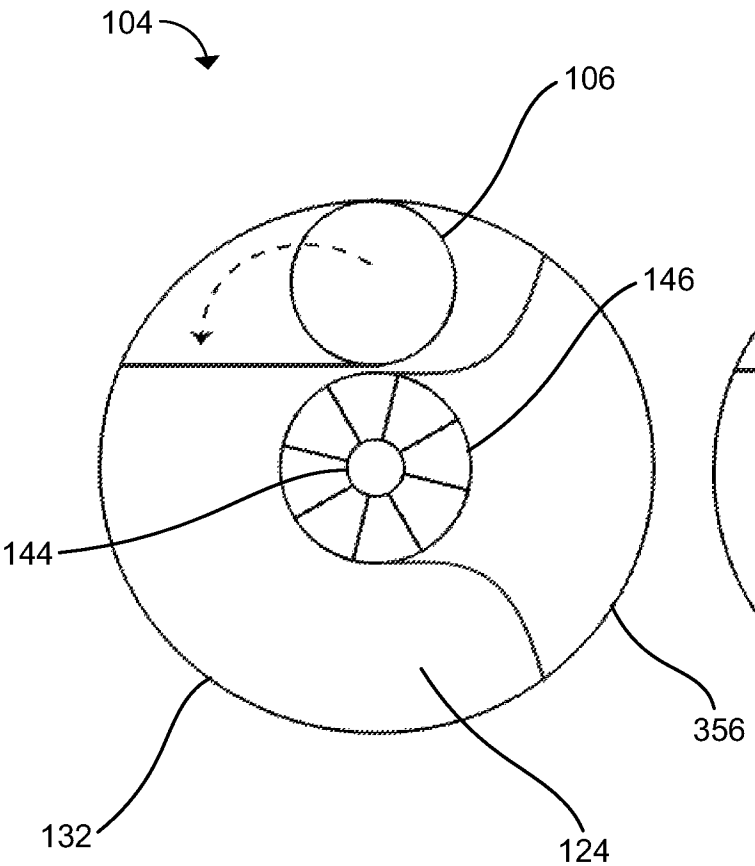
FIG. 54A is a front view of an alternate surface cleaning apparatus with an air treatment member of the surface cleaning apparatus in a closed position.
Figure 55B:
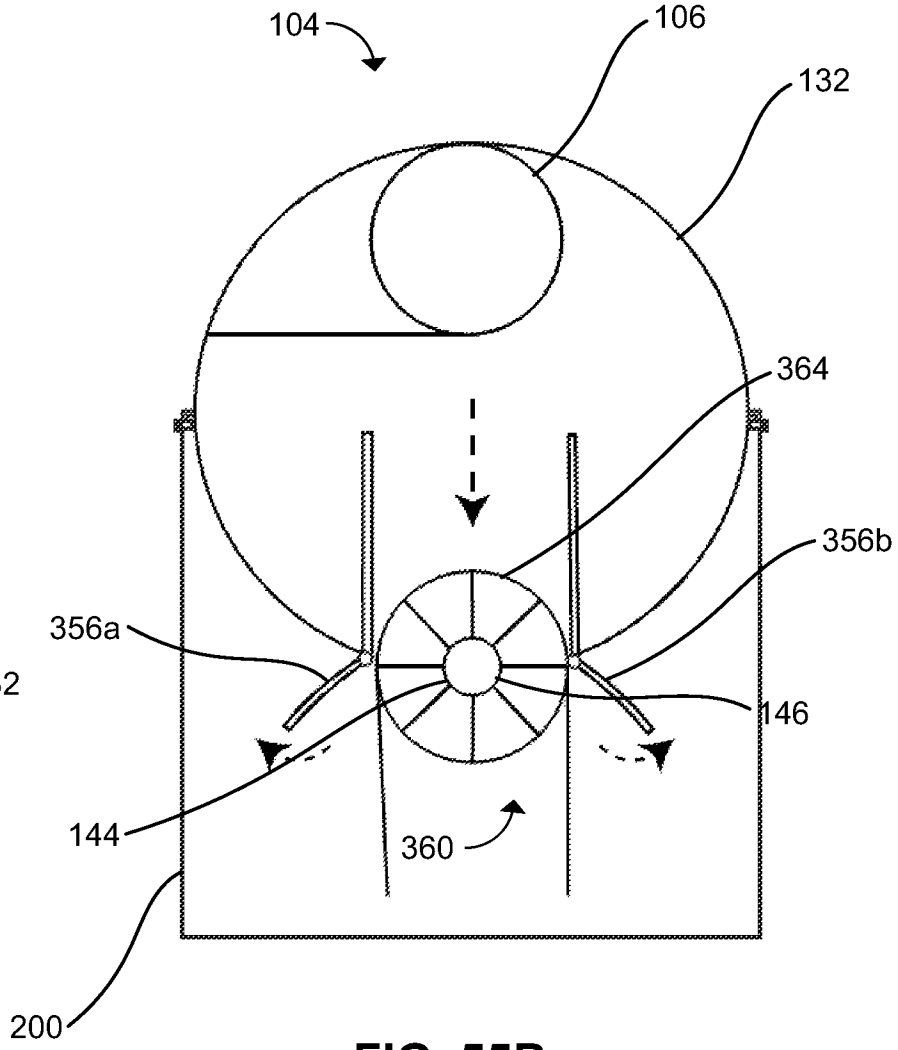
FIG. 55B is a front view of the surface cleaning apparatus of FIG. 55A docked to the docking station of FIG. 2 with an air treatment member of the surface cleaning apparatus in an open position.
Figure 55A:
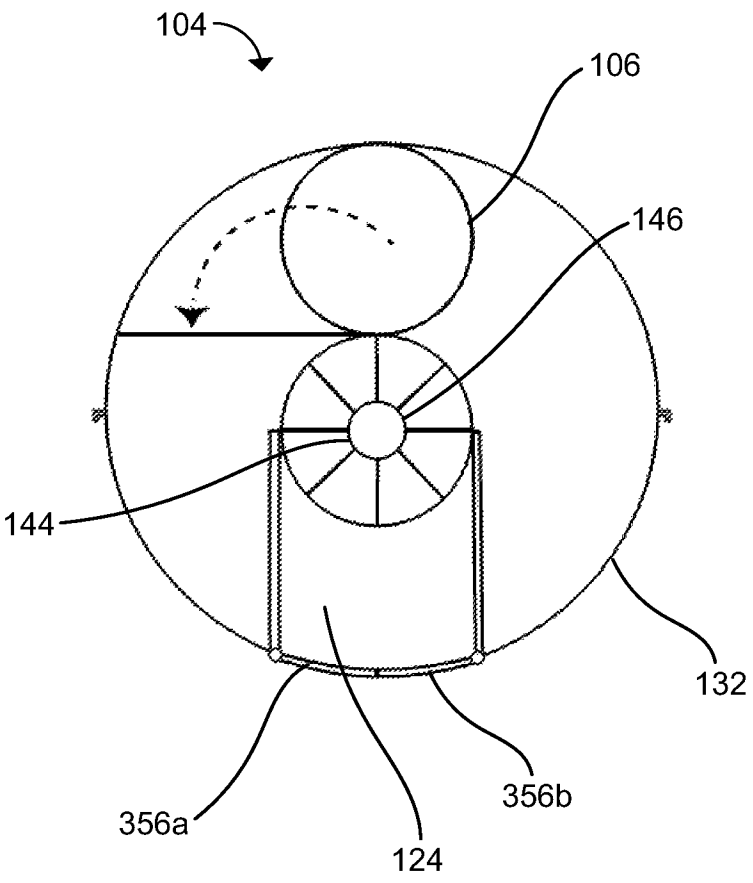
FIG. 55A is a front view of an alternate surface cleaning apparatus with an air treatment member of the surface cleaning apparatus in a closed position.
Figure 55C:
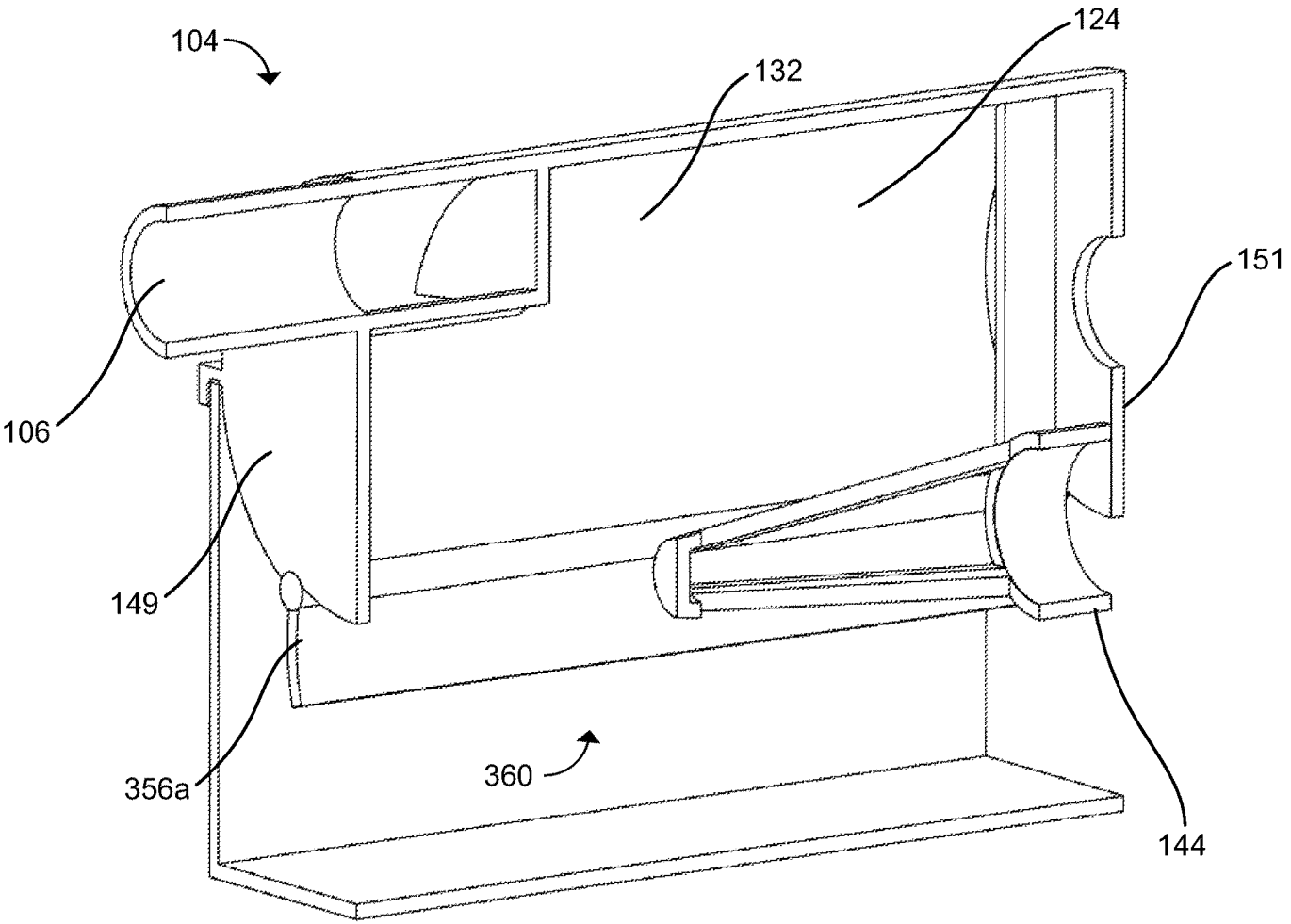
FIG. 55C is a cross-sectional perspective view of the surface cleaning apparatus of FIG. 55B.

Referring to FIGS. 51A-51B, in some embodiments, the stationary portion 166 includes the plate 156. FIG. 51A shows an example in which plate 156 remains stationary when moveable portion 168 is moved to the open position. Optionally, plate 156 may be rotatable about an axis of rotation 348 that is generally transverse to axis 148. FIG. 51B shows an example in which plate 156 may be rotated about axis of rotation 348 to provide greater access to air treatment chamber 124 and/or reduced backpressure for the dirt transferal air flow (in the docked position).

In some embodiments, surface cleaning apparatus 100 may not include a plate 156. As exemplified in FIG. 52, dirt collection chamber 126 may be positioned radially outwardly of air treatment chamber 124. When moveable portion 168 moves to the open position, both air treatment chamber 124 and dirt collection chamber 126 may be opened.

It will be appreciated that, in other embodiments, only the front end wall 196 translates or rotates laterally.

Air Treatment Member Having an Air Treatment Chamber with a Portion that Moves after the Air Treatment Chamber is Opened.

In accordance with another aspect of this disclosure, the moveable portion includes a portion of the sidewall of the air treatment chamber that can be opened to create an opening through which a portion of the air treatment chamber (e.g., the vortex finder with the mesh screen) can be moved through the opening from an in-use position (within the air treatment chamber) to a cleaning position. This can provide greater user access for cleaning and/or replacement of the internal components of the air treatment chamber. For example, the vortex finder and the mesh screen may be moved from an in-use position to a cleaning position in which the vortex finder and the mesh screen are positioned at least partially outside the air treatment chamber.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

Reference is now made to FIGS. 53A to 62. Sidewall 132 of air treatment chamber 124 may include one or more axially extending doors 356. Doors 356 may be openable to create an opening 360. A portion 364 of air treatment chamber 124 may be moved through opening 360 from an in-use position (i.e., the position for when the surface cleaning apparatus is being used to clean surfaces of dirt) within air treatment chamber 124 to a cleaning position (i.e., the position for when the surface cleaning apparatus is being emptied of dirt) where portion 364 is positioned at least partially outside air treatment chamber 124.

Doors 356 may have any suitable axial length (i.e., dimension parallel to the central air treatment chamber axis 134 (FIG. 6)) to create opening 360 that is large enough to accommodate movement of portion 364 from the in-use position to the cleaning position. In some embodiments, doors 356 may extend along the full axial length of sidewall 132. This may provide a large enough opening to accommodate portion 364 and also make it easier to completely empty 124 of dirt. In other embodiments, doors 356 may extend along a smaller portion of the axial length of sidewall 132. This may maintain greater structural integrity to the sidewall 132 when doors 356 are open.

Sidewall 132 may include any suitable number of doors 356 (e.g., 1 to 4) that are openable to create opening 360. As exemplified in FIGS. 53A, 53B, 54A, 54B, and 57 to 62, sidewall 132 may include a single door 356. As exemplified in FIGS. 55A and 55B, sidewall 132 may include two doors 356*a* and 356*b* that rotate open in opposite directions to create opening 360.

It will be appreciated that one or more doors rotatable about an axially extending rotational mount may be used to open any other portion of the air treatment assembly. For example, in the embodiment of FIG. 6, a first set of doors may open the dirt collection chamber. The first stage air treatment chamber may then be translated or rotated through the dirt collection chamber to a location partially or fully exterior to the dirt collection chamber. A second set of doors may then open the first stage air treatment chamber. It will be appreciated that the doors may open in the opposite order (the air treatment chamber is opened before the dirt collection chamber) or they may open concurrently.

It will also be appreciated that, in such an embodiment, the dirt collection chamber may be the dirt collection chamber for a first stage air treatment chamber and/or a second stage air treatment chamber.

Figure 56B:
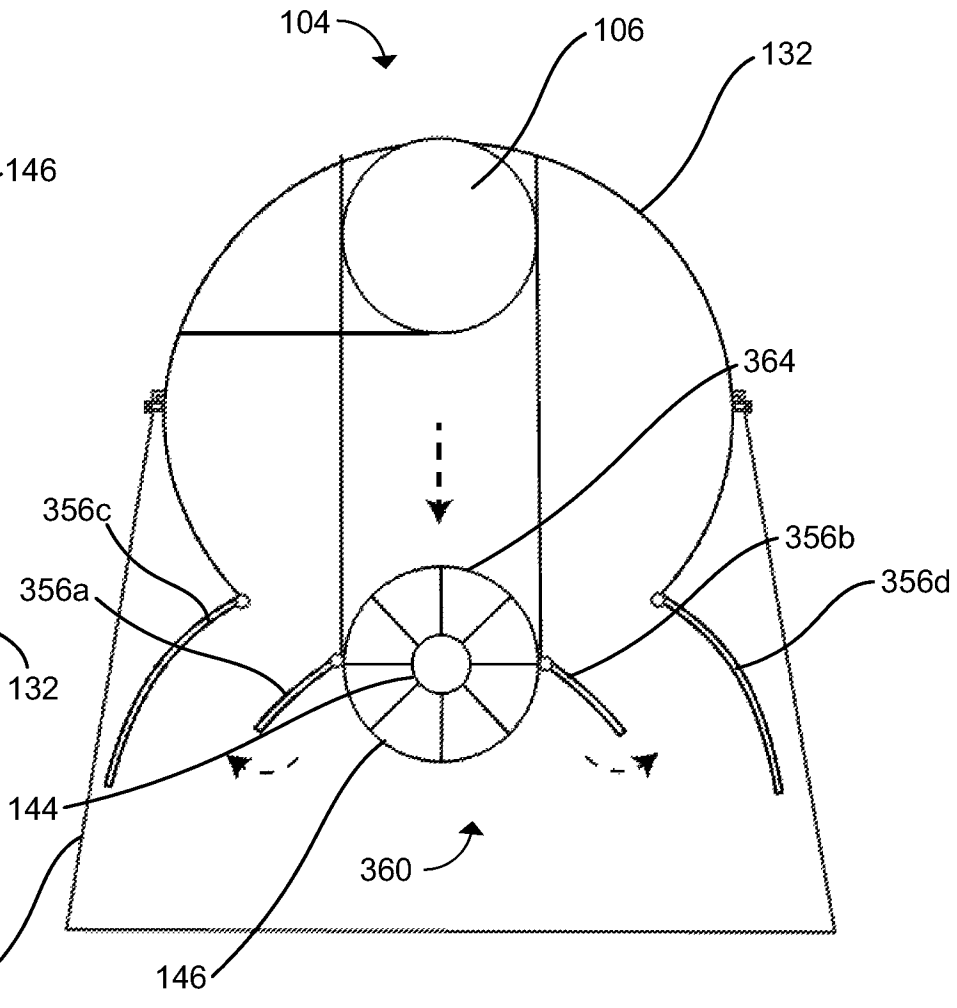
FIG. 56B is a front view of the surface cleaning apparatus of FIG. 56A docked to the docking station of FIG. 2 with an air treatment member of the surface cleaning apparatus in an open position.
Figure 56A:
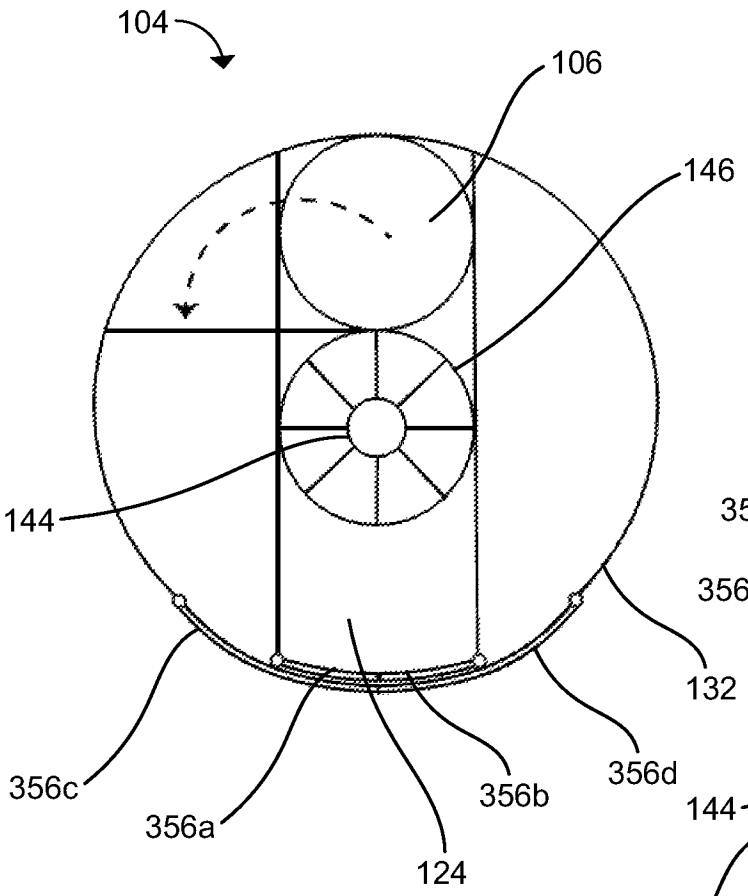
FIG. 56A is a front view of an alternate surface cleaning apparatus with an air treatment member of the surface cleaning apparatus in a closed position.
Figures 57A, 57B:
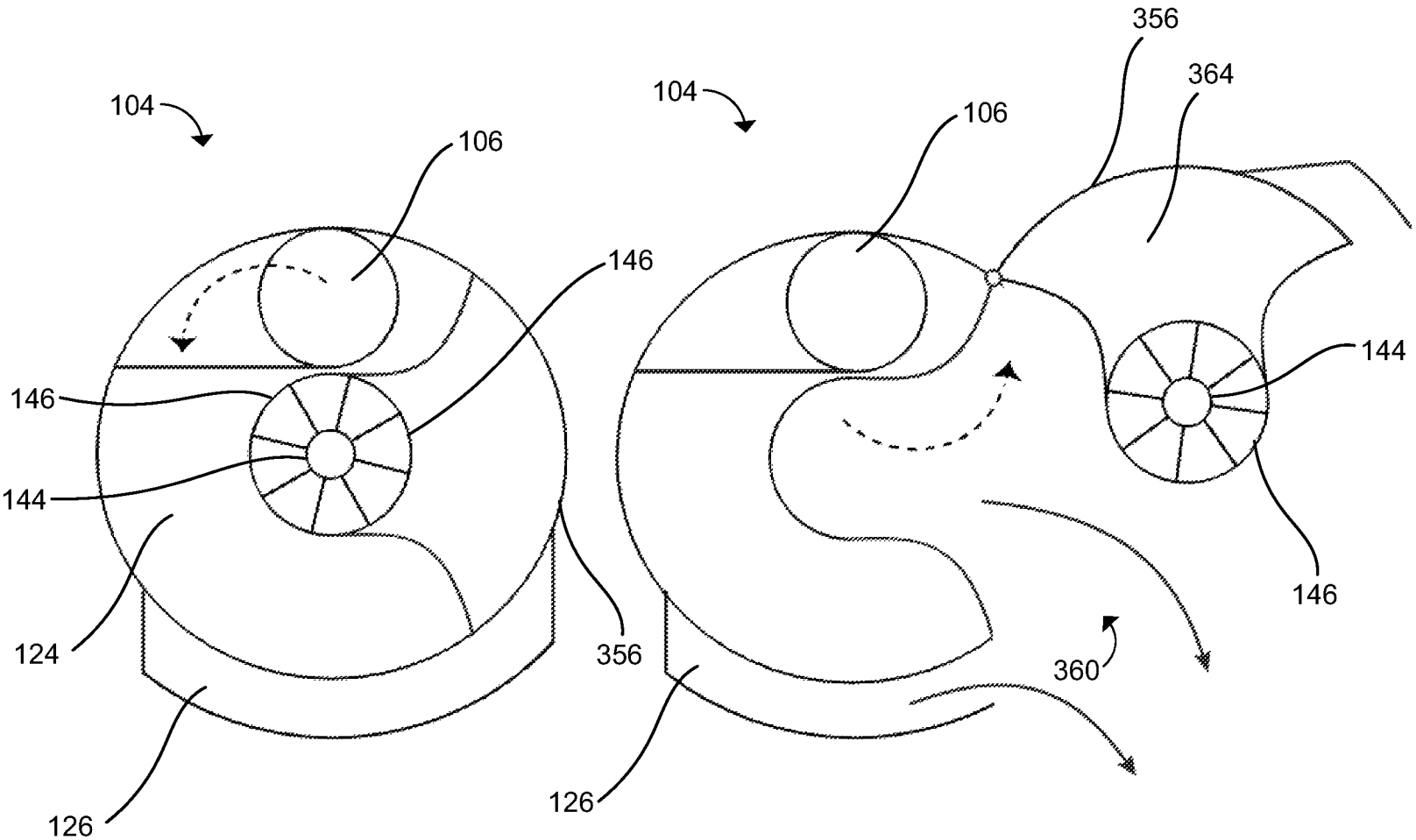
FIG. 57A is a front view of an alternate surface cleaning apparatus with an air treatment member of the surface cleaning apparatus in a closed position.
FIG. 57B is a front view of the surface cleaning apparatus of FIG. 57A with an air treatment member of the surface cleaning apparatus in an open position.
Figure 58B:
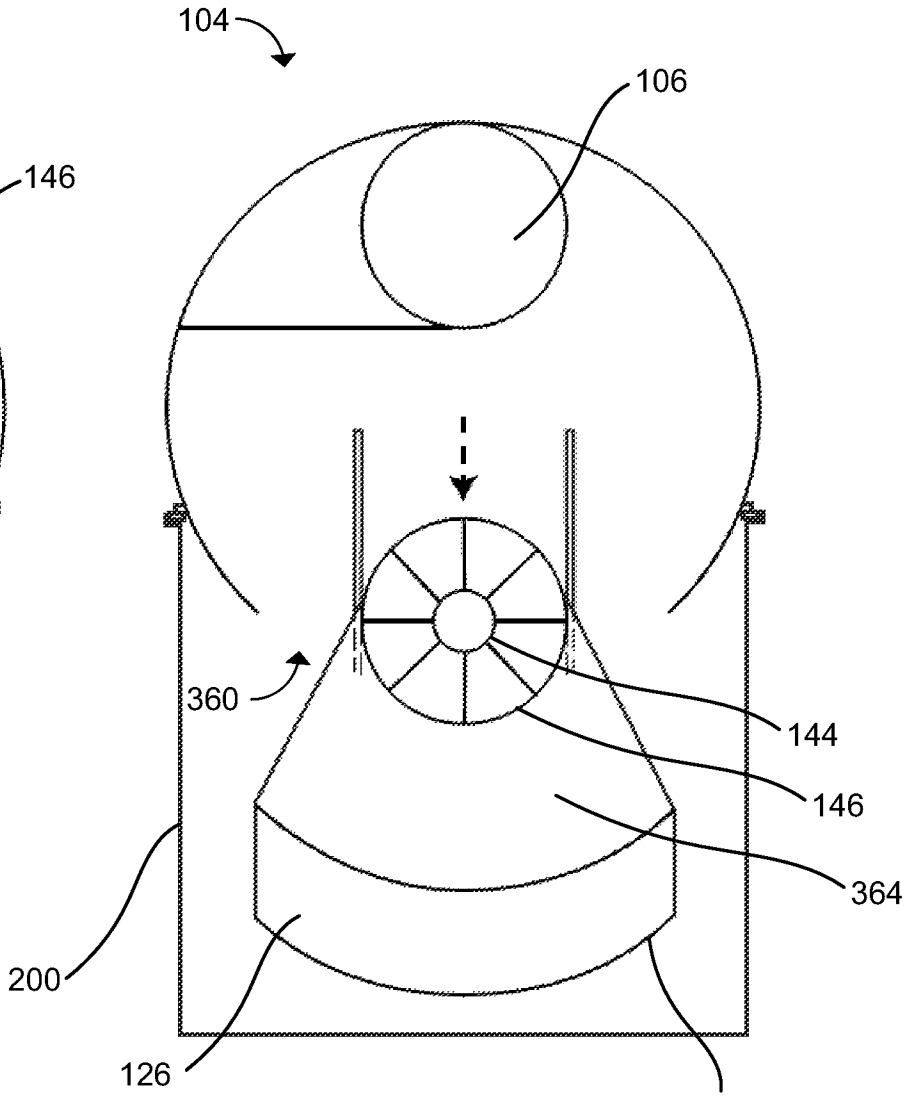
FIG. 58B is a front view of the surface cleaning apparatus of FIG. 58A docked to the docking station of FIG. 2 with an air treatment member of the surface cleaning apparatus in an open position.
Figure 58A:
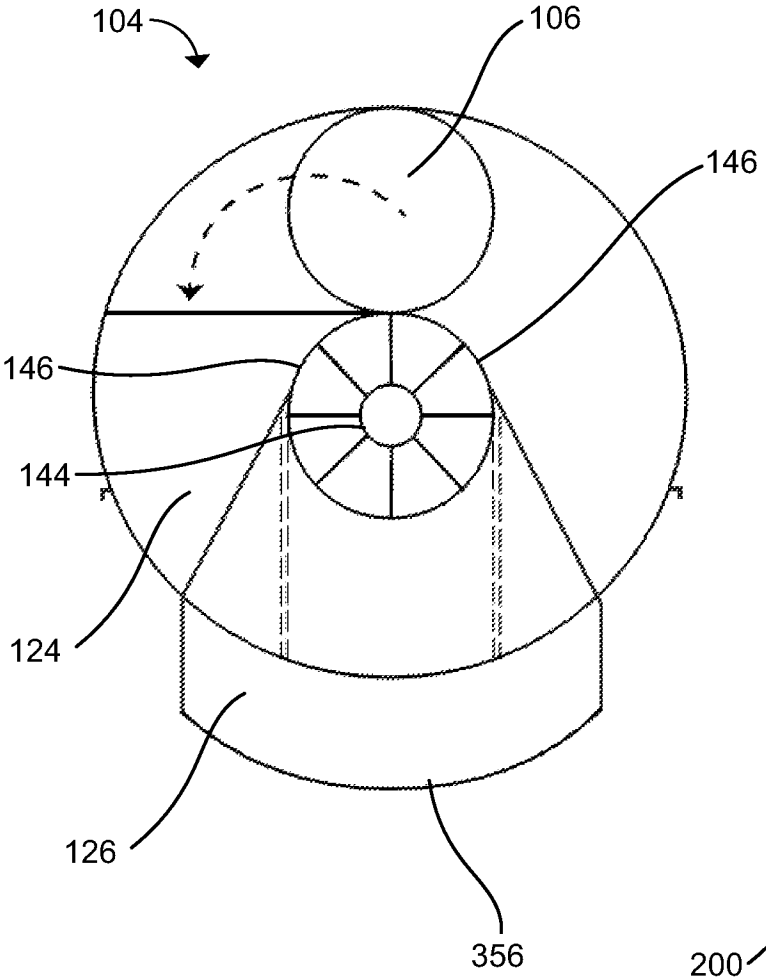
FIG. 58A is a front view of an alternate surface cleaning apparatus with an air treatment member of the surface cleaning apparatus in a closed position.
Figure 59:
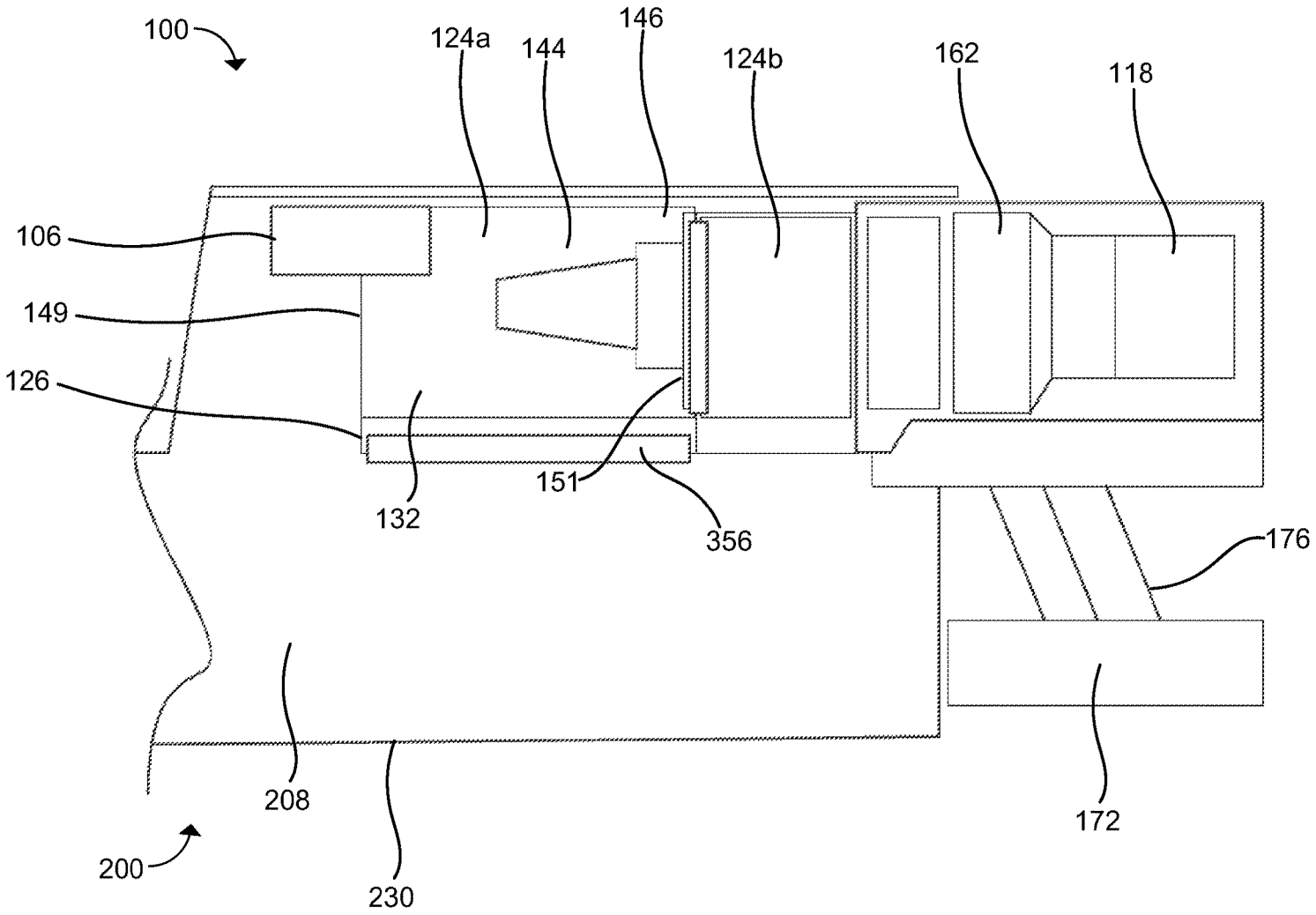
FIG. 59 is a side cross-sectional view of an alternate surface cleaning apparatus docked to the docking station of FIG. 2 with an air treatment member of the surface cleaning apparatus in a closed position.

As exemplified in FIGS. 56A and 56B, four doors 356*a*-356*d* are provided. A first set of doors 356*a* and 356*b* may be opening to create a first opening 360*a*. Vortex finder 144 and mesh screen 146 of a first stage air treatment chamber can be moved from an in-use position to a cleaning position through first opening 360*a*. A second set of doors 356*c* and 356*d* may be opened to create a second opening 360*b*. A portion of a second stage air treatment chamber (if present) may be moved from an in-use position to a cleaning position through second opening 360*b*. In other embodiments, more than 4 doors may be provided.

As exemplified in FIGS. 53A to 57B, doors 356 may be rotatably openable about an axis that extends generally axially. As exemplified in FIGS. 59 to 62, doors 356 may be translatable axially to create opening 360.

The opening of doors 356 may be actuated by the movement of portion 364 or doors 365 may be opened and/or closed using any suitable mechanism (e.g., mechanical, electromechanical or pneumatic). The doors 356 may be biased in one direction (e.g., the opening direction or the closing direction).

As exemplified in FIGS. 53A, 53B, 55A, 55B, 56A, 56B, 58A, 58B, and 60, portion 364 may be translatable from an in-use position to a cleaning position. The translational movement can be, for example, a downward, sideward, or diagonal movement. The translational movement can be a single movement (e.g., a single diagonal movement) or a combination of movements (e.g., a diagonal movement that includes a combination of a downward and a sideward movement). In some embodiments (e.g., as shown in FIGS. 54A, 54B, 57A, 57B, and 62), portion 364 may be rotatable from an in-use position to a cleaning position.

In some embodiments, door 356 may move independently of portion 364 to create opening 360. In other embodiments (e.g., FIGS. 54A, 54B, 57A, 57B, 58A and 58B), door 356 may move with portion 364 (e.g., portion 364 may be drivingly connected, e.g., by a mechanical linkage, to the doors or an electromechanical member that is driving connected to the doors).

Portion 364 may include, for example, vortex finder 144 and mesh screen 146. As exemplified in FIGS. 60 and 62, portion 364 may include at least a portion of second end-wall 151 of air treatment chamber 124. This may provide access to other portions of air treatment member 104. For example, this may provide access to components located behind (e.g., downstream) of portion 364, such as a second air treatment chamber 124*b* and/or pre-motor filter 162.

As exemplified in FIGS. 57A to 62, air treatment member may include a dirt collection chamber 126. As discussed previously, door 356 may include at least a portion 368 of sidewall 180 of dirt collection chamber 126. Both air treatment chamber 124 and dirt collection chamber 126 may be opened concurrently when door 356 is moved to the open position. This may enable removal of dirt collected in dirt collection chamber 126.

Figure 60:
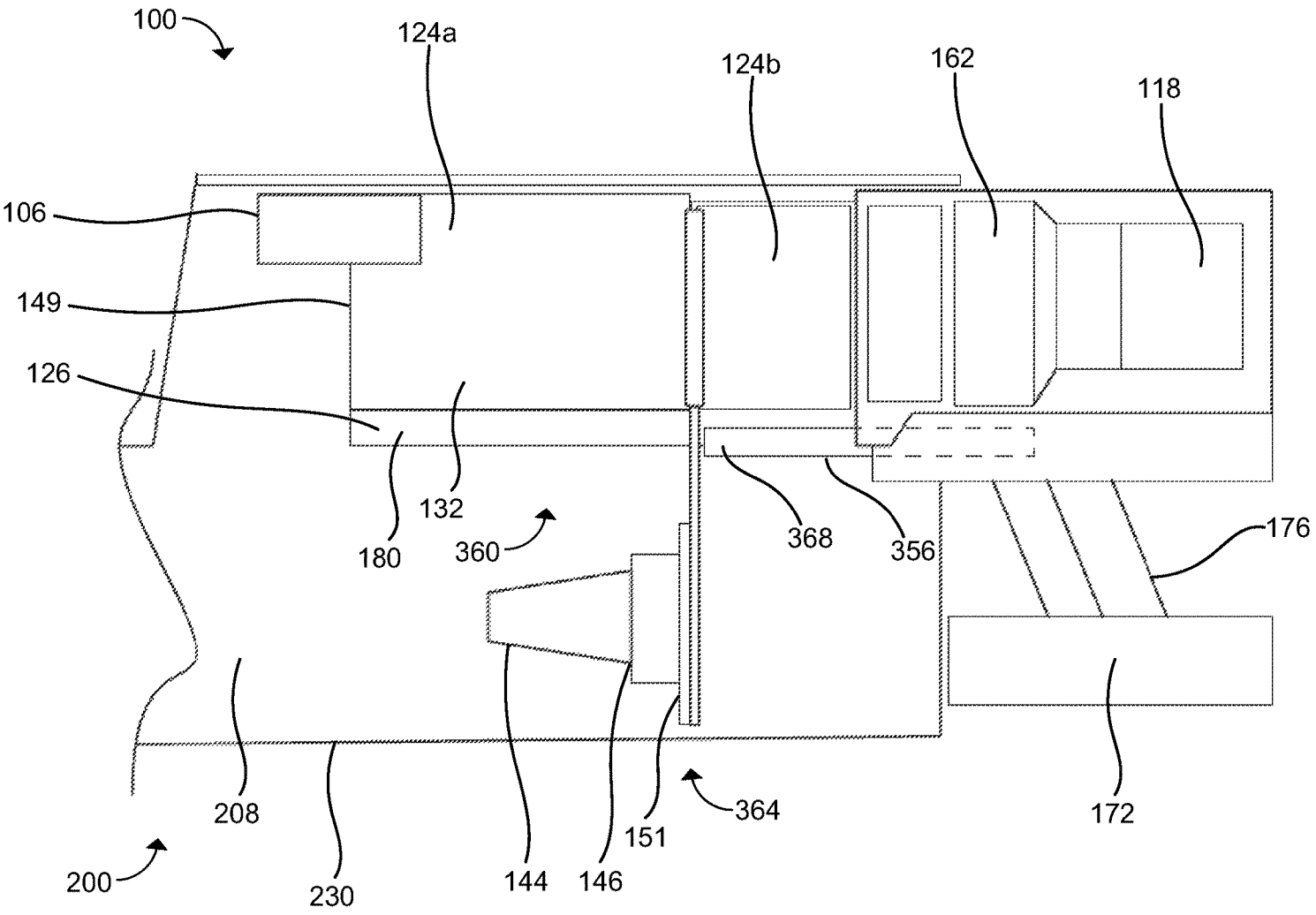
FIG. 60 is a side cross-sectional view of the surface cleaning apparatus of FIG. 59 with the air treatment member in an open position.
Figure 61:
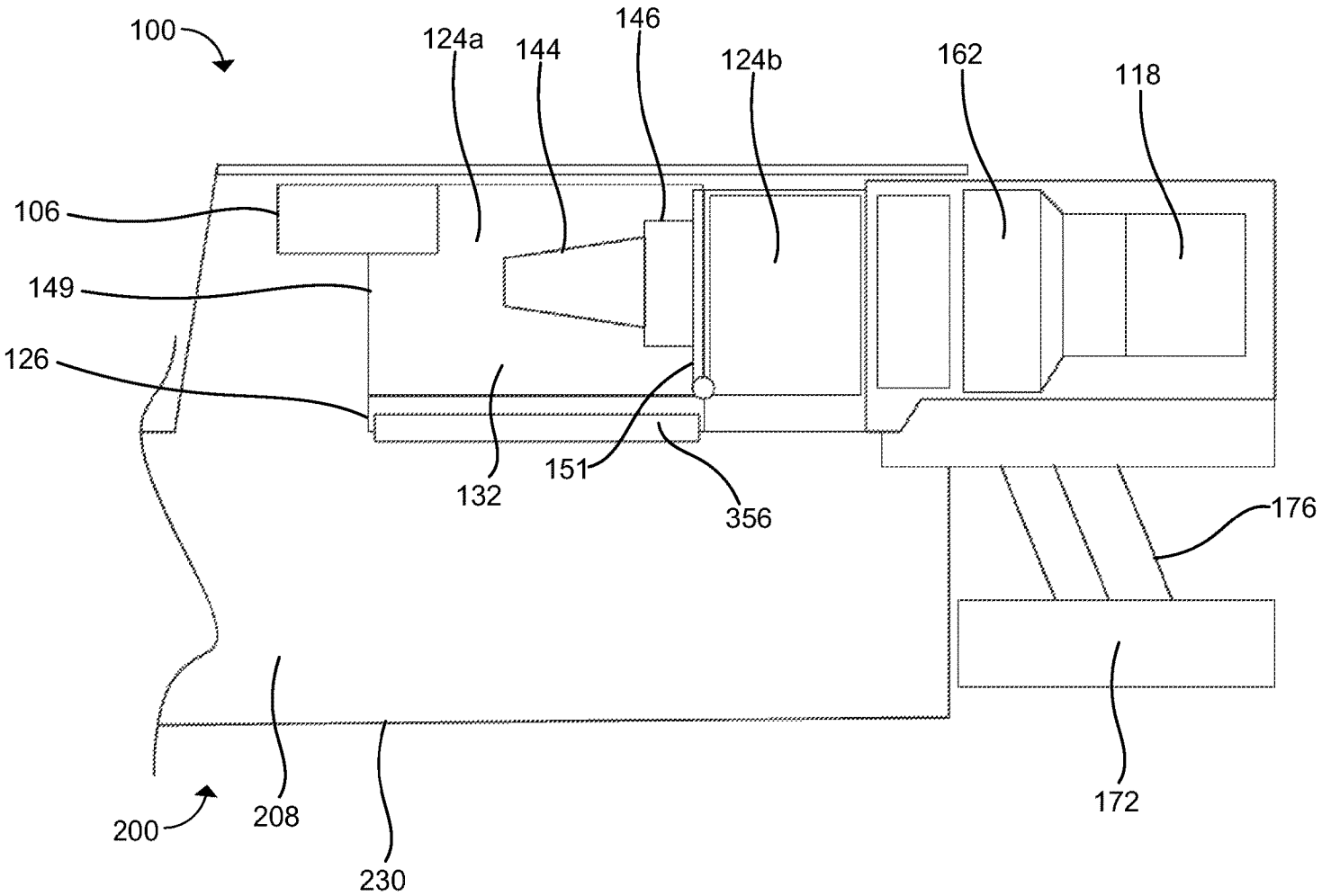
FIG. 61 is a side cross-sectional view of an alternate surface cleaning apparatus docked to the docking station of FIG. 2 with an air treatment member of the surface cleaning apparatus in a closed position.

Portion 364 may travel through dirt collection chamber 126 when moving from the in-use position to the cleaning position. As exemplified in FIGS. 59 and 60, portion 364 may travel through dirt collection chamber 126 when translate from the in-use position (FIG. 59) to the cleaning position (FIG. 60). As exemplified in FIGS. 61 and 62, portion 364 may travel through dirt collection chamber 126 when rotated from the in-use position (FIG. 61) to the cleaning position (FIG. 62).

Figure 62:
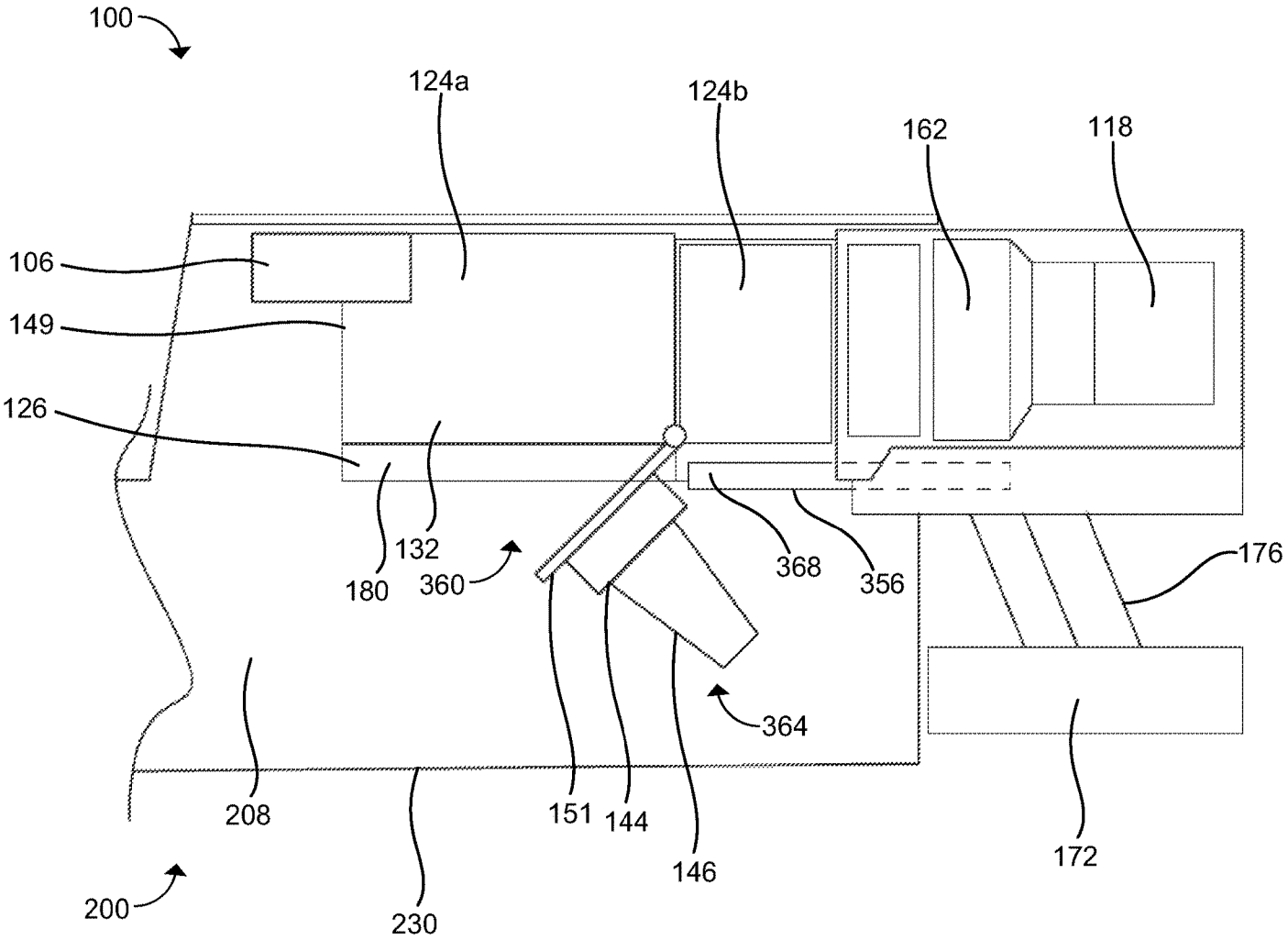
FIG. 62 is a side cross-sectional view of the surface cleaning apparatus of FIG. 61 with the air treatment member in an open position.

As exemplified in FIG. 62 and as discussed previously, a portion (e.g., the vortex finder) may also be rotationally mounted). In such a case, if the pre-motor filter is port of the rotatably mounted portion, the portion may rotate (e.g., to the position shown in FIG. 62) to expose the downstream side of the pre-motor filter.

Air Treatment Member with a Moveable Portion that Includes a Portion of the Air Treatment Chamber Sidewall and a Portion of the Dirt Collection Chamber Sidewall.

In accordance with another aspect of this disclosure, the moveable portion of the air treatment member includes an axially translatable portion that includes portions of the air treatment chamber sidewall and the dirt collection chamber sidewall. The stationary portion may include the rear end-wall of the air treatment chamber. When the moveable portion is moved from the closed position to the open position, the air treatment chamber and the dirt collection chamber are opened. This can enable removal of dirt collected in the air treatment chamber and/or the dirt collection chamber.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

Figure 63:
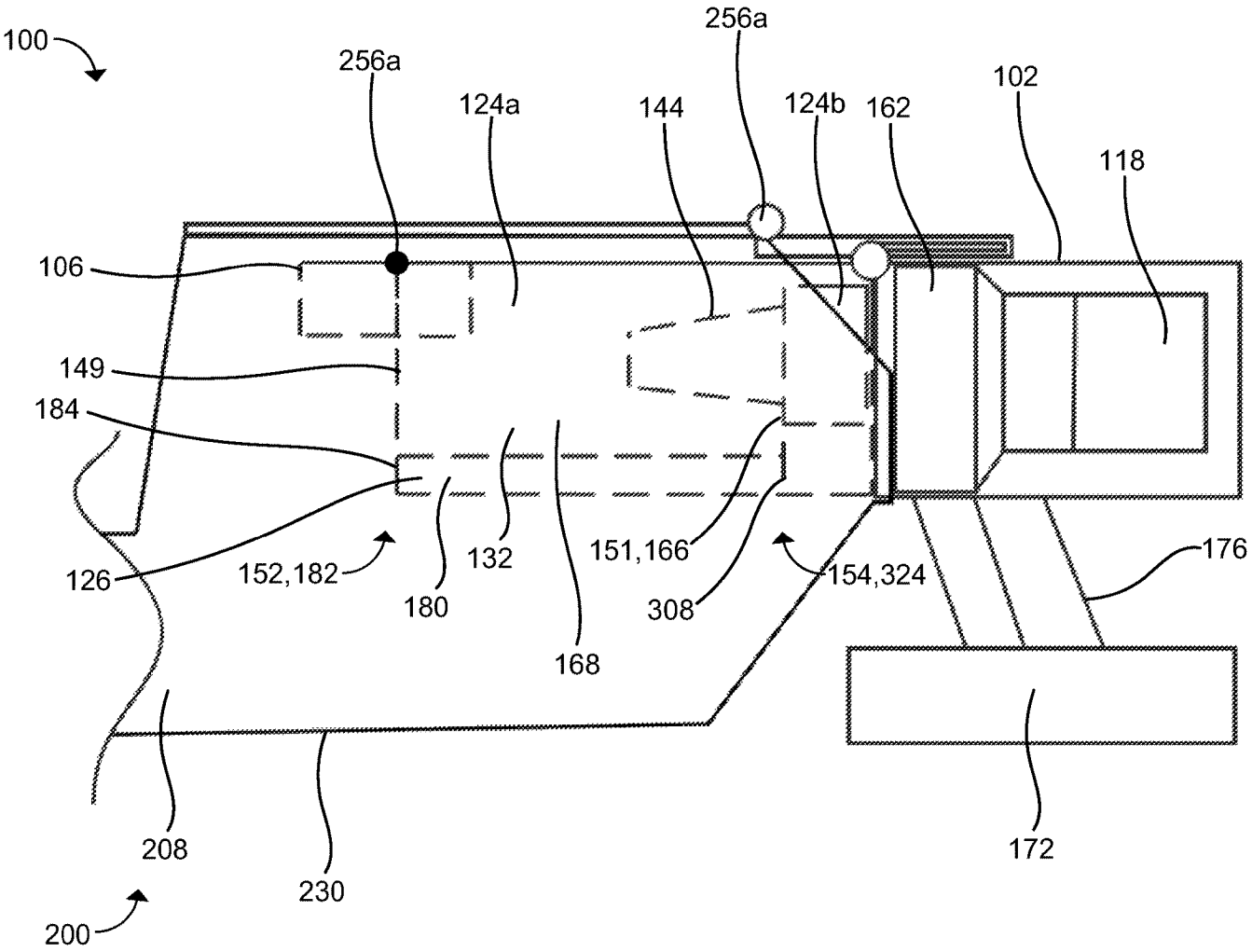
FIG. 63 is a side cross-sectional view of an alternate surface cleaning apparatus docked to the docking station of FIG. 2 with an air treatment member of the surface cleaning apparatus in a closed position.
Figure 64:
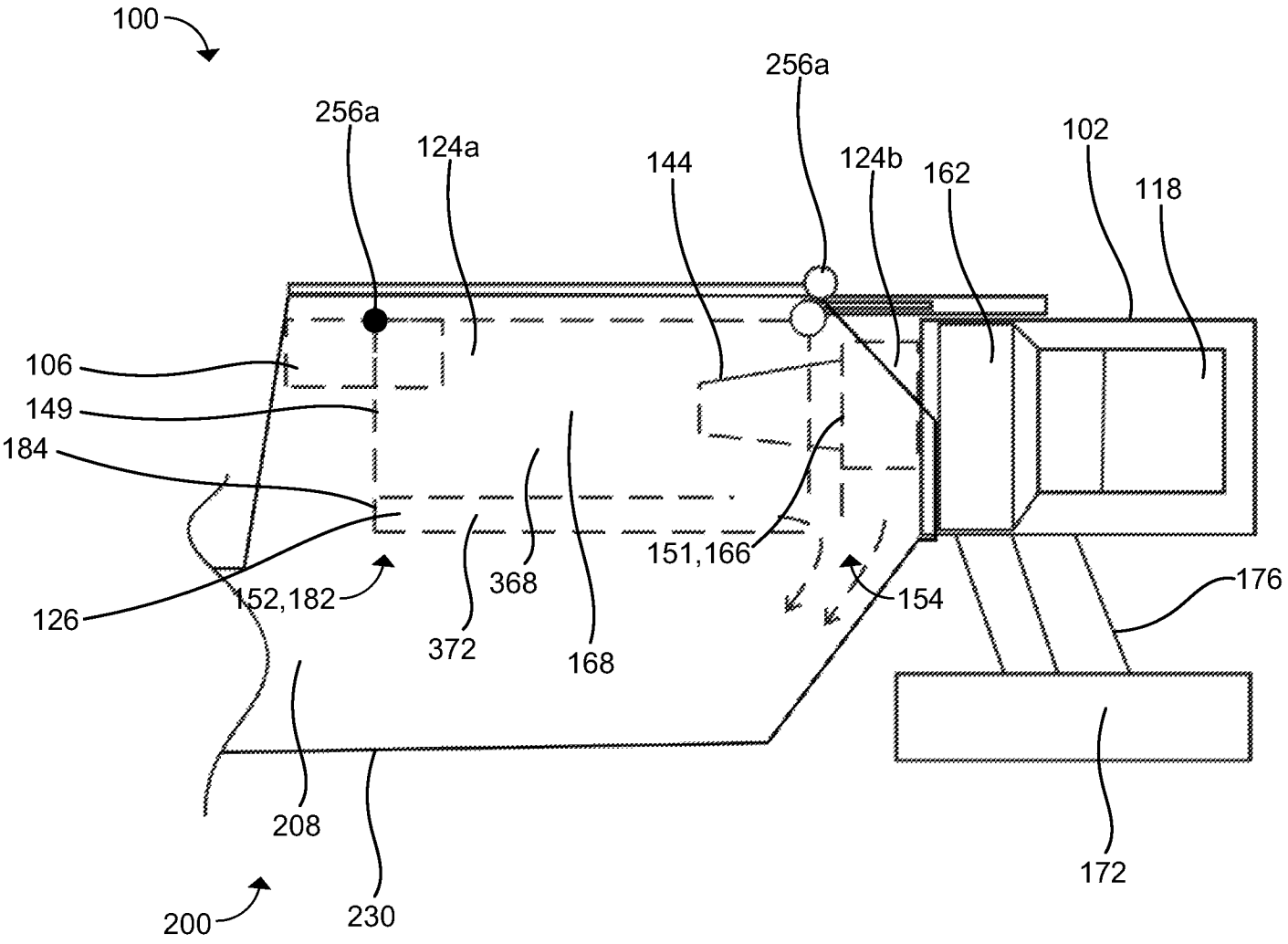
FIGS. 64 and 65 are side cross-sectional views of the surface cleaning apparatus of FIG. 63 with the air treatment member in an open position.
Figure 65:
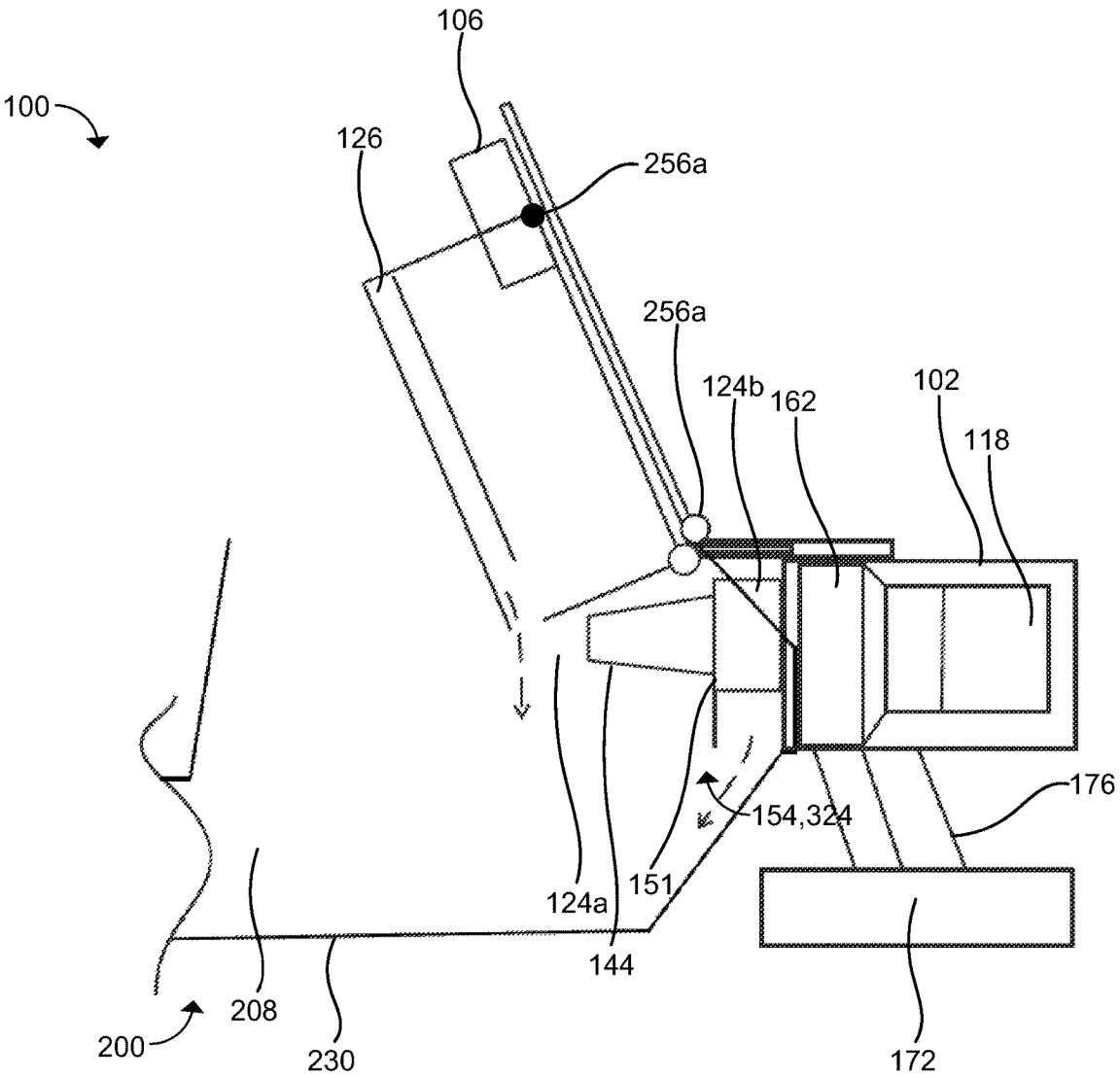

Referring now to FIGS. 63 to 65, the moveable portion 168 may be axially translated between a closed position (FIG. 63) to an open position (FIG. 64). The moveable portion may include a portion 368 of sidewall 132 of air treatment chamber 124*a* and a portion 372 of sidewall 180 of dirt collection chamber 126. The translation movement can be in a forward or a rearward direction.

The docking interface can be sized to accommodate the translation movement and in the docked position, the sealing interface can maintain a closed volume when the moveable portion 168 translates into the open position and moves into the closed volume. In the open position, the air treatment chamber 124*a* and dirt collection chamber 126 are opened. This can enable removal of dirt collected in air treatment chamber 124*a* and/or dirt collection chamber 126.

As exemplified in FIG. 64, the moveable portion 168 may translate in a forward direction to move from the closed position (FIG. 63) to the open position. In the closed position, first end 152 and second end 154 of air treatment chamber 124*a*, and first end 182 and second end 324 of dirt collection chamber 126 may be closed (FIG. 63). In the open position, first end 152 of air treatment chamber 124*a* and first end 182 of dirt collection chamber 126 may remain closed. In the open position, second end 154 of air treatment chamber 124*a* and second end 324 of dirt collection chamber 126 may be opened.

In some embodiments, second stage air treatment chamber 124*b* may include a dirt outlet 308 that is in communication with dirt collection chamber 126. This may enable dirt separated by second stage air treatment chamber 124*b* to be transferred to dirt collection chamber 126.

In some embodiments, first end 152 may be openable, e.g., independent of or concurrently with, the opening of moveable portion 168. For example, as discussed elsewhere herein, at least a portion of first end-wall 149 may be openable (e.g., rotatable or translatable) e.g., when moveable portion 168 is in the closed position. FIGS. 63 to 65 shown an example in which first end wall 149 is rotatable by a rotational mount 256*a* independent of the position of moveable portion 168. This may enable user access to internal components of the air treatment chamber from an end away from the dirt outlet.

In some embodiments, the moveable portion 168 may be movably mounted to main body 102 using rotational mount 256*a*. The moveable portion 168 may be rotated between a closed position (FIG. 63) in which air treatment chamber 124*a* is closed and an open position (FIG. 65) in which air treatment chamber 124*a* is opened. Rotational mount 256*a* may be provided at any suitable location. As exemplified in FIGS. 63 to 65, rotational mount 256*a* may be provided at an upper end of air treatment chamber 124*a*.

Air Treatment Member with a Transverse Air Treatment Chamber

In accordance with another aspect of this disclosure, the air treatment member includes a transverse air treatment chamber (i.e., the air treatment chamber axis is transverse to the longitudinal axis). This may provide a more compact configuration for the surface cleaning apparatus (e.g. in which the axial dimension of the air treatment chamber is greater than the lateral dimension of the air treatment chamber). When the moveable portion moves to the open position, the air treatment chamber and/or a dirt collection chamber is opened. This may enable removal of dirt collected in the air treatment chamber and/or dirt collection chamber.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

Referring now to FIGS. 66 to 70, air treatment member 104 may have a first lateral end 376, an axially spaced apart second lateral end 380 and an air treatment member sidewall 384 extending between first lateral end 376 and second lateral end 380. Air treatment chamber 124 may have a first lateral end 388, an axially spaced apart second lateral end 392, an air treatment chamber axis 134 extending between first lateral end 376 and second lateral end 380, and a sidewall 396 extending between first lateral end 376 and second lateral end 380.

In such a configuration, the moveable portion may open the air treatment chamber and/or a dirt collection chamber.

For example, the one or both of the opposed lateral end walls of the air treatment assembly is opened, then, during an evacuation operation, air may travel transversely through the air treatment assembly (the air treatment chamber and/or the dirt collection chamber) to empty the air treatment chamber and/or the dirt collection chamber.

Alternately, or in addition, if the air treatment chamber is the front end of the air treatment assembly, then the transversely extending sidewall of the air treatment chamber may be opened. For example, if the sidewall includes a stationary portion and a moveable portion that meet at a transversely extending juncture in the closed position, then the moveable portion may translate or rotate open.

Alternately, or in addition a portion of the air treatment assembly may open to enable a portion of the air treatment assembly to translate or rotate to a location exterior to the air treatment chamber as discussed previously herein.

Figure 75:
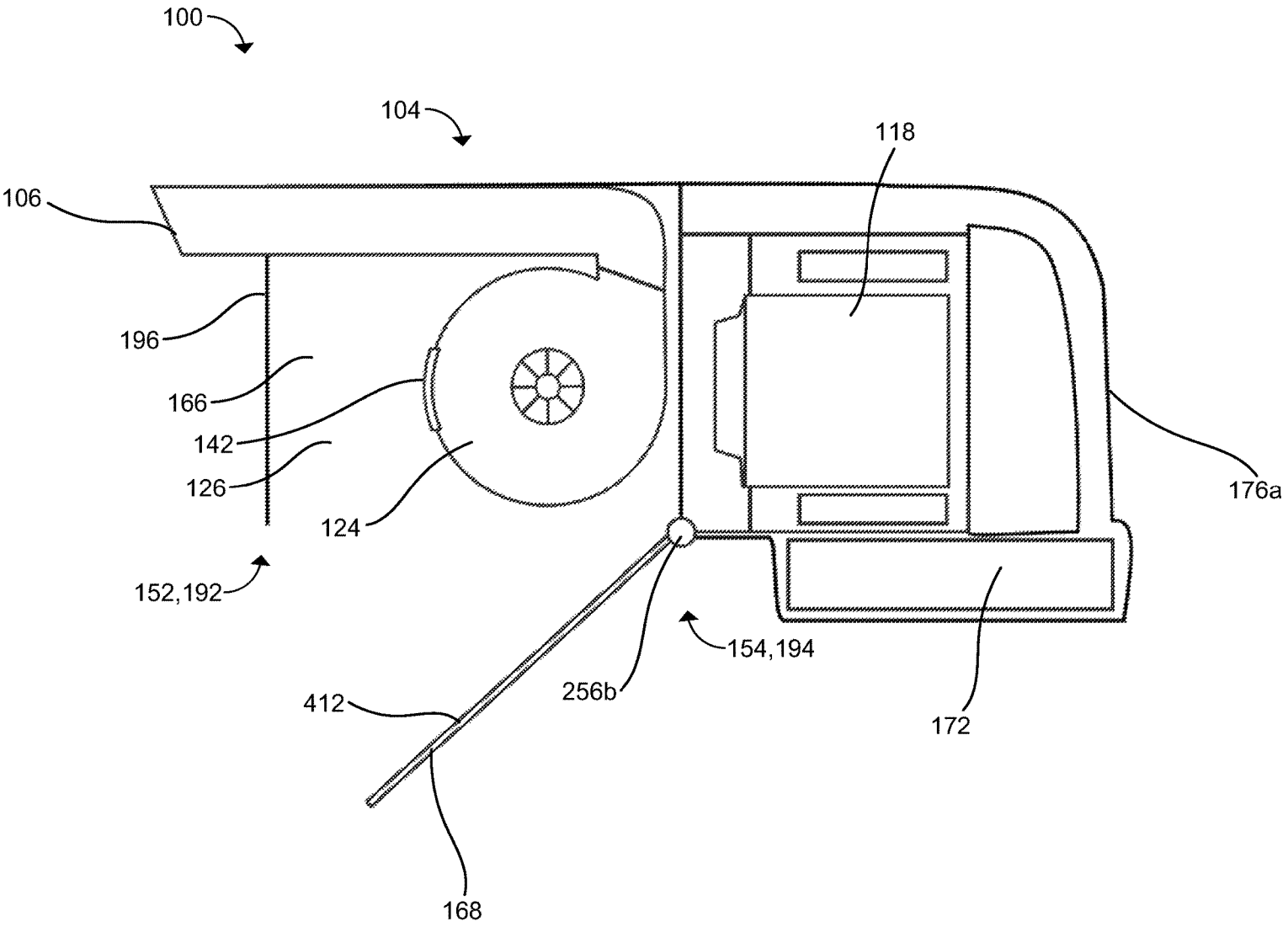

For example, the moveable portion 168 may include a portion of sidewall 384 of air treatment member 104. The stationary portion 166 may include first end-wall 196 of air treatment member 104. The moveable portion may move between a closed position (e.g., FIGS. 66 to 70) and an open position (e.g., FIGS. 71 to 75). As exemplified in FIGS. 71 to 74, the moveable portion 168 may include a portion of sidewall 396 of air treatment chamber 124. In other examples (e.g., FIG. 75), the stationary portion 166 includes all of sidewall 396 of air treatment chamber 124 and the moveable portion 168 includes only a portion of air treatment member wall(s) (e.g. sidewall 384 and/or ends 376, 380). As exemplified in FIG. 75, the moveable portion 168 may have an inner surface 412 that is free of discontinuities (e.g., inner surface 412 may be generally planar).

Figure 73:
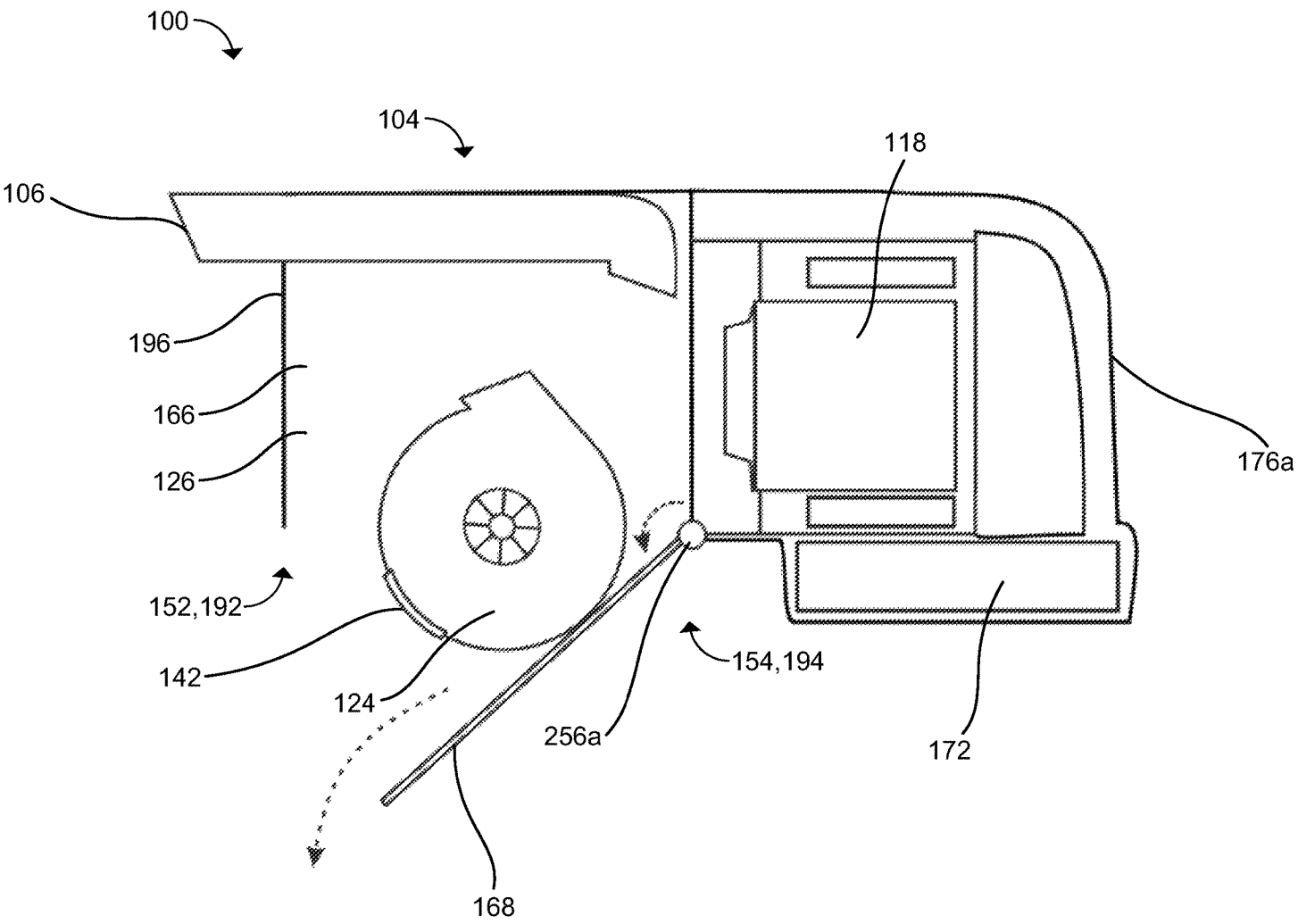
FIGS. 73 to 75 are side cross-sectional views of a surface cleaning apparatus similar to the surface cleaning apparatus of FIG. 68 with the air treatment member in an open position, in accordance with various alternate embodiments.
Figure 74:
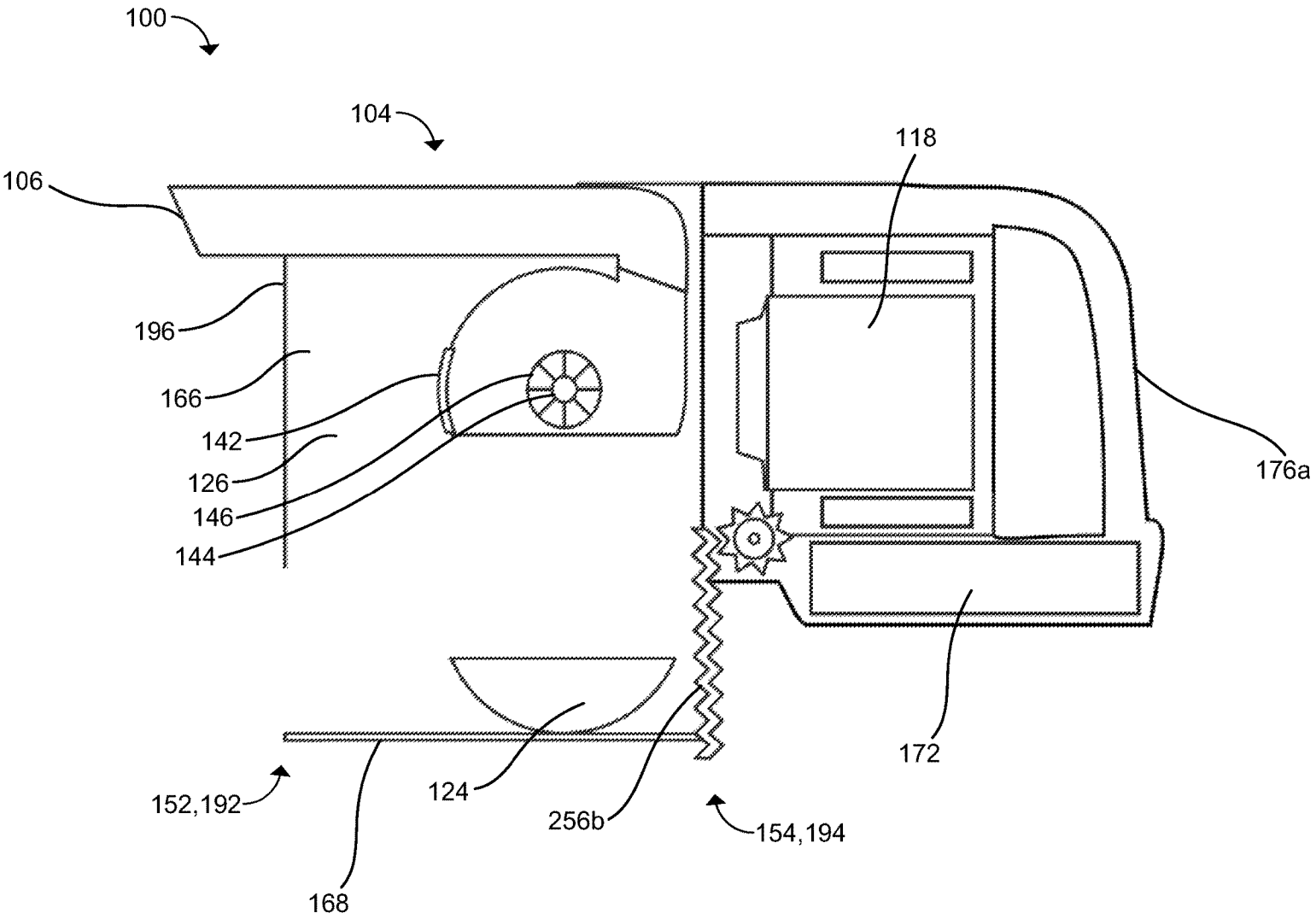

As exemplified in FIG. 73, moveable portion 168 may include all of air treatment chamber 124. For example, one or more of the lateral end walls of the air treatment chamber may be part of the stationary portion thereby enabling lateral air flow through the air treatment chamber during a docking operation. In other examples, moveable portion 168 may include only a portion (i.e. some but not all) of air treatment chamber 124. As exemplified in FIG. 74, moveable portion 168 may include a lower portion of air treatment chamber 124. This may provide greater access to internal components (e.g., vortex finder 144 and mesh screen 146) of air treatment chamber 124 for inspection, cleaning, repair, and/or replacement.

As exemplified in FIGS. 66-72 and 74, moveable portion 168 may be translatably mounted. Moveable portion 168 may translate between a closed position and an open position in any suitable direction (e.g., upward, downward, forward, rearward, or sideward). As exemplified in FIGS. 73 and 75, moveable portion 168 may be rotatably mounted. Moveable portion 168 may rotate between a closed position and an open position in any suitable direction (e.g., upward, downward, or sideward).

Figure 67:
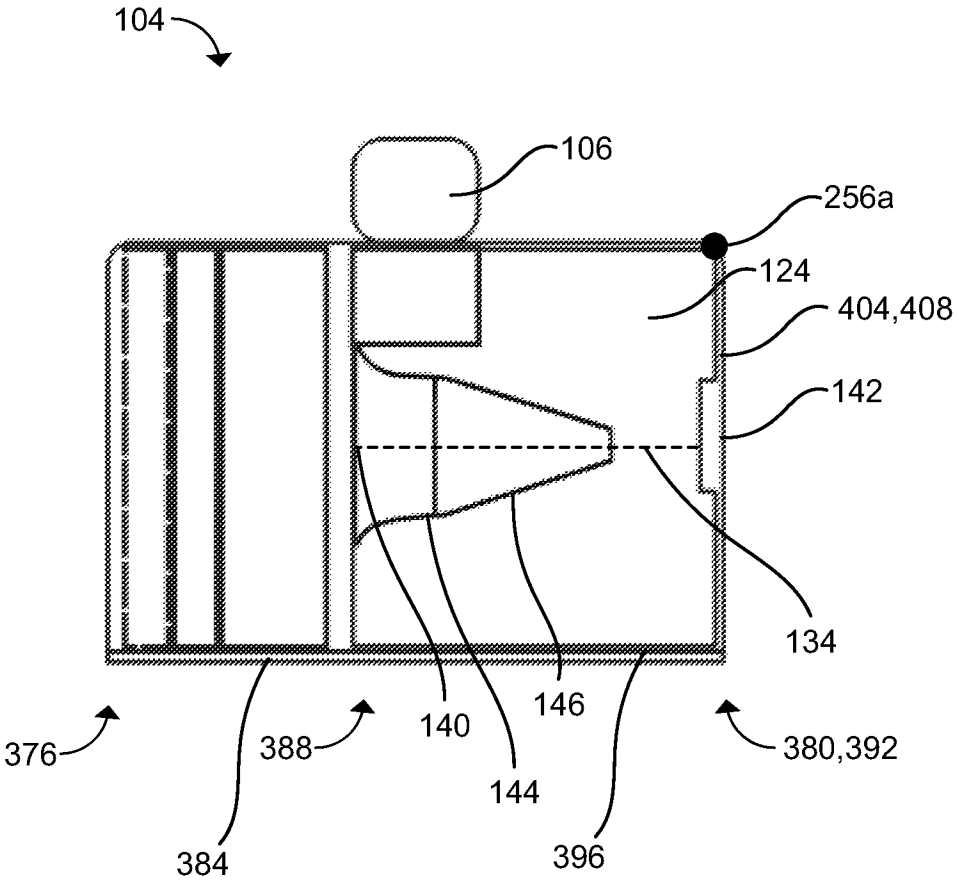
FIG. 67 is a cross-sectional front view taken along line A-A in FIG. 66.
Figure 68:
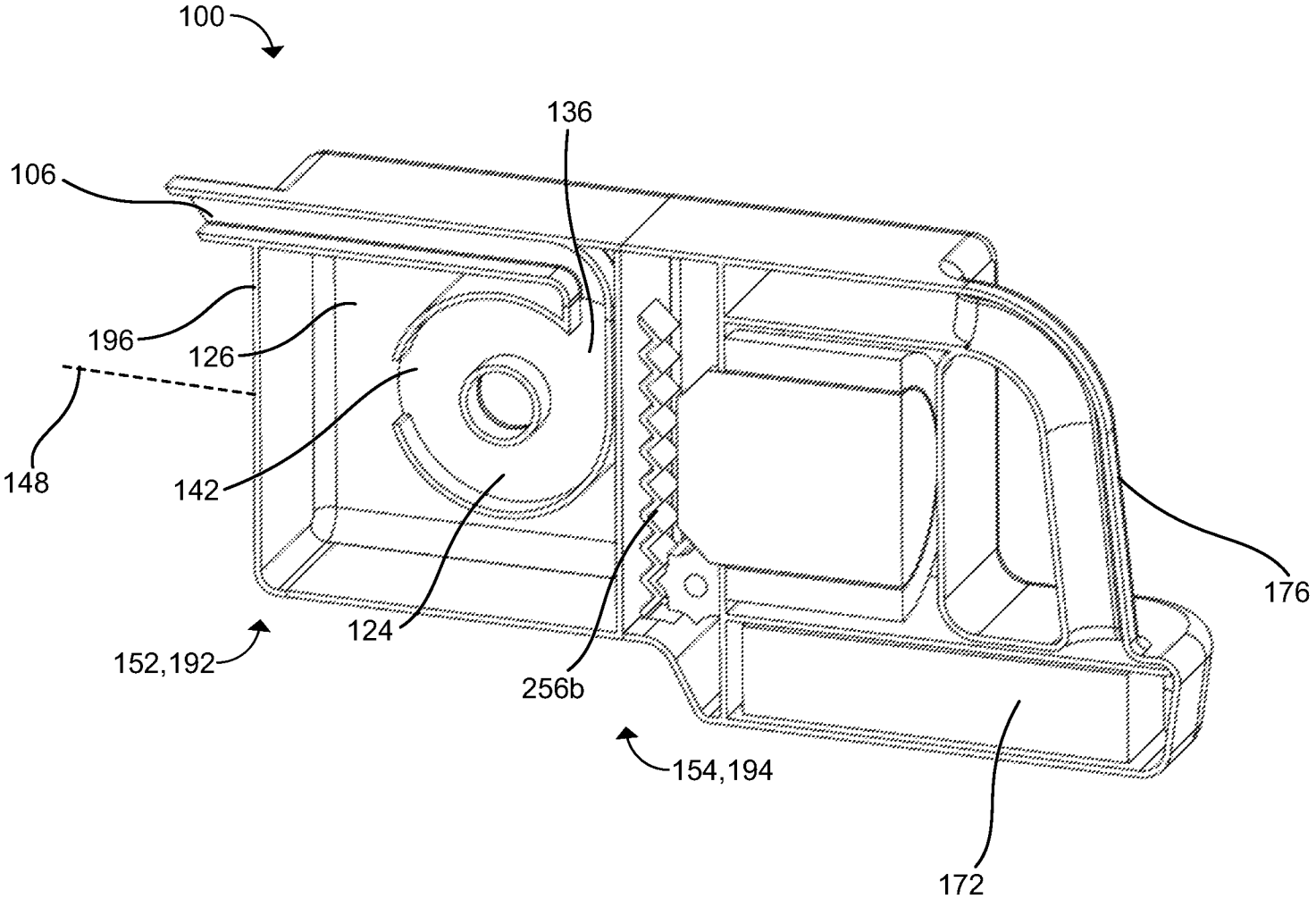
FIG. 68 is a cross-sectional perspective view of the surface cleaning apparatus of FIG. 66.

In some embodiments, at least one of first lateral end 376 and second lateral end 380 may be openable independent of the opening of moveable portion 168. For example, at least a portion of first end-wall 404 may be openable (e.g., rotatable or translatable) when moveable portion 168 is in the closed position. FIG. 67 shows an example in which end wall 404 is rotatable, independent of the position of moveable portion 168, using rotational mount 256*a*. This may enable user access to internal components of air treatment member 104.

In some embodiments, at least one of first lateral end 388 and second lateral end 392 may be openable independent of the opening of moveable portion 168. For example, at least a portion of first end-wall 408 may be openable (e.g., rotatable or translatable) when moveable portion 168 is in the closed position. FIG. 67 shows an example in which end wall 408 is rotatable, independent of the position of moveable portion 168, using rotational mount 256*a*. This may enable user access to internal components of air treatment chamber 124.

It will be appreciated that the actuation of and the drive member may be any of those discussed with respect to the laterally moveable air treatment chamber.

Removable Filter

In accordance with another aspect of this disclosure, the moveable portion of the air treatment member may include the pre-motor filter. In the open position of the moveable portion, the pre-motor filter may be accessible for cleaning and/or replacement. The removable filter may be used by itself or in combination with one or more (or all) of the sealing interface, the non-linear interface, the plate configuration, the auto-closing mechanism, and the air treatment member configuration or any other aspect disclosed herein.

Figure 76:
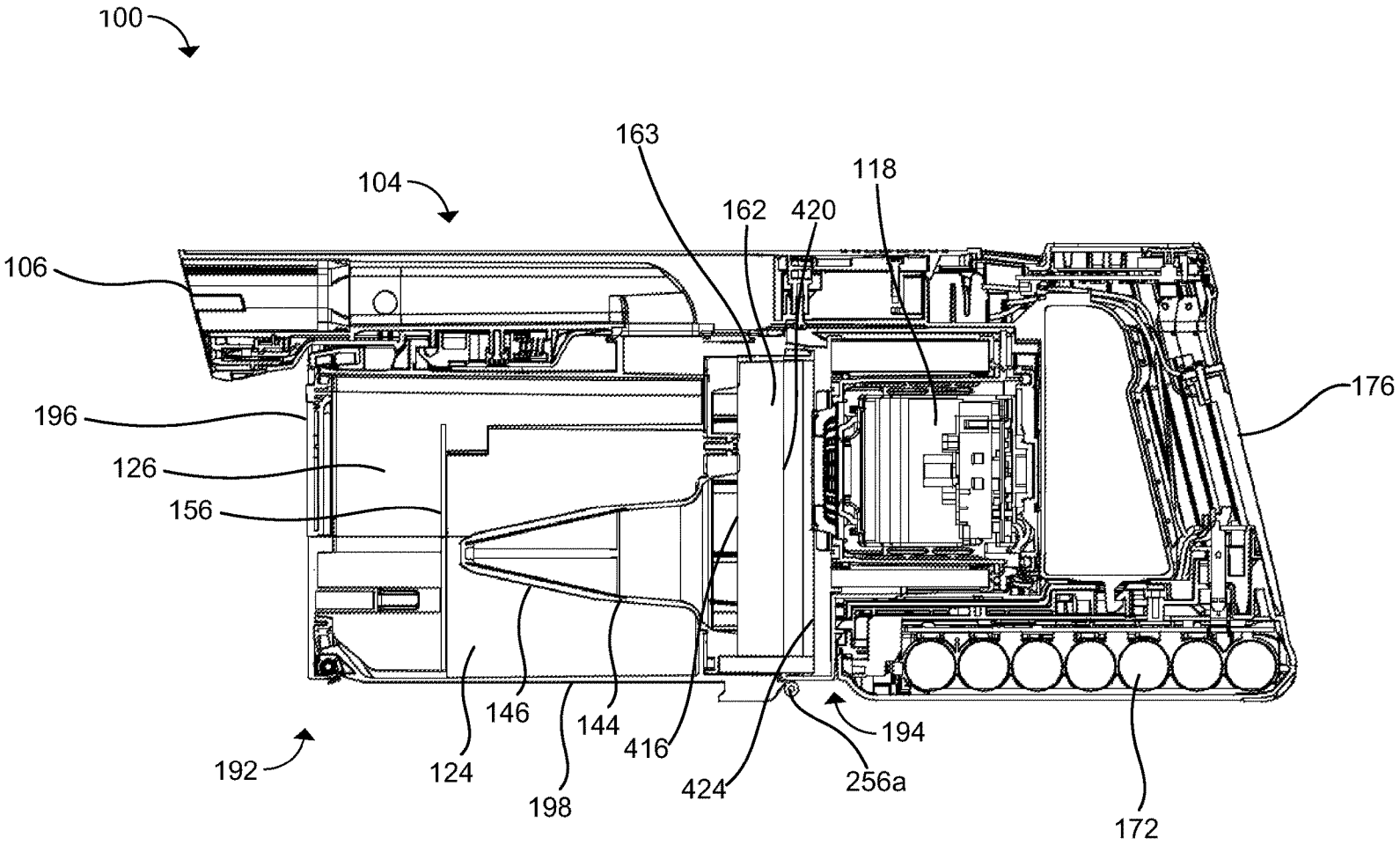
FIG. 76 is a side cross-sectional view of a surface cleaning apparatus similar to the surface cleaning apparatus of FIG. 38 with the air treatment member of the surface cleaning apparatus in a closed position.
Figure 77:
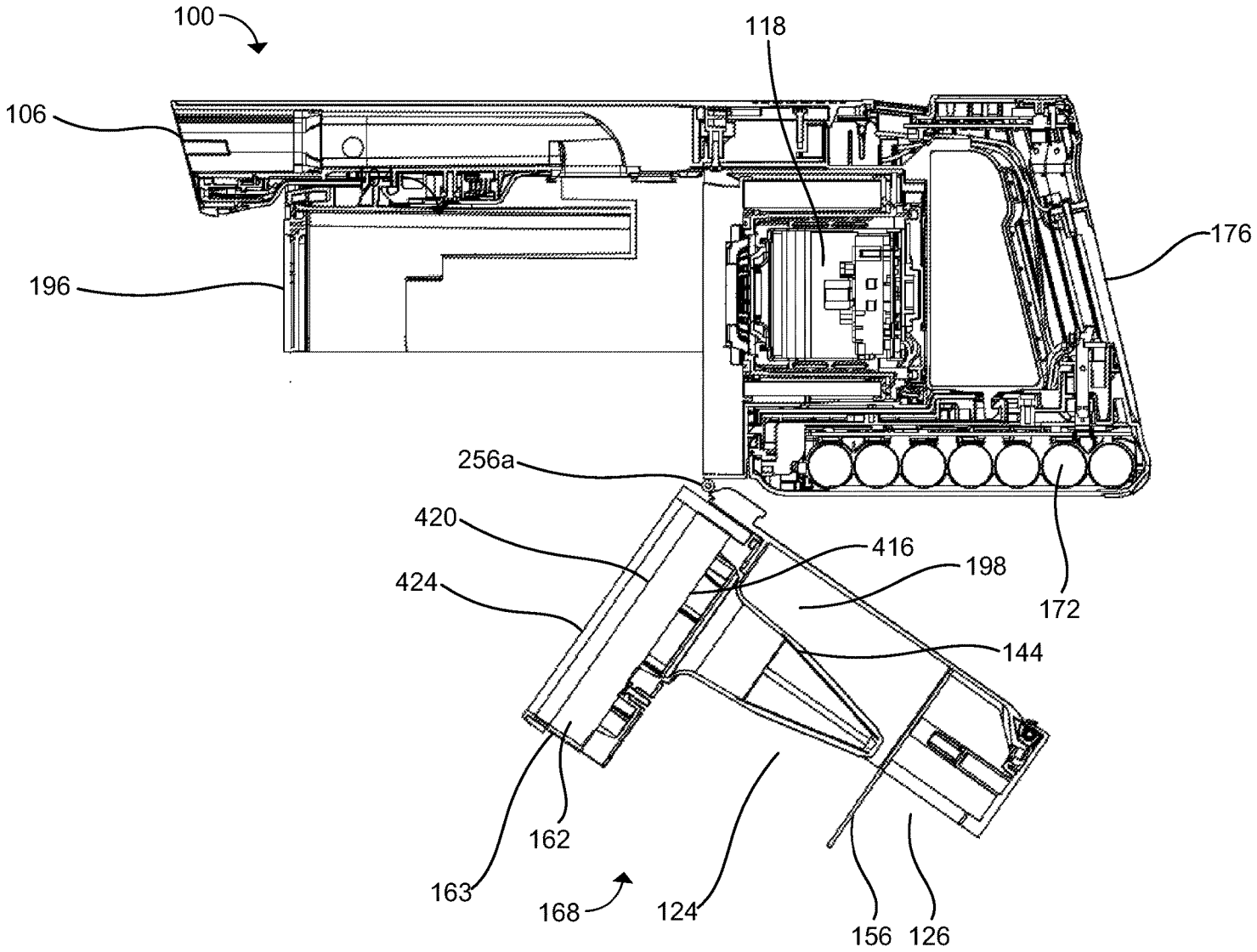
FIG. 77 is a side cross-sectional view of the surface cleaning apparatus of FIG. 76 with the air treatment member in an open position.

Referring now to FIGS. 76 and 77, rear-end 194 of air treatment member 104 may have a rear-wall 424 that forms part of pre-motor filter housing 163. Pre-motor filter 162 may have a first side 416 and an axially opposed second side 420. As shown, filter first side 416 may be upstream of filter second side 420.

The moveable portion 168 may include at least a portion of pre-motor filter housing 163 and carry with it pre-motor filter 162. When the moveable portion 168 is in the closed position (FIG. 76), filter first side 416 may face generally forwardly and filter second side 420 may face generally rearwardly. When the moveable portion 168 is in the open position (FIG. 77), pre-motor filter housing 163 may be opened and pre-motor filter 162 may be exposed. As shown, in the open position (FIG. 77) filter first side 416 may face generally rearwardly and filter second side 420 may be exposed and face generally forwardly.

The moveable portion 168 may include a portion of sidewall 198 of air treatment member 104. In some embodiments, the moveable portion 168 may include vortex finder 144 and mesh screen 146.

As exemplified in FIGS. 76 and 77, the moveable portion 168 may be rotatably mounted using mount 256*a*. The moveable portion 168 may be rotated between a closed position (FIG. 76) and an open position (FIG. 77). The rotation may be in any suitable direction, e.g., upward, downward, sideward etc. For example, mount 256*a* may be located towards the rear end of air treatment chamber 124 and the moveable portion 168 may be rotated downward as illustrated in FIG. 77.

It will be appreciated that the rotational movement to reveal the pre-motor filter may be used in conjunction with any of the openable portions disclosed herein.

Figure 32:
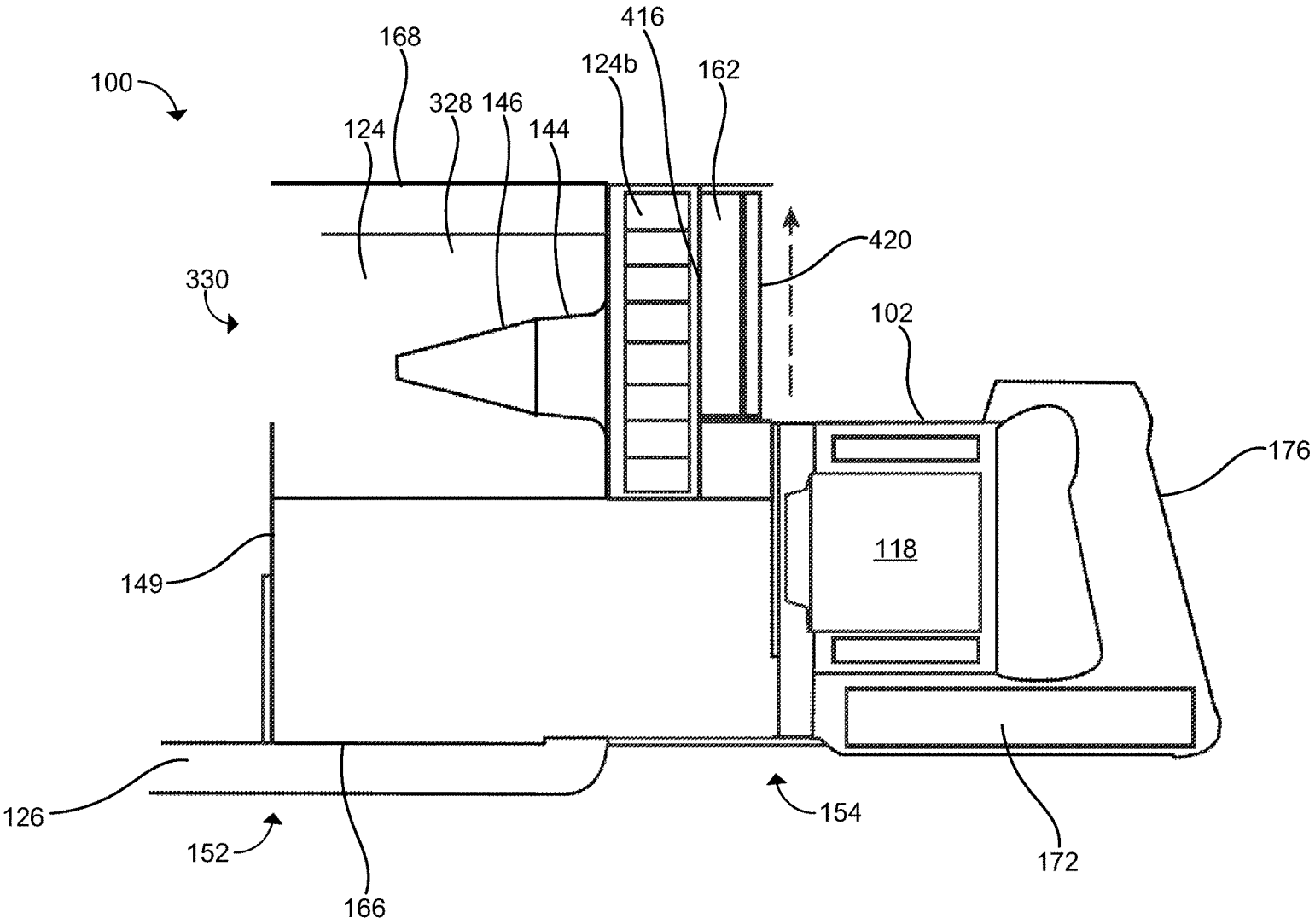

As exemplified in FIG. 32, the moveable the moveable portion 168 may be translatably mounted. The moveable portion 168 may be translated between an open and closed position. The translation may be in any suitable direction, e.g., upward, downward, sideward etc. The example illustrated in FIG. 32 shows an open position where the filter orientation remains the same between the closed and open positions and in the open position the filter second side 420 is exposed and rearward facing.

Air Treatment Member Having a Moveable Portion that Includes an Upper End of the Air Treatment Chamber.

In accordance with another aspect of this disclosure, the moveable portion includes an upper end of the air treatment chamber that is moveable between an open position and a closed position. When the moveable portion is moved to the open position, the air treatment chamber and/or a dirt collection chamber/region is opened. While opened, dirt collected in the dirt collection chamber and/or the air treatment chamber can be removed by the user and/or transferred to a docking station.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

The moveable portion may be rotatably or translatably moveable as discussed herein. The moveable portion may be port of one or more air treatment stages (e.g., one or more air treatment chambers and/or dirt collection chambers), and may include the inlet conduit.

Figure 78:
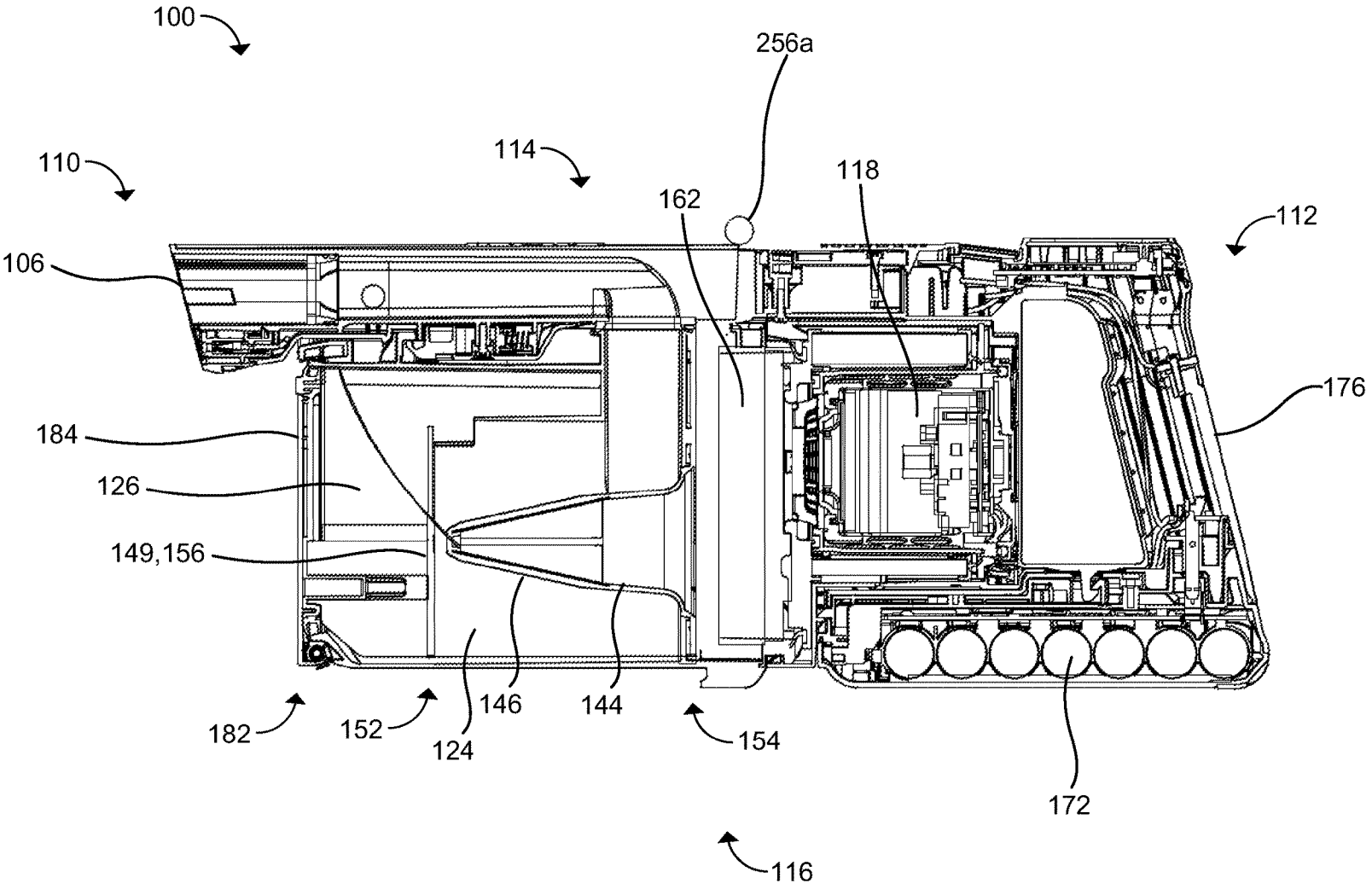
FIG. 78 is a side cross-sectional view of a surface cleaning apparatus similar to the surface cleaning apparatus of FIG. 38 with the air treatment member of the surface cleaning apparatus in a closed position.
Figure 79:
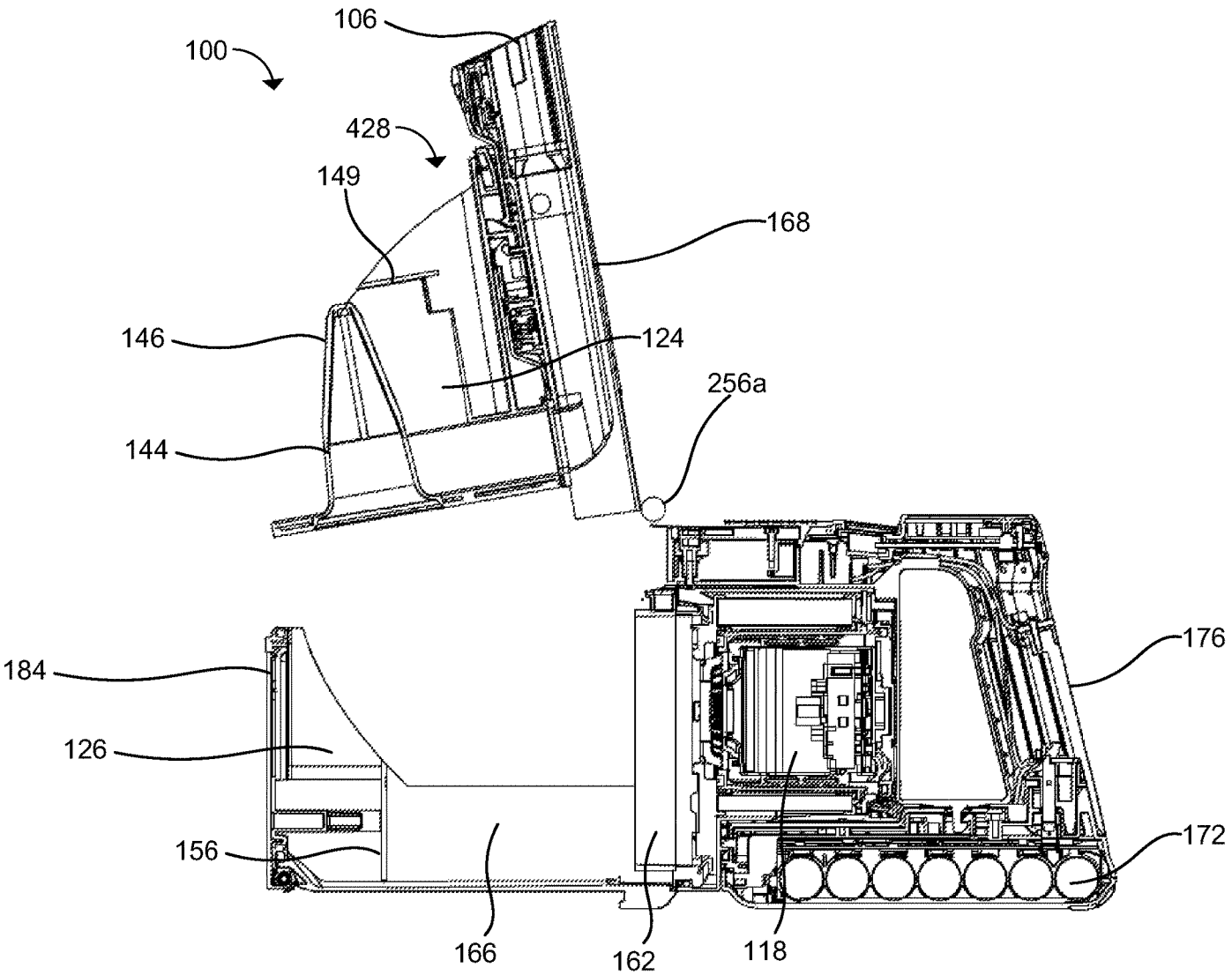
FIG. 79 is a side cross-sectional view of the surface cleaning apparatus of FIG. 78 with the air treatment member in an open position.

Reference is now made to FIGS. 78 and 79. The moveable portion 168 may include an upper end 428 of air treatment chamber 124. The moveable portion 168 may be movably mounted by a mount 256. The moveable portion 168 may move between a closed position (FIG. 78) in which air treatment chamber 124 is closed and an open position (FIG. 79) in which air treatment chamber 124 is open.

As exemplified in FIG. 79, the moveable portion 168 may include dirty air inlet 106. FIG. 32 shows an alternative embodiment in which stationary portion 166 includes dirty air inlet 106.

As exemplified in FIG. 79, the moveable portion 168 may include vortex finder 144. This may provide greater user access to mesh screen 146 and/or pre-motor filter 162 for cleaning/replacement. In alternative embodiments, the stationary portion 166 may include vortex finder 144. In the docked position, this may enable the dirt transferal air flow to flow through and remove dirt collected in mesh screen 146.

If a plate 156 is provided, then the plate may be part of the moveable portion or the stationary portion. If the plate is part of the moveable portion, it may itself be moveable relative to the moveable portion as discussed previously herein.

As exemplified in FIG. 79, plate 156 is provided and the moveable portion 168 includes a portion of first end-wall 149 of air treatment chamber 124. The stationary portion 166 includes the remaining portion (that is not include in moveable portion 168) of first end-wall 149. In other examples, the stationary portion 166 or the moveable portion may include an entirety of first end-wall 149.

In some embodiments, dirt collection chamber 126 may be opened when the moveable portion 168 is in the open position. This may enable removal of dirt collected in dirt collection chamber 126. Referring now to FIG. 15, the moveable portion 168 may include at least a portion of first end wall 184 of dirt collection chamber 126. In alternative embodiments (e.g., as shown in FIG. 79), the stationary portion 166 may include first end wall 184 and the moveable portion 168 may include an upper portion of dirt collection chamber 126 whereby dirt collection chamber 126 is opened when moveable portion 168 is moved to the open position.

In the embodiment of FIG. 79, the first end wall 184 may be moveable relative to the stationary portion, in a similar manner as discussed previously with respect to a moveable portion that include a plate 156 wherein the plate 156 is moveable relative to the moveable portion.

Air Treatment Member with an Air Treatment Member Having a Radially Outward Narrower Portion.

In accordance with another aspect of this disclosure, the dirt collection chamber has a radial inner portion and a narrower radial outer portion. That is a lateral dimension of the radial outer portion is less than a lateral dimension of the radial inner portion. When the air treatment member is docked with a docking station, the docking interface connects with the narrower radial outer portion to form the closed volume. In the docked position, the radial inner portion may be exterior to the closed volume. The narrower dimension of the radial outer portion can allow for a reduction in the size of the docking interface 210 compared with a design where the docking interface connects with the wider radial inner portion.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

Reference is now made to FIGS. 80A to 85B. Dirt collection chamber 126 may have a radial inner portion 432 and a radial outer portion 436. As used herein and in the claims, the terms "radial inner" and "radial outer" may refer to proximity to the air treatment chamber axis 134. In a direction 440 that is transverse to axis 148, radial outer portion 436 may be narrower than radial inner portion 432.

As exemplified, radial inner portion 432 may be located at the lower end of air treatment chamber 124. In the illustrated example, radial inner portion 432 surrounds the lower portion of air treatment chamber 124. It will be appreciated that the dirt collection chamber 126 may surround part or all of the air treatment chamber. When the air treatment member 104 is docked with docking station 200, all or portion of the radial outer portion 436 may be in the closed volume of the docking station (e.g., optionally a portion of radial outer portion 436 may be exterior to docking station 200). Because radial outer portion 436 may be narrower than radial inner portion 432, a smaller and more compact docking station interface 210 can be used with air treatment member 104.

Figure 80B:
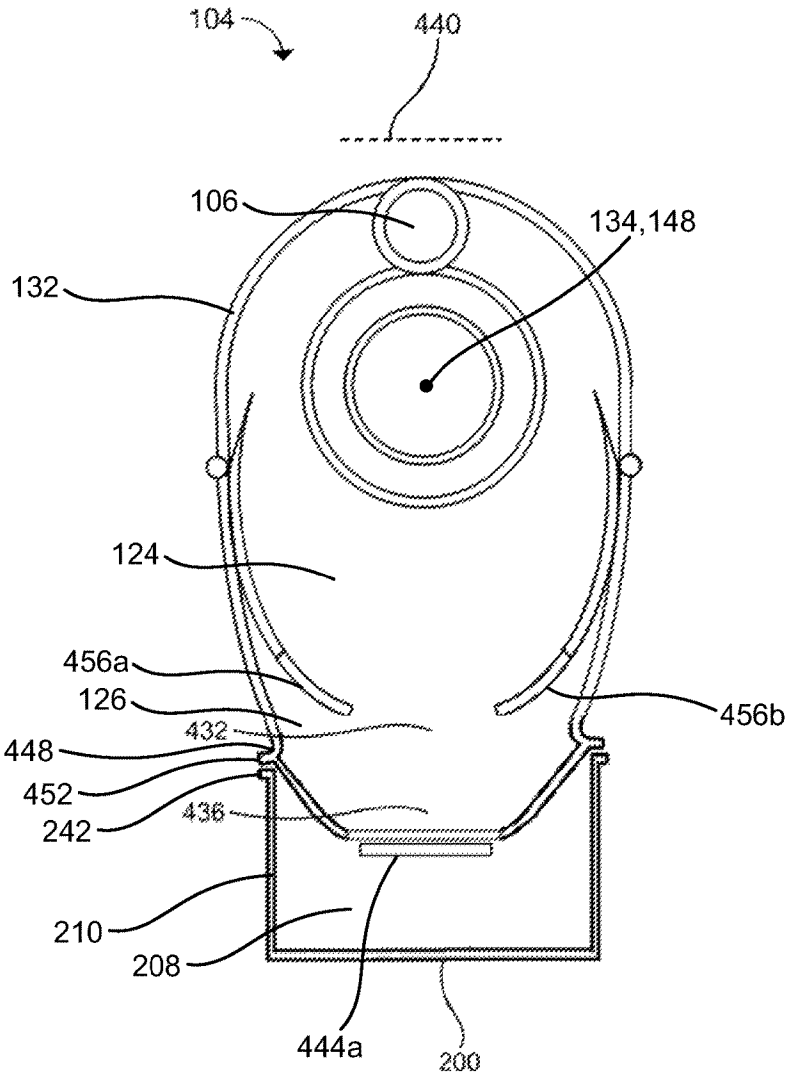
FIG. 80B is a front cross-sectional view of the surface cleaning apparatus of FIG. 80A with the air treatment member in an open position.
Figure 80A:
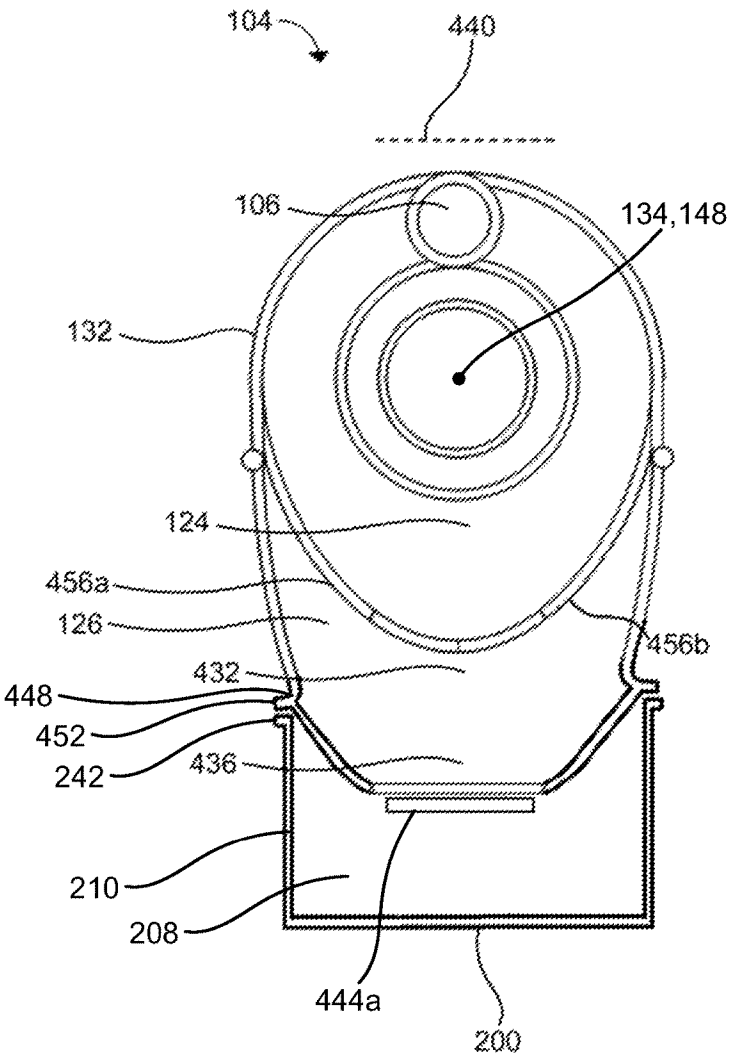
FIG. 80A is a front cross-sectional view of an alternate surface cleaning apparatus with an air treatment member of the surface cleaning apparatus in a closed position.
Figure 81:
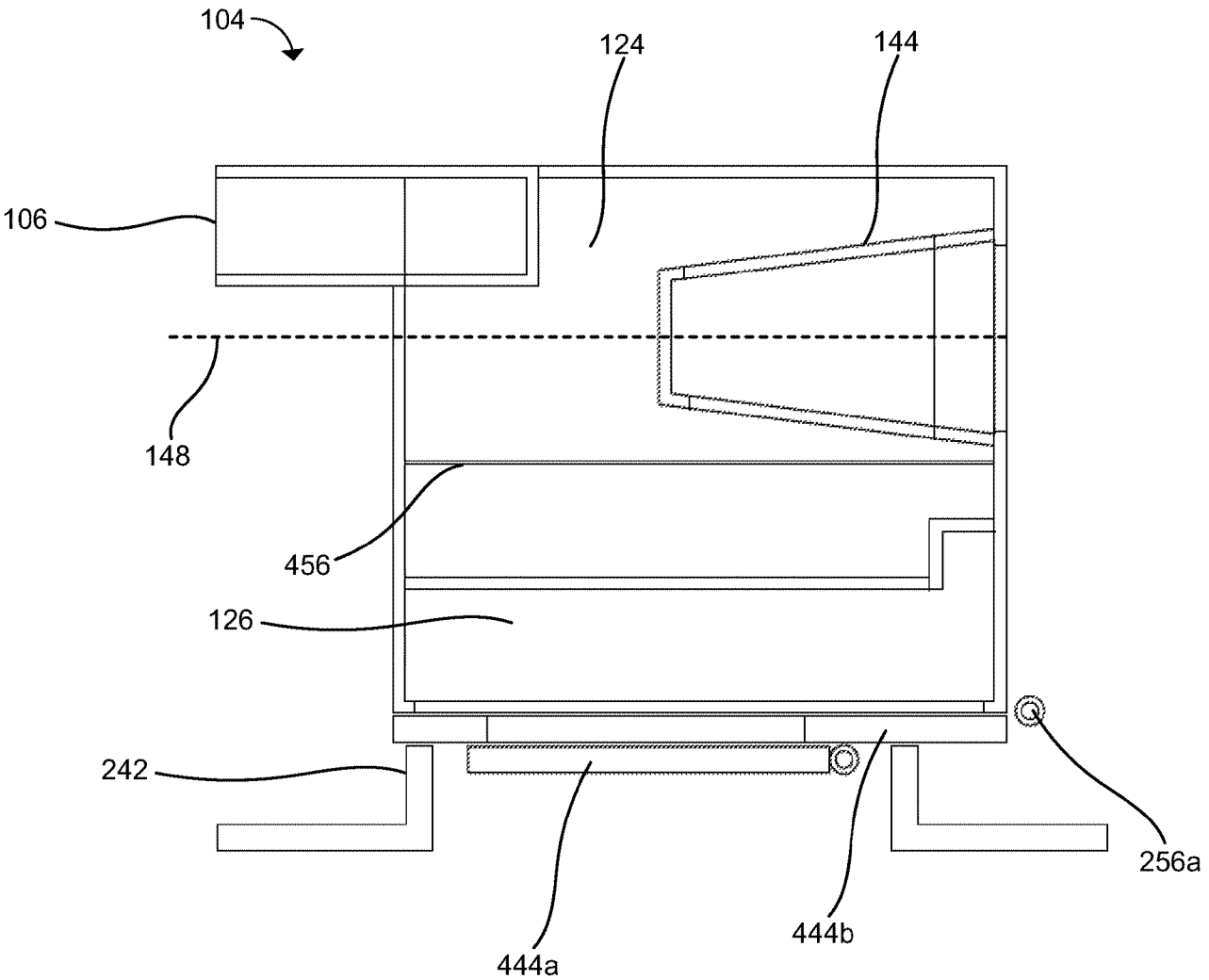
FIG. 81 is a side cross-sectional view of the surface cleaning apparatus of FIG. 80A.
Figure 82:
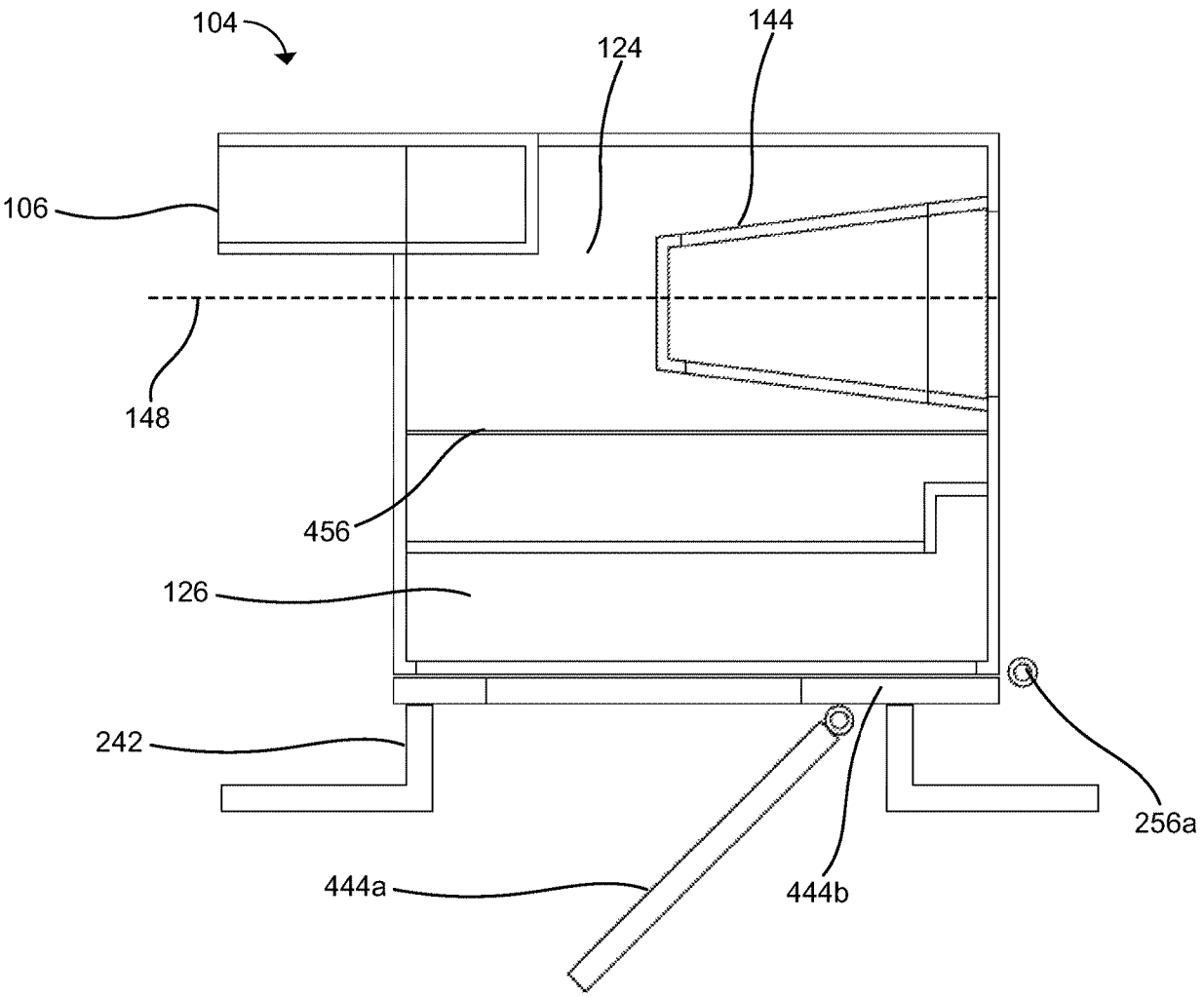
FIG. 82 is a side cross-sectional view of the surface cleaning apparatus of FIG. 80A with the air treatment member in an open position.
Figure 83:
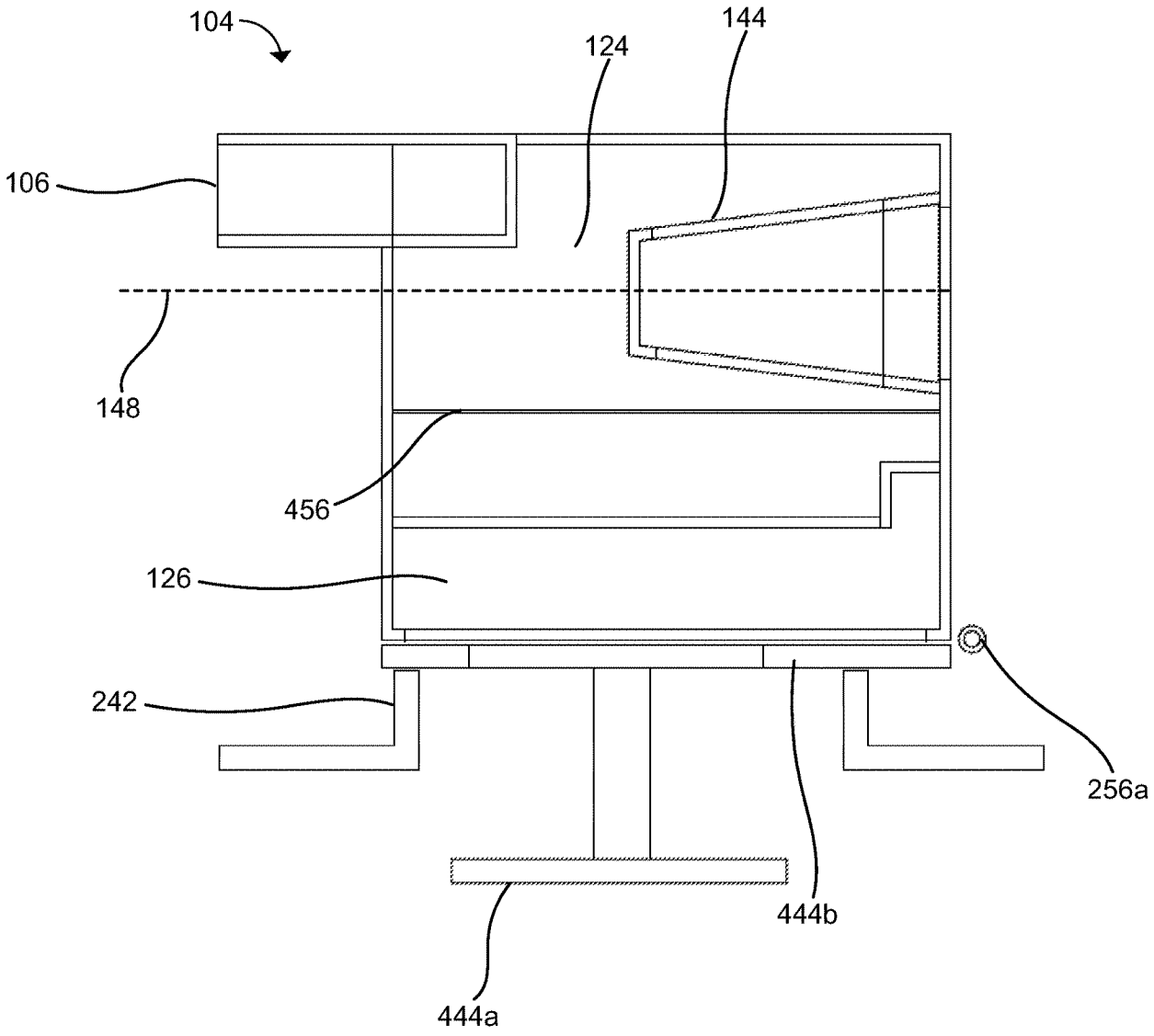
FIG. 83 is a side cross-sectional view of an alternate surface cleaning apparatus with an air treatment member of the surface cleaning apparatus in an open position.
Figure 84:
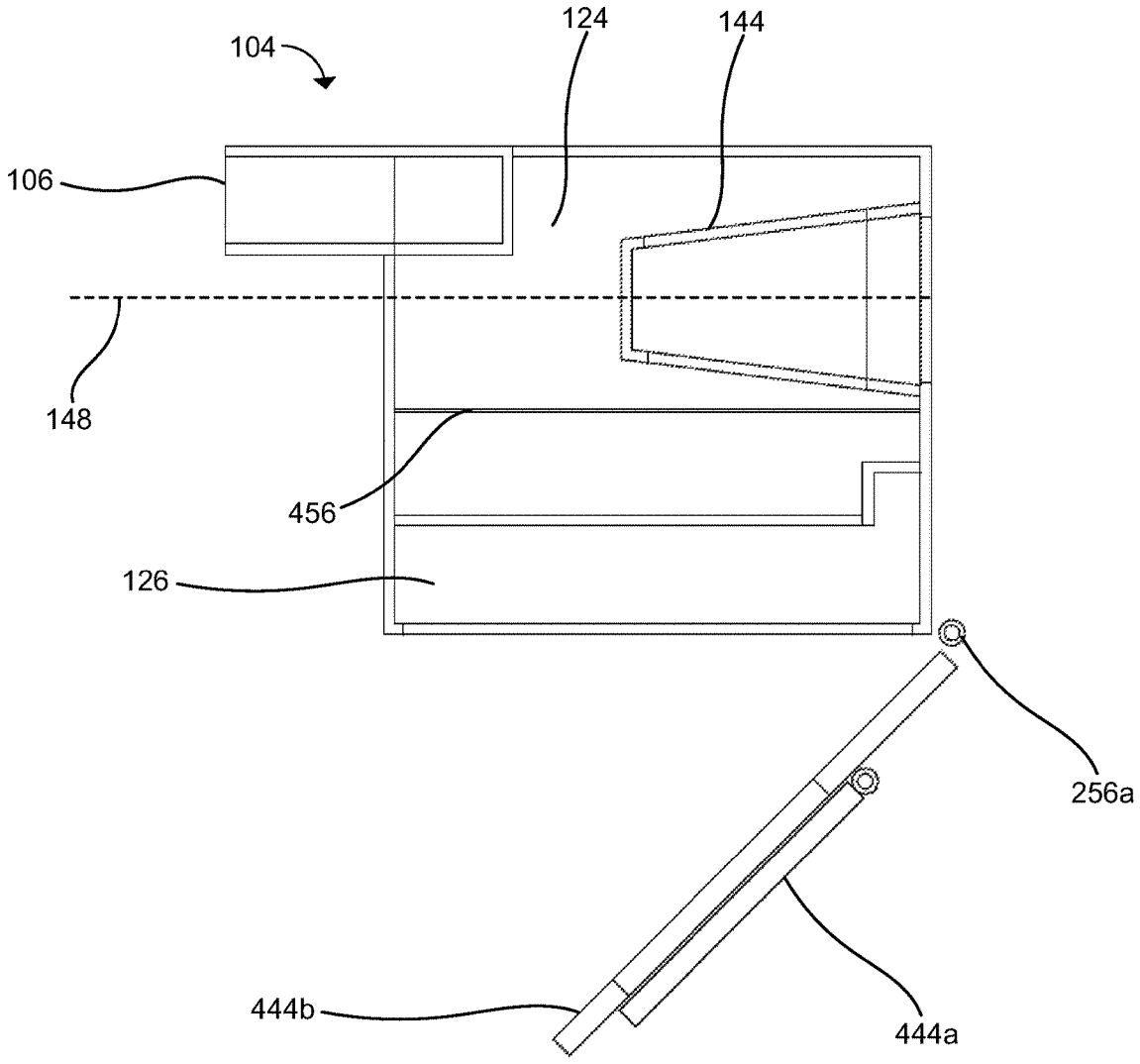
FIG. 84 is a side cross-sectional view of the surface cleaning apparatus of FIG. 80A with the air treatment member in an open position.
Figures 85A, 85B:
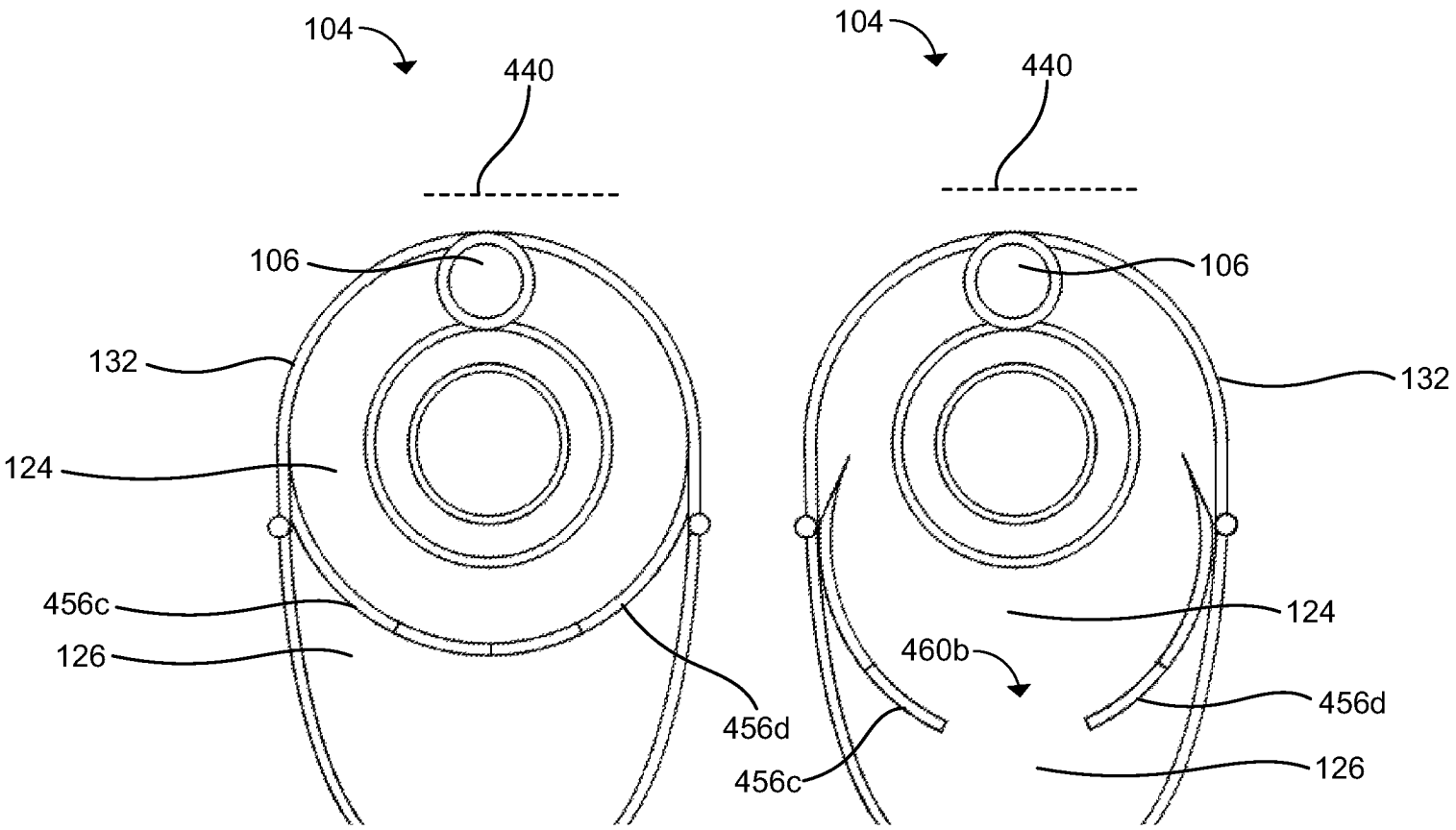
FIG. 85A is a front cross-sectional view of an alternate surface cleaning apparatus with an air treatment member of the surface cleaning apparatus in a closed position.
FIG. 85B is a front cross-sectional view of the surface cleaning apparatus of FIG. 85A with the air treatment member in an open position.
Figure 86:
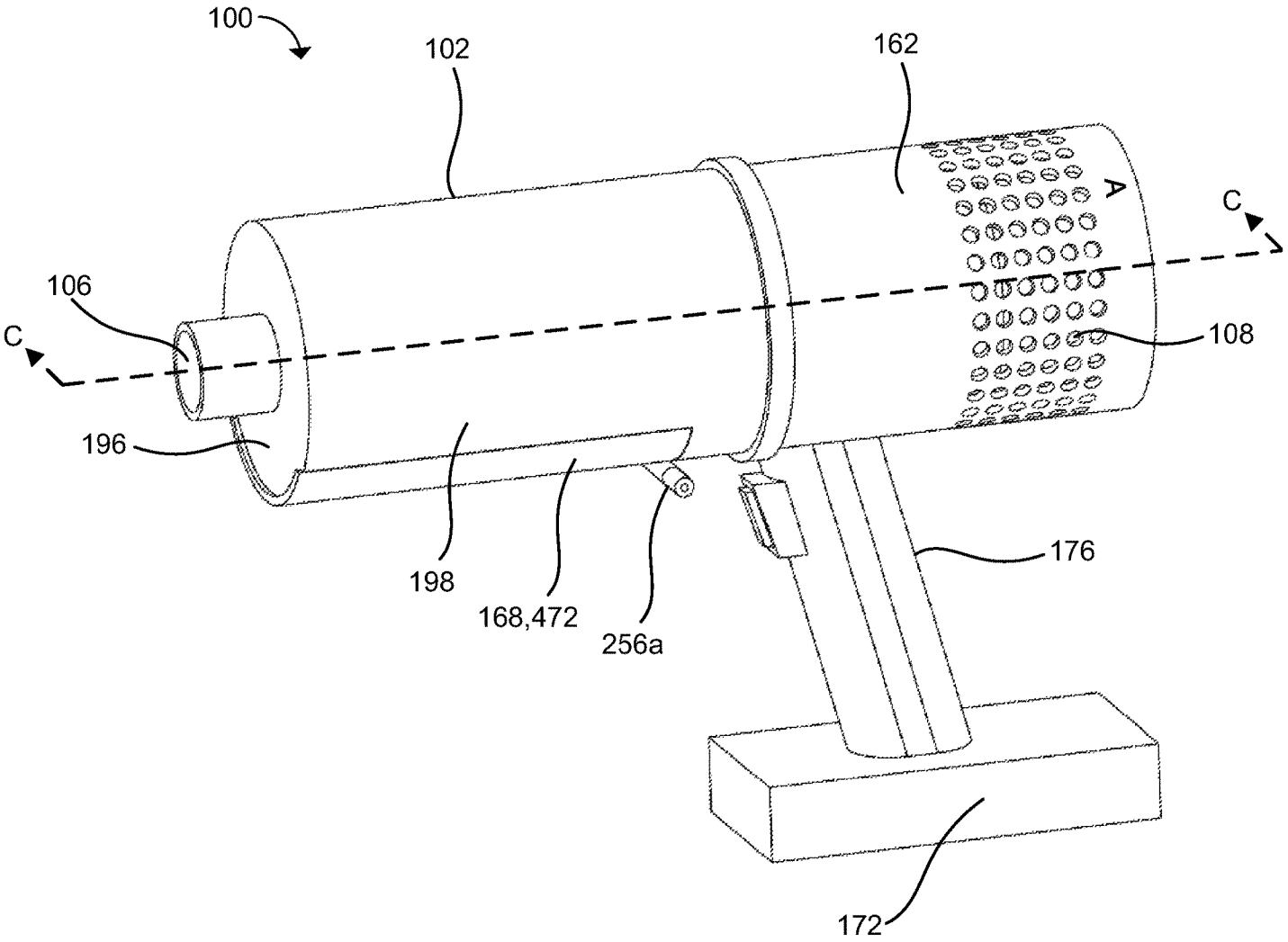
FIG. 86 is a perspective view of an alternate surface cleaning apparatus with an air treatment member of the surface cleaning apparatus in a closed position.
Figure 87:
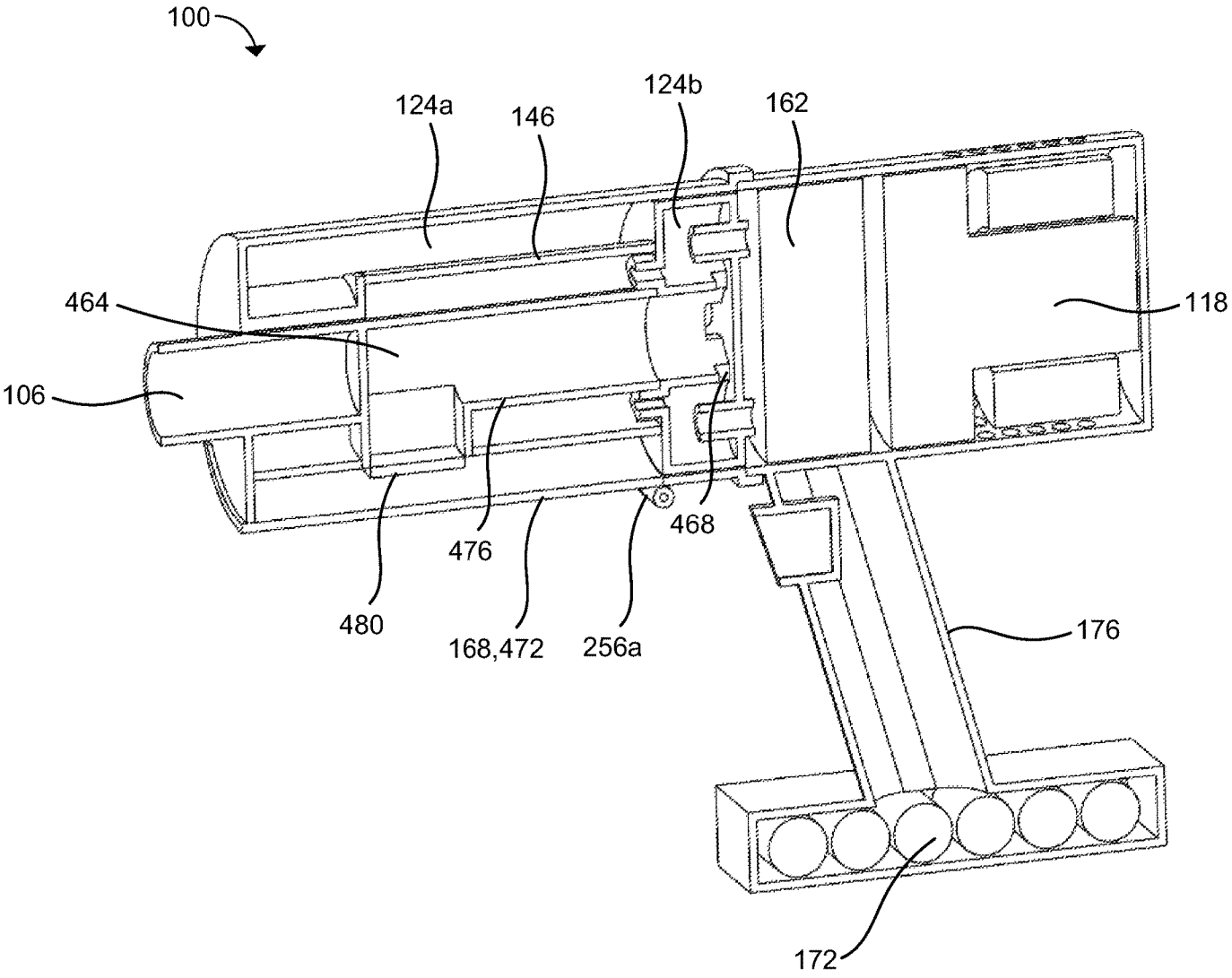
FIG. 87 is a side cross-sectional view taken along line C-C in FIG. 86.

In the radial direction, the dirt collection chamber may gradually narrow (e.g., it may be a curved surface with no discontinuities) or it may be stepped. As exemplified in FIGS. 80A and 80B, dirt collection chamber 126 may have a discontinuity 448 at a juncture of radial inner portion 432 and radial outer portion 436. As exemplified in FIGS. 80A and 80B, when air treatment member 104 is docked with docking station 200, the docking interface perimeter 242 may contact discontinuity 448. Discontinuity 448 may have a flange portion 452 that docking interface perimeter 242 may contact when air treatment member 104 is docked with docking station 200. As shown in FIGS. 80A and 80B, the narrower radial outer portion 436 may be inside of closed volume 208 formed by docking interface 210 and the wider radial inner portion 432 may be outside of closed volume 208 formed by docking interface 210. This can enable a smaller docking interface 210 in that docking interface 210 only needs to accommodate the width of the narrower portion.

Radial outer portion 436 may be openable in any manner disclosed herein. For example, radial outer portion 436 may have an openable door 444. Door 444 may be rotated or translated between a closed and an open position. For example, radial outer portion 436 may be opened concurrently with or after air treatment member 104 is docked with docking station 200 to transfer dirt collected in dirt collection chamber 126 to docking station 200. As exemplified in FIGS. 80A to 85B, door 444 may be positioned at a radial distal end of radial outer portion 436.

As exemplified in FIGS. 80A to 85B, radial outer portion 436 may have multiple doors 444. Multiple doors 444 may extend along different axial lengths. For example, when in the docked position, a smaller door 444*a* may be used for opening or closing dirt collection chamber 126. This may enable a smaller length of docking interface perimeter 242 and enable reduction in size of the docking interface 210. A larger door 444*b* may be used when a user manually empties the air treatment chamber 124 or to provide greater user access to internal components of air treatment member 104.

Air treatment chamber 124 may be openable in any manner disclosed herein. As exemplified in FIGS. 80A to 85B, air treatment chamber 124 may have an openable portion. For example, air treatment chamber 124 may have an openable door 456. Door 456 may extend along any suitable axial length of air treatment chamber 124. In the docked position, door 456 may be opened so that air treatment chamber 124 is in fluid flow communication with docking station 200. A dirt transferal air flow may be used to transfer dirt collected in air treatment chamber 124 to docking station 200.

Air treatment chamber 124 may include any suitable number of doors (e.g., 1 to 4). Door 456 may be translated or rotated between an open and a closed position. As exemplified in FIGS. 80A and 80B, door 456 may include rotatably openable doors 456*a* and 456*b*. Doors 456*a* and 456*b* may be rotatable about an axis that extends generally in a direction of axis 148. Doors 456*a* and 456*b* may be formed in an arc shape that is less curved (e.g., is planar or curved with a greater radius of curvature) than a remainder of sidewall 132 of air treatment chamber 124. This may enable doors 456*a*, 456*b* to rotate open more widely (compared with doors 456*c* and 456*d* (FIGS. 85A and 85B) that are curved the same as sidewall 132) and thereby form a greater opening 460*a* (compared with opening 460*b* shown in FIG. 85B) for exiting dirt and dirt transferal airflow.

Air Treatment Member Having a Dirt Collection Chamber with a Sidewall Portion that is Openable.

In accordance with another aspect of this disclosure, the air treatment member includes a dirt collection chamber that is positioned radially inwardly of the first stage air treatment chamber. The sidewall of the dirt collection chamber has an openable portion to enable removal of dirt collected in the dirt collection chamber.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

Reference is now made to FIGS. 86 to 90. Dirt collection chamber 464 may be positioned radially inwardly of first stage air treatment chamber 124*a*. The second stage air treatment chamber 124*b* may be in communication with dirt collection chamber 464 by dirt outlet 468. Dirt separated by second stage air treatment chamber 124*b* may be collected in dirt collection chamber 464.

The moveable portion 168 may include a portion 472 of sidewall 132 of first stage air treatment chamber 124*a*. The moveable portion 168 may be movably mounted by a mount 256 (e.g., a rotational or a translational mount). As exemplified in FIGS. 86 to 90, moveable portion 168 may be rotatably mounted by a rotational mount 256*a*. Moveable portion 168 may rotate between a closed position (FIGS. 86, 87 and 89) in which first stage air treatment chamber 124*a* is closed and an open position (FIGS. 88 and 90) in which first stage air treatment chamber 124*a* is opened. In other examples, moveable portion 168 may translate between a closed position and an open position.

Sidewall 476 of dirt collection chamber 464 may have an openable portion 480. When openable portion 480 is opened, dirt collection chamber 464 may be in communication with first stage air treatment chamber 124*a*. As exemplified in FIG. 89, when openable portion 480 is opened, dirt collected in dirt collection chamber 464 may be transferred to first stage air treatment chamber 124*a*.

Figure 88A:
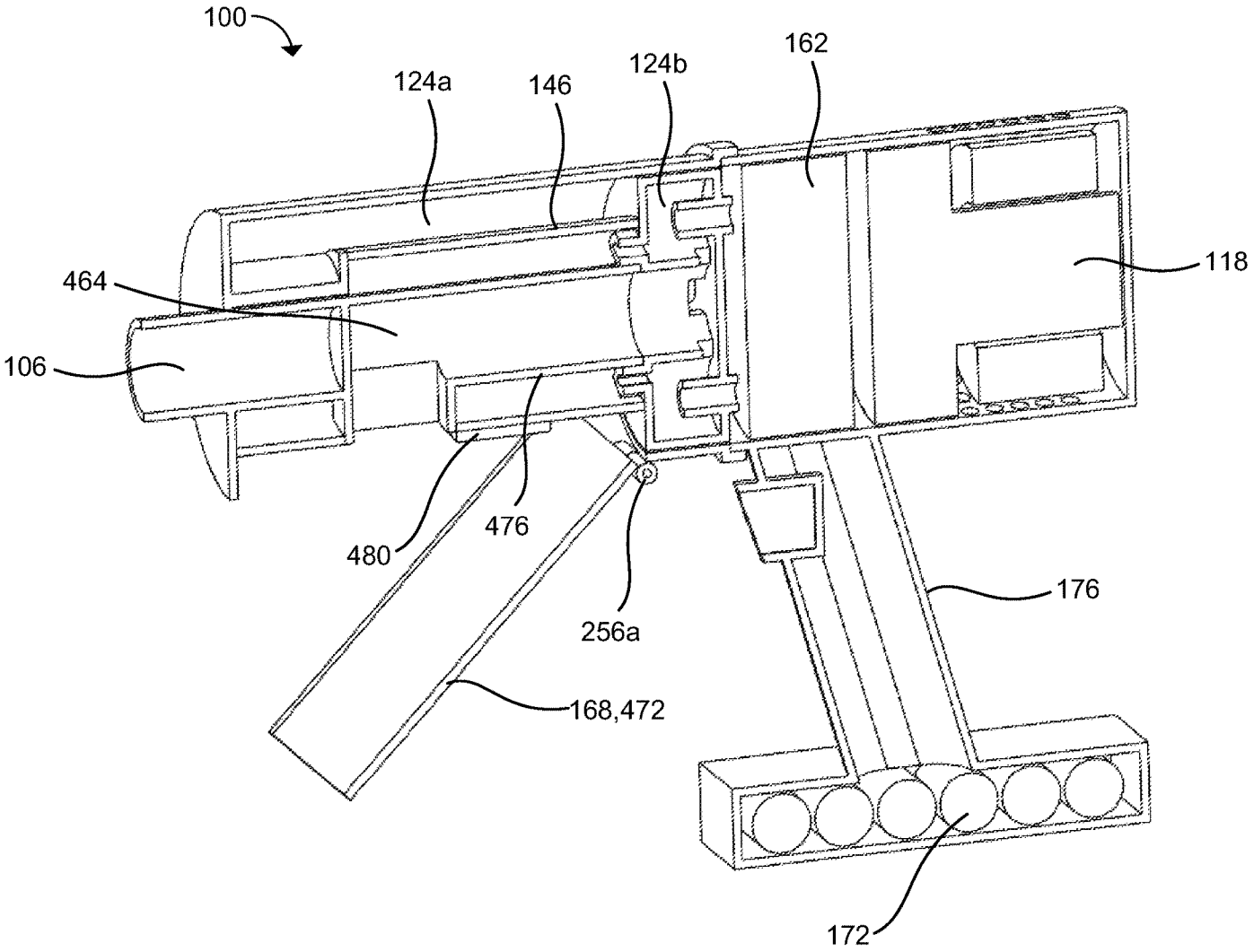
FIG. 88A is a side cross-sectional view of the surface cleaning apparatus of FIG. 86 with the air treatment member and a dirt collection chamber of the surface cleaning apparatus in open positions.
Figure 88B:
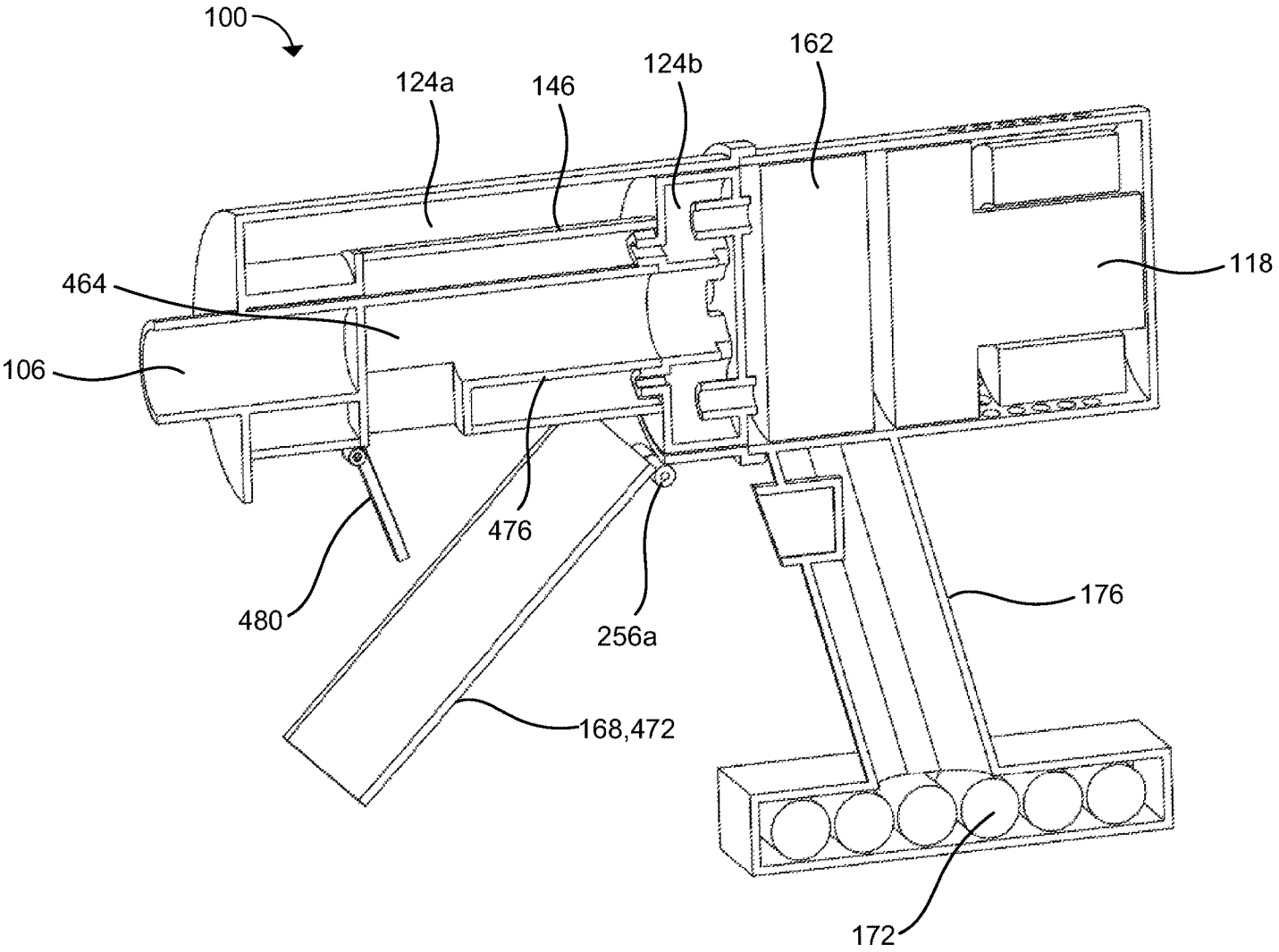
FIG. 88B is a side cross-sectional view of a surface cleaning apparatus similar to the surface cleaning apparatus of FIG. 86 with the air treatment member and the dirt collection chamber of the surface cleaning apparatus in open positions.

As exemplified in FIGS. 88A and 88B, moveable portion 168 and openable portion 480 may both be moved to the open position so that dirt collection chamber 464 and first stage air treatment chamber 124*a* may be concurrently openable. This may enable simultaneous removal of dirt collected in dirt collection chamber 464 and first stage air treatment chamber 124*a* (and/or a first stage dirt collection chamber). The dirt collected in dirt collection chamber 464 may be transferred (momentarily) to first stage air treatment chamber 124*a* as it is being removed.

Figure 89:
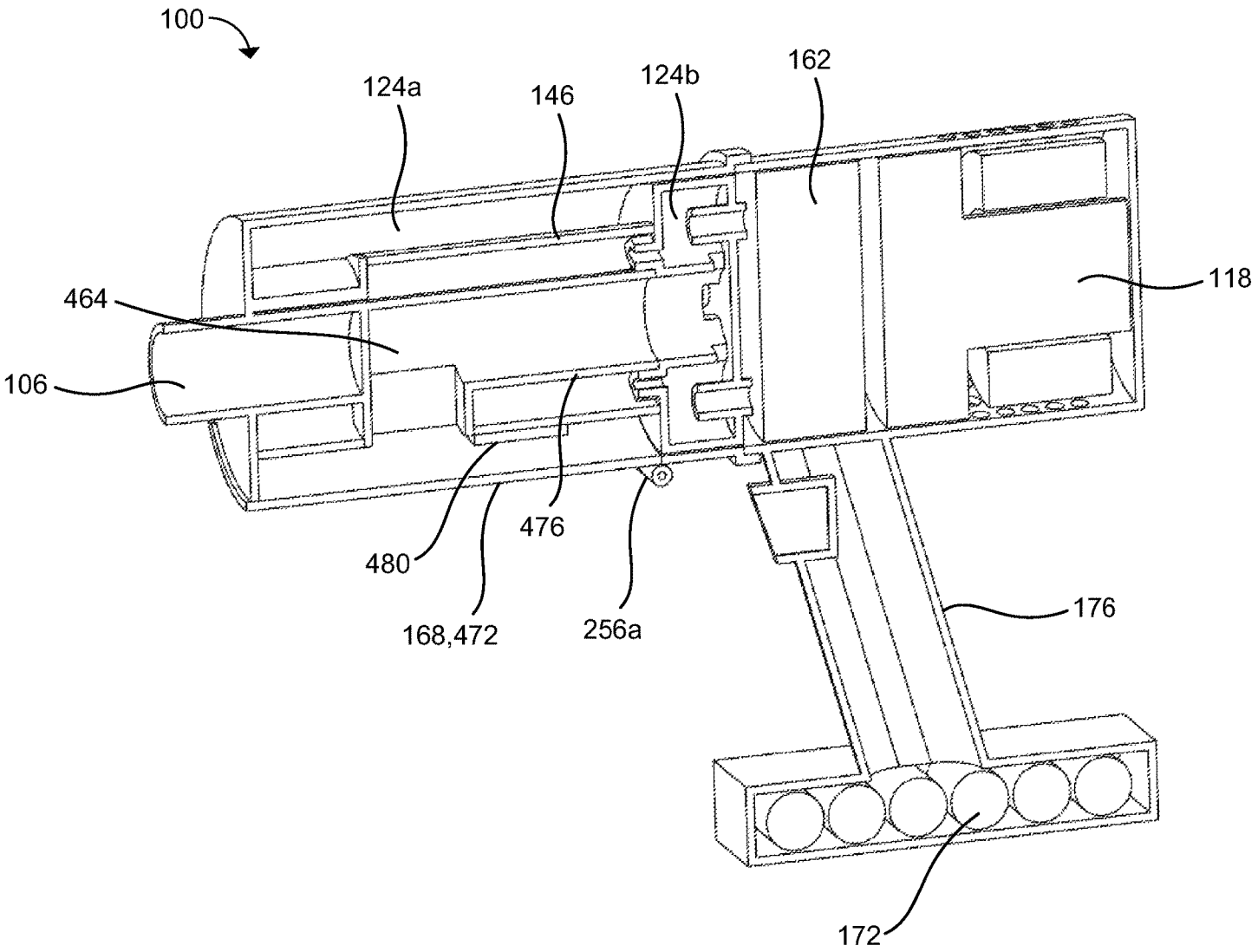
FIG. 89 is a side cross-sectional view of a surface cleaning apparatus similar to the surface cleaning apparatus of FIG. 86 with the air treatment member in a closed position and a dirt collection chamber of the surface cleaning apparatus in an open position.
Figure 90:
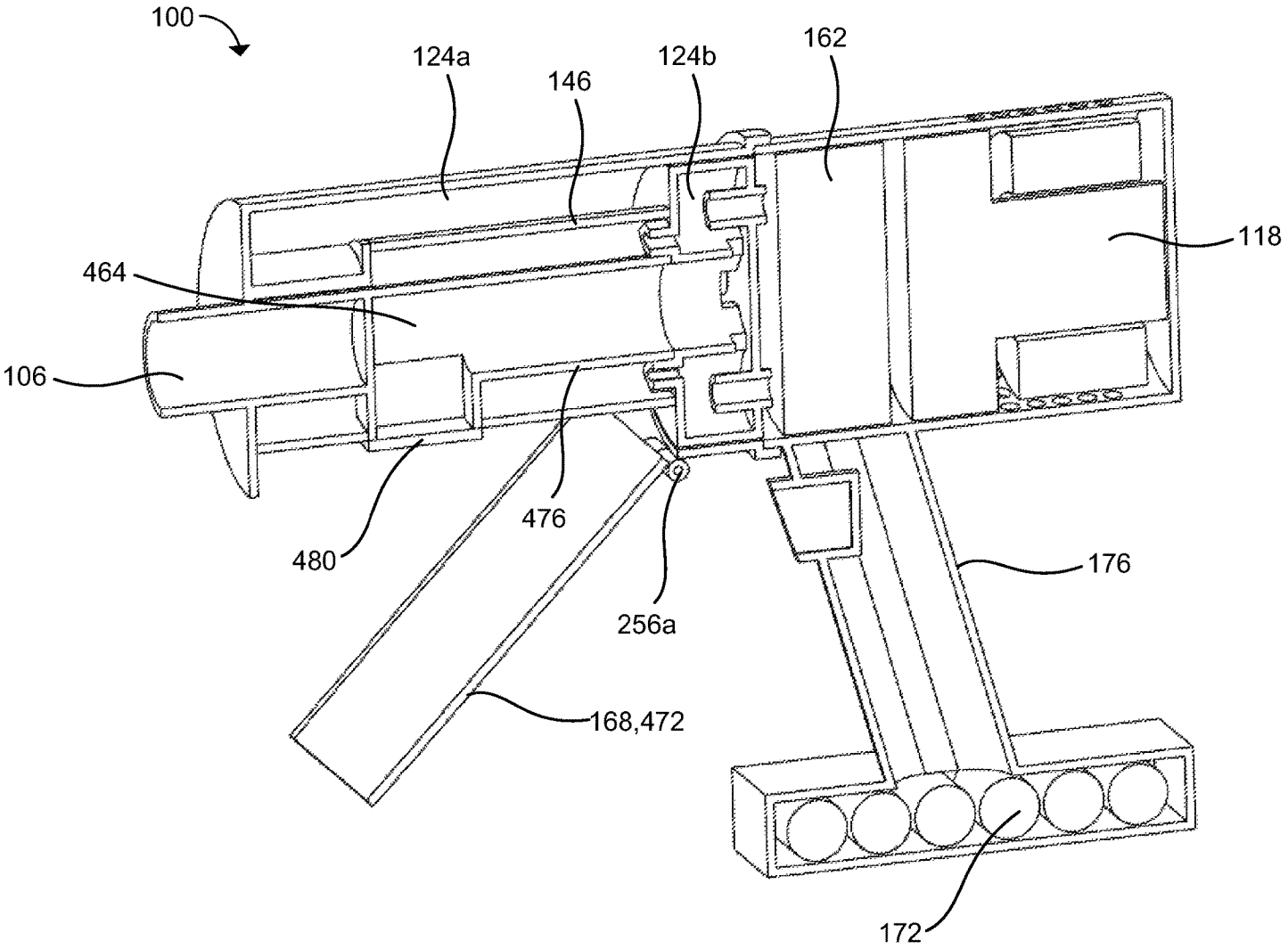
FIG. 90 is a side cross-sectional view of the surface cleaning apparatus of FIG. 87 with the air treatment member in an open position and a dirt collection chamber of the surface cleaning apparatus in a closed position.

As exemplified in FIGS. 89 and 90, dirt collection chamber 464 and first stage air treatment chamber 124*a* may be sequentially openable. For example, openable portion 480 may first be moved to open position while moveable portion 168 remains in a closed position. Dirt collected in dirt collection chamber 464 may be transferred to first stage air treatment chamber 124*a*. Subsequently, openable portion 480 may optionally be moved to the closed position and moveable portion 168 may be moved to the open position. Dirt collected in first stage air treatment chamber 124*a* (including dirt transferred from dirt collection chamber 464) can be removed (e.g., manually or using a dirt transferal air flow in a docked position).

Air Treatment Member Having a Moveable Portion that Includes a Front End Wall of the Dirt Collection Chamber.

In accordance with another aspect of this disclosure, the moveable portion includes a portion of the air treatment chamber and a front end wall of the dirt collection chamber. When the moveable portion is moved to the open position, the air treatment chamber and the dirt collection chamber are both opened. This can enable removal of dirt collected in the air treatment chamber and/or the dirt collection chamber.

The air treatment member configuration may be used by itself or in combination with one or more (or all) of the sealing interface, the non-linear interface, the plate configuration, the auto-closing mechanism, the removable filter, and the other air treatment member configurations or any other aspect disclosed herein.

Figure 91:
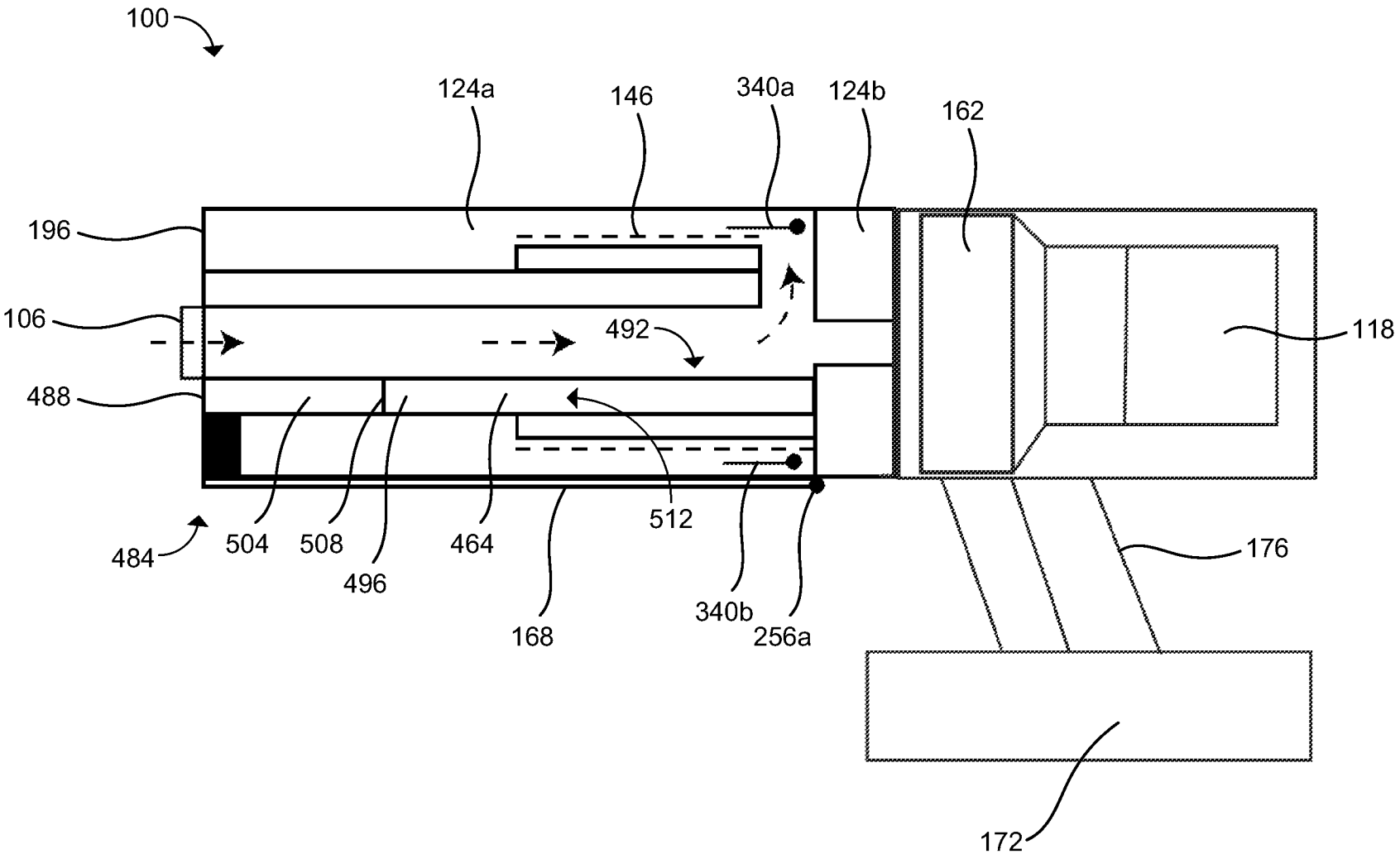
FIG. 91 is a side cross-sectional view of an alternate surface cleaning apparatus with an air treatment member of the surface cleaning apparatus in a closed position; and, FIG. 92 is a side cross-sectional view of the surface cleaning apparatus of FIG. 91 with the air treatment member in an open position.
Figure 92:
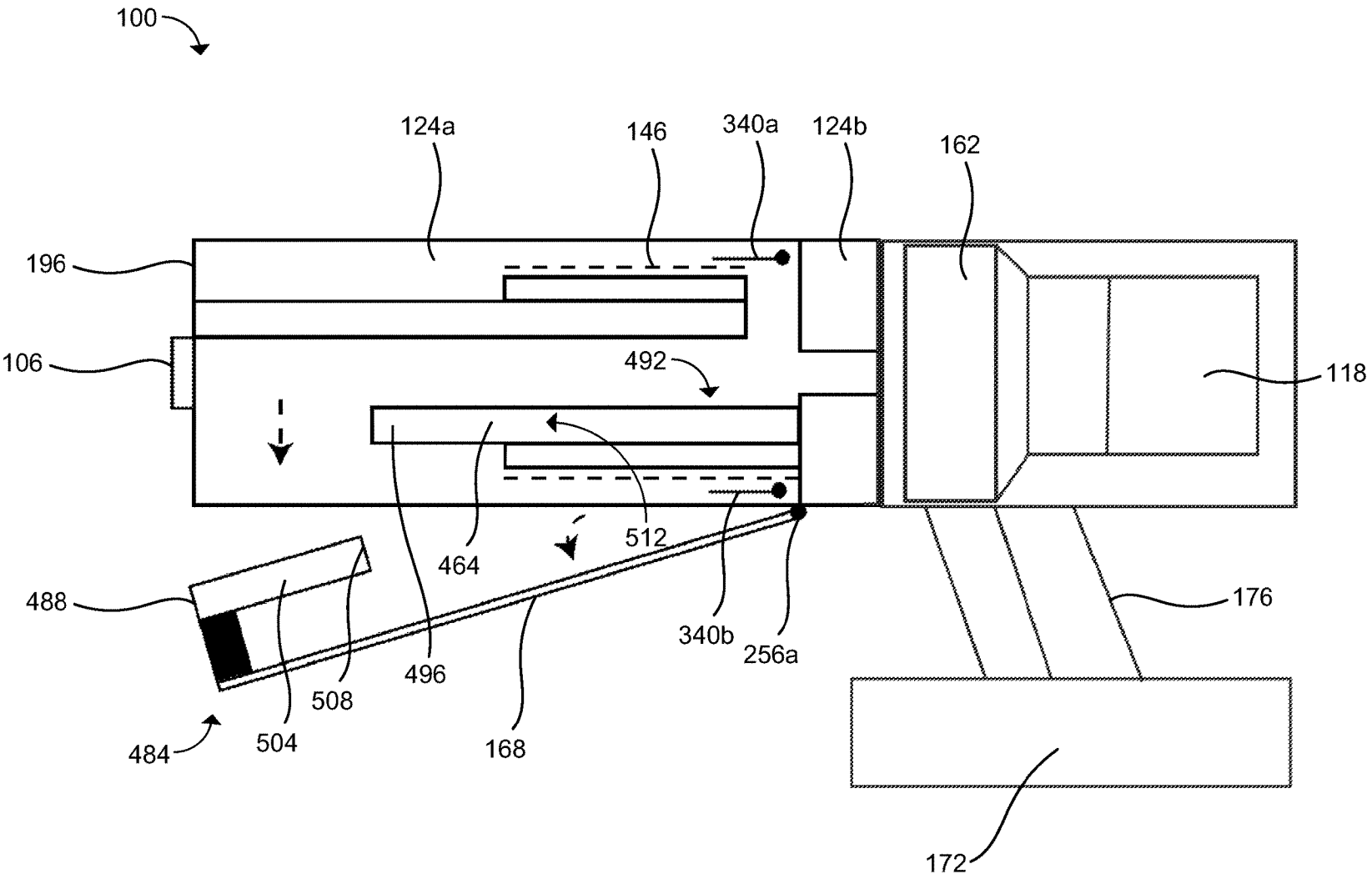

Reference is now made to FIGS. 91 and 92. Dirt collection chamber 464 may have a front end 484 having a front end wall 488 and a rearward portion 492 having a forward port 496. Front end 484 may have a member 504 that extends rearwardly from first end-wall 196 of air treatment member 104 to forward port 496. Front end 484 may have a rear end 508 that closes forward port 496. In some embodiments, rear end 508 may be closed. In other embodiments, rear end 508 may be open and an internal volume 512 of front end 484 includes a portion of a storage volume of dirt collection chamber 464. In this case, member 504 is a portion of dirt collection chamber 464 where dirt may be collected.

The moveable portion 168 may include front end wall 488 and any suitable portion of first stage air treatment chamber 124*a*. As exemplified in FIG. 92, the moveable portion 168 may include front end wall 488 and a lower portion of air treatment chamber 124*a*. The stationary portion 166 may include first end-wall 196 of air treatment member 104.

The moveable portion 168 may be movably mounted by a mount 256 (e.g., any rotational or translational mount as discussed elsewhere herein). As exemplified in FIGS. 91 and 92, moveable portion 168 may be rotatably mounted by a rotational mount 256*a*. Moveable portion 168 may rotate between a closed position (FIG. 91) and an open position (FIG. 92). In other examples, moveable portion 168 may translate between a closed position and an open position. When moveable portion 168 is in the closed position, first stage air treatment chamber 124*a* and forward port 496 of dirt collection chamber 464 may both be closed. In the closed position, rear end 508 of member 504 may abut forward port 496 whereby forward port 496 is closed. When moveable portion 168 is in the open position, first stage air treatment chamber 124*a* and forward port 496 of dirt collection chamber 464 may both be opened. In the open position, rear end 508 of member 504 may be separated from forward port 496 whereby forward port 496 is opened.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Clauses

Clause Set A

1. A hand vacuum cleaner having an upper end, a lower end, a front end, a rear end, a handle and a forward/rearward axis, the hand vacuum cleaner comprising:
   (a) an air flow path extending from a dirty air inlet provided at the front end of the hand vacuum cleaner to a clean air outlet positioned rearward of the dirty air inlet;
   (b) a suction motor positioned in the air flow path upstream of the clean air outlet; and,
   (c) an air treatment member positioned in the air flow path, the air treatment member comprising an air treatment chamber, the air treatment chamber having a front end, an axially spaced apart rear end, a sidewall extending between the front end of the air treatment chamber and the rear end of the air treatment chamber, an air inlet and an air outlet, the air treatment member comprises a stationary portion and a moveable portion, the moveable portion comprises a portion of the sidewall and the moveable portion is moveably mounted by a mount between a closed position in which the air treatment chamber is closed and an open position in which the air treatment chamber is open, wherein, when the moveable portion is in the closed position, the moveable portion and the stationery portion abut along peripheral edges that extend forwardly from a location of the mount, and the peripheral edge of the moveable portion has a discontinuity.

2. The hand vacuum cleaner of clause 1 wherein the peripheral edge extends forwardly generally axially from the mount.

3. The hand vacuum cleaner of clause 1 wherein the air outlet of the air treatment member is provided at the rear end of the air treatment chamber.

4. The hand vacuum cleaner of clause 3 wherein the mount is located at or towards the rear end of the air treatment chamber.

5. The hand vacuum cleaner of clause 3 wherein the air outlet comprises an outlet conduit that extends into the air treatment chamber from the rear end of the air treatment chamber, the outlet conduit has an axial inner end and the discontinuity is provided rearward of the axial inner end.

6. The hand vacuum cleaner of clause 5 wherein the outlet conduit comprises a porous member.

7. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet; and, (c) an air treatment member positioned in the air flow path, the air treatment member comprising an air treatment chamber, the air treatment chamber having a front end, an axially spaced apart rear end, a sidewall extending between the front end of the air treatment chamber and the rear end of the air treatment chamber, an air inlet and an air outlet, the air treatment member comprises a stationary portion and a moveable portion, the moveable portion comprises a portion of the sidewall and the moveable portion is moveably mounted by a mount between a closed position in which the air treatment chamber is closed and an open position in which the air treatment chamber is open, wherein, when the moveable portion is in the closed position, the moveable portion and the stationery portion abut along peripheral edges that extend forwardly from a location of the mount, and wherein the air outlet of the air treatment member is provided at the rear end of the air treatment chamber, the mount is located at or towards the rear end of the air treatment chamber, the air outlet comprises an outlet conduit that extends into the air treatment chamber from the rear end of the air treatment chamber, the outlet conduit has an axial inner end and the peripheral edge of the moveable portion extends downwardly from a location adjacent or rearward of the axial inner end.

8. The hand vacuum cleaner of clause 7 wherein the outlet conduit comprises a porous member.

9. The hand vacuum cleaner of clause 7 wherein the moveable portion extends downwardly from a location adjacent the axial inner end.

10. The hand vacuum cleaner of clause 9 wherein the moveable portion extends linearly from the location.

11. The hand vacuum cleaner of clause 9 wherein the outlet conduit comprises a porous member.

12. The hand vacuum cleaner of clause 7 wherein the moveable portion extends downwardly from a location rearward of the axial inner end.

13. The hand vacuum cleaner of clause 12 wherein the moveable portion extends linearly from the location.

14. The hand vacuum cleaner of clause 12 wherein the outlet conduit comprises a porous member.

Clause Set B

1. A surface cleaning apparatus comprising:

(a) an air flow path extending from a dirty air inlet to a clean air outlet;

(b) an air treatment chamber comprising a first end having a first end wall, an axially opposed second end having a second end wall, an air treatment chamber air inlet, an air treatment chamber air outlet, an air treatment chamber dirt outlet, an air treatment chamber axis extending between the first and second axially opposed ends and an axially extending air treatment chamber sidewall extending between the first and second axially opposed ends;

(c) a dirt collection chamber exterior to the air treatment chamber, the dirt collection chamber comprises an axially extending dirt collection chamber sidewall and a first end having a first end wall, the first end wall is spaced from and faces the first end wall of the air treatment chamber, the dirt collection chamber sidewall comprises a portion that extends between the first end of the dirt collection chamber and the first end wall of the air treatment chamber, the dirt collection chamber is in communication with the air treatment chamber through the dirt outlet; and, (d) a suction motor provided in the air flow path, wherein the air treatment chamber has a stationary portion and a moveable portion, the stationary portion comprises the first end wall of the air treatment chamber, and the moveable portion is moveably mounted by a mount between a closed position in which the air treatment chamber is closed and an open position in which the air treatment chamber is open.

2. The surface cleaning apparatus of clause 1 wherein, when the moveable portion is in the closed position, the moveable portion and the stationery portion abut along peripheral edges that extend along a length of the air treatment chamber sidewall.

3. The surface cleaning apparatus of clause 1 wherein, when the moveable portion is in the closed position, the moveable portion and the stationery portion abut along peripheral edges that extend along a length of the air treatment chamber sidewall and a length of the dirt collection chamber sidewall.

4. The surface cleaning apparatus of clause 1 wherein the dirt outlet comprises a gap provided between at least a portion of the sidewall and at least a portion of the first end wall of the air treatment chamber.

5. The surface cleaning apparatus of clause 1 wherein the air treatment chamber air outlet comprises a porous member that is positioned in the air treatment chamber when the moveable portion is in the closed position and the air treatment chamber air outlet is moveable with the moveable portion.

6. The surface cleaning apparatus of clause 1 wherein the surface cleaning apparatus comprises a hand vacuum cleaner, the dirty air inlet is provided at an upper end of the hand vacuum cleaner and the moveable portion comprises a lower end of the air treatment chamber.

7. The surface cleaning apparatus of clause 1 wherein the surface cleaning apparatus comprises a hand vacuum cleaner, the dirty air inlet is provided at an upper end of the hand vacuum cleaner and the moveable portion comprises an upper end of the air treatment chamber.

8. The surface cleaning apparatus of clause 7 wherein the moveable portion also comprises the dirty air inlet.

9. The surface cleaning apparatus of clause 7 wherein the air treatment chamber air outlet comprises a porous member that is positioned in the air treatment chamber when the moveable portion is in the closed position and the air treatment chamber air outlet is moveable with the moveable portion.

10. The surface cleaning apparatus of clause 1 wherein the first end wall of the air treatment chamber is moveably mounted to the stationary portion.

11. The surface cleaning apparatus of clause 10 wherein the first end wall of the air treatment chamber is pivotally mounted to the stationary portion.

12. A surface cleaning apparatus comprising:

(a) an air flow path extending from a dirty air inlet to a clean air outlet;

(b) an air treatment chamber comprising a first end having a first end wall, an axially opposed second end having a second end wall, an air treatment chamber air inlet, an air treatment chamber air outlet, an air treatment chamber dirt outlet, a central air treatment chamber axis extending between the first and second axially opposed ends and an axially extending air treatment chamber sidewall extending between the first and second axially opposed ends;

(c) a dirt collection chamber exterior to the air treatment chamber, the dirt collection chamber comprises an axially extending dirt collection chamber sidewall and a first end having a first end wall, the first end wall is spaced from and faces the first end wall of the air treatment chamber, the dirt collection chamber sidewall comprises a portion that extends between the first end of the dirt collection chamber and the first end wall of the air treatment chamber, the dirt collection chamber is in communication with the air treatment chamber through the dirt outlet; and, (d) a suction motor provided in the air flow path, wherein the air treatment chamber has a stationary portion and a moveable portion, the moveable portion comprises the first end wall of the air treatment chamber, and the moveable portion is moveably mounted by a mount between a closed position in which the air treatment chamber is closed and an open position in which the air treatment chamber is open, and wherein, when the moveable portion is in the closed position, the moveable portion and the stationery portion abut along peripheral edges that extend along a length of the air treatment chamber sidewall.

13. The surface cleaning apparatus of clause 12 wherein the first end wall of the air treatment chamber is moveably mounted to the moveable portion between a closed in use position and a second position.

14. The surface cleaning apparatus of clause 12 wherein the first end wall of the air treatment chamber is pivotally mounted to the moveable portion.

15. The surface cleaning apparatus of clause 13 wherein the first end wall of the air treatment chamber moves after the moveable portion commences movement to the open position.

16. The surface cleaning apparatus of clause 13 wherein the first end wall of the air treatment chamber moves after the moveable portion moves to the open position.

17. The surface cleaning apparatus of clause 13 wherein the first end wall of the air treatment chamber has a first end that is moveably mounted to the moveable portion and an opposed end, and, when first end wall of the air treatment chamber moves, the opposed end moves away from the second end wall of the air treatment chamber.

18. The surface cleaning apparatus of clause 13 wherein when the moveable portion is in a closed position, the central air treatment chamber axis extends through the first end wall of the air treatment chamber and the first end wall of the air treatment chamber is movable relative to the central air treatment chamber axis.

19. The surface cleaning apparatus of clause 18 wherein in the second position, the first end wall of the air treatment chamber extends towards generally parallel to the central air treatment chamber axis.

20. A surface cleaning apparatus comprising:

(a) an air flow path extending from a dirty air inlet to a clean air outlet;

(b) an air treatment chamber comprising a first end having a first end wall, an axially opposed second end having a second end wall, an air treatment chamber air inlet, an air treatment chamber air outlet, an air treatment chamber dirt outlet, a central air treatment chamber axis extends in a first direction from the first end to the second axially opposed end and an axially extending air treatment chamber sidewall extending between the first and second axially opposed ends;

(c) a dirt collection chamber exterior to the air treatment chamber, the dirt collection chamber comprises an axially extending dirt collection chamber sidewall and a first end having a first end wall, the first end wall is spaced from and faces the first end wall of the air treatment chamber, the dirt collection chamber comprises a portion that extends between the first end of the dirt collection chamber and the first end wall of the air treatment chamber, the dirt collection chamber is in communication with the air treatment chamber through the dirt outlet; and, (d) a suction motor provided in the air flow path, wherein an axially translatable portion, comprising at least a portion of the sidewall of the dirt collection chamber and at least a portion of the sidewall of the cyclone chamber, is translatable axially to an open position.

21. The surface cleaning apparatus of clause 20 wherein the axially translatable portion translates in the first direction.

22. The surface cleaning apparatus of clause 20 wherein the axially translatable portion comprises all of the sidewall of the cyclone chamber and a section of the sidewall of the dirt collection chamber that extends between the first end wall of the dirt collection chamber and the first end wall of the air treatment chamber.

23. The surface cleaning apparatus of clause 20 wherein the suction motor is provided in a suction motor housing and, in the open position, the axially translatable portion overlies the motor housing.

24. The surface cleaning apparatus of clause 20 wherein as the axially translatable portion commences movement towards the open position, the first end wall of the dirt collection chamber and the first end wall of the air treatment chamber remain in position.

25. The surface cleaning apparatus of clause 20 wherein the axially translatable portion is moveable relative to the first end wall of the dirt collection chamber and the first end wall of the air treatment chamber.

26. The surface cleaning apparatus of clause 20 wherein the axially translatable portion translates in a second direction that is opposite to the first direction.

27. The surface cleaning apparatus of clause 26 wherein the axially translatable portion comprises all of the sidewall of the cyclone chamber and a section of the sidewall of the dirt collection chamber that extends between the first end wall of the dirt collection chamber and the first end wall of the air treatment chamber.

28. The surface cleaning apparatus of clause 26 wherein, when the axially translatable portion is in the open position, the at least a portion of the sidewall of the air treatment chamber is positioned in the second direction spaced from the first end wall of the air treatment chamber.

29. The surface cleaning apparatus of clause 28 wherein the axially translatable portion comprises all of the sidewall of the air treatment chamber.

30. The surface cleaning apparatus of clause 26 wherein as the axially translatable portion commences movement towards the open position, the first end wall of the dirt collection chamber and the first end wall of the air treatment chamber remain in position.

31. The surface cleaning apparatus of clause 26 wherein the axially translatable portion is moveable relative to the first end wall of the dirt collection chamber and the first end wall of the air treatment chamber.

Clause Set C

1. A surface cleaning apparatus comprising:

(a) an air flow path extending from a dirty air inlet to a clean air outlet;

(b) an air treatment assembly comprising a first stage air treatment chamber and a dirt collection chamber that is exterior to the first stage air treatment chamber;

(c) the first stage air treatment chamber comprises a first end having a first end wall, an axially opposed second end having a second end wall, a first stage air treatment chamber air inlet, a first stage air treatment chamber air outlet, a central air treatment chamber axis which extends in a first direction from the first end to the second axially opposed end and an axially extending air treatment chamber sidewall extending between the first and second axially opposed ends;

(d) the dirt collection chamber comprises a first end having a first end wall, an axially opposed second end having a second end wall, wherein the dirt collection chamber comprises a portion that is positioned radially of the first stage air treatment chamber; and, (e) a suction motor provided in the air flow path, wherein an axially translatable portion, which comprises at least a portion of the axially extending air treatment chamber sidewall, is axially translatable from a closed position to an open position wherein, when the axially translatable portion is in the open position, dirt collected in the dirt collection chamber is transferrable to the first stage air treatment chamber.

2. The surface cleaning apparatus of clause 1 wherein the first stage air treatment chamber air outlet is provided at the second end of the first stage air treatment chamber, and, when the axially translatable portion is in the open position, the second end of the first stage air treatment chamber is opened.

3. The surface cleaning apparatus of clause 2 wherein the first end of the first stage air treatment chamber remains closed when the axially translatable portion is in the open position.

4. The surface cleaning apparatus of clause 1 wherein the first end of the first stage air treatment chamber remains closed when the axially translatable portion is in the open position.

5. The surface cleaning apparatus of clause 1 wherein the first stage air treatment chamber has a dirt outlet and, when in use to clean a surface, the dirt collection chamber is in communication with the first stage air treatment chamber through the dirt outlet and, when the axially translatable portion is in the open position a second opening that connects the first stage air treatment chamber and the dirt collection chamber in fluid flow communication is opened.

6. The surface cleaning apparatus of clause 5 wherein the first stage air treatment chamber air outlet is provided at the second end of the first stage air treatment chamber, and, when the axially translatable portion is in the open position, the second end of the first stage air treatment chamber is opened.

7. The surface cleaning apparatus of clause 5 wherein the first end of the first stage air treatment chamber remains closed when the axially translatable portion is in the open position.

8. The surface cleaning apparatus of clause 6 wherein the first end of the first stage air treatment chamber remains closed when the axially translatable portion is in the open position.

9. The surface cleaning apparatus of clause 1 further comprising a second stage air treatment chamber, wherein the second stage air treatment chamber has a dirt outlet and the dirt collection chamber is in communication with the second stage air treatment chamber through the dirt outlet.

10. The surface cleaning apparatus of clause 9 wherein the first stage air treatment chamber air outlet is provided at the second end of the first stage air treatment chamber, and, when the axially translatable portion is in the open position, the second end of the first stage air treatment chamber and the dirt collection chamber are opened.

11. The surface cleaning apparatus of clause 9 wherein the first end of the first stage air treatment chamber remains closed when the axially translatable portion is in the open position.

12. The surface cleaning apparatus of clause 10 wherein the first end of the first stage air treatment chamber remains closed when the axially translatable portion is in the open position.

13. The surface cleaning apparatus of clause 1 wherein the first stage air treatment chamber air outlet is provided at the second end of the first stage air treatment chamber, and the first end of the first stage air treatment chamber is openable when the axially translatable portion is in the closed position.

Clause Set D

1. A surface cleaning apparatus comprising:

(a) an air flow path extending from a dirty air inlet to a clean air outlet;

(b) an air treatment assembly comprising a first stage air treatment chamber, the first stage air treatment chamber comprises a first end having a first end wall, an axially opposed second end having a second end wall, a first stage air treatment chamber air inlet, a first stage air treatment chamber air outlet, a central air treatment chamber axis which extends in a first direction from the first end to the second axially opposed end and an axially extending air treatment chamber sidewall extending between the first and second axially opposed ends; and, (c) a suction motor provided in the air flow path, wherein a laterally moveable portion, which comprises at least a portion of the first stage air treatment chamber, is laterally moveable from a closed position to an open position wherein, when the laterally moveable portion is in the open position, the first stage air treatment chamber is opened.

2. The surface cleaning apparatus of clause 1 wherein the laterally moveable portion is translatable in a direction that is generally transverse to the central air treatment chamber axis.

3. The surface cleaning apparatus of clause 2 wherein, subsequent to the laterally moveable portion being translated in a direction that is generally transverse to the central air treatment chamber axis, the laterally moveable portion is translatable in a direction generally parallel to the central air treatment chamber axis.

4. The surface cleaning apparatus of clause 1 wherein the laterally moveable portion is translatable in a direction that is at an angle to both a plane that is transverse to the central air treatment chamber axis and the central air treatment chamber axis.

5. The surface cleaning apparatus of clause 1 wherein the surface cleaning apparatus comprises a hand vacuum cleaner, the dirty air inlet is provided at an upper end of a front end of the hand vacuum cleaner and the laterally moveable portion is translatable downwardly.

6. The surface cleaning apparatus of clause 5 wherein, subsequent to the laterally moveable portion being translated downwardly, the laterally moveable portion is translatable forwardly.

7. The surface cleaning apparatus of clause 1 wherein the surface cleaning apparatus comprises a hand vacuum cleaner, the dirty air inlet is provided at an upper end of a front end of the hand vacuum cleaner and the laterally moveable portion is translatable downwardly and forwardly.

8. The surface cleaning apparatus of clause 1 wherein the laterally moveable portion is rotatable to the open position.

9. The surface cleaning apparatus of clause 1 wherein the first stage air treatment chamber air outlet is provided at the second end of the first stage air treatment chamber, and the first end of the first stage air treatment chamber is openable when the laterally moveable portion is in the closed position.

10. The surface cleaning apparatus of clause 9 wherein the first end of the first stage air treatment chamber comprises a first wall, the central air treatment chamber axis extends through the first wall and the first wall remains in position when the laterally moveable portion moves to the open position.

11. The surface cleaning apparatus of clause 1 wherein the first stage air treatment chamber air outlet is provided at the second end of the first stage air treatment chamber, and the second end of the first stage air treatment chamber is openable when the laterally moveable portion is in the open position.

12. The surface cleaning apparatus of clause 9 wherein the second end of the first stage air treatment chamber is opened when the laterally moveable portion is moved to the open position.

13. The surface cleaning apparatus of clause 1 wherein the first stage air treatment chamber air outlet is provided at the second end of the first stage air treatment chamber, the first end of the first stage air treatment chamber comprises a first wall, the central air treatment chamber axis extends through the first wall and the first wall remains in position when the laterally moveable portion moves to the open position.

14. The surface cleaning apparatus of clause 1 wherein the first stage air treatment chamber air outlet is provided at the second end of the first stage air treatment chamber, the first end of the first stage air treatment chamber comprises a first wall that is generally transverse to the central air treatment chamber axis and the first wall remains in position when the laterally moveable portion moves to the open position.

15. The surface cleaning apparatus of clause 13 wherein the first end of the first stage air treatment chamber is openable when the laterally moveable portion is in the closed position.

16. The surface cleaning apparatus of clause 15 wherein the second end of the first stage air treatment chamber is opened when the laterally moveable portion is moved to the open position.

17. The surface cleaning apparatus of clause 1 wherein the second end of the first stage air treatment chamber is opened when the laterally moveable portion is moved to the open position.

18. The surface cleaning apparatus of clause 1 wherein the first stage air treatment chamber air outlet comprises a porous member positioned in the air treatment chamber when the laterally moveable portion is moved to the closed position, and the laterally moveable portion further comprises the porous member.

19. The surface cleaning apparatus of clause 1 further comprising a second stage air treatment chamber, and the laterally moveable portion comprises at least a portion of the second stage air treatment chamber.

20. The surface cleaning apparatus of clause 1 further comprising a dirt collection chamber that is exterior to the first stage air treatment chamber, the dirt collection chamber comprises a first end having a first end wall, an axially opposed second end having a second end wall, wherein the dirt collection chamber comprises a portion that is positioned radially outwardly of the first stage air treatment chamber, and the laterally moveable portion further comprises at least a portion of the dirt collection chamber, wherein, when the laterally moveable portion is in the open position, the dirt collection chamber is opened.

21. The surface cleaning apparatus of clause 20 further comprising a second stage air treatment chamber, wherein the second stage air treatment chamber has a dirt outlet and the dirt collection chamber is in communication with the second stage air treatment chamber through the dirt outlet.

22. The surface cleaning apparatus of clause 20 wherein the first stage air treatment chamber has a dirt outlet and the dirt collection chamber is in communication with the first stage air treatment chamber through the dirt outlet.

Clause Set E

1. A surface cleaning apparatus comprising:

(a) an air flow path extending from a dirty air inlet to a clean air outlet;

(b) an air treatment assembly comprising a first stage air treatment chamber, the air treatment assembly comprises a first end having a first end wall and an axially opposed second end, the first stage air treatment chamber comprises a first end having a first end wall, an axially opposed second end having a second end wall, a first stage air treatment chamber air inlet, a first stage air treatment chamber air outlet and a central air treatment chamber axis which extends in a first direction from the first end to the second axially opposed end of the first stage air treatment chamber; and, (c) a suction motor provided in the air flow path, wherein the first end of the air treatment assembly is laterally moveable from a closed position to an open position wherein, when the first end of the air treatment assembly is in the open position, the first stage air treatment chamber is opened.

2. The surface cleaning apparatus of clause 1 wherein the first end wall of the air treatment assembly is the front wall of the first stage air treatment chamber.

3. The surface cleaning apparatus of clause 1 wherein the first end wall of the air treatment assembly is axially spaced from the first end wall of the first stage air treatment chamber, and air treatment assembly further comprises a dirt collection chamber, the dirt collection chamber comprises a volume between the first end wall of the air treatment assembly and the first end wall of the first stage air treatment chamber.

4. The surface cleaning apparatus of clause 3 wherein a dirt outlet is provided at the first end of the first stage air treatment chamber and the dirt outlet is in communication with the dirt collection chamber.

5. The surface cleaning apparatus of clause 3 wherein, when the first end of the air treatment assembly is in the open position, the volume is also opened.

6. The surface cleaning apparatus of clause 3 wherein the first end wall of the air treatment assembly and the first end wall of the first stage air treatment chamber are concurrently moveable.

7. The surface cleaning apparatus of clause 3 wherein first end wall of the first stage air treatment chamber is moveable in a different direction to the first end wall of the air treatment assembly.

8. The surface cleaning apparatus of clause 7 wherein that first end wall of the first stage air treatment chamber is rotatable about an axis of rotation that is in a direction that is generally transverse to the central air treatment chamber axis.

9. The surface cleaning apparatus of clause 1 wherein the first end of the air treatment assembly is translatable to the open position.

10. The surface cleaning apparatus of clause 9 wherein the first end wall of the air treatment assembly is axially spaced from the first end wall of the first stage air treatment chamber, and the air treatment assembly further comprises a dirt collection chamber, the dirt collection chamber comprises a volume between the first end wall of the air treatment assembly and the first end wall of the first stage air treatment chamber, and that first end wall of the first stage air treatment chamber is rotatable about an axis of rotation that is in a direction that is generally transverse to the central air treatment chamber axis.

11. The surface cleaning apparatus of clause 1 wherein the first end of the air treatment assembly is rotatable to the open position.

12. The surface cleaning apparatus of clause 11 wherein the first end wall of the air treatment assembly is axially spaced from the first end wall of the first stage air treatment chamber, and air treatment assembly further comprises a dirt collection chamber, the dirt collection chamber comprises a volume between the first end wall of the air treatment assembly and the first end wall of the first stage air treatment chamber, and that first end wall of the first stage air treatment chamber is rotatable about an axis of rotation that is in a direction that is generally transverse to the central air treatment chamber axis.

13. The surface cleaning apparatus of clause 1 further comprising a second stage air treatment chamber, wherein the second stage air treatment chamber has a dirt outlet that is in communication with a dirt collection chamber that is exterior to the second stage air treatment chamber and, when the first end of the air treatment assembly is in the open position, the dirt collection chamber is also opened.

14. The surface cleaning apparatus of clause 13 where the dirt collection chamber comprises a portion that is positioned radially outwardly of the first stage air treatment chamber, and, when the first end of the air treatment assembly is in the open position, the dirt collection chamber is also opened.

15. The surface cleaning apparatus of clause 1 further comprising a dirt collection chamber that is exterior to the first stage air treatment chamber, the dirt collection chamber comprises a portion that is positioned radially outwardly of the first stage air treatment chamber, and, when the first end of the air treatment assembly is in the open position, the dirt collection chamber is also opened.

Clause Set F

1. A surface cleaning apparatus comprising:

(a) an air flow path extending from a dirty air inlet to a clean air outlet;

(b) an air treatment assembly comprising an air treatment chamber, the air treatment chamber comprises a first end having a first end wall, an axially opposed second end having a second end wall, an air treatment chamber air inlet, an air treatment chamber air outlet comprising a porous member, a central air treatment chamber axis which extends in a first direction from the first end to the second axially opposed end of the air treatment chamber, and an axially extending air treatment chamber sidewall extending between the first and second axially opposed ends; and, (c) a suction motor provided in the air flow path, wherein at least a portion of the sidewall of the air treatment chamber is openable, and when the sidewall is opened an opening is provided whereby the porous member is moveable from an in-use position, in which the porous member is positioned in the air treatment chamber, to a cleaning position in which the porous member is positioned at least partially outside the air treatment chamber.

2. The surface cleaning apparatus of clause 1 wherein the porous member is translatable to the cleaning position.

3. The surface cleaning apparatus of clause 1 wherein the porous member is rotatable to the cleaning position.

4. The surface cleaning apparatus of clause 1 further comprising a dirt collection chamber exterior to the air treatment chamber, the dirt collection chamber comprises a portion that is positioned radially outwardly of the air treatment chamber and the porous member travels through the dirt collection chamber to the cleaning position.

5. The surface cleaning apparatus of clause 4 wherein the dirt collection chamber is opened concurrently with the sidewall of the air treatment chamber.

6. The surface cleaning apparatus of clause 4 wherein the dirt collection chamber comprises an axially extending dirt collection chamber sidewall which is openable.

7. The surface cleaning apparatus of clause 1 wherein the portion of the sidewall of the air treatment chamber is rotatably openable about an axis that extends generally axially.

8. The surface cleaning apparatus of clause 1 wherein the portion of the sidewall of the air treatment chamber comprises two doors, each of which is rotatably openable about an axis that extends generally axially.

9. The surface cleaning apparatus of clause 7 further comprising a dirt collection chamber exterior to the air treatment chamber, the dirt collection chamber comprises a portion that is positioned radially outwardly of the air treatment chamber and the portion of the sidewall rotates into the dirt collection chamber when the portion of the sidewall rotates open.

10. The surface cleaning apparatus of clause 9 wherein the porous member travels through the dirt collection chamber to the cleaning position.

11. The surface cleaning apparatus of clause 1 further comprising a dirt collection chamber exterior to the air treatment chamber, the dirt collection chamber comprises a portion that is positioned radially outwardly of the air treatment chamber and the dirt collection chamber has a generally axially extending sidewall wherein at least a portion of the sidewall of the dirt collection chamber is openable.

12. The surface cleaning apparatus of clause 11 wherein the air treatment chamber and the dirt collection chamber are concurrently openable.

13. The surface cleaning apparatus of clause 11 wherein the porous member travels through the dirt collection chamber to the cleaning position.

14. The surface cleaning apparatus of clause 13 wherein the portion of the sidewall of the air treatment chamber moves with the porous member.

15. The surface cleaning apparatus of clause 11 wherein the portion of the sidewall of the dirt collection chamber is rotatably openable about an axis that extends generally axially.

16. The surface cleaning apparatus of clause 11 wherein the portion of the sidewall of the dirt collection chamber comprises two doors, each of which is rotatably openable about an axis that extends generally axially.

17. The surface cleaning apparatus of clause 11 wherein the porous member is translatable to the cleaning position.

18. The surface cleaning apparatus of clause 1 wherein the portion of the sidewall of the air treatment chamber is translatable axially to an open position.

19. The surface cleaning apparatus of clause 18 further comprising a dirt collection chamber exterior to the air treatment chamber, the dirt collection chamber comprises a portion that is positioned radially outwardly of the air treatment chamber and the porous member travels through the dirt collection chamber to the cleaning position.

20. The surface cleaning apparatus of clause 1 wherein the second axially opposed end of the air treatment chamber comprises a second end wall and the porous member and at least a portion of the second end wall moves with the porous member.

Clause Set G

1. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet;

(c) a first stage air treatment chamber comprising a front end, an axially spaced apart rear end, a sidewall extending between the front end of the first stage air treatment chamber and the rear end of the first stage air treatment chamber, an air inlet and an air outlet;

(d) a dirt collection chamber exterior to the first stage air treatment chamber and positioned radially inwardly of the first stage air treatment chamber, the dirt collection chamber comprises an axially extending dirt collection chamber sidewall, the dirt collection chamber sidewall having an openable portion whereby the dirt collection chamber is emptyable.

2. The hand vacuum cleaner of clause 1 wherein the dirt collection chamber is emptyable concurrently with the first stage air treatment chamber.

3. The hand vacuum cleaner of clause 1 wherein the first stage air treatment chamber further comprises a dirt outlet and the dirt collection chamber is in communication with the first stage air treatment chamber through the dirt outlet.

4. The hand vacuum cleaner of clause 1 further comprising a second stage air treatment chamber, the second stage air treatment chamber further comprises a dirt outlet and the dirt collection chamber is in communication with the second stage air treatment chamber by the dirt outlet.

5. The hand vacuum cleaner of clause 1 wherein the first stage air treatment chamber comprises a stationary portion and a moveable portion, the moveable portion comprises a portion of the sidewall of the first stage air treatment chamber and the moveable portion is moveably mounted by a mount between a closed position in which the first stage air treatment chamber is closed and an open position in which the first stage air treatment chamber is open.

6. The hand vacuum cleaner of clause 5 wherein, when the moveable portion is in the closed position, the moveable portion and the stationery portion abut along peripheral edges that extend forwardly from a location of the mount.

7. The hand vacuum cleaner of clause 1 wherein the openable portion is rotatably openable.

8. The hand vacuum cleaner of clause 1 wherein the openable portion translates to an open position.

9. The hand vacuum cleaner of clause 1 wherein, when the openable portion is opened, the dirt collection chamber is in communication with the first stage air treatment chamber.

10. The hand vacuum cleaner of clause 9 further comprising a second stage air treatment chamber, the second stage air treatment chamber further comprises a dirt outlet and the dirt collection chamber is in communication with the second stage air treatment chamber through the dirt outlet.

11. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet;

(c) a first stage air treatment chamber comprising a front end, an axially spaced apart rear end, a sidewall extending between the front end of the first stage air treatment chamber and the rear end of the first stage air treatment chamber, an air inlet and an air outlet;

(d) a second stage air treatment chamber comprising a dirt outlet;

(e) a second stage dirt collection chamber exterior to the second stage air treatment chamber and in communication with the second stage air treatment chamber through the dirt outlet, the second stage dirt collection chamber comprises an axially extending second stage dirt collection chamber sidewall, the second stage dirt collection chamber sidewall having an openable portion whereby the dirt collection chamber is emptyable.

12. The hand vacuum cleaner of clause 11 wherein the first stage air treatment chamber comprises a stationary portion and a moveable portion, the moveable portion comprises a portion of the sidewall of the first stage air treatment chamber and the moveable portion is moveably mounted by a mount between a closed position in which the first stage air treatment chamber is closed and an open position in which the first stage air treatment chamber is open.

13. The hand vacuum cleaner of clause 11 wherein, when the openable portion is open, dirt in the second stage dirt collection chamber is transferable to the first stage air treatment chamber.

14. The hand vacuum cleaner of clause 11 wherein, when the openable portion is open, the second stage dirt collection chamber is in communication with the first stage air treatment chamber.

15. The hand vacuum cleaner of clause 11 further comprising a first stage dirt collection chamber exterior to the first stage air treatment chamber and in communication with the first stage air treatment chamber through a first stage dirt outlet.

16. The hand vacuum cleaner of clause 15 wherein, when the openable portion is open, dirt in the second stage dirt collection chamber is transferable to the first stage dirt collection chamber.

17. The hand vacuum cleaner of clause 15 wherein, when the openable portion is open, the second stage dirt collection chamber is in communication with the first stage dirt collection chamber.

18. The hand vacuum cleaner of clause 11 wherein the second stage dirt collection chamber is positioned radially from the first stage air treatment chamber.

19. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet;

(c) a first stage air treatment chamber comprising a front end, an axially spaced apart rear end, a first stage air treatment chamber sidewall extending between the front end of the first stage air treatment chamber and the rear end of the first stage air treatment chamber, an air inlet and an air outlet, the first stage air treatment chamber sidewall having an openable portion whereby the first stage air treatment chamber is emptyable;

(d) a second stage air treatment chamber comprising a dirt outlet;

(e) a second stage dirt collection chamber exterior to the second stage air treatment chamber and in communication with the second stage air treatment chamber through the dirt outlet, the second stage dirt collection chamber comprises an axially extending second stage dirt collection chamber sidewall, the second stage dirt collection chamber sidewall having an openable portion whereby the second stage dirt collection chamber is emptyable.

20. The hand vacuum cleaner of clause 19 wherein the first stage air treatment chamber and the second stage dirt collection chamber are sequentially openable.

21. The hand vacuum cleaner of clause 19 wherein the first stage air treatment chamber and the second stage dirt collection chamber are concurrently openable.

Clause Set H

1. A surface cleaning apparatus comprising:

(a) an air flow path extending from a dirty air inlet to a clean air outlet;

(b) an air treatment assembly comprising a first stage air treatment chamber and a dirt collection chamber that is exterior to the first stage air treatment chamber;

(c) the first stage air treatment chamber comprises a first end having a first end wall, an axially opposed second end having a second end wall, a first stage air treatment chamber air inlet, a first stage air treatment chamber air outlet, a central air treatment chamber axis which extends in a first direction from the first end to the second axially opposed end and an axially extending air treatment chamber sidewall extending between the first and second axially opposed ends;

(d) the dirt collection chamber comprises a first end having a first end wall, an axially opposed second end having a second end wall, wherein the dirt collection chamber comprises a portion that is positioned radially outwardly of the first stage air treatment chamber; and, (e) a suction motor provided in the air flow path, wherein an axially translatable portion, which comprises at least a portion of the first stage air treatment chamber and the dirt collection chamber, is axially translatable from a closed position to an open position wherein, when the axially translatable portion is in the open position, the cyclone chamber and the dirt collection chamber are opened.

2. The surface cleaning apparatus of clause 1 wherein the first stage air treatment chamber air outlet is provided at the second end of the first stage air treatment chamber, and, when the axially translatable portion is in the open position, the second end of the first stage air treatment chamber and the dirt collection chamber are opened.

3. The surface cleaning apparatus of clause 2 wherein the first end of the first stage air treatment chamber remains closed when the axially translatable portion is in the open position.

4. The surface cleaning apparatus of clause 1 wherein the first end of the first stage air treatment chamber remains closed when the axially translatable portion is in the open position.

5. The surface cleaning apparatus of clause 1 wherein the first stage air treatment chamber has a dirt outlet and the dirt collection chamber is in communication with the first stage air treatment chamber through the dirt outlet.

6. The surface cleaning apparatus of clause 5 wherein the first stage air treatment chamber air outlet is provided at the second end of the first stage air treatment chamber, and, when the axially translatable portion is in the open position, the second end of the first stage air treatment chamber and the dirt collection chamber are opened.

7. The surface cleaning apparatus of clause 5 wherein the first end of the first stage air treatment chamber remains closed when the axially translatable portion is in the open position.

8. The surface cleaning apparatus of clause 6 wherein the first end of the first stage air treatment chamber remains closed when the axially translatable portion is in the open position.

9. The surface cleaning apparatus of clause 1 further comprising a second stage air treatment chamber, wherein the second stage air treatment chamber has a dirt outlet and the dirt collection chamber is in communication with the second stage air treatment chamber through the dirt outlet.

10. The surface cleaning apparatus of clause 9 wherein the first stage air treatment chamber air outlet is provided at the second end of the first stage air treatment chamber, and, when the axially translatable portion is in the open position, the second end of the first stage air treatment chamber and the dirt collection chamber are opened.

11. The surface cleaning apparatus of clause 9 wherein the first end of the first stage air treatment chamber remains closed when the axially translatable portion is in the open position.

12. The surface cleaning apparatus of clause 10 wherein the first end of the first stage air treatment chamber remains closed when the axially translatable portion is in the open position.

13. The surface cleaning apparatus of clause 1 wherein the first stage air treatment chamber air outlet is provided at the second end of the first stage air treatment chamber, and the first end of the first stage air treatment chamber is openable when the axially translatable portion is in the closed position.

14. The surface cleaning apparatus of clause 1 wherein first stage air treatment chamber comprises a stationary portion and a moveable portion, the moveable portion comprises a portion of the axially extending air treatment chamber sidewall and the moveable portion is moveably mounted by a mount between a closed position in which the first stage air treatment chamber is closed and an open position in which the first stage air treatment chamber is open.

15. The surface cleaning apparatus of clause 14 wherein the first stage air treatment chamber comprises a stationary portion and a moveable portion comprises the portion of the dirt collection chamber.

16. The surface cleaning apparatus of clause 14 further comprising a main body which houses the suction motor, a handle extends downwardly from the main body and the mount is provided at an upper end of the first stage air treatment chamber.

Clause Set I

1. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet;

(c) an air treatment member positioned in the air flow path, the air treatment member comprising an air treatment chamber and a dirt collection chamber, the air treatment member having a first lateral end, an axially spaced apart second lateral end, an air treatment member sidewall extending between the first and second ends, a front side and a rear side, the front side comprising a front wall; and, (d) the air treatment chamber comprises a first lateral end, an axially spaced apart second lateral end, a sidewall extending between the first lateral end of the air treatment chamber and the second lateral end of the air treatment chamber, a central air treatment chamber axis extending between the first and second lateral ends of the air treatment chamber, a dirt outlet in communication with the dirt collection chamber, an air inlet and an air outlet, the air outlet is provided at one of the first and second ends of the air treatment chamber;

wherein the air treatment member comprises a stationary portion and a moveable portion, the moveable portion is moveably mounted by a mount between a closed position in which the dirt collection chamber is closed and an open position in which the dirt collection chamber is open wherein, when the moveable portion moves to the open position, the front wall remains in position.

2. The hand vacuum cleaner of clause 1 wherein the moveable portion comprises a portion of the air treatment member sidewall.

3. The hand vacuum cleaner of clause 2 wherein the moveable portion is translatably mounted.

4. The hand vacuum cleaner of clause 3 wherein the moveable portion comprises at least a portion of the air treatment chamber.

5. The hand vacuum cleaner of clause 3 wherein the moveable portion comprises the air treatment chamber.

6. The hand vacuum cleaner of clause 2 wherein the moveable portion is rotatably mounted.

7. The hand vacuum cleaner of clause 6 wherein the moveable portion comprises at least a portion of the air treatment chamber.

8. The hand vacuum cleaner of clause 6 wherein the moveable portion comprises the air treatment chamber.

9. The hand vacuum cleaner of clause 1 wherein at least one of the first and second ends of the air treatment chamber is openable.

10. The hand vacuum cleaner of clause 1 wherein at least one of the first and second ends of the air treatment chamber is openable when the moveable portion is in the closed position.

11. The hand vacuum cleaner of clause 1 wherein at least one of the first and second ends of the air treatment member is openable.

12. The hand vacuum cleaner of clause 1 wherein at least one of the first and second ends of the air treatment member is openable when the moveable portion is in the closed position.

13. The hand vacuum cleaner of clause 1 wherein the front side of the air treatment member is spaced from and faces a front side of the air treatment chamber whereby the dirt collection chamber comprises a volume positioned between the front side of the air treatment member and the front side of the air treatment chamber.

14. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet; and, (c) an air treatment member positioned in the air flow path, the air treatment member comprising an air treatment chamber, the air treatment member having a first lateral end, an axially spaced apart second lateral end, an air treatment member sidewall extending between the first and second ends, a front side and a rear side, the front side comprising a front wall; and, (d) the air treatment chamber comprises a first lateral end, an axially spaced apart second lateral end, a central air treatment chamber axis extending between the first and second lateral ends of the air treatment chamber, a sidewall extending between the first lateral end of the air treatment chamber and the second lateral end of the air treatment chamber, an air inlet and an air outlet, the air outlet is provided at one of the first and second ends of the air treatment chamber;

wherein the front wall of the air treatment member comprises at least a portion of the sidewall of the air treatment chamber, and wherein the air treatment member comprises a stationary portion and a moveable portion, the moveable portion comprises the front wall, the moveable portion is moveably mounted by a mount between a closed position in which the air treatment chamber is closed and an open position in which the air treatment chamber is open.

15. The hand vacuum cleaner of clause 14 further comprising a dirt collection chamber that is in communication with the air treatment chamber through a dirt outlet.

16. The hand vacuum cleaner of clause 154 wherein at least a portion of the dirt collection chamber is axially spaced from one of the first and second lateral ends of the air treatment chamber.

17. The hand vacuum cleaner of clause 14 wherein the moveable portion is translatably mounted.

18. The hand vacuum cleaner of clause 14 wherein the moveable portion is rotatably mounted.

19. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet;

(c) an air treatment member positioned in the air flow path, the air treatment member comprising an air treatment chamber and a dirt collection chamber, the air treatment member having a first lateral end, an axially spaced apart second lateral end, an air treatment member sidewall extending between the first and second ends, a front side and a rear side, the front side comprising a front wall; and, (d) the air treatment chamber comprises a first lateral end, an axially spaced apart second lateral end, a sidewall extending between the first lateral end of the air treatment chamber and the second lateral end of the air treatment chamber, a central air treatment chamber axis extending between the first and second lateral ends of the air treatment chamber, a dirt outlet in communication with the dirt collection chamber, an air inlet and an air outlet, the air outlet is provided at one of the first and second ends of the air treatment chamber;

wherein the air treatment member comprises a stationary portion and a moveable portion, the stationary portion comprises a front side of the air treatment chamber, the moveable portion is moveably mounted by a mount between a closed position in which the dirt collection chamber is closed and an open position in which the dirt collection chamber is open.

20. The hand vacuum cleaner of clause 19 wherein the moveable portion comprises a portion of the air treatment member which extends in a direction of the axis, the moveable portion has an inner surface and the inner surface has an absence of discontinuities.

21. The hand vacuum cleaner of clause 19 wherein the inner surface is generally smooth.

22. The hand vacuum cleaner of clause 19 wherein the moveable portion is translatably mounted.

23. The hand vacuum cleaner of clause 19 wherein the moveable portion is rotatably mounted.

Clause Set J

1. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) an air treatment member positioned in the air flow path, the air treatment member comprising an air treatment chamber, the air treatment chamber having a front end, an axially spaced apart rear end, a sidewall extending between the front end of the air treatment chamber and the rear end of the air treatment chamber, an air inlet and an air outlet, the air treatment member comprises a stationary portion and a moveable portion, the moveable portion is rotatably mounted by a rotational mount between a closed position in which the air treatment chamber is closed and an open position in which the air treatment chamber is open; and (c) a pre-motor filter positioned downstream of the air treatment chamber, the pre-motor filter has a first side and an axially opposed second side; and, (d) a suction motor positioned in the air flow path upstream of the clean air outlet, wherein the moveable portion comprises the pre-motor filter whereby, when the moveable portion is in the closed position, the first side of the pre-motor filter faces generally forwardly and when the moveable portion is in the open position, the first side of the pre-motor filter faces generally rearwardly.

2. The hand vacuum cleaner of clause 1 wherein the first side of the pre-motor filter comprises an upstream side and the second side of the pre-motor filter comprises a downstream side.

3. The hand vacuum cleaner of clause 1 wherein the rear end of the air treatment member comprises a rear wall and the rear wall forms part of a pre-motor filter housing.

4. The hand vacuum cleaner of clause 1 wherein the air outlet of the air treatment member is provided at the rear end of the air treatment chamber.

5. The hand vacuum cleaner of clause 4 wherein the rotational mount is located at or towards the rear end of the air treatment chamber.

6. The hand vacuum cleaner of clause 4 wherein the air outlet comprises an outlet conduit that extends into the air treatment chamber from the rear end of the air treatment chamber, and the outlet conduit comprises a porous member.

7. The hand vacuum cleaner of clause 4 wherein the rear end of the air treatment member comprises a rear wall and the rear wall forms part of a pre-motor filter housing.

8. The hand vacuum cleaner of clause 1 wherein the moveable member comprises a portion of the sidewall.

9. The hand vacuum cleaner of clause 1 wherein the moveable portion is translatably mounted.

10. The hand vacuum cleaner of clause 1 wherein the moveable portion is rotatably mounted.

Clause Set K

1. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet, the dirty air inlet is provided at an upper end of the hand vacuum cleaner;

(b) an air treatment chamber comprising a front end having a front end wall, an axially opposed rear end having a rear end wall, an air treatment chamber air inlet, an air treatment chamber air outlet, an air treatment chamber axis extending between the front and rear axially opposed ends and an axially extending air treatment chamber sidewall extending between the front and rear axially opposed ends; and, (c) a suction motor provided in the air flow path, wherein the air treatment chamber has a stationary portion and a moveable portion, the moveable portion comprises an upper end of the air treatment chamber, and the moveable portion is moveably mounted by a mount between a closed position in which the air treatment chamber is closed and an open position in which the air treatment chamber is open.

2. The surface cleaning apparatus of clause 1 wherein the moveable portion further comprises the dirty air inlet.

3. The hand vacuum cleaner of clause 1 wherein the air treatment chamber air outlet comprises an outlet conduit that extends into the air treatment chamber from the rear end of the air treatment chamber, and the moveable portion further comprises the air treatment chamber air outlet.

4. The hand vacuum cleaner of clause 3 wherein the air treatment chamber air outlet comprises a porous member.

5. The hand vacuum cleaner of clause 3 wherein the moveable portion further comprises the front end wall of the air treatment chamber.

6. The hand vacuum cleaner of clause 1 wherein the moveable portion further comprises the front end wall of the air treatment chamber.

7. The surface cleaning apparatus of clause 1 further comprising a dirt collection chamber exterior to the air treatment chamber, and the dirt collection chamber is opened when the moveable portion is in the open position.

8. The hand vacuum cleaner of clause 6 wherein at least a portion of the dirt collection chamber is located radially of the air treatment chamber.

9. The hand vacuum cleaner of clause 7 wherein the dirt collection chamber has a front end wall and the moveable portion further comprises the front end wall of the dirt collection chamber.

10. The hand vacuum cleaner of clause 9 wherein the moveable portion further comprises the front end wall of the air treatment chamber.

11. The hand vacuum cleaner of clause 7 wherein the dirt collection chamber comprises an axially extending dirt collection chamber sidewall and a front end having a front end wall, the front end wall is spaced from and faces the front end wall of the air treatment chamber, the dirt collection chamber sidewall comprises a portion that extends between the front end wall of the dirt collection chamber and the front end wall of the air treatment chamber, the dirt collection chamber is in communication with the air treatment chamber through a dirt outlet.

12. The hand vacuum cleaner of clause 11 wherein the moveable portion further comprises the front end wall of the air treatment chamber.

13. The hand vacuum cleaner of clause 12 wherein the moveable portion further comprises the front end wall of the dirt collection chamber.

14. The hand vacuum cleaner of clause 11 wherein the moveable portion further comprises the front end wall of the dirt collection chamber.

Clause Set L

1. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) an air treatment member comprising a first stage air treatment chamber and a dirt collection chamber, (c) the first stage air treatment chamber comprising a front end having a front end wall, an axially opposed rear end having a rear end wall, a first stage air treatment chamber air inlet, a first stage air treatment chamber air outlet, an air treatment chamber axis extending between the front and rear axially opposed ends and an axially extending air treatment chamber sidewall extending between the front and rear axially opposed ends;

(d) the dirt collection chamber is exterior to the air treatment chamber, the dirt collection chamber comprises a front end having a front end wall and a rearward portion that has a forward port; and, (e) a suction motor provided in the air flow path, wherein the air treatment member has a stationary portion and a moveable portion, the moveable portion comprises a portion of the air treatment chamber and the front wall of the dirt collection chamber, and the moveable portion is moveably mounted by a mount between a closed position in which the air treatment chamber and the forward port of the dirt collection chamber are closed and an open position in which the air treatment chamber and the forward port of the dirt collection chamber are open.

2. The hand vacuum cleaner of clause 1 wherein the first stage air treatment chamber has a dirt outlet and the dirt collection chamber is in communication with the first stage air treatment chamber through the dirt outlet.

3. The hand vacuum cleaner of clause 1 further comprising a second stage air treatment chamber downstream from the first stage air treatment chamber and the second stage air treatment chamber has a dirt outlet that is in communication with the dirt collection chamber.

4. The hand vacuum cleaner of clause 3 wherein the dirt collection chamber has a first portion that is positioned radially from the first stage air treatment chamber.

5. The hand vacuum cleaner of clause 4 wherein the first portion is positioned radially outwardly from the first stage air treatment chamber.

6. The hand vacuum cleaner of clause 1 wherein the dirty air inlet is provided at an upper end of the hand vacuum cleaner and the moveable portion is a lower portion of the air treatment member.

7. The hand vacuum cleaner of clause 6 wherein the moveable portion is translatably mounted.

8. The hand vacuum cleaner of clause 6 wherein the moveable portion is rotatably mounted.

9. The hand vacuum cleaner of clause 1 wherein the front end of the dirt collection chamber is the front end wall of the dirt collection chamber.

10. The hand vacuum cleaner of clause 1 wherein the air treatment member has a front wall and the front wall remains in position when the moveable portion moves to the open position.

11. The hand vacuum cleaner of clause 10 wherein the front wall of the air treatment member comprises the front end wall of the dirt collection chamber.

12. The hand vacuum cleaner of clause 10 wherein the front wall of the air treatment member comprises the front end wall of the dirt collection chamber and the front end wall of the first stage air treatment chamber.

13. The hand vacuum cleaner of clause 10 wherein the front end wall of the dirt collection chamber comprises a member that extends rearwardly from the front wall of the air treatment member to the forward port.

14. The hand vacuum cleaner of clause 10 wherein the front end of the dirt collection chamber comprises a rear end that closes the forward port and the rear end is closed.

15. The hand vacuum cleaner of clause 10 wherein the front end of the dirt collection chamber comprises a rear end that closes the forward port and the rear end is open whereby an internal volume of the front end of the dirt collection chamber comprises a portion of a storage volume of the dirt collection chamber.

Clause Set M

1. An apparatus comprising:

(a) a surface cleaning apparatus comprising:

(i) a surface cleaning apparatus having an air flow path extending from a surface cleaning apparatus dirty air inlet to a surface cleaning apparatus clean air outlet;

(ii) a suction motor positioned in the surface cleaning apparatus air flow path upstream of the surface cleaning apparatus clean air outlet; and, (iii) an air treatment member positioned in the surface cleaning apparatus air flow path, the air treatment member comprising an air treatment chamber and a dirt collection chamber, the air treatment chamber having a first end, an axially spaced apart second end, a central air treatment chamber axis extending between the first and second axially opposed ends of the air treatment chamber, a sidewall extending between the first end of the air treatment chamber and the second end of the air treatment chamber, an air inlet and an air outlet, the dirt collection chamber is positioned radially outwardly of the air treatment chamber; and, (b) a docking station comprising:

(i) a docking station air flow path extending from a docking station air inlet to a docking station air outlet; and, (ii) a docking interface comprising wall portions and a docking interface perimeter extending around the wall portions, wherein, the dirt collection chamber has a radial inner portion and a radial outer portion, the radial outer portion is narrower in a direction transverse to the central air treatment chamber axis than the radial inner portion and, when the air treatment member is docked with the docking station, at least a portion of the radial outer portion is exterior to the docking station.

2. The apparatus of clause 1 wherein the radial outer portion is openable.

3. The apparatus of clause 2 wherein a radial distal end of the radial outer portion comprises an openable door.

4. The apparatus of clause 1 wherein the dirt collection chamber has a discontinuity at a juncture of the radial inner portion and the radial outer portion and, when the air treatment member is docked with the docking station, the docking interface perimeter contacts the discontinuity.

5. The apparatus of clause 4 wherein the discontinuity comprises a flange portion that the docking interface perimeter contacts when the air treatment member is docked with the docking station.

6. The apparatus of clause 1 wherein the air treatment member is openable when the air treatment member is docked with the docking station.

7. The apparatus of clause 6 wherein the air treatment member has an openable portion and, when the when the air treatment member is docked with the docking station and the docking station is in an evacuation mode of operation, the air treatment chamber is in fluid flow communication with the docking station.

8. The apparatus of clause 1 wherein the air treatment member has a rotatable openable door, the door is rotatable about an axis that extends generally in a direction of the central air treatment chamber axis.

9. The apparatus of clause 8 wherein the rotatable openable door comprises an arc, the arc is less curved than a remainder of the sidewall of the air treatment chamber.

10. The apparatus of clause 1 wherein the air treatment member is exterior to the docking station when the air treatment member is docked with the docking station.

11. A hand vacuum cleaner having an upper end, a lower end, a front end, a rear end, a handle and a forward/rearward axis, the hand vacuum cleaner comprising:

(a) an air flow path extending from a dirty air inlet provided at the front end of the hand vacuum cleaner to a clean air outlet positioned rearward of the dirty air inlet;

(b) an air treatment member comprising an air treatment chamber and a dirt collection chamber, (c) the air treatment chamber comprising a front end having a front end wall, an axially opposed rear end having a rear end wall, an air treatment chamber air inlet, an air treatment chamber air outlet, an air treatment chamber axis extending between the front and rear axially opposed ends and an axially extending air treatment chamber sidewall extending between the front and rear axially opposed ends;

(d) the dirt collection chamber is positioned radially outwardly of the air treatment chamber; and, (e) a suction motor provided in the air flow path, wherein, the dirt collection chamber has a radial inner portion and a radial outer portion, the radial outer portion is narrower in a direction transverse to the central air treatment chamber axis than the radial inner portion.

12. The apparatus of clause 11 wherein the radial outer portion is openable.

13. The apparatus of clause 12 wherein a radial distal end of the radial outer portion comprises an openable door.

14. The apparatus of clause 11 wherein the dirt collection chamber has a discontinuity at a juncture of the radial inner portion and the radial outer portion.

15. The apparatus of clause 14 wherein the discontinuity comprises a flange portion.

16. The apparatus of clause 11 wherein the air treatment member is also openable.

17. The apparatus of clause 11 wherein the air treatment member has a rotatable openable door, the door is rotatable about an axis that extends generally in a direction of the air treatment chamber axis.

18. The apparatus of clause 17 wherein the rotatable openable door comprises an arc, the arc is less curved than a remainder of the sidewall of the air treatment chamber.

The apparatus of clause 1 wherein the air treatment member is exterior to the radial outer portion.

The invention claimed is:

1. An apparatus comprising:

(a) a surface cleaning apparatus comprising:

(i) a surface cleaning apparatus air flow path extending from a surface cleaning apparatus dirty air inlet to a surface cleaning apparatus clean air outlet;

(ii) a suction motor positioned in the surface cleaning apparatus air flow path upstream of the surface cleaning apparatus clean air outlet; and, (iii) a surface cleaning apparatus air treatment member positioned in the surface cleaning apparatus air flow path, the surface cleaning apparatus air treatment member comprising a first stage air treatment chamber, the first stage air treatment chamber having a first end, an axially spaced apart second end, a sidewall extending between the first end of the first stage air treatment chamber and the second end of the first stage air treatment chamber, an air inlet and an air outlet, the surface cleaning apparatus air treatment member comprises a stationary portion and a moveable portion, the stationary portion comprises a first portion of the sidewall, the moveable portion comprises a second portion of the sidewall, the first and second portions of the sidewall extend between the first and second ends of the first stage air treatment chamber, and the moveable portion is moveably mounted by a mount between a closed position in which the first stage air treatment chamber is closed and an open position in which the first stage air treatment chamber is open; and, (b) a docking station comprising:

(i) a docking station air flow path extending from a docking station air inlet to a docking station air outlet;

(ii) a docking interface comprising wall portions, an interface volume positioned interior the wall portions and having an interface opening, and a docking interface perimeter extending around the wall portions and defining the interface opening, the interface volume accessible through the interface opening; and (iii) a docking station air treatment member positioned in the docking station airflow path downstream of the interface volume, wherein, when the air treatment member is docked with the docking station, a first portion of the docking interface perimeter contacts the stationary portion of the air treatment member proximate the moveable portion and a second portion of the docking interface perimeter contacts the surface cleaning apparatus at a location that is axially spaced from the second end of the first stage air treatment chamber whereby, when the surface cleaning apparatus is docked with the docking station, the interface opening is closed with the moveable portion of the air treatment member located inwards of the interface perimeter, whereby, when the moveable portion is moved to the open position, the moveable portion is moved within the volume and the interface volume defines the docking station air inlet.

2. The apparatus of claim 1 wherein the moveable portion is rotatably mounted by a rotational mount whereby, when the moveable portion is moved to the open position, the moveable portion is rotated within the interface volume.

3. The apparatus of claim 2 wherein the air outlet is provided at the second end of the first stage air treatment chamber and the rotational mount is located adjacent the second end.

4. The apparatus of claim 1 wherein the moveable portion is translatably moveable whereby, when the moveable portion is moved to the open position, the moveable portion is translated within the interface volume.

5. The apparatus of claim 4 wherein the air outlet is provided at the second end of the first stage air treatment chamber and a translatable mount is located adjacent the second end.

6. The apparatus of claim 1 wherein, when the moveable portion is in the closed position, the moveable portion and the stationary portion abut along peripheral edges that generally extend at least partially in an axial direction.

7. The apparatus of claim 6 wherein, when the hand vacuum cleaner air treatment member is docked with the docking station, the peripheral edges of the moveable and stationary portions are located interior to the interface volume.

8. The apparatus of claim 1 wherein the perimeter comprises a first abutment surface that extends axially and the air treatment member has a second abutment surface that extends axially.

9. The apparatus of claim 1 wherein, when the hand vacuum cleaner is docked with the docking station, the first portion of the docking interface perimeter contacts the first end of the first stage air treatment chamber.

10. The apparatus of claim 1 wherein the first stage air treatment chamber has a chamber length extending from the first end to the axially spaced apart second end and the interface opening has an opening length that is greater than the chamber length.

11. The apparatus of claim 1 wherein, when the air treatment member is docked with the docking station, an end of the interface volume is axially spaced from the second end of the first stage air treatment chamber.

12. An apparatus comprising:

(a) a hand vacuum cleaner comprising:

(i) a hand vacuum cleaner air flow path extending from a hand vacuum cleaner dirty air inlet to a hand vacuum cleaner clean air outlet;

(ii) a suction motor positioned in the hand vacuum cleaner air flow path upstream of the hand vacuum cleaner clean air outlet; and, (iii) a hand vacuum cleaner air treatment member positioned in the hand vacuum cleaner air flow path, the hand vacuum cleaner air treatment member comprising an air treatment chamber, the air treatment chamber having a first end, an axially spaced apart second end, a sidewall extending between the first end of the air treatment chamber and the second end of the air treatment chamber, an air inlet and an air outlet, the hand vacuum cleaner air treatment member comprises a stationary portion and a moveable portion, the stationary portion comprises a first portion of the sidewall and the moveable portion comprises a second portion of the sidewall, the first end second portions of the sidewall extending between the first and second ends of the air treatment chamber, and the moveable portion is moveably mounted by a mount between a closed position in which the air treatment chamber is closed and an open position in which the air treatment chamber is open; and, (b) a docking station comprising:

(i) a docking station air flow path extending from a docking station air inlet to a docking station air outlet; and, (ii) a docking interface comprising wall portions and a docking interface perimeter extending around the wall portions, wherein an interface volume positioned interior the wall portions and has an interface opening; and (iii) a docking station air treatment chamber positioned in the docking station airflow path downstream from the docking interface, wherein, when the hand vacuum cleaner air treatment member is docked with the docking station, the docking interface perimeter comprises an axially extending first portion that contacts one lateral side of the hand vacuum cleaner and an axially extending second portion that contacts an opposed lateral side of the hand vacuum cleaner whereby a closed volume is formed interior of the wall portions whereby, when the moveable portion is moved to the open position, the moveable portion is moved within the volume to an open portion and the volume defines the docking station air inlet.

13. The apparatus of claim 12 wherein the moveable portion is rotatably mounted by a rotational mount whereby, when the moveable portion is moved to the open position, the moveable portion is rotated within the volume.

14. The apparatus of claim 13 wherein the air outlet is provided at the second end of the first stage air treatment chamber and the rotational mount is located adjacent the second end.

15. The apparatus of claim 14 wherein, when the hand vacuum cleaner is docked with the docking station, an end of the interface volume is axially spaced from the first end of the hand vacuum cleaner air treatment chamber.

16. The apparatus of claim 12 wherein the moveable portion is translatably moveable whereby, when the moveable portion is moved to the open position, the moveable portion is translated within the volume.

17. The apparatus of claim 16 wherein the air outlet is provided at the second end of the first stage air treatment chamber and a translatable mount is located adjacent the second end.

18. The apparatus of claim 12 wherein, when the moveable portion is in the closed position, the moveable portion and the stationary portion abut along peripheral edges that generally extend at least partially in an axial direction.

19. The apparatus of claim 18 wherein, when the hand vacuum cleaner is docked with the docking station, the peripheral edges of the moveable and stationary portions are located interior to the volume interior of the wall portions.

20. The apparatus of claim 12 wherein the first end of the hand vacuum cleaner air treatment chamber has a first end wall and the stationary portion comprises the first end wall.

21. The apparatus of claim 20 wherein the second end of the hand vacuum cleaner air treatment chamber has a second end wall and a third portion of the docking interface perimeter contacts the surface cleaning apparatus at a location that is axially spaced from the second end wall.

22. The apparatus of claim 12 wherein, when the hand vacuum cleaner is docked with the docking station, the docking interface perimeter contacts the hand vacuum cleaner at a location that is axially spaced from the second end of the air treatment chamber.

23. The apparatus of claim 22 wherein the first end of the hand vacuum cleaner air treatment chamber has a first end wall and the stationary portion comprises the first end wall.

24. The apparatus of claim 23 wherein the second end of the hand vacuum cleaner air treatment chamber has a second end wall and the docking interface perimeter contacts the hand vacuum cleaner at a location that is axially spaced from the second end wall.

25. The apparatus of claim 12 wherein the hand vacuum cleaner air treatment chamber has a chamber length extending from the first end to the axially spaced apart second end and the docking interface perimeter defines an interface opening having an opening length that is greater than the chamber length.

26. The apparatus of claim 12 wherein, when the hand vacuum cleaner is docked with the docking station, a first end of the volume interior of the wall portions is axially spaced from the second end of the hand vacuum cleaner air treatment chamber.

27. The apparatus of claim 26 wherein, when the hand vacuum cleaner is docked with the docking station, a second end of the volume interior of the wall portions is axially spaced from the first end of the hand vacuum cleaner air treatment chamber.

* * * * *